US012134897B2

(12) United States Patent
Crowell et al.

(10) Patent No.: US 12,134,897 B2
(45) **Date of Patent: *Nov. 5, 2024**

(54) REAR RECEIVERS FOR USE WITH SYSTEMS AND METHODS FOR MODULAR PLATFORMS FOR GUTTER GUARD SYSTEMS WITH INTERCHANGEABLE COMPONENTS

(71) Applicant: LeafFilter North, LLC, Hudson, OH (US)

(72) Inventors: Jason Alan Crowell, Akron, OH (US); Michael Gori, Norton, OH (US)

( * ) Notice: Subject to any disclaimer, the term of this patent is extended or adjusted under 35 U.S.C. 154(b) by 193 days.

This patent is subject to a terminal disclaimer.

(21) Appl. No.: 17/820,715

(22) Filed: Aug. 18, 2022

(65) Prior Publication Data

US 2023/0228088 A1 Jul. 20, 2023

Related U.S. Application Data

(60) Continuation-in-part of application No. 17/328,609, filed on May 24, 2021, now abandoned, which is a division of application No. 16/204,140, filed on Nov. 29, 2018, now Pat. No. 11,015,348, which is a continuation of application No. 16/126,487, filed on Sep. 10, 2018, now Pat. No. 10,443,244, which is a (Continued)

(51) Int. Cl.
*E04D 13/076* (2006.01)

(52) U.S. Cl.
CPC ..... *E04D 13/076* (2013.01)

(58) Field of Classification Search
CPC ..... E04D 13/076; E04D 13/0725
See application file for complete search history.

(56) References Cited

U.S. PATENT DOCUMENTS 2,636,458 A 4/1953 Harris
2,810,173 A 10/1957 Bearden
3,256,650 A 6/1966 Weckerly (Continued)

FOREIGN PATENT DOCUMENTS

WO 2016099294 A1 6/2016

OTHER PUBLICATIONS

Non-Final Office Action issued in U.S. Appl. No. 16/049,233, mailing date Mar. 22, 2019.

(Continued)

*Primary Examiner* — Patrick J Maestri
(74) *Attorney, Agent, or Firm* — Benesch Friedlander Coplan & Aronoff LLP

(57) ABSTRACT

A modular platform for configuring gutter guard systems is disclosed and claimed herein. Such gutter guard systems are designed and arranged to be positioned across the opening of a rain gutter to prevent debris from entering the rain gutter. The modular platform includes a number of interchangeable components. Select interchangeable components can be assembled to form a gutter guard system for use with a specific rain gutter based on the rain gutter's style, size, color and the mechanism used to secure the rain gutter to a structure and/or roofline. In one embodiment, the components of a modular platform for configuring gutter guard systems include a number of main bodies, a front receiver, a number of rear receivers, a number of screens, and a clip.

13 Claims, 119 Drawing Sheets

Related U.S. Application Data continuation-in-part of application No. 16/049,233, filed on Jul. 30, 2018, now Pat. No. 11,078,670.

(60) Provisional application No. 62/618,210, filed on Jan. 17, 2018.

(56) References Cited

U.S. PATENT DOCUMENTS 3,351,206 A 11/1967 Wennerstrom
4,553,356 A 11/1985 Pepper
4,713,915 A 12/1987 Sweers
4,727,689 A 3/1988 Bosler
4,757,649 A 7/1988 Vahldieck
4,780,300 A 10/1988 Yokoyama et al.
4,905,427 A 3/1990 McPhalen
4,941,299 A 7/1990 Sweers
4,959,932 A 10/1990 Pfeifer
5,017,309 A 5/1991 Peterson
5,555,680 A 9/1996 Sweers
5,566,513 A 10/1996 Herren
5,595,027 A 1/1997 Vail
5,611,175 A 3/1997 Sweers
5,640,809 A 6/1997 Iannelli
5,660,001 A 8/1997 Albracht
5,899,023 A 5/1999 Byer
6,047,502 A 4/2000 Kimmitt et al.
6,073,398 A 6/2000 Williams
6,427,388 B1 8/2002 Brochu
6,463,700 B2 10/2002 Davis
6,598,352 B2 7/2003 Higgenbotham
6,732,477 B1 5/2004 Richard
6,883,760 B2 4/2005 Seise, Jr.
7,104,012 B1 9/2006 Bayram
7,278,239 B1 10/2007 West
7,287,746 B2 10/2007 Fehr et al.
7,530,200 B2 5/2009 Gramling
7,975,435 B2 7/2011 Lenney et al.
8,104,230 B2 1/2012 Gramling
8,176,687 B2 5/2012 Roque Alonso
8,276,321 B2 10/2012 Bell
8,375,644 B2 2/2013 Robins
8,646,218 B1 2/2014 Iannelli
8,925,253 B2 1/2015 Bullinger
9,127,463 B1 9/2015 Feldaus
9,163,406 B1 10/2015 Ealer, Sr.
9,212,490 B1 12/2015 Ealer, Sr.
9,284,735 B2 3/2016 Bryer et al.
9,404,266 B2 8/2016 Yildiz
9,487,955 B2 11/2016 Breyer et al.
9,683,371 B1 * 6/2017 Nitch ..... E04D 13/068
9,869,094 B2 1/2018 Lenney
9,890,535 B2 2/2018 Breyer et al.
10,538,920 B2 1/2020 Sager
2003/0046876 A1 3/2003 Higgenbotham
2003/0110712 A1 * 6/2003 Brochu ..... E04D 13/076 52/12
2005/0257432 A1 11/2005 Higginbotham
2006/0107603 A1 5/2006 Brownridge
2006/0179723 A1 * 8/2006 Robins ..... E04D 13/076 52/11
2006/0230687 A1 10/2006 Ealer, Sr.
2006/0283097 A1 12/2006 Gregg
2007/0012845 A1 1/2007 Iannelli
2007/0074466 A1 4/2007 Rasmussen
2007/0234647 A1 10/2007 Higginbotham
2008/0047206 A1 2/2008 Gramling
2008/0134587 A1 6/2008 Ealer
2008/0190039 A1 8/2008 Brochu
2009/0056234 A1 3/2009 Brochu
2010/0300008 A1 12/2010 Jelacic
2011/0056145 A1 3/2011 Lenney
2011/0067318 A1 3/2011 Lenney
2011/0114800 A1 5/2011 Gramling
2011/0138696 A1 6/2011 Olson et al.
2012/0042579 A1 2/2012 McCoy
2012/0047817 A1 3/2012 Prentice
2012/0110923 A1 * 5/2012 Robins ..... E04D 13/076 52/12
2012/0132759 A1 * 5/2012 Sager ..... E04D 13/0762 248/49
2013/0091780 A1 * 4/2013 Robins ..... E04D 13/076 52/12
2013/0097943 A1 4/2013 Higgenbotham
2013/0130377 A1 5/2013 Sager
2013/0160377 A1 6/2013 Sager
2013/0248672 A1 9/2013 Martin
2013/0291448 A1 11/2013 Brochu
2013/0326846 A1 12/2013 Cullen
2014/0069028 A1 3/2014 Lenney
2014/0202086 A1 7/2014 Reese
2014/0215929 A1 8/2014 Lenney
2015/0143756 A1 5/2015 Higginbotham
2015/0225959 A1 8/2015 Lenney
2015/0259924 A1 9/2015 Van Biber
2015/0330085 A1 11/2015 Iannelli
2016/0102459 A1 4/2016 Breyer
2017/0058531 A1 3/2017 Brochu
2017/0204612 A1 7/2017 Lenney
2018/0030733 A1 2/2018 Brochu
2018/0216348 A1 8/2018 Morris
2019/0063070 A1 2/2019 Cullen
2019/0071874 A1 3/2019 Brochu
2019/0071875 A1 3/2019 Lenney

OTHER PUBLICATIONS

Non-Final Office Action issued in U.S. Appl. No. 16/126,487, mailing date May 1, 2019.
Non-Final Office Action issued in U.S. Appl. No. 16/184,342, mailing date Oct. 28, 2019.
Non-Final Office Action issued in U.S. Appl. No. 16/204,140, mailing date Feb. 10, 2020.
Final Office Action issued in U.S. Appl. No. 16/204,140, mailing date Sep. 16, 2020.
Non-Final Office Action issued in U.S. Appl. No. 16/359,375, mailing date Jul. 18, 2019.
Non-Final Office Action issued in U.S. Appl. No. 16/382,372, mailing date Dec. 20, 2019.
Notice of Allowance issued in U.S. Appl. No. 16/393,251, mailing date Aug. 5, 2019.
Non-Final Office Action issued in U.S. Appl. No. 17/517,285, mailing date Dec. 27, 2022.
Final Office Action issued in U.S. Appl. No. 17/517,292, mailing date May 28, 2024.
Non-Final Office Action issued in U.S. Appl. No. 17/517,292, mailing date Nov. 3, 2023.
Non-Final Office Action issued in U.S. Appl. No. 17/517,292, mailing date Jan. 24, 2023.
Non-Final Office Action issued in U.S. Appl. No. 17/517,299, mailing date Feb. 2, 2023.
Non-Final Office Action issued in U.S. Appl. No. 17/517,310, mailing date Jul. 1, 2024.
Non-Final Office Action issued in U.S. Appl. No. 17/517,310, mailing date Feb. 6, 2023.
Non-Final Office Action issued in U.S. Appl. No. 17/517,330, mailing date Mar. 28, 2023.
Non-Final Office Action issued in U.S. Appl. No. 17/517,328, mailing date Mar. 20, 2023.
Non-Final Office Action issued in U.S. Appl. No. 17/820,714, mailing date Mar. 25, 2024.
Non-Final Office Action issued in U.S. Appl. No. 17/820,715, mailing date May 22, 2024.
Non-Final Office Action issued in U.S. Appl. No. 17/820,718, mailing date Jun. 23, 2023.

* cited by examiner

REAR RECEIVERS FOR USE WITH SYSTEMS AND METHODS FOR MODULAR PLATFORMS FOR GUTTER GUARD SYSTEMS WITH INTERCHANGEABLE COMPONENTS

CROSS-REFERENCE TO RELATED APPLICATIONS

This application is a continuation-in-part application of pending U.S. patent application Ser. No. 17/328,609, titled "Rear Receiver and Methods for Use with Modular Platform for Gutter Guard Systems with Interchangeable Components" and filed on May 24, 2021, which is a divisional of pending U.S. patent application Ser. No. 16/204,140, titled "Rear Receiver and Methods for Use with Modular Platform for Gutter Guard Systems with Interchangeable Components" and filed on Nov. 29, 2018, which is a continuation of U.S. patent application Ser. No. 16/126,487, titled "Main Bodies and Methods for use with Modular Platform for Gutter Guard System with Interchangeable Component" and filed on Sep. 10, 2018, which is a continuation-in-part of U.S. patent application Ser. No. 16/049,233, titled Systems and Methods for Modular Platform for Gutter Guards Systems with Interchangeable Components" and filed on Jul. 30, 2018, which claims priority to U.S. Provisional Patent Application Ser. No. 62/618,210, titled "Systems and Methods for Modular Platform for Gutter Guards Systems with Interchangeable Components" and filed on Jan. 17, 2018, each of which are expressly incorporated by reference herein in its entirety.

FIELD OF INVENTION

The present disclosure generally relates to systems and methods for preventing debris from entering rain gutters while optimizing water flow and infusion into the rain gutter. More specifically, the present disclosure relates to a modular platform for gutter guard systems with interchangeable components for: 1) forming gutter guard assemblies for positioning onto a variety of rain gutter styles and sizes for a variety of structures and rooflines; 2) preventing debris from entering the rain gutters once the gutter guard is positioned onto the rain gutter; and 3) managing the flow of water across the gutter guard such as to optimize the infusion of the water into the rain gutter. In particular, the present disclosure relates to interchangeable front receiver components that engage the front lip of a rain gutter when a gutter guard systems is positioned into a rain gutter.

BACKGROUND

Rain gutter systems are commonly used for residential homes, building, and other structures to manage rainwater by collecting the rainwater and channeling that rainwater away from the structure. Such management of rainwater can be critical for the over all maintenance and condition of the structure by reducing or eliminating damage to the structure and its foundation that can be caused by uncontrolled rainwater. Gutter guards are components or systems that are typically attached to or incorporated into rain gutters to prevent leaves, pine needles, branches, soot, and other such debris from entering the rain gutter. Such debris can clog the rain gutter and reduce its effectiveness in channeling rainwater away from a residential home, building, or other structure. In addition, such debris can damage and shorten the service life of a rain gutter system by causing corrosion, pitting, or other deleterious effects on the rain gutter system. Unfortunately, prior art gutter guard systems do not effectively channel water away from a structure. Inefficient water management designs, matting of debris onto the gutter guard system over time, and ill-fitting gutter guard systems cause unnecessary damage to homes and other structures, which reduces property values, increases maintenance costs, and causes dangerous conditions for occupants of structures.

Gutter guards are typically manufactured to fit a specific style and specific size of rain gutter. Such gutter guards are typically manufactured as a single component or assembly of subcomponents, where the subcomponents are irreversibly joined together. Thus, gutter guard manufacturers, distributors, and/or dealers typically choose between making and/or stocking a limited number of products that accommodate a limited segment of the market, or making and/or stocking a large number of products to accommodate the large number of variations of rain gutter guards.

There are many different sizes and styles of rain gutters on the market in the United States and internationally. The differences in rain gutter sizes and styles are driven by a number of factors including different architectural styles for homes and buildings in different geographical regions and regional homebuilder and contractor trade practices that develop over time. Such different architectural styles can also be driven by differences in climate and weather patterns (for example, annual rain and snow fall), historical influences, availability of building materials, and so on. The different architectural styles often dictate the rooflines of structures, which in large part dictates the style and size of rain gutters and how the rain gutter is attached to the structure/roofline. The term "structure" is used herein generically to mean a residential home, multi-residential buildings, office buildings, warehouses, commercial building, or any other structure for which rain gutter systems are used to channel rainwater away from the structure. The term "roofline" is used herein generically to mean the intersection of the underside of the roof of a structure with the exterior walls of the structure and/or other proximal exterior features such as rafter tails, fascia board, starter strips, flashing, drip edge s, and so on. Once a particular style of rain gutter becomes dominant in a region or market, the regional or local homebuilder and contractor trade practices are heavily influenced by the dominant rain gutter style and homebuilders and installation contractors become accustomed to installing that rain gutter style, thus reinforcing the dominance of the rain gutter style in the geographic region. The particular size of this dominant style gutter is variable due to considerations such as the surface area of the roof of a specific structure and regional architectural influences.

As will be appreciated from the following discussion, the number of variations in types of rain gutters, sizes of rain gutters, mechanisms for securing rain gutters to structures and/or rooflines, etc. creates a plethora of potential combinations of rain gutter arrangements. Thus, designing a generic gutter guard product to accommodate such a large number of potential combinations is a challenge that has yet to be met in the marketplace.

Three styles of rain gutters make up a majority of the market—"K-style" gutters, "half-round gutters," and "fascia-style" gutters. FIG. 1 illustrates an exemplary K-style gutter 10. Typically, K-style gutters have a generally flat back section 12 that engages the structure and a flat bottom section 14 extending away from the structure that is generally perpendicular to the back section 12. A front section 16 extends upward and angles away from the bottom section 14 such that it forms an obtuse angle between the bottom section 14 and front section 16. The front section 16 typically includes a front lip 18 that is curled inward toward the interior of the gutter 10. The back section 12 also includes a rear edge or lip 20 that is slightly bent outward. Sizes for K-style gutters 10 are determined by the approximate distance from the front lip 18 of the front section 16 to the rear lip 20 of the back section 12, and typically come in sizes from about three inches to about six inches.

FIGS. 2 and 3 illustrates exemplary half-round gutters 30. 50. As its name implies, a half-round gutter includes a body 32, 52 that is shaped as approximately a half-section of a tube. The half-round gutter 30, 50 is installed such that a back portion 34, 54 of the gutter 30, 50 is typically spaced apart from the structure due to connecting hardware. Such connecting hardware is typically inserted between the structure and the gutter 30, 50 so as to cause a slight relief for structure. However, there are also embodiments where an installed half-round gutter 30, 50 is installed such that the half-round gutter 30, 50 is in contact with the structure. In either embodiment the half round gutter typically has a reinforced rear lip or hem 36, 56 as part of the back portion 34, 54 which is typically positioned just under the roofline of the structure. The reinforced rear lip or hem 36, 56 can be arranged with substantially different heights and thicknesses based on manufacturing processes and design preferences. A front portion 38, 58 of the gutter 30, 50 typically includes a front lip 40, 60. In one example, as illustrated in FIG. 2, the front lip 40 can be arranged such that it curls inward toward the interior of the gutter 30. In another example, as illustrated in FIG. 3, the front lip 60 can be arranged such that it curls outward away from the interior of the gutter 50. Half-round gutters 30, 50 can be attached to the roofline or the structure by many different types of hardware or accessories, which are dictated by the arrangement and style of the front lip, the roofline, the regional architectural style, and/or regional or local trade practices. Such variation in attachment hardware and/or accessories, along with the variability in front lip 40, 60 curl and the variability in the dimensions of the reinforced rear lip or hem 36, 56, substantially complicate the task of designing gutter guard systems for half-round gutters.

Examples of exemplary hardware and accessories used to attach half-round gutters to structures and/or rooflines are illustrated in FIGS. 4A through 4O. Common hardware and accessories include a rival hanger 70 (FIG. 4A), a hidden hanger t-strap 71 (FIG. 4B), a hidden hanger rival bar 72 (FIG. 4C), a regal bar hanger 73 (FIG. 4D), and a sickle and shank hanger 74, which is often coupled with a spring clip 75 (FIG. 4E). All these common hardware and accessories, except for the sickle and shank hanger 74, include a portion (for example, bases 71B and 72B) that is positioned within the body of the half-round gutter and a portion extending upward out of the body and away from the half-round gutter such as to attach to the structure and/or roofline. The shank portion of the sickle and shank hanger 74 is secured to the structure and/or roofline. Because the shank portion is relatively thick, in such an arrangement, once the half-round gutter is installed it is spaced farther away from the structure and/or roofline than when other common hardware and accessories are utilized. Additionally, a hook 74B extending from the sickle and shank hanger 74 engages the rear lip or hem of the gutter and the spring clip 75 engages the front lip of the gutter, thus, creating obstructions protruding from the front and rear lips of the gutter.

FIG. 4F illustrates a first bracket 76 which is exclusively used with half-round gutters 30 with a front lip 40 that curls inward toward the body 32 of the half-round gutter 30. FIG. 4G illustrates a t-bracket 77 that may also be used with a half-round gutter 30 when additional structural support is needed when using bracket 76. One end of each bracket 76, 77 is attached to the rear portion of the half-round gutter 30 which allows for relief from the structure. Bracket 76 is attached to the rear portion of half round gutter 30 and the structure by passing a fastener through the rear portion of bracket 76 and the rear portion of gutter 30. Alternatively a shorter fastener may be used to secure bracket 76 only to the rear portion of gutter 30 and then a strap 71A (as illustrated in FIG. 4B, also strap 72A illustrated in FIG. 4C, which is a similar arrangement as strap 71A) may be used as an attachment mechanism to the structure and/or roofline. When a strap such as 71A or 72A is not used, a bracket 77 can be used as a support mechanism for gutter 30 when a fascia board is present as part of the structure and/or roofline, the tail 77B of the bracket may be trimmed to size depending on the angle of the fascia board. The opposite end of the bracket 77 engages with the front lip 40 of the gutter 30. As will be understood the brackets 76, 77 attach the gutter 30 to a structure and/or roofline in a manner that results in the gutter 30 being spaced apart from the structure and/or roofline. FIG. 4H illustrates a first mounting hanger 78, and FIG. 4I illustrates a second mounting hanger 79 for attaching a half-round gutter to a fascia board and/or rafter tail of a roofline. Both hangers 78, 79 provide unique spacing that also results in the half-round gutters 30 or 50 being spaced apart from the structure and/or roofline.

FIGS. 4J-4O illustrate various arrangements of sickle and shank hardware with varying methods of attachment to the structure and/or roofline. FIG. 4J illustrate sickle and shank hardware mounted to a fascia board of the structure just under the roofline. FIG. 4K illustrate sickle and shank hardware mounted to a fascia board of the structure with an extension component allowing for vertical adjustment. FIG. 4L illustrate sickle and shank hardware mounted to a roofline with an extension component allowing for vertical adjustment. FIG. 4M illustrate sickle and shank hardware mounted to a fascia board of the structure just under the roofline, where the fascia board is positioned at an angle. FIG. 4N illustrate sickle and shank hardware mounted to a crown molding board of the structure under the roofline. FIG. 4O illustrate sickle and shank hardware mounted to rafter tails of the roofline. The term "attachment mechanism" is used herein generically to mean hardware and accessories that attach and/or secure a gutter to a structure and/or roofline. Non-limiting examples of attachment mechanisms are illustrated in FIGS. 4A-4O. It will also be understood that some and/or all of the attachment mechanisms described and illustrated herein may be available in similar form for other styles of gutters such as K-style gutters.

It will be appreciated that with such diversity in attachment mechanisms used with a half-round gutter, it is difficult to anticipate the specific requirements and/or challenges for installing a gutter guard system because of the unpredictability of what portions of attachment mechanisms are extending from within and/or around the body of the gutter and/or what obtrusions and/or obstructions are present along the front lip 40, 60 and rear lip 36, 56. Sizes for half-round gutters 30, 50 are determined by the approximate distance from the front lip 40, 60 of the front section to the reinforced rear lip or hem 36, 56 of the back section 34, 54 and typically come in sizes from about four inches to about six inches.

FIG. 5 illustrates an exemplary fascia-style gutter 80. Fascia-style gutters 80 are typically secured to rafter tails of the structure or roofline. Typically, fascia-style gutters 80 have a generally flat back section 82 that engages the rater tail or other similar portion of the structure and/or roofline. Optionally, the back section 82 can include an extended edge 84 protruding from the back section 82 (as illustrated in FIG. 5), which can be referred to in the industry as a "winged" or "winged-backed" fascia gutter. A bottom section 86 extends generally perpendicular away from the back section 82, and is generally shorter than the bottom section of a K-style gutter. A front section 88 extends upward and angles away from the bottom section 86 such that it forms an obtuse angle between the bottom section 86 and front section 88. This obtuse angle is generally larger than the similarly situated angle in a K-style gutter. The front section 88 typically includes a front lip 90 that is bent inward toward the interior of the gutter 80. As illustrated in FIG. 6, the extended edge or wing 84 of the fascia-style gutter 80 can be positioned under the roofing material 92 and above the wood sheathing 94 of the structure. Sizes for fascia-style gutters are determined by the approximate distance from the front lip 90 of the front section 88 to the back section 82, and typically come in sizes from about four inches to about six inches.

The extended edge or wing 84 illustrated in FIG. 6 is one example of a rain gutter arrangement that disturbs the roofing material of a structure. Many prior art gutter guard systems similarly intrude upon the structural integrity of the roofing material of a structure. For example, many prior art gutter guard systems include intrusive metal components and/or fasteners that penetrate the roofing material. Not only do such arrangements compromise the structural integrity of the roofing material, which can lead to leakage and other serious damage to structures, but may also void any roofing installation or manufacturing warranties, which is detrimental to the property owner.

Throughout this disclosure rain gutters will be described by reference to the rain gutter "size," i.e., four inch, five inch, etc. However, it will be understood that such descriptions of size do not indicate that a rain gutter is exactly four inches or five inches in width. Such naming conventions indicate to those in the industry that a rain gutter is approximately four inches in width or five inches in width. Additionally, certain rain gutter styles are described as typically coming in a range of sizes. It will be understood that such styles of rain gutters can come in larger or smaller sizes as well, where size of gutter is typically determined by the volume of rain water that the rain gutter will be expected to handle, which in turn is determined by the surface area of the roof of a structure and the local climate. Such wide variations and approximations in size of rain gutters further complicate the task of designing gutter guard systems for rain gutters.

Because of the variety of sizes and styles of gutters in the marketplace, current business models in the industry are for manufacturers, distributors, and/or dealers to manufacture and/or stock a limited number of gutter guard products that accommodate a limited segment of the market, or to manufacture and/or stock a large number of gutter guard products to accommodate the large number of variations of rain gutters. Such approaches are both limited and inefficient. There is a need for improvement to existing gutter guards, systems, and/or methods for gutter guard protection to accommodate a more efficient and effective business model for manufacturing, distributing, and installing gutter guards to the diver se and disparate national and regional marketplace.

SUMMARY

A modular platform for configuring gutter guard systems is disclosed and claimed herein. Such gutter guard systems are designed and arranged to be positioned across the opening of a rain gutter to prevent debris from entering the rain gutter. The modular platform includes a number of interchangeable components. Select interchangeable components can be assembled to form a gutter guard system for use with a specific rain gutter based on the rain gutter's style, size, color, and the attachment mechanism used to secure the rain gutter to a structure and/or roofline.

In one embodiment, the components of a modular platform for configuring gutter guard systems include a number of main bodies, a front receiver, a number of rear receivers, and a number of screens. Such components are arranged to be interchangeable. This is to say that, for example, components such as a main body can be used with some or all of the front receivers and rear receivers. Such arrangements can result in the components combining to form a substantially large number of combinations for use with a substantially large number of different rain gutters, attachment mechanisms, and accompanying structures and/or rooflines.

In one embodiment, the main body includes a first edge, a second edge that is generally parallel to and spaced apart from the first edge, a top surface, and a bottom surface. The main body can be formed from a series of intersecting members, where each member intersects other members at a generally ninety degree angle to form a diamond pattern. The top surface of the main body includes a series of water management features such as wicking edge s. The screen is placed in contact with at least some of the series of wicking features on the top surface of the main body. When the wicking edges are placed in contact with the screen, the wicking edges encourage water flowing along the screen to flow downward through the screen and main body and into the rain gutter. The front receiver is reversibly secured to the first edge of the main body, and the rear receiver is reversibly secured to the second edge of the main body.

In another embodiment, the components of a modular platform for configuring gutter guard systems include a number of clips. Select clips are used with the gutter guard system to secure the gutter guard system to the rain gutter based on the style of the rain gutter, the arrangement of the rear lip of the rain gutter, and the mechanism used to secure the rain gutter to the structure and/or roofline. The clip includes a first channel and a second channel. The first channel is arranged to engage a portion of the rear receiver and the second channel is arranged to engage a portion of the rain gutter such as the rear lip or hem to secure the gutter guard system to the rain gutter. Optionally, the clip can include an aperture proximate to the second channel and arranged to accommodate a fastener to secure the clip to rain gutter, structure, and/or roofline.

BRIEF DESCRIPTION OF THE DRAWINGS

In the accompanying drawings, structures are illustrated that, together with the detailed description provided below, describe example embodiments of the disclosed systems, methods, and apparatus. Where appropriate, like elements are identified with the same or similar reference numerals. Elements shown as a single component can be replaced with multiple components. Elements shown as multiple components can be replaced with a single component. The drawings may not be to scale. The proportion of certain elements may be exaggerated for the purpose of illustration.

Figure 96:
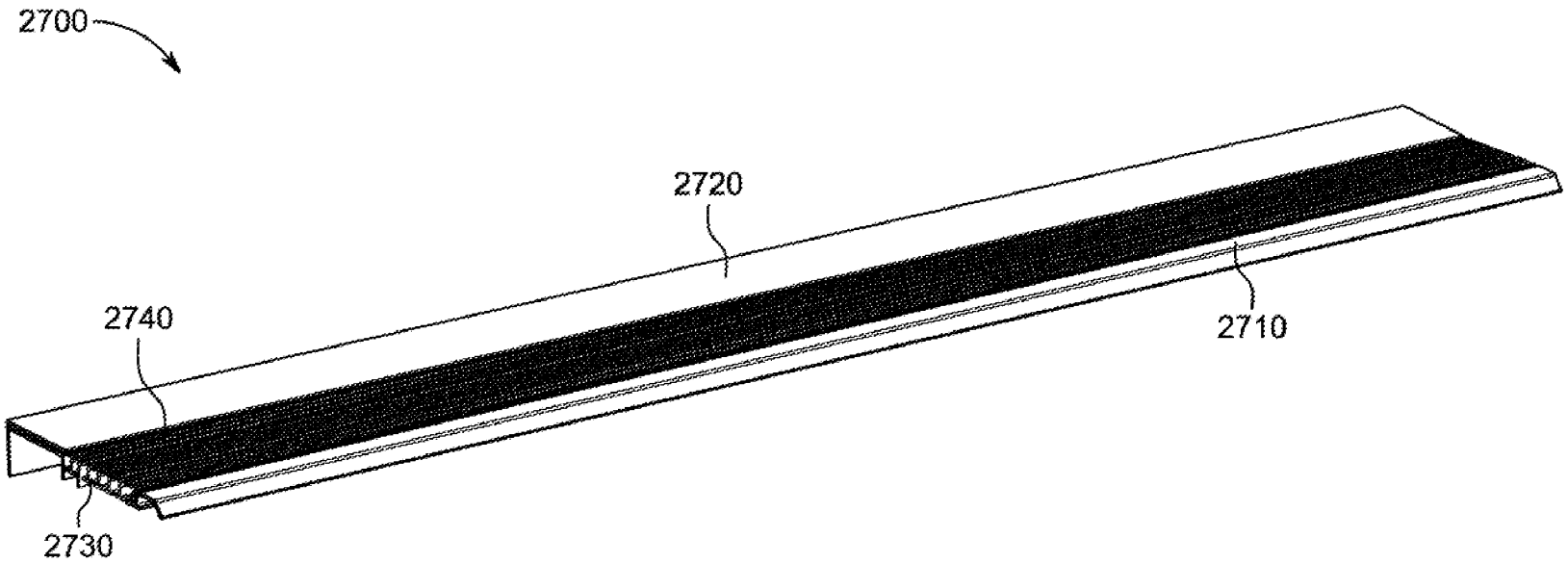
FIG. 96 schematically illustrates a perspective view of an adjustable gutter guard system positioned in a fully contracted position.
Figure 97:
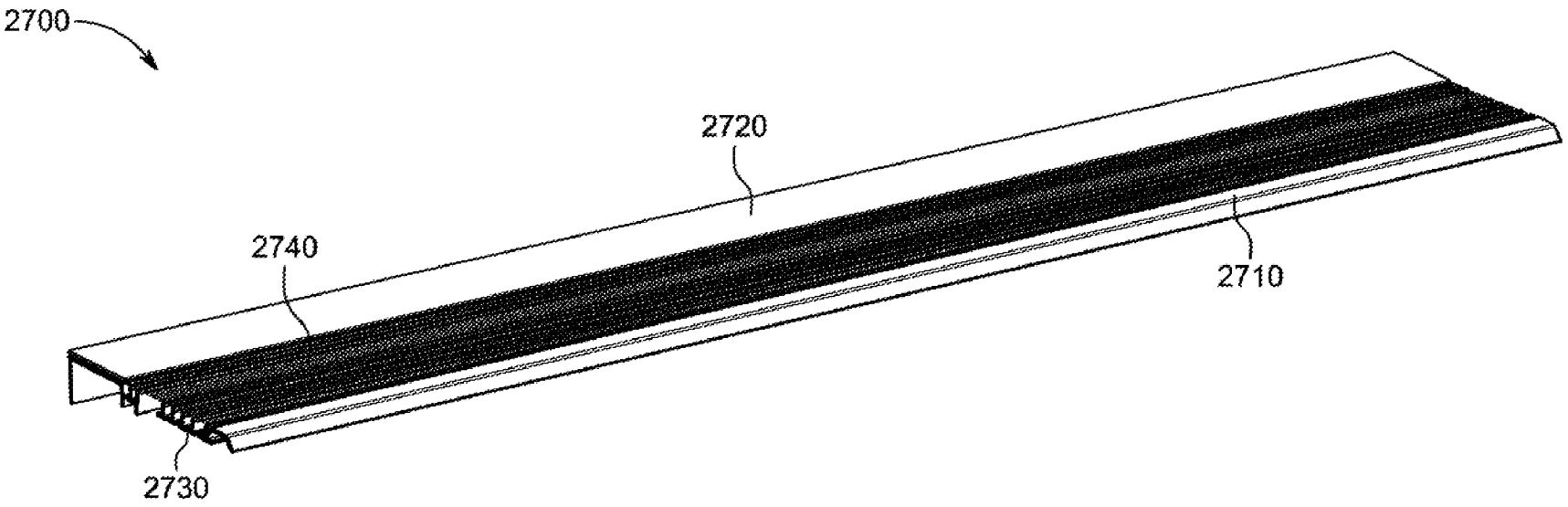

FIG. 97 schematically illustrates a perspective view of the adjustable gutter guard system of FIG. 96 positioned in the fully extended position.

Figure 98:
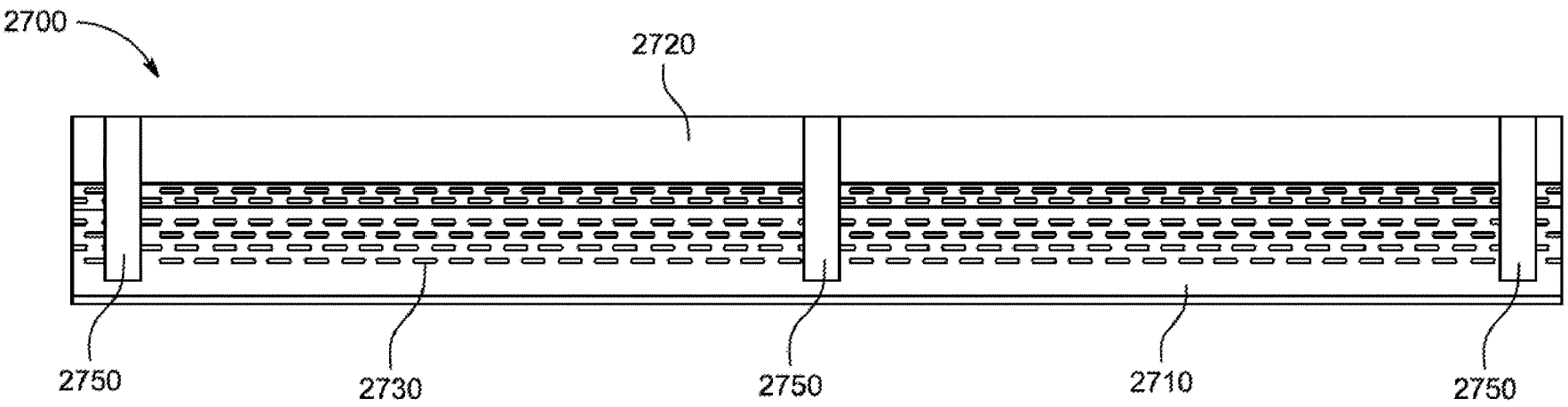

FIG. 98 schematically illustrates a bottom view of the adjustable gutter guard system of FIG. 96 positioned in the fully contracted position.

Figure 99:
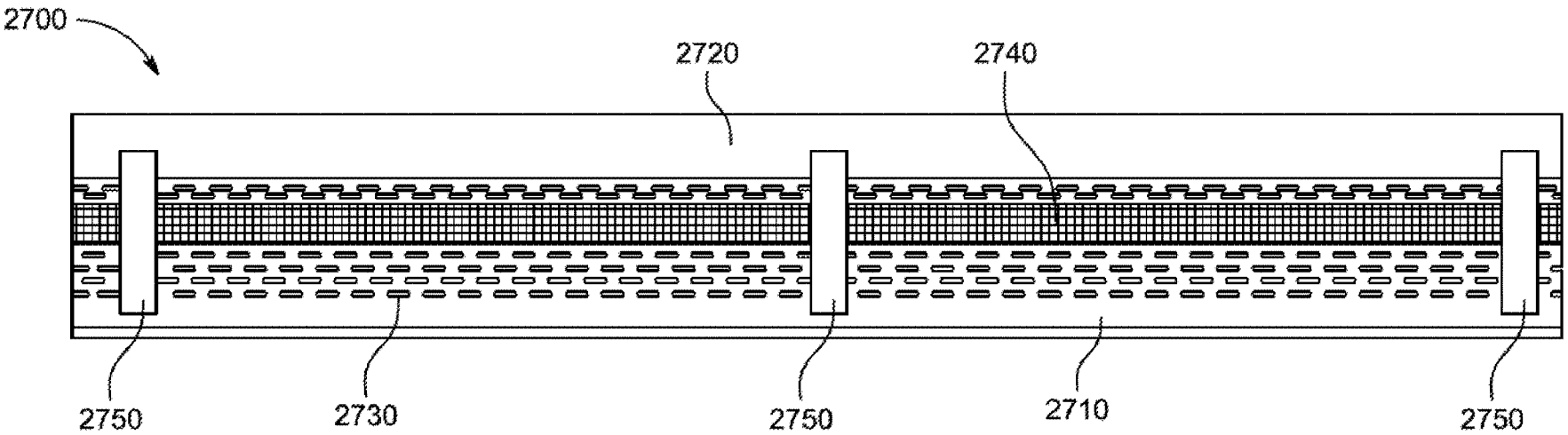

FIG. 99 schematically illustrates a bottom view of the adjustable gutter guard system of FIG. 96 positioned in the fully extended position.

Figure 100:
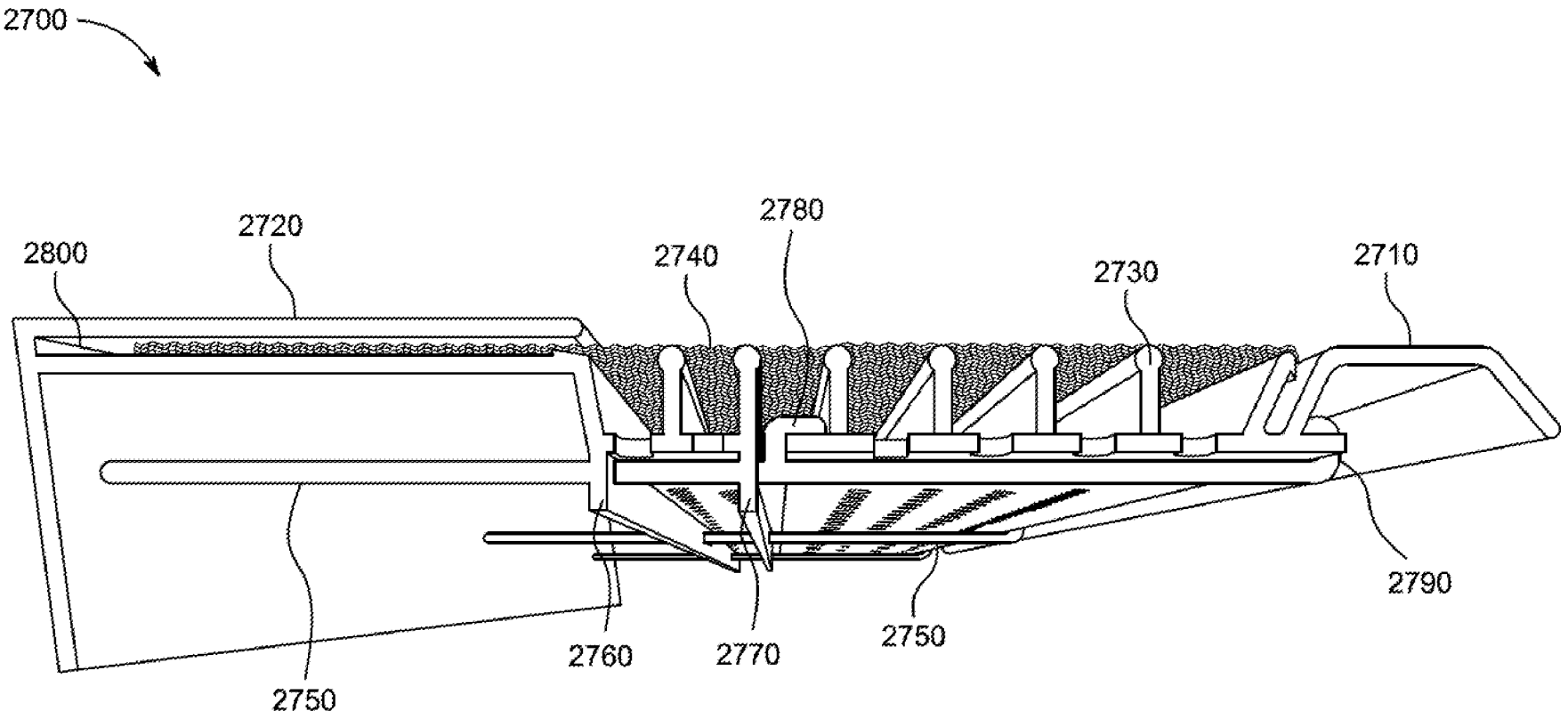

FIG. 100 is a side view of the adjustable gutter guard system of FIG. 96 positioned in a fully contracted position.

Figure 101:
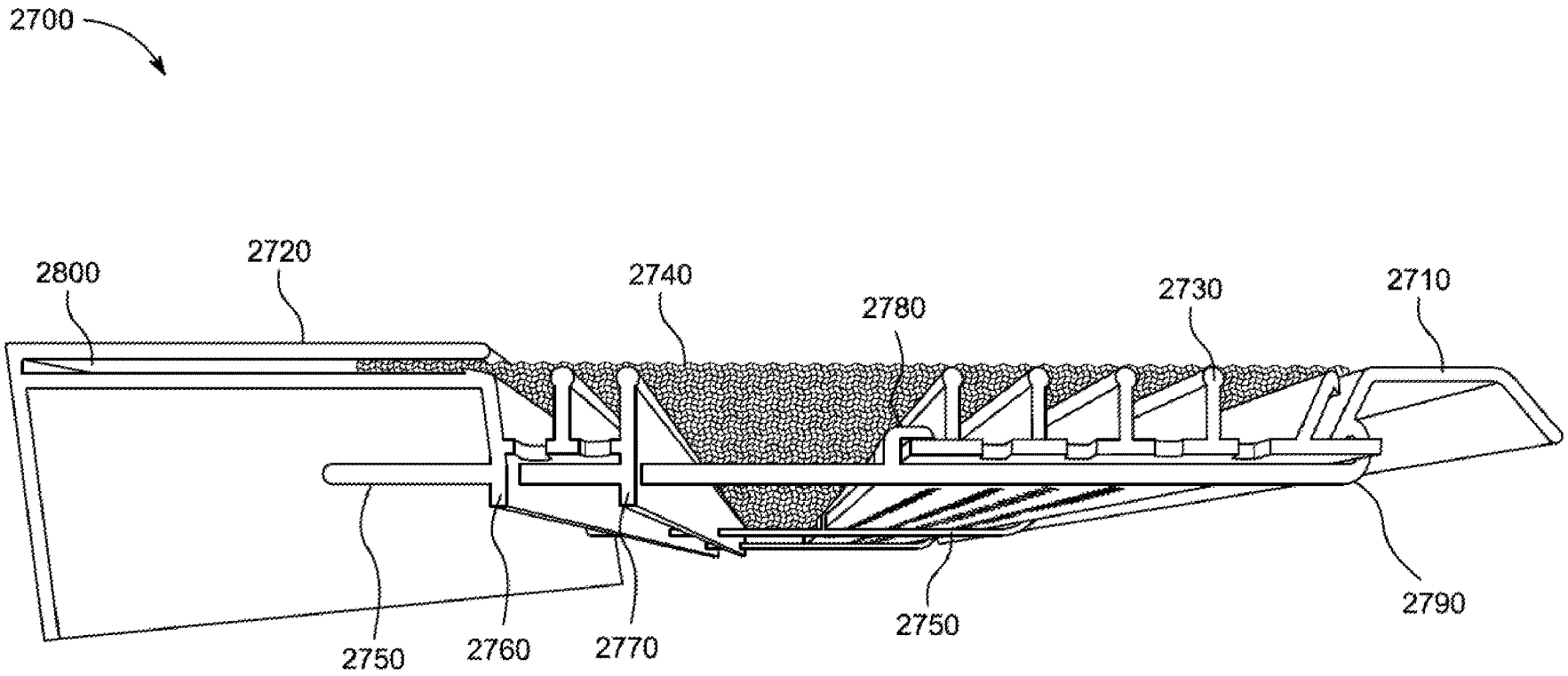

FIG. 101 is a side view of the adjustable gutter guard system of FIG. 96 positioned in a fully extended position.

Figure 102:
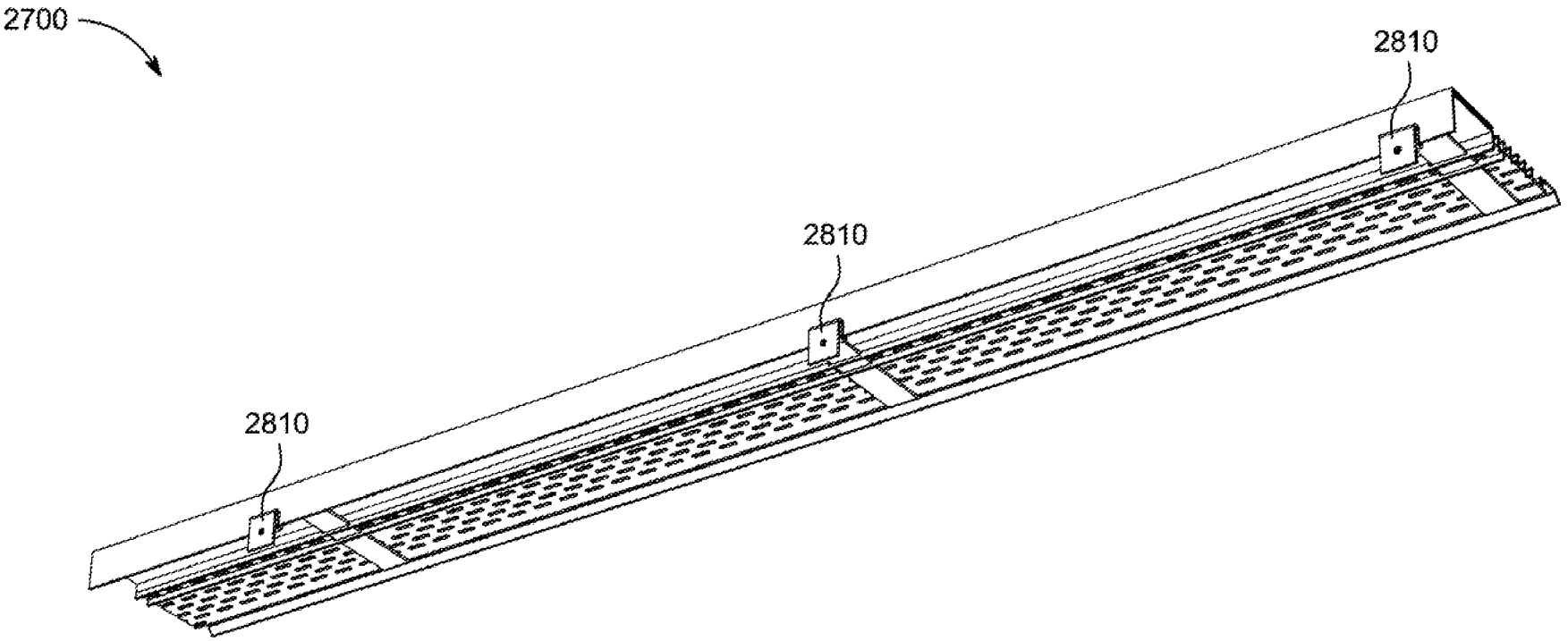

FIG. 102 is a perspective view of the adjustable gutter guard system of FIG. 96 illustrating a series of clips attached to the rear receiver.

FIG. 102 is a side view of the adjustable gutter guard system of FIG. 96 illustrating a front receiver cover plate and a rear receiver cover plate.

Figure 104:
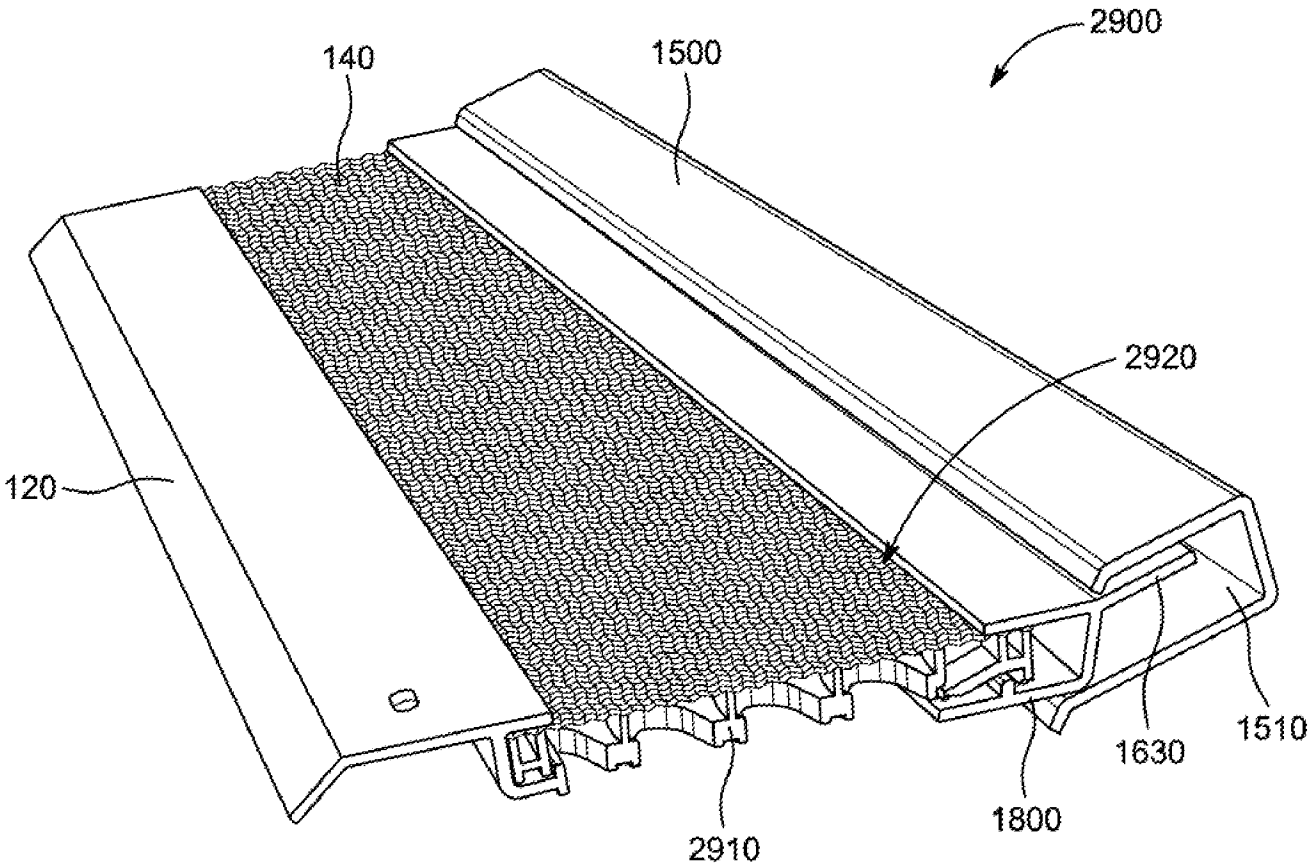

FIG. 104 is a perspective view of a gutter guard system that includes two rear receivers.

Figure 105:
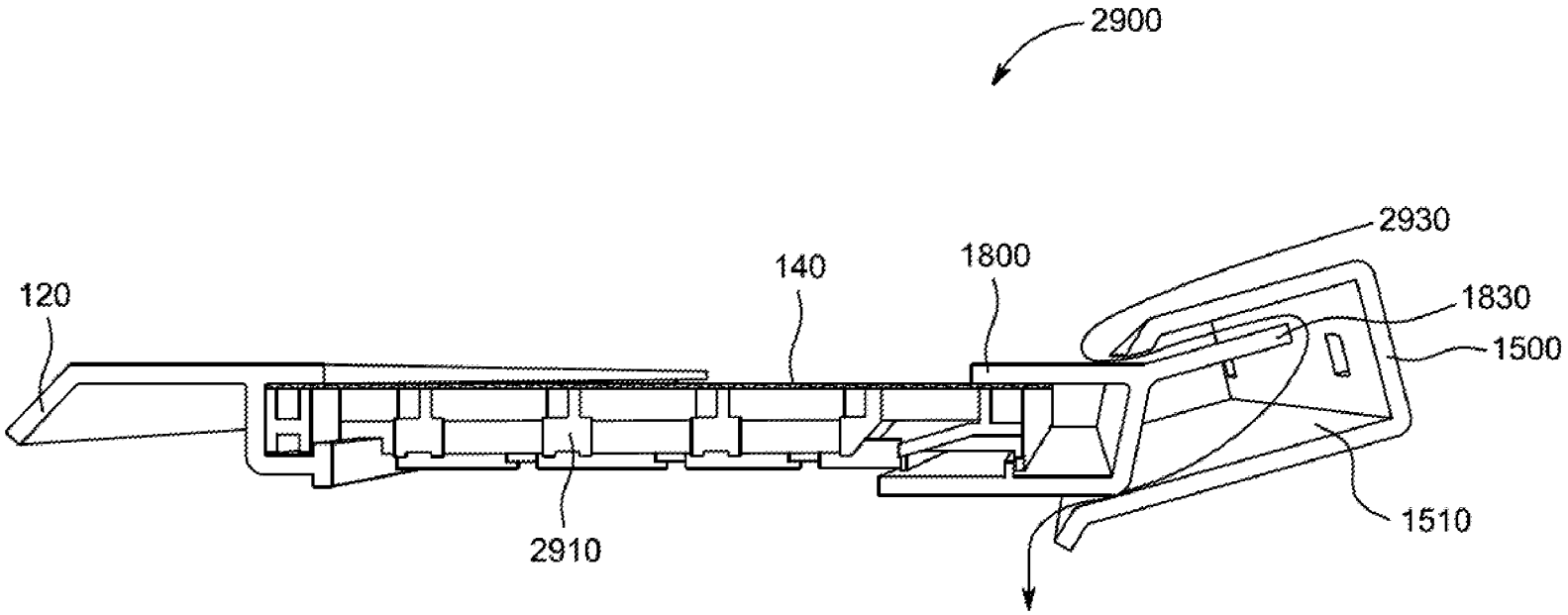

FIG. 105 is a side view of a gutter guard system of FIG. 104.

Figure 106:
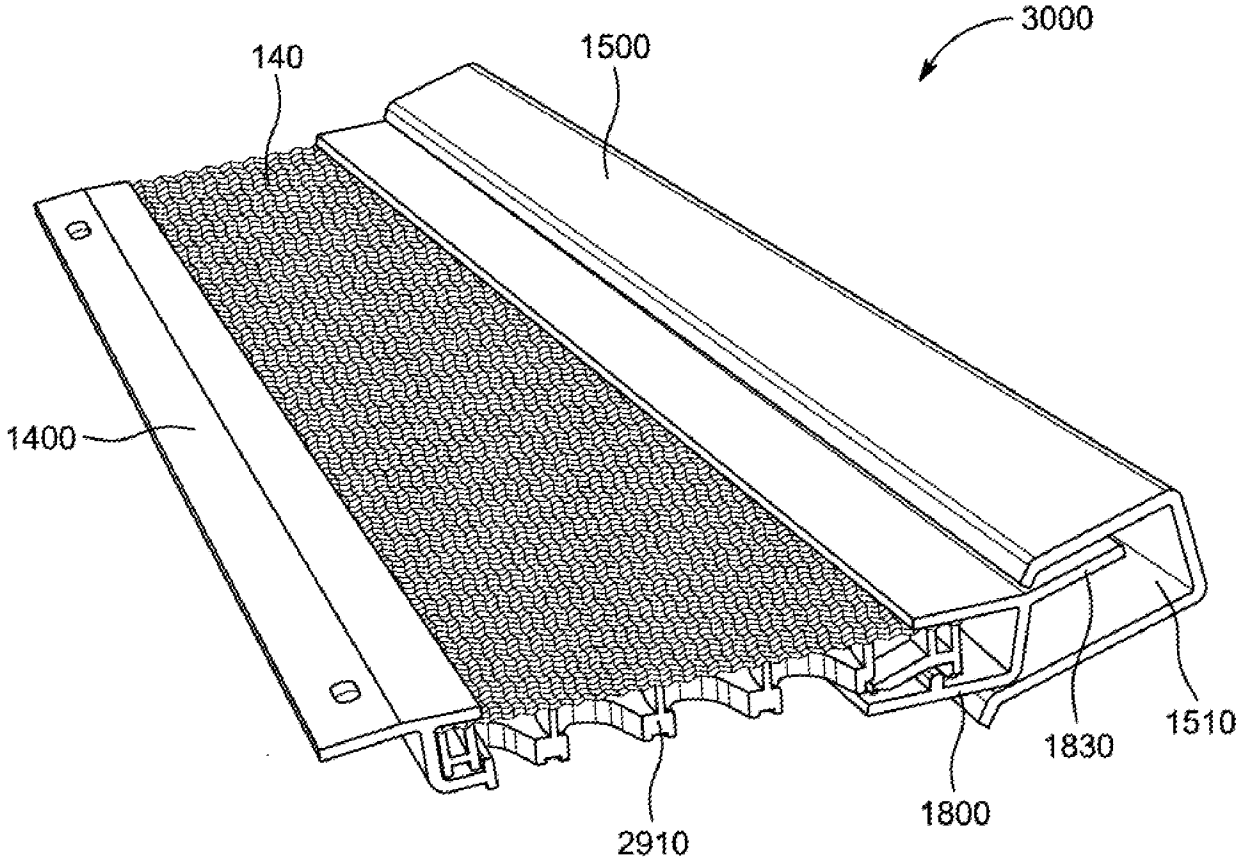

FIG. 106 is a perspective view of a gutter guard system that includes two rear receivers.

Figure 107:
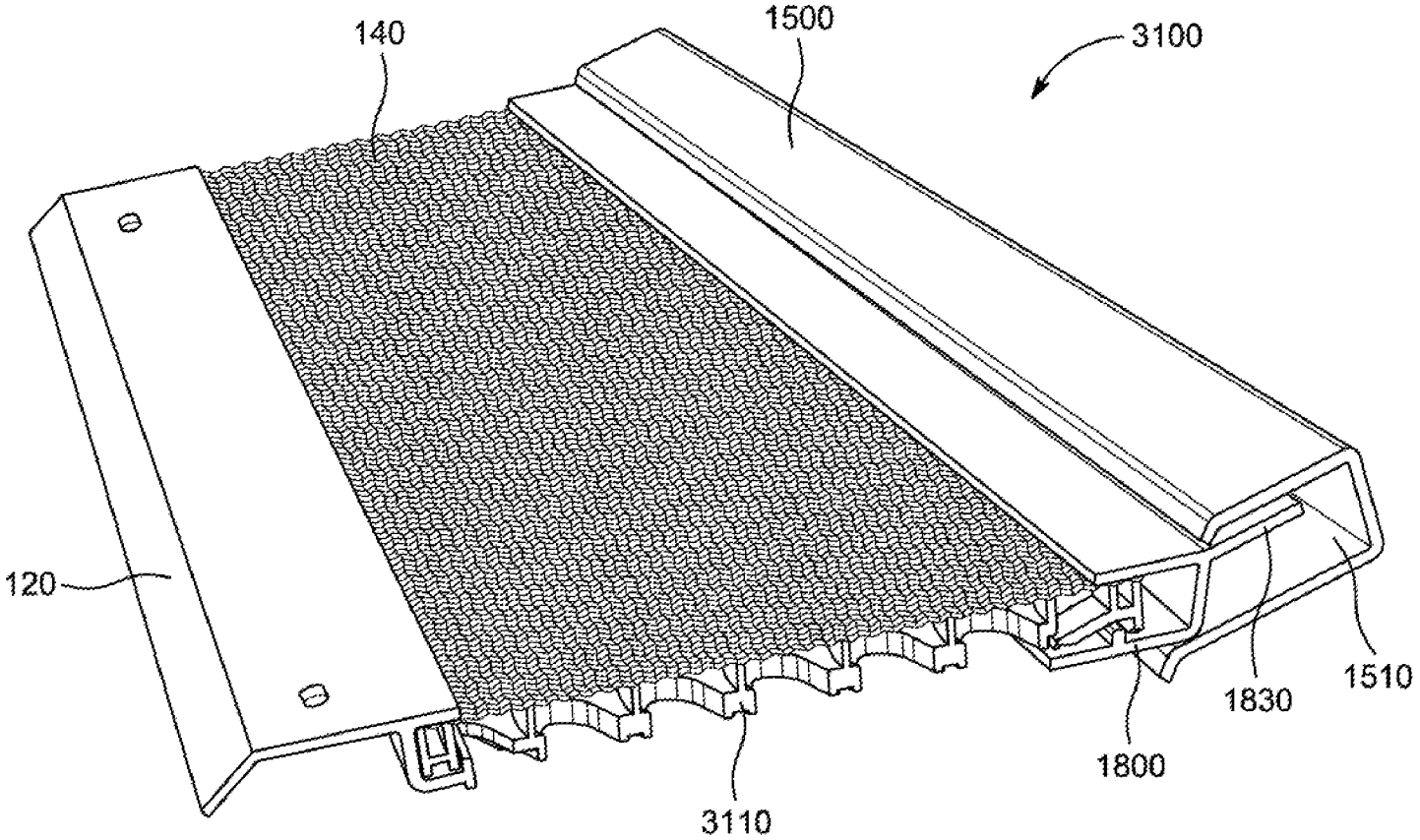

FIG. 107 is a perspective view of another gutter guard system that includes two rear receivers.

Figure 108:
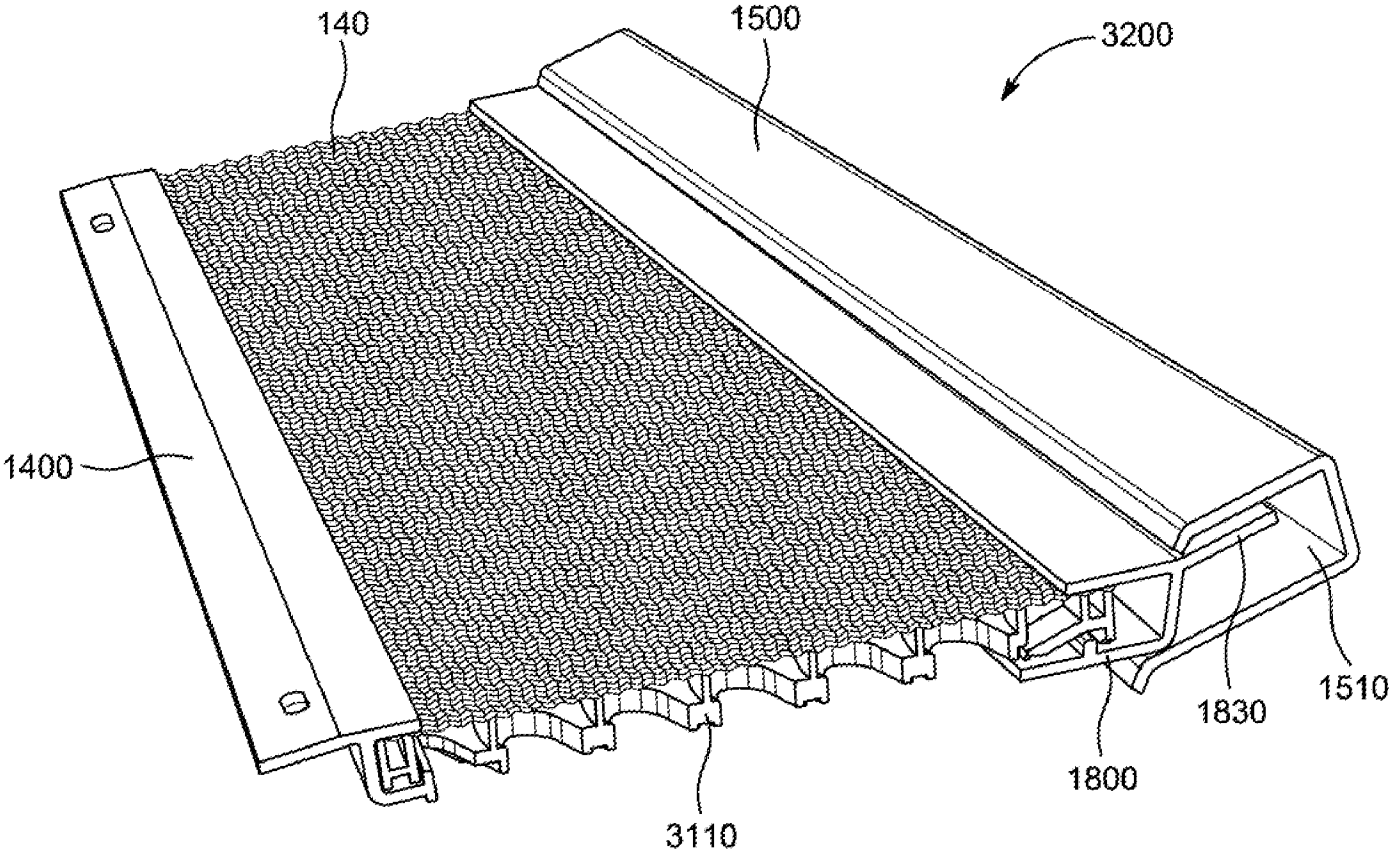

FIG. 108 is a perspective view of another gutter guard system that includes two rear receivers.

Figure 109:
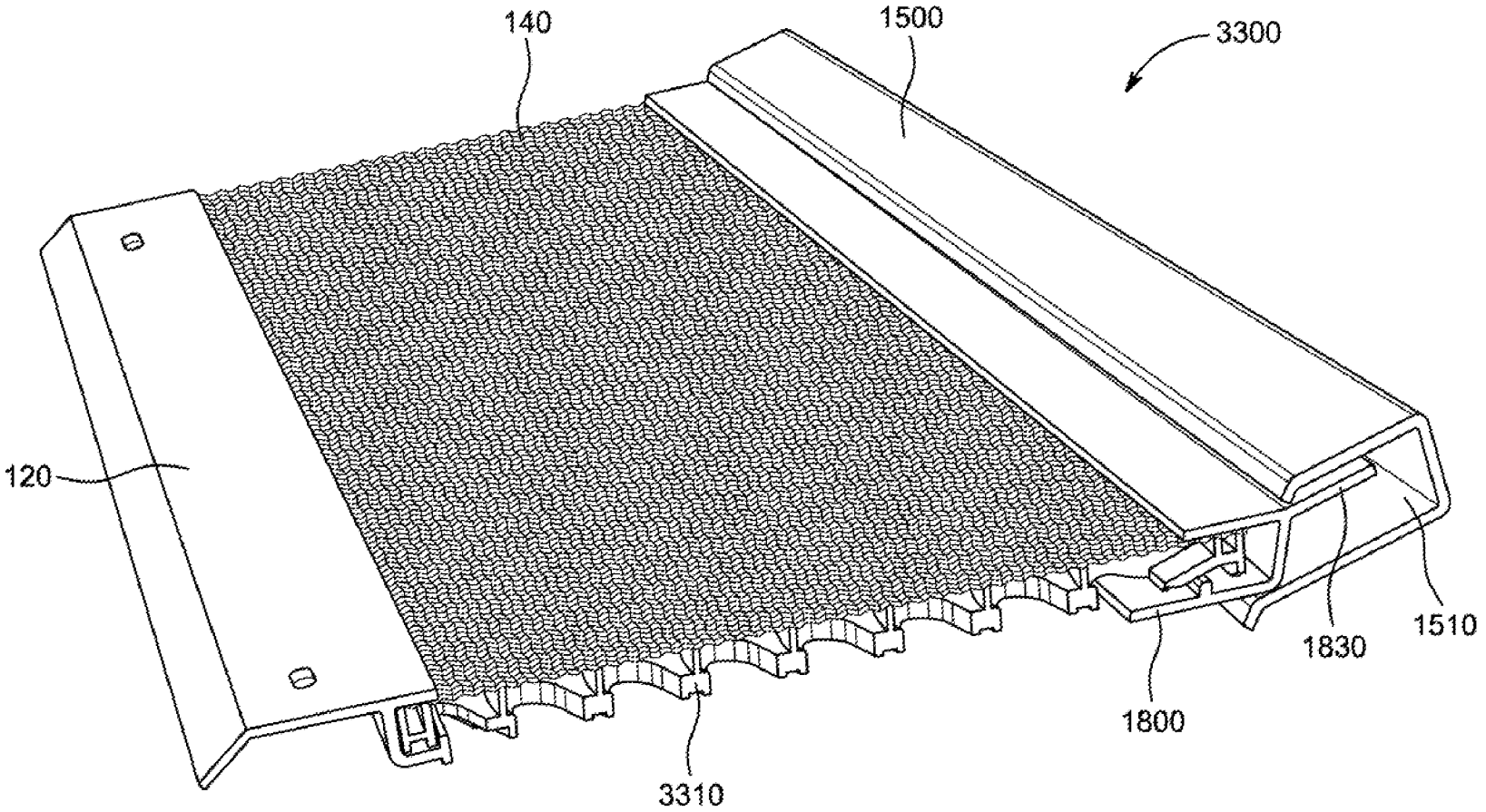

FIG. 109 is a perspective view of another gutter guard system that includes two rear receivers.

Figure 110:
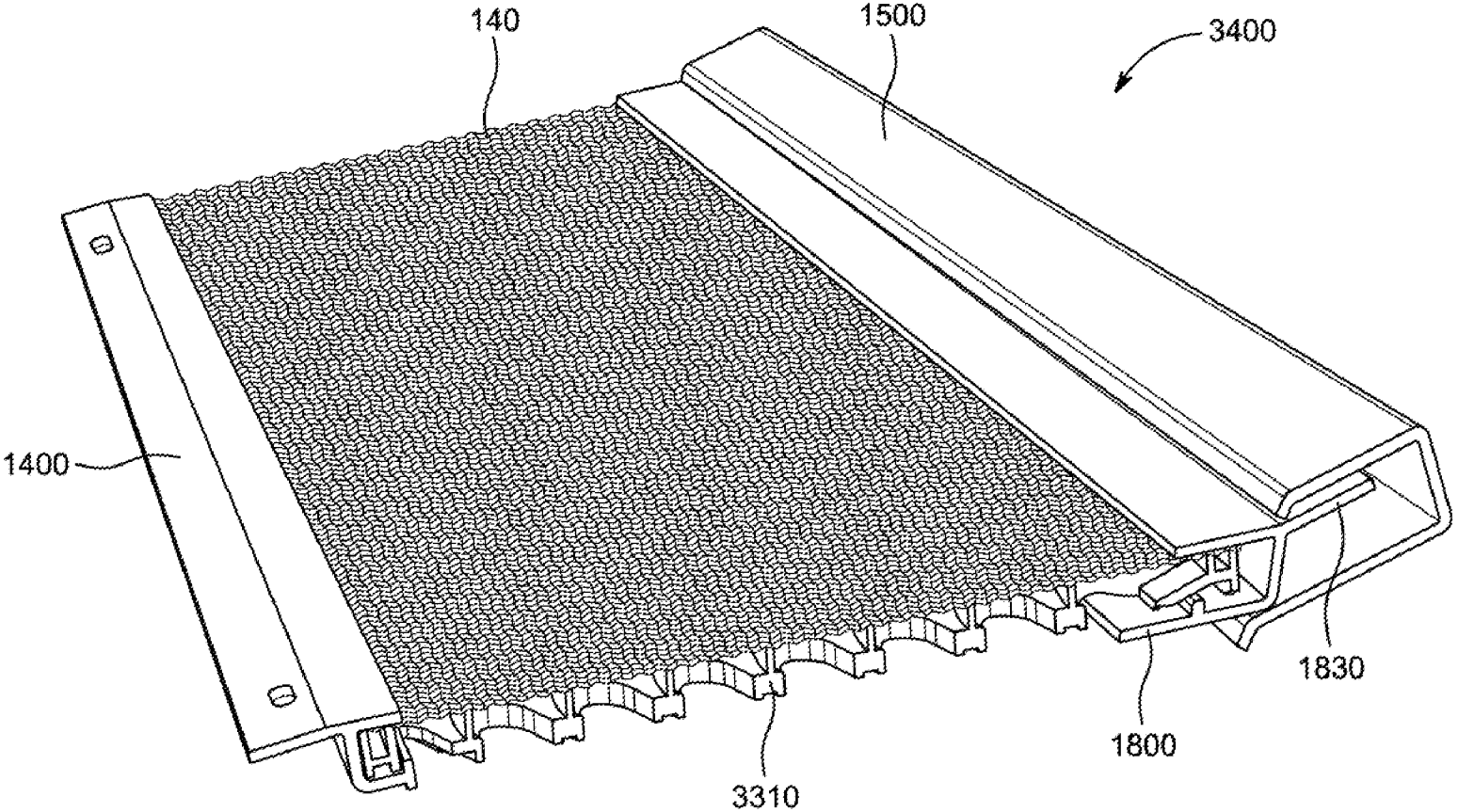

FIG. 110 is a perspective view of another gutter guard system that includes two rear receivers.

DETAILED DESCRIPTION

Figure 1:
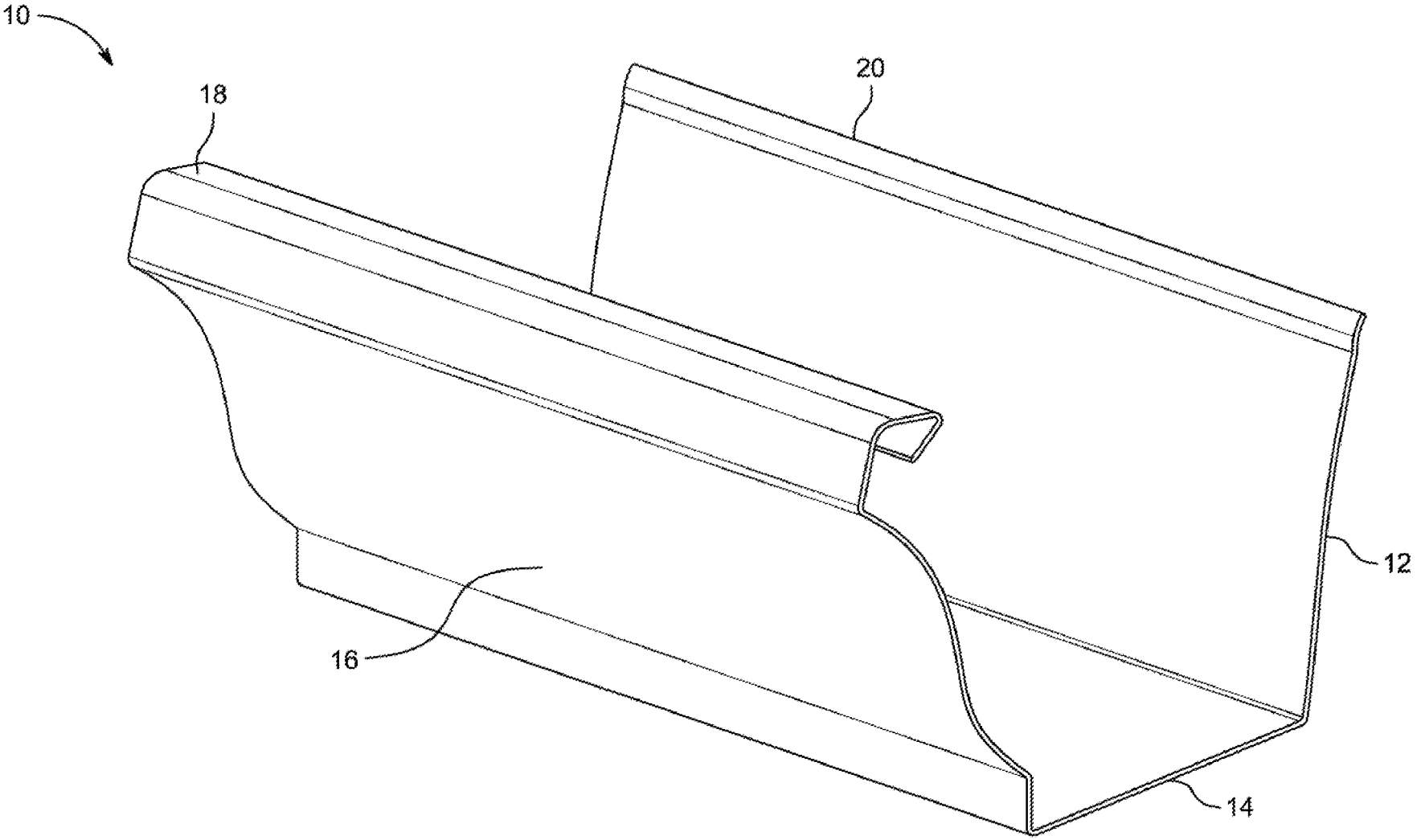
FIG. 1 schematically illustrates a perspective view of an exemplary K-style gutter for use with gutter guard systems disclosed herein.
Figure 2:
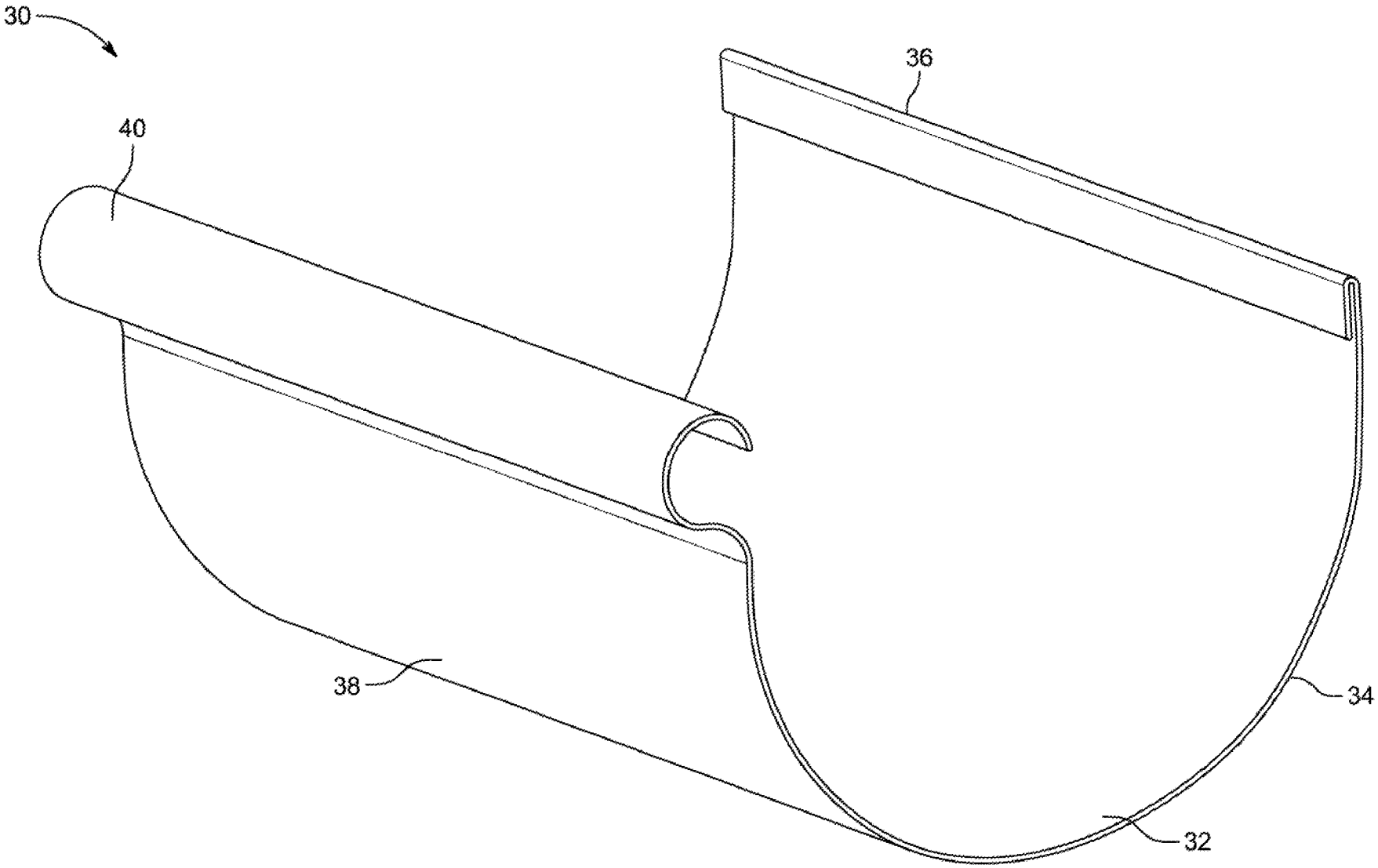
FIG. 2 schematically illustrates a perspective view of an exemplary half-round gutter for use with gutter guard systems disclosed herein.
Figure 3:
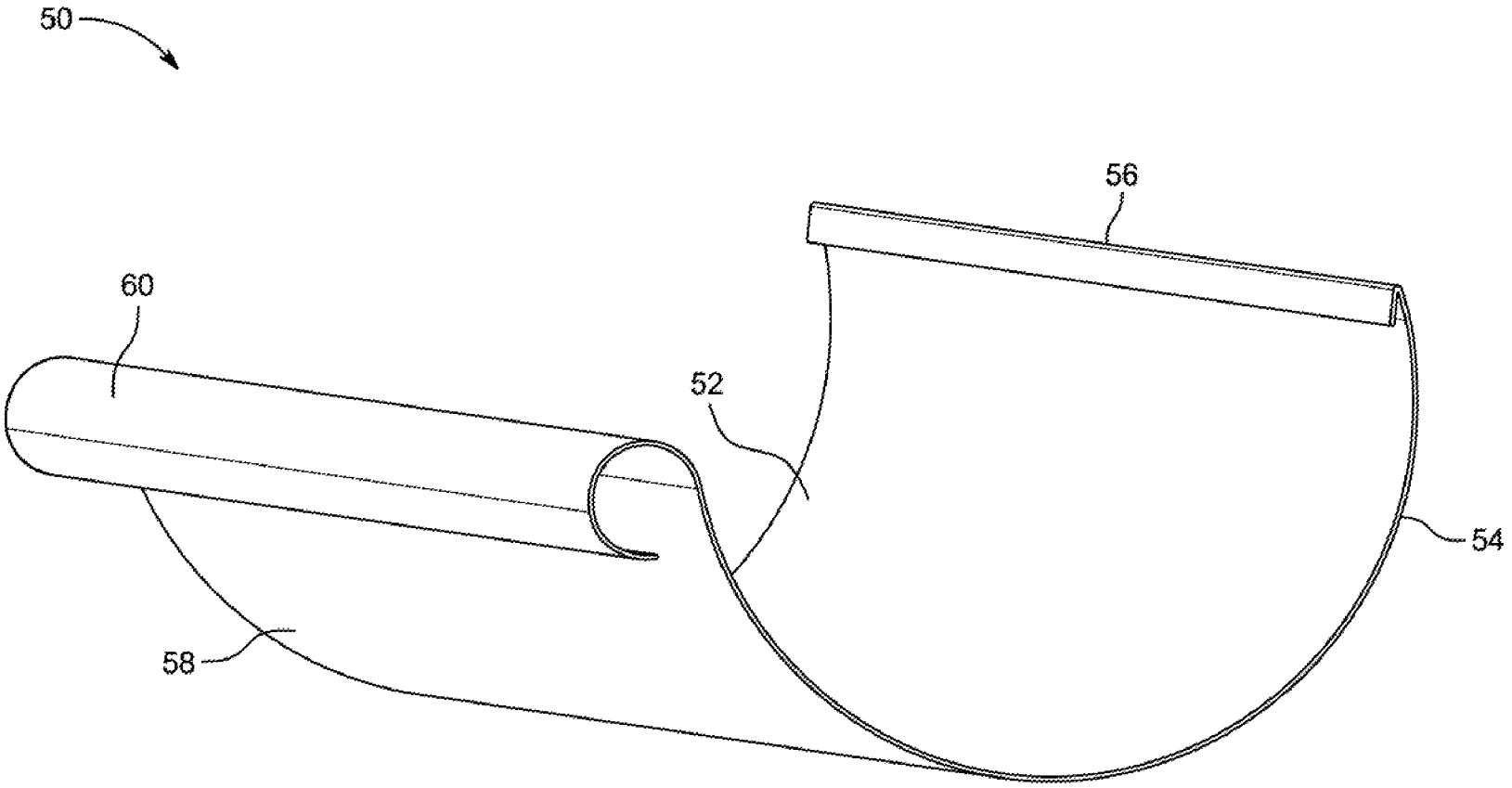
FIG. 3 schematically illustrates a perspective view of another exemplary half-round gutter for use with gutter guard systems disclosed herein.

The apparatus, systems, arrangements, and methods disclosed in this document are described in detail by way of examples and with reference to the figures. It will be appreciated that modifications to disclosed and described examples, arrangements, configurations, components, elements, apparatus, methods, materials, etc. can be made and may be desired for a specific application. In this disclosure, any identification of specific techniques, arrangements, method, etc. are either related to a specific example presented or are merely a general description of such a technique, arrangement, method, etc. Identifications of specific details or examples are not intended to be and should not be construed as mandatory or limiting unless specifically designated as such. Selected examples of modular platforms that include a number of interchangeable components that can be assembled to form gutter guard systems for use with a variety of rain gutters based on the rain gutters' style, size, and the attachment mechanism used to secure the rain gutters to a structure and/or roofline are hereinafter disclosed and described in detail with reference made to FIGS. 1-XX.

As will be described in detail herein, an exemplary embodiment of a novel gutter guard system includes four major components: a main body, a front receiver, a rear receiver, and a screen. Such components can be assembled to form the gutter guard system and subsequently positioned proximate to the top opening of a rain gutter installed on a structure. Typically the gutter guard system generally spans the top opening of the rain gutter. The gutter guard system includes certain features that are arranged to effectively and efficiently channel rainwater away from the structure and into the rain gutter. The gutter guard system further includes other features arranged to block debris from entering the rain gutter.

Each component of the gutter guard system can be made in a plurality of styles and/or sizes to accommodate various styles, shapes, materials, sizes, and colors of rain gutters. For example, the main body can be made in different widths to accommodate different sizes of rain gutter, such as three inch rain gutters, four inch rain gutters, five inch rain gutters, five and a half inch rain gutters, and six inch rain gutters. The main body can be manufactured from a number of materials, including metal and polymeric material such as polyvinyl chloride (PVC), polyethylene (PE), polyolefin (PO), or any other relatively rigid polymer. The main body can be manufactured using a variety of methods including injection molding, additive manufacturing (i.e., 3D printing), machining, metal casting, metal stamping and the like. In some embodiments, more than one manufacturing process can be used. For example, a main body can be machined after it is formed via injection molding or a polymer can be injection molded or 3D printed onto a stamped metal component. When an injection molding process is used, any polymeric material can be used that has acceptable flow characteristics for injection molding that yields a main body with relatively rigid properties.

In another example, the structure of the front and rear receivers relative to the main body can be arranged to accommodate both different style of rain gutters, such as K-style, half-round, fascia style, and even custom designed rain gutters and different structures and rooflines dictated by different architectural styles. One novel feature of the components of a gutter guard system is that the components can be arranged to be interchangeable such that the gutter guard systems can be quickly and easily assembled to accommodate a large variety of styles, shapes, materials, sizes, and color of rain gutters and structures and rooflines of various architectural styles. The components are designed such that the assembly of components into a gutter guard system can be accomplished at the place of manufacture, at a distributor's or dealer's facility prior to shipping to job site, or at the job site itself just prior to installation. The front and rear receivers can be fabricated from any number of materials such as metal or relatively rigid polymeric material such as polyvinyl chloride (PVC), polyethylene (PE), and/or polyolefin (PO). The front and rear receivers can be fabricated using a variety of methods including extrusion, injection molding, additive manufacturing (i.e., 3D printing), machining, metal casting, metal stamping and the like. Similar to the main body, in some embodiments, more than one manufacturing process can be used to fabricate the front and rear receivers. As will be further explained herein, coatings and/or films of various colors can be applied to the front and rear receivers to enhance the aesthetic appeal and weather resistance of the front and rear receivers.

Another novel feature of the components is that once the components are assembled into a gutter guard system, the system can be disassembled and the components reused in different arrangements. This is to say, for example, different styles of front and rear receivers can be assembled with the different sizes of main bodies. If a gutter guard system were to be installed in a four inch K-style gutter, front and rear receivers for K-style gutters can be assembled with a three inch main body. Conversely, the same front and rear receivers can be assembled with a four inch main body for a five inch K-style gutter, and the four inch main body can be assembled with front and rear receivers for half round gutters in order to install on a five inch half round gutter. Thus, creating multiple combinations to accommodate multiple size and styles of gutters and different structures and rooflines. Furthermore, an installed gutter guard system can be upgraded after installation. For example, a gutter guard system can be assembled with a certain front receiver and subsequently upgraded by disassembling the front receiver and replacing it with a front receiver that includes a heating element to manage the formation of ice during winter months. In such an arrangement, all the components of the gutter guard assembly remain the same except for the front receiver. It will be understood that the examples provided herein are exemplary only and that any number of components can be reused or interchanged when configuring a gutter guard system.

Referring to FIGS. 7 through 11, an exemplary embodiment of a gutter guard system 100 includes a main body 110, a front receiver 120, a rear receiver 130, a screen 140, and an elastomeric strip 150 secured to an edge of the rear receiver 130. As will be further detailed herein, the gutter guard system 100 can be assembled from its components and once assembled, can generally be disassembled as required. Additionally, the components illustrated, such as the front 120 and rear 130 receivers and the main body 110, can be replaced with similar but different components to accommodate a variety of styles, sizes, and color of rain gutters as well as accommodating different structures and rooflines.

The gutter guard system 100 can be assembled such that the screen 140 is placed in contact with a top surface of the main body 110, a front receiver 120 is attached to a first or front edge the main body 110, and the rear receiver 130 is attached to a second and opposite edge or rear edge of the main body 110. The front 120 and rear 130 receivers each include a channel, such that the front edge of the main body 110 is slid into the channel of the front receiver 120, and the rear edge of the main body 110 is slid into the channel of the rear receiver 130 to secure the screen 140 to the main body 110 together with the front 120 and rear 130 receivers. The main body 110 and front 120 and rear 130 receivers can be arranged such that the rear receiver 130 can only be assembled with a rear portion of the main body 110 and the front receiver 120 can only be assembled with a front portion of the main body 110. Thus, the arrangement minimizes or eliminates inadvertent errors during assembly of the gutter guard system.

In one embodiment, the screen 140 is a metal mesh screen. In one example, the screen can be made of 316L stainless steel wire, more specifically, 316L stainless steel wire that is 0.0065 inches in diameter. The screen can be arranged in a square weave such that there are 42 wires for each linear inch of screen in both the width and length directions. In such an arrangement, the surface area of the screen includes between 52% and 54% open area. It will be understood with such a large percentage of open area, the screen can facilitate water flowing through the screen and into the gutter even when debris such as leaves that may temporarily come to rest on top of the screen. The 0.0065 inch diameter 316L stainless steel wire arranged as such provides a number of benefits, including resistance to corrosion and rust when exposed to the elements, generally prevents common debris from passing through the screen, inhibits self-healing of the screen due to debris passing over the screen, and promotes water infusion through the screen as water travels across the screen. Furthermore, such an arrangement maintains a generally flat surface when exposed to the elements so that the screen maintains its functionality and aesthetic appeal over time.

The main body 110 can be manufactured in different widths to accommodate different widths of rain gutter such as, for example, three inch, four inch, and five inch widths for residential use. Such an arrangement provides for structural integrity of the gutter guard system because the components are typically used as designed. It is currently common in the industry to cut or plane a larger main body (such as a six inch width) before assembly to accommodate a rain gutter with a smaller width (such as a four inch width). Such modifications before assembly result in degraded structural integrity and inferior gutter guard assemblies. The main body 110 of the present disclosure provides sufficient stiffness and strength such that the main body 110, and the gutter guard system 100 remains planar when installed on a rain gutter without the requirement for any ancillary support structures such as hangers and straps. The main body 110 provides the required rigidity despite the main body 110 having a greater percentage of open area than present gutter guard assemblies currently on the market. Thus, the combination of the main body 110 and the screen 140 result in greater percentage of open area to facilitate water infusion through the screen 140 and main body 110, while providing the rigidity and structural integrity required to efficiently install the gutter guard system 100 without the need for hangers, straps, and the like.

Figure 8:
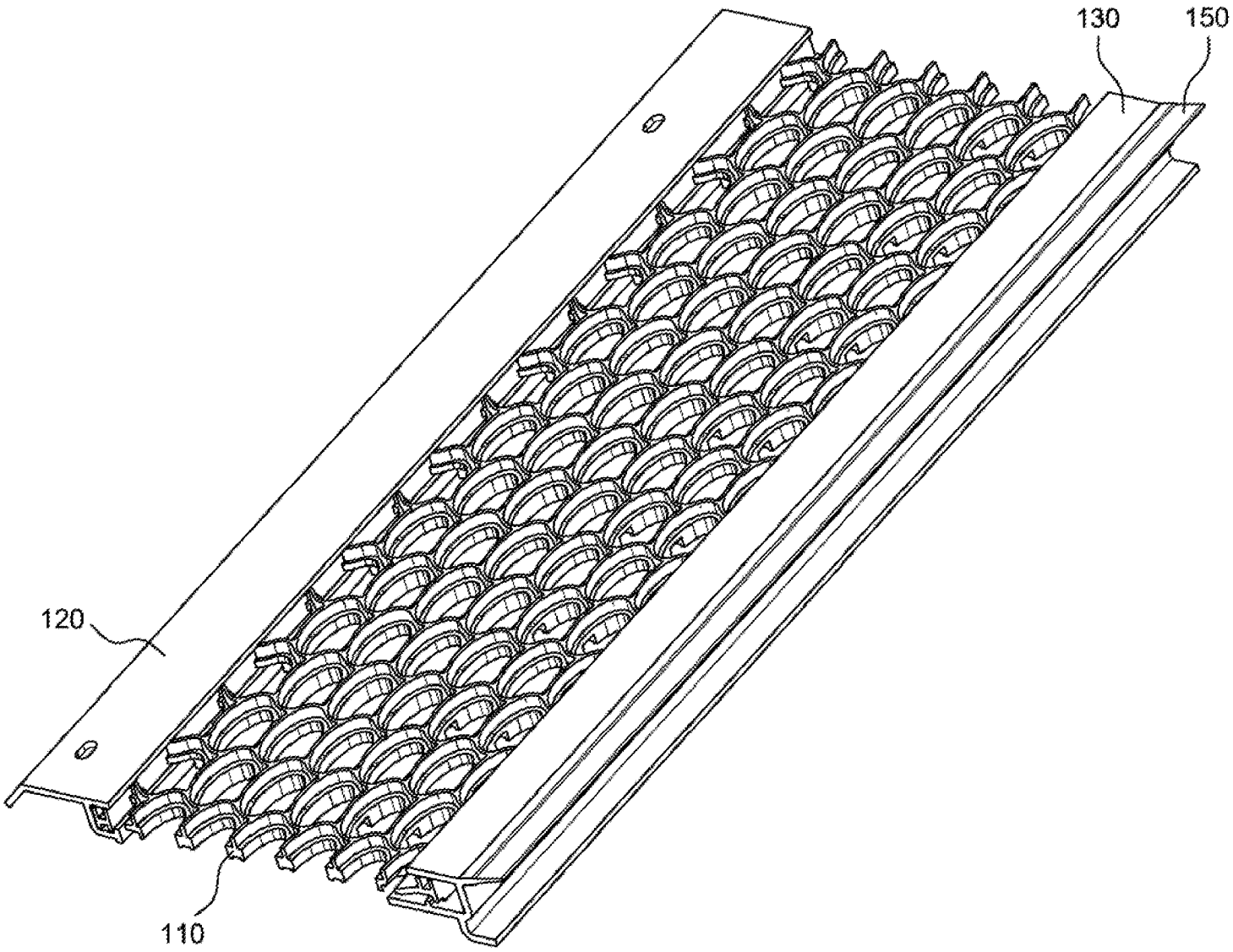
FIG. 8 schematically illustrates a perspective view of the gutter guard system of FIG. 7 with the screen removed.
Figure 9:
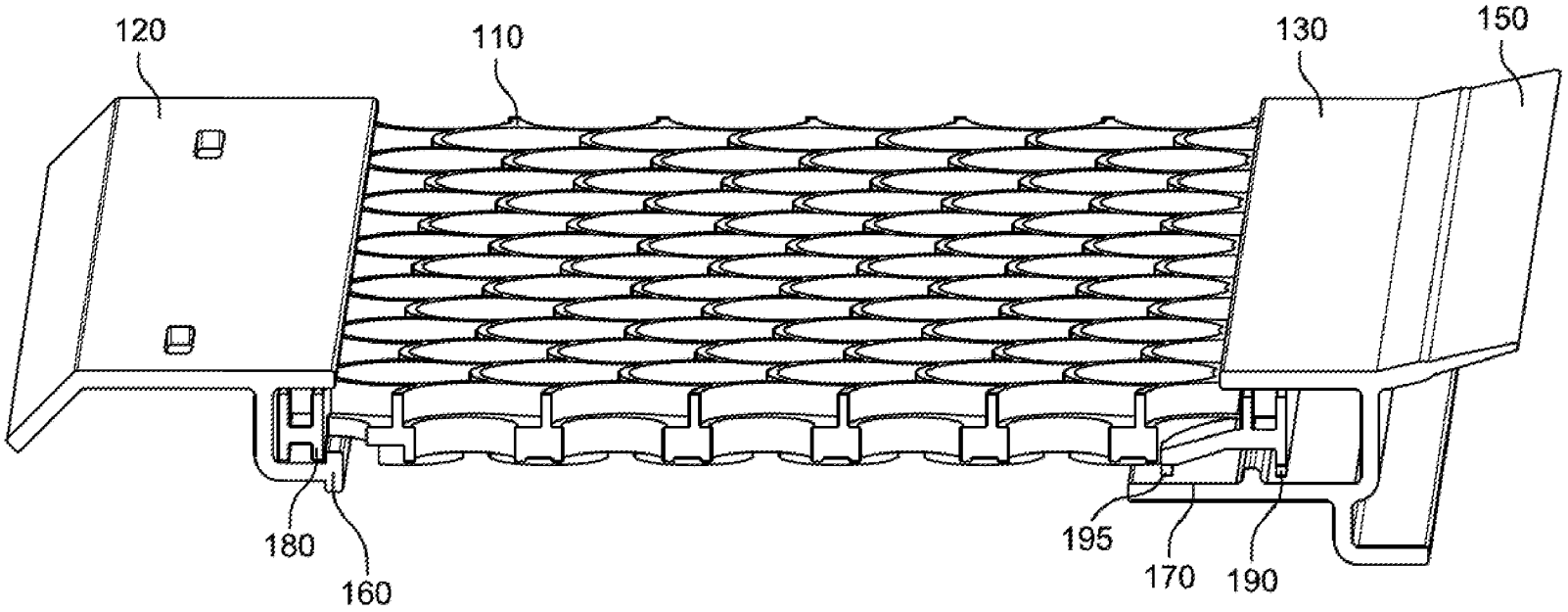
FIG. 9 schematically illustrates a side view of the gutter guard system as illustrated in FIG. 8.
Figure 10:
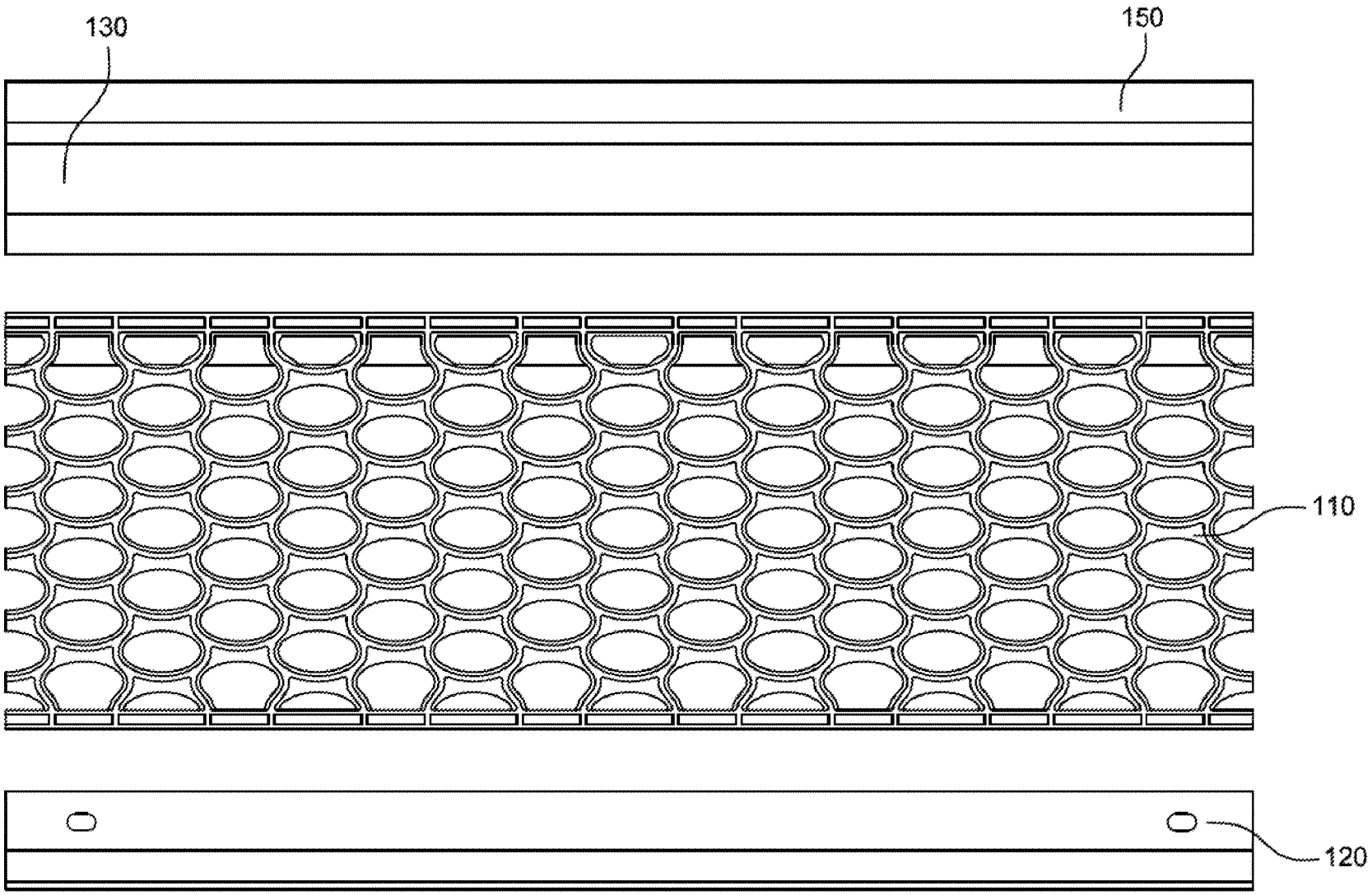
FIG. 10 schematically illustrates a top, exploded view of the gutter guard system as illustrated in FIG. 8.

For structures, such as large homes or commercial buildings, with large roof surface areas, larger rain gutters can be utilized to accommodate the greater flow of rain water from the roof and into the rain gutter. For such larger rain gutters, including rain gutters that are six, seven, eight inches in width or more, the main body can be arranged generally as illustrated in FIGS. 8 through 10, but the thickness of the main body can be increased to provide additional rigidity and structural integrity to accommodate substantially wider rain gutters. Such increased thicknesses can be achieved by modifications to injection molding tooling, but such modifications can maintain the thickness of the edges of the main body such that the front and rear receivers as described herein can continue to be used to accommodate the assembly of gutter guard systems for substantially wider rain gutters. Additionally, a rear receiver can be widened and used with main bodies disclosed herein to span gutter openings greater than six inches in width.

The channels of the front 120 and rear 130 receivers can be arranged such that the main body 110 can move laterally such that the width of the gutter guard system can be adjusted to accommodate for imperfections and different manufacturing tolerances amongst rain gutters. For example, as illustrated in FIG. 9, the front receiver 120 includes a stop 160 that engages with a first extending leg 180 positioned near the front of the main body 110, and the rear receiver 130 includes a stop 170 that engage a second extending leg 190 near the rear of the main body 110. As will be understood, the engagement of stop 160 of the front receiver 120 with the first extended leg 180 and the engagement of the stop 170 of the rear receiver 130 and the second extended leg 190 secures the front portion of the main body 110 within the front receiver 120 and secures the rear portion of the main body 110 within the rear receiver 130. As is further illustrated in FIG. 9, the second extended leg 190 of the main body 110 and the stop 170 of the rear receiver 130 are arranged such that there is "play" within the components (i.e., arranged to allow for a degree of lateral movement of the rear receiver 130 relative to the main body 110). Such an arrangement allows for the over all width of the gutter guard system 100 to be adjustable to accommodate rain gutters that are nominally the same width, but have varying widths due to manufacturing tolerances, inconsistencies in raw materials, warping, deformation, and the like. The rear receiver 130 can further include a third extending leg 195. This third extending leg 195 can allow for further flexibility in accommodating additional over all widths when assembling a gutter guard system. Furthermore, when the rear receiver 130 is arranged as illustrated in FIG. 9, i.e., the second extended leg 190 is positioned to be engageable with the stop 170, the third extending leg 195 engages with the bottom surface of the rear receiver 130 such as to further stabilize and increase the structural integrity of the gutter guard system 100. For example, the engagement of the third extending leg 195 with the bottom surface of the rear receiver 130 prevents or limits rotational movement of the rear receiver 130 with respect to the main body 110, which further constrains unwanted movement between the components of the gutter guard system 100. As will be understood, preventing or limiting rotational movement of the rear receiver 130 with respect to the main body 110 can be advantageous when a force is applied to the top surface of the main body 110 once the gutter guard system 100 is installed onto a rain gutter.

Although the example as illustrated in FIG. 9 includes a single stop 160 on both the front receiver 120 and a single stop 170 on the rear receiver 130, it will be understood that a front receiver and a rear receiver can each include more than one stop. For example, a rear receiver can include a second stop positioned on the same surface as the first stop that allows for the rear receiver to be assembled with the main body to either increase the over all width of a gutter guard assembly or decease the over all width of the gutter guard assembly (based on the second stops position relative to the first stop). Additionally, a second stop can be positioned on the underside of the surface opposite the first stop. In such an arrangement, the second stop can engage an upper portion of the main body when assembled with the rear receiver to further secure the rear receiver to the main body. As will be further understood, the second stop as described with respect to a rear receiver can also be applied to a front receiver.

Figure 11:
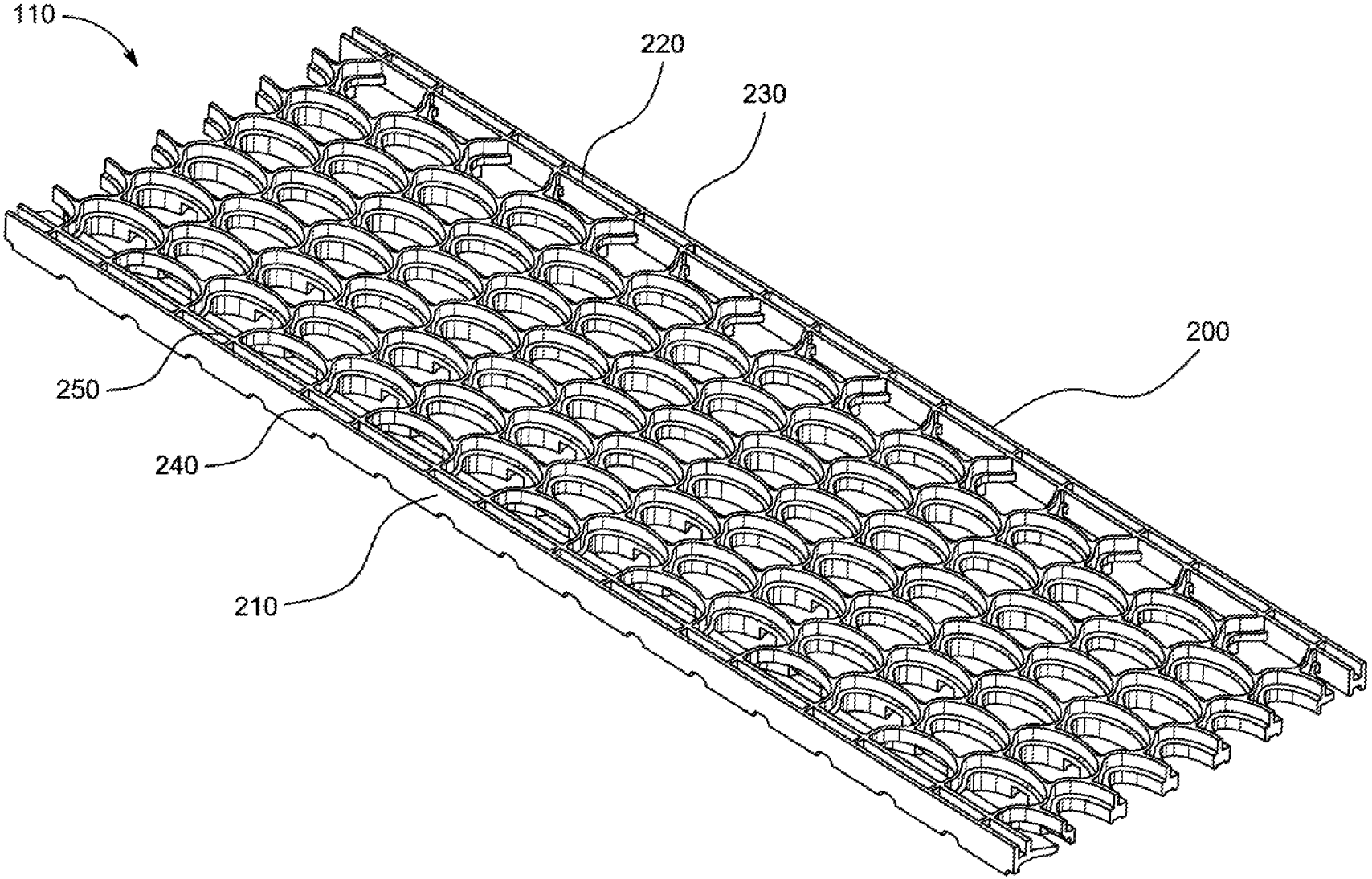
FIG. 11 illustrates a perspective view of the main body of the gutter guard system of FIG. 7.

Securing the front 120 and rear 130 receivers and the main body 110 and screen 140 forms a stable assembly that can be unassembled as necessary. In another embodiment, the screen 140 can be secured to the main body 110 via a bonding method such as heat staking. The screen 140 can be placed on the main body 110 and subsequently set in place in a staking machine, where the screen 140 is heat staked to certain features on the top surface of the main body 110. As illustrated in FIG. 11, the main body 110, includes a first edge 200 (which can also be referred to as a "front edge") and a second edge 210 (which can also be referred to as a "rear edge"). As will be understood, when the gutter guard system 100 is assembled, the first edge 200 engages with the front receiver 120 and the second edge engages with the rear receiver 130. A first pair of rails 220 and 230 are located proximate to the first edge 200, and a second set of rails 240 and 250 are located proximate to the second edge 210. In one embodiment the first pair of rails 220 and 230 and the second set of rails 240 and 250 are the features on the top surface of the main body 110 that add structural rigidity to the main body in the direction parallel to the rain gutter when the gutter guard system is installed in a rain gutter. Additionally, the first pair of rails 220 and 230 and the second set of rails 240 and 250 can facilitate bonding of the screen 140 to the main body 110. It will be understood that the screen 140 can be bonded to features of the main body 110 other than the rails 220, 230, 240, 250. For example, the screen 140 can be secured to edges extending above the various apertures of the main body. In certain embodiments, select portions of the screen can be heat staked to extending edge s, with such heat staking locations arranged to provide the desired properties for the gutter guard system.

Figure 12:
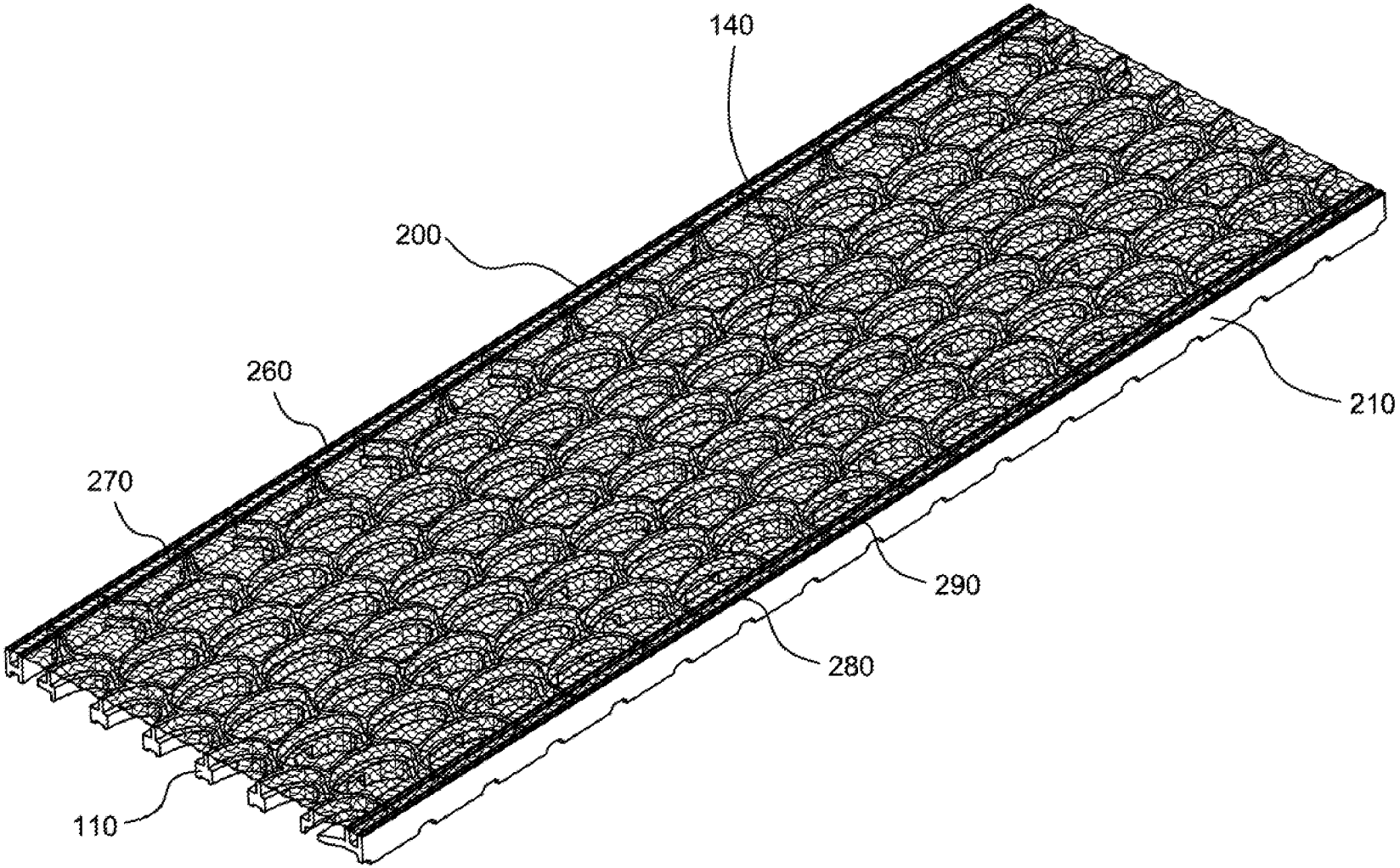
FIG. 12 schematically illustrates a perspective view of an arrangement of the screen heat staked to the main body of the gutter guard system of FIG. 7.
Figure 13:
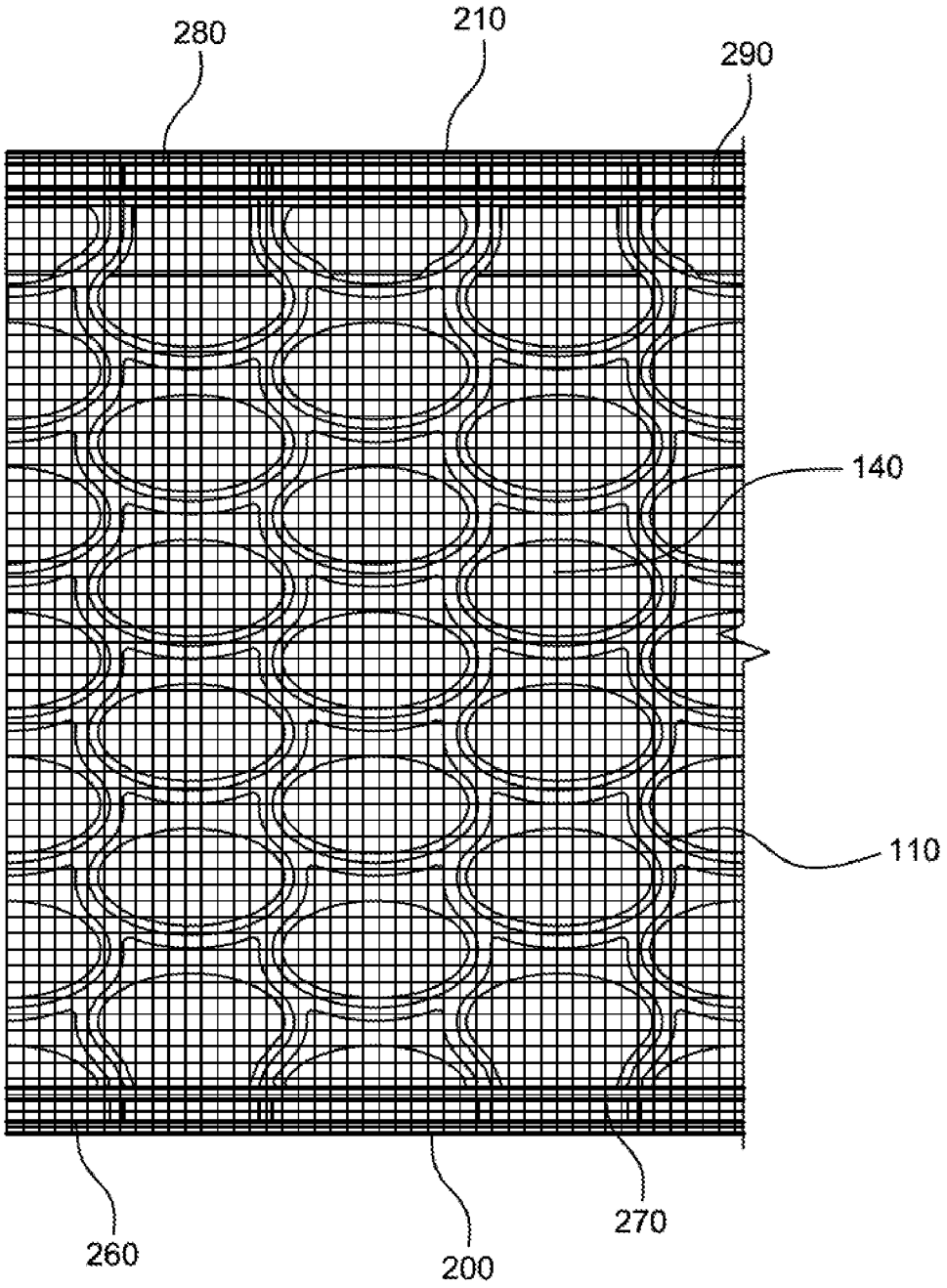
FIG. 13 schematically illustrates a detailed top view of an arrangement of the screen heat staked to the main body of the gutter guard system of FIG. 7.
Figure 14:
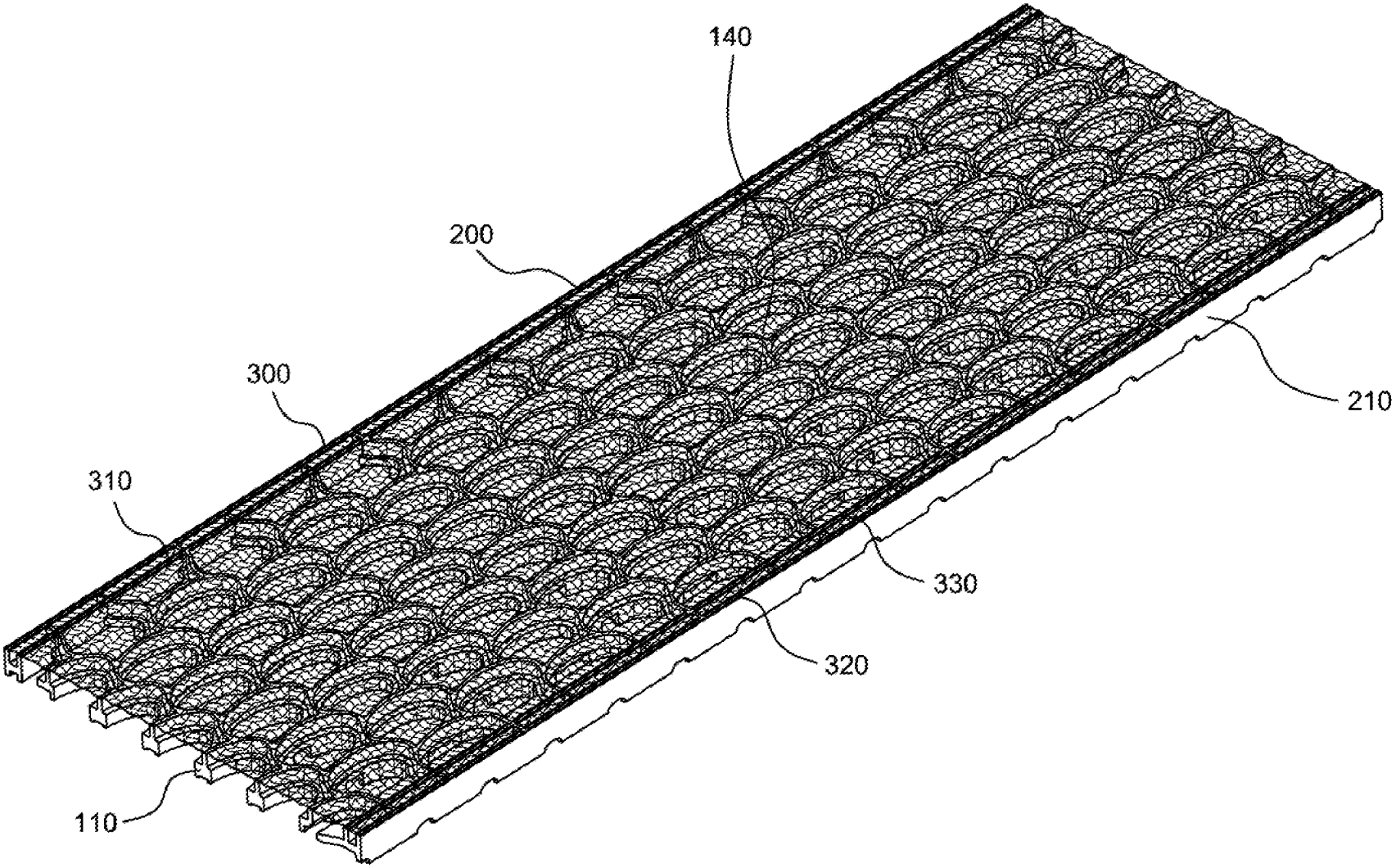
FIG. 14 schematically illustrates a perspective view of another arrangement of the screen heat staked to the main body of the gutter guard system of FIG. 7.
Figure 15:
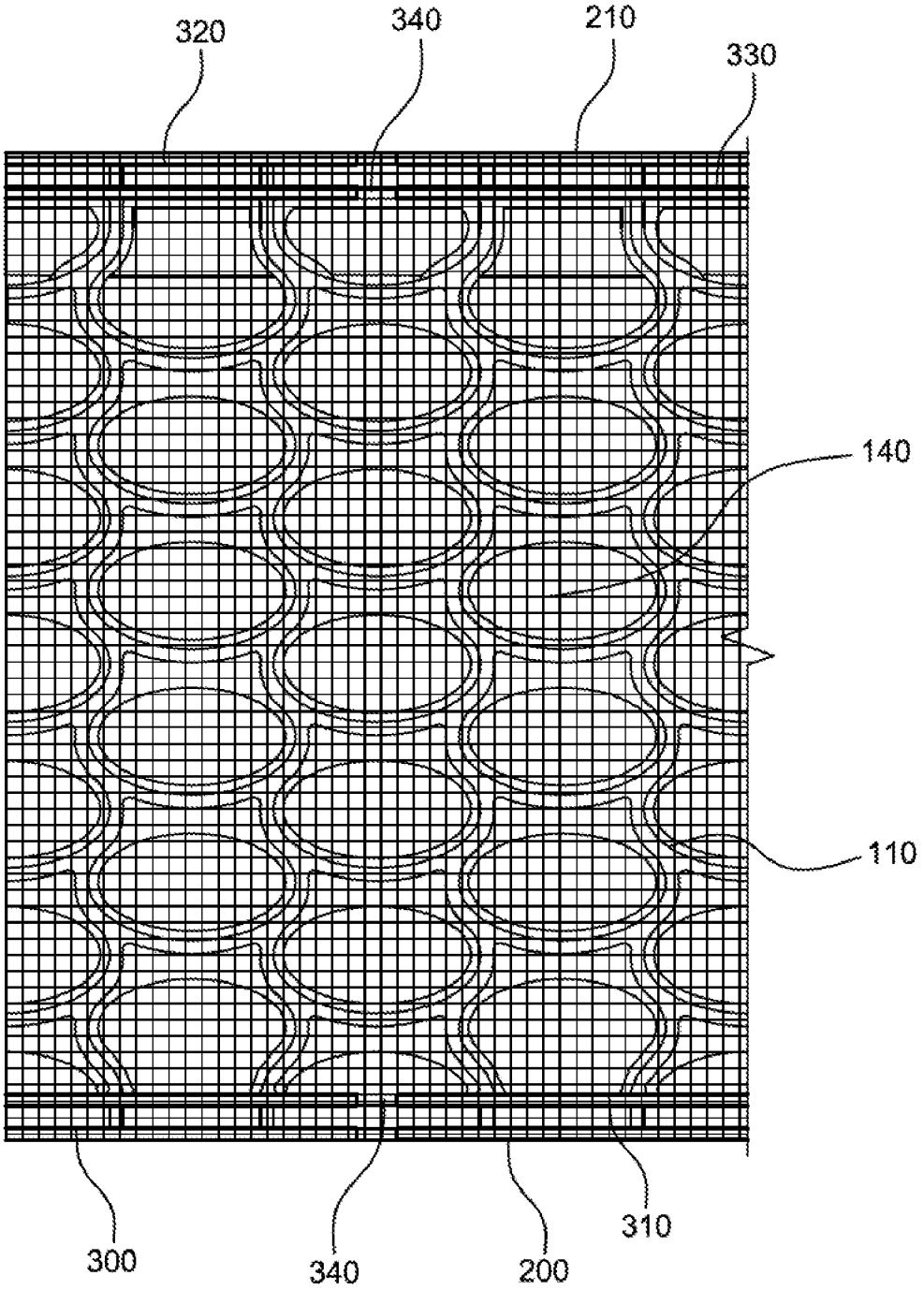
FIG. 15 schematically illustrates a detailed top view of another arrangement of the screen heat staked to the main body of the gutter guard system of FIG. 7.

As illustrated in FIGS. 12 and 13 (a detailed view of FIG. 12), one method of forming a bond between the screen 140 and the main body 110, and thus securing the screen 140 to the main body 110, is to form linear adhesion sections (260, 270, 280, and 290) between the screen 140 and main body 110 along the length of the first and second pair of rails (220, 230, 240, and 250). As illustrated in FIGS. 14 and 15 (a detailed view of FIG. 14), another method of forming a bond between the screen 140 and the main body 110, and thus securing the screen 140 to the main body 110, is to form a plurality of linear adhesion sections (300, 310, 320, and 330) between the screen 140 and main body 110 along the length of the first and second pair of rails (220, 230, 240, and 250). As best illustrated in FIG. 15, each of the plurality of adhesion sections (300, 310, 320, and 330) can be separated by a small gap 340. In one example, each adhesion section (300, 310, 320, and 330) is approximately 12 inches in length, and the gaps 340 are substantially smaller, where the gaps 340 are arranged to be large enough to accommodate a coefficient of linear thermal expansion between different materials. Such staking processes can provide a number of benefits to a gutter guard system 100. For example, the screen 140 can be secured to the main body 110 such as to prevent warping and/or deforming of the screen 140 over time due to exposure to the elements and inclement weather such as high winds, heavy snow fall, etc. Furthermore, when the screen 140 is secured to the main body 110 the screen 140 can be placed under tension. Such an arrangement can result in the screen 140 generally maintaining contact with the raised features of the main body 110 (to be subsequently discussed herein). Such contact can facilitate flow of rainwater downward through the screen 140 and apertures in the main body 110 and into the rain gutter, particularly in light of the high percentage of open area provided by both the screen 140 and main body 110. Such arrangement thus allowing the gutter guard system to accommodate a higher rate of water flow across the gutter guard system.

Figure 16:
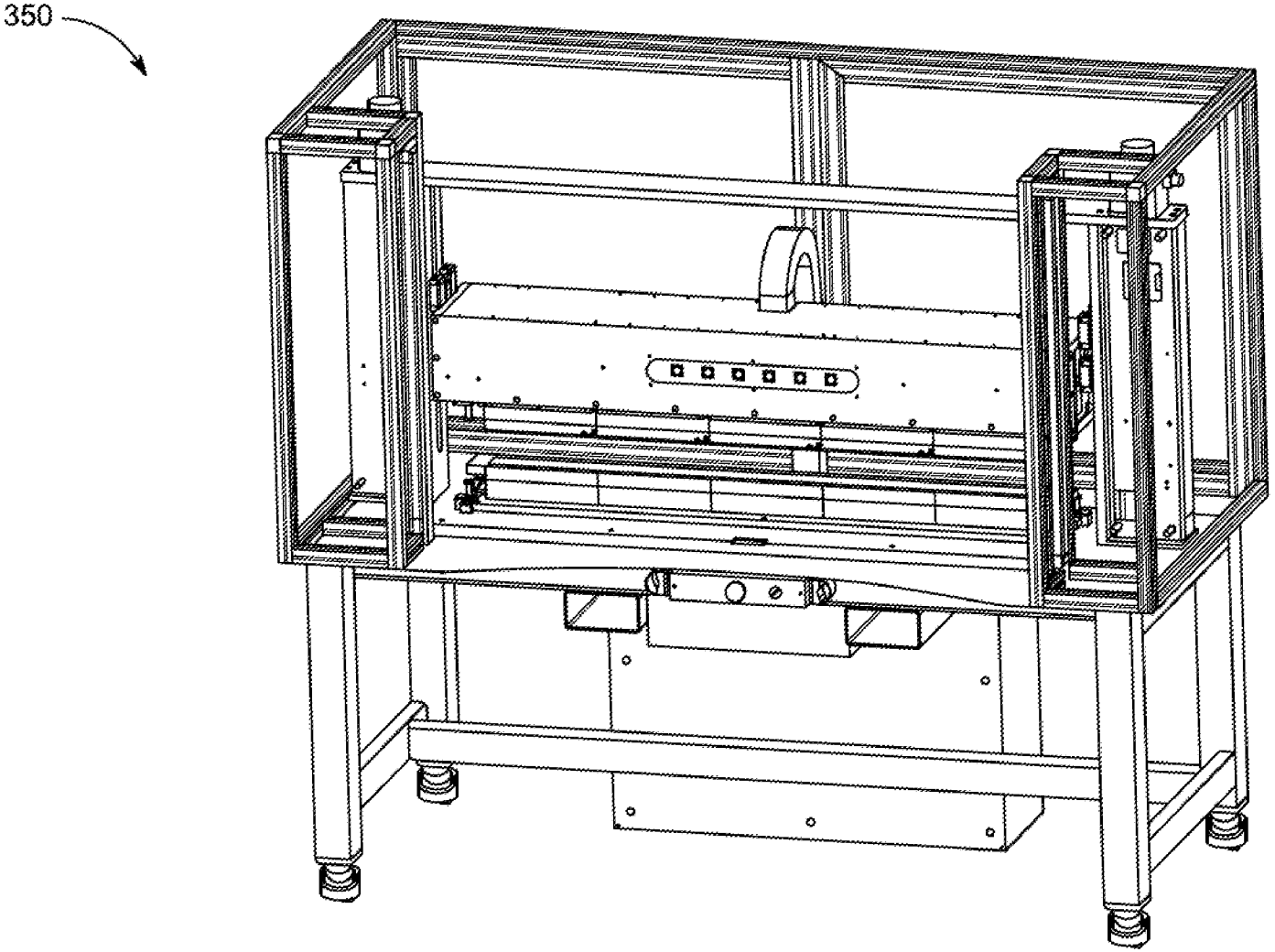
FIG. 16 schematically illustrates a perspective view of a heat staking machine.
Figure 17:
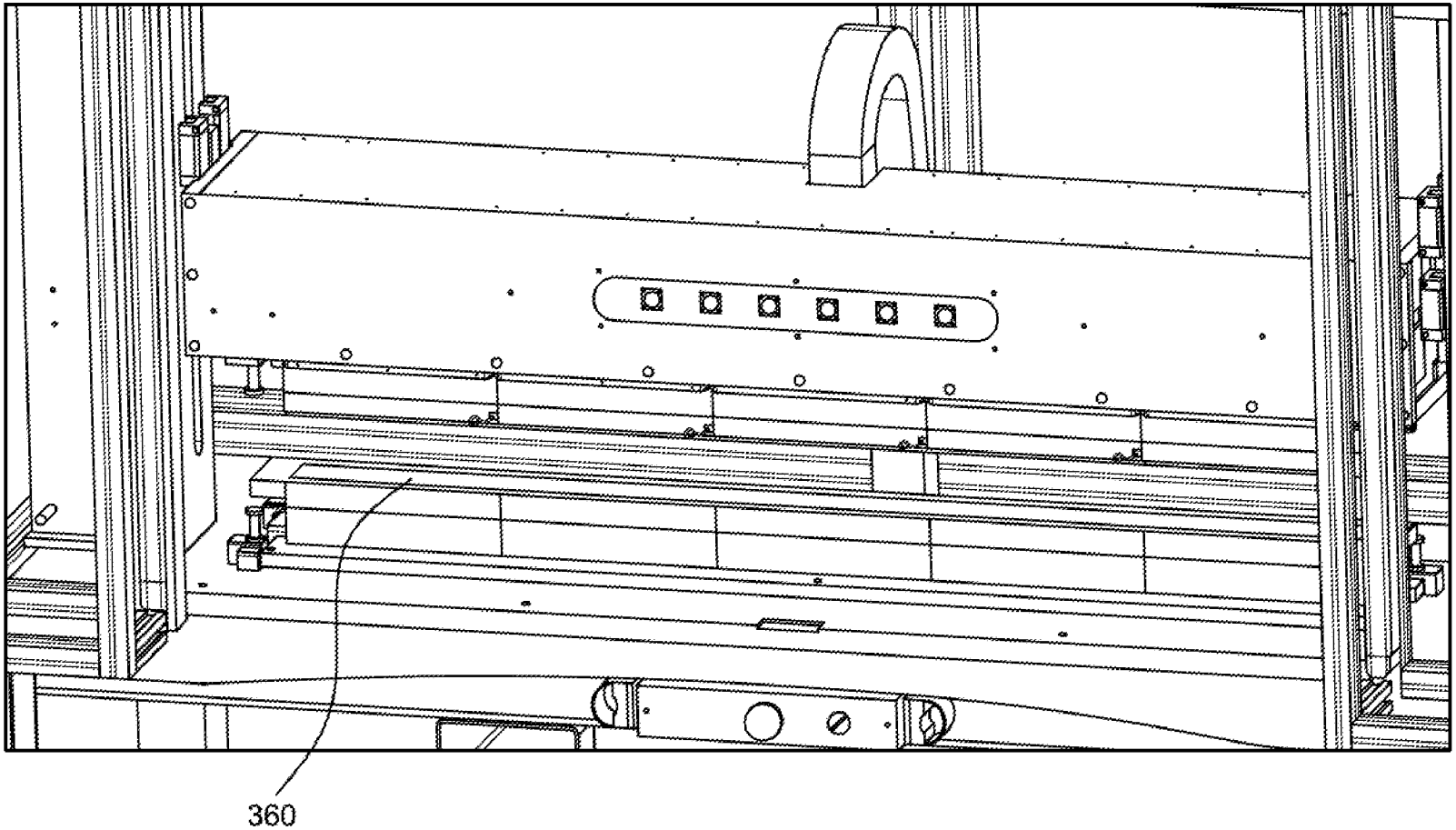
FIG. 17 schematically illustrates a detailed perspective view of the heat staking machine of FIG. 16.

FIGS. 16 and 17 illustrate an exemplary heat staking machine 350. The heat staking machine includes a bed 360 onto which a main body and screen can be placed in order to undergo a heat staking process. The heat staking process includes the steps of applying localized heat and pressure to the top surface of the screen, where the heat and pressure transfer through the screen and onto the polymeric main body. The heat and pressure are applied in a controlled manner such that the polymeric material of the main body experiences localized deformation due to softening and melting of the polymeric material. The heat staking machine 350 is designed such that heat and pressure applied to the main body does not affect the over all dimensions or shape of the main body, which remain stable throughout the heat staking process. The pressure engages the screen and the softening and melting polymeric material such that the screen becomes adhered to the main body upon the cooling of the polymeric material, thus, forming adhesion sections such as those illustrated in FIGS. 12 through 15. To facilitate such a process, the heat staking machine 350 includes a series of heads positioned over the bed 360 of the staking machine 350. The heads are heated and lowered onto the screen in a controlled manner such that a predetermined heat and pressure are applied to the screen and main body for a predetermined period of time (i.e., dwell time). Such heads are arranged to be positionally adjustable to vary the placement of the heat and pressure along the surface of the screen and main body. Additionally, the staking machine 350 is arranged to vary the dwell time, which affects the strength of the bond between the screen and main body. As will be understood, such variability of the position of the heads and dwell time allows for the formation of adhesion sections to accommodate a variety of variables including the width and length of a main body, the thickness of the screen, the screen and main body materials, and the strength of the bond between the screen and main body. In one embodiment, the screen can be longer than the main body so that after the heat staking process, a portion of the screen extends past the ends of the main body. For example, the screen can extend 1.75 inches past each end of the main body. In such an arrangement, the excess screening material can form downward wicking butt joints between sections of the gutter guard system when the sections are installed next to one another.

One application that benefits from the securing of the screen to the main body is the installation of sections of a gutter guard system that cover the outside corners and inside corners of rain gutters. As will be appreciated, whenever a roofline diverges at a corner of a structure, the rain gutter also diverges at the same angle, typically a right angle. Because gutter guard assemblies are not specifically designed to accommodate such inside and outside corners, gutter guard assemblies typically perform poorly at sections that cover inside and outside corners. However, because the screen and the main body of the gutter guard system described herein are adhered along the extend of the main body on both edges of the main body, a main body and screen can be cut on an angle to accommodate inside and outside corners of rain gutters while maintaining the integrity and function of the screen and main body. The heat staking process can also facilitate the staking of a screen to a main body, where the main body has been pre-cut or formed with an angle on one end to accommodate an inside or outside corner of rain gutters. Similar to the description above, sections of the screen can extend past the ends of the main body. Such an arrangement can provide a butt joint between sections of the gutter guard system installed in inside and outside corners of the rain gutters on a structure, where the excess screen can form a downward wicking butt joint to manage the flow of water downward into the rain gutter.

For installation of a gutter guard system 100 onto the rain gutter, the rear receiver 130 is designed to engage with the rear lip of the rain gutter (i.e., the lip that is closest to the roofline and/or structure), and the front receiver 120 is designed to engage with the front lip of the rain gutter (i.e., the lip that is spaced away from the roofline and/or structure). As will be subsequently discussed, front receivers and rear receivers can have a number of different designs, often driven by regional architectural styles, rooflines, structures, and contractor trade practices, to accommodate various installations for the gutter guard system 100.

In certain embodiments, the gutter guard system can be secured to the rain gutter, roofline, and/or the structure. For example, the front receiver can be secured to the front lip of the rain gutter with one or more fasteners, and the rear receiver can be secured to the rear lip of the gutter or secured directly to the roofline and/or structure with one or more fasteners. In yet another embodiment, clips or brackets can be used to secure or hold the gutter guard in position. It will also be understood that the gutter guard systems can also be positioned within a rain gutter without any fasteners, brackets, clips, or hangers. In such embodiments, features of the front and rear receivers can engage with the rain gutter to retain the gutter guard system within the rain gutter.

As will be appreciated, the gutter guard systems are installed at a downward angle so that rainwater from the roof of the structure flows away from the structure and/or roofline. The rainwater flows across the screen, where contact points between the screen and the main body encourage the flow of rainwater downward through the screen and main body and into the rain gutter. The main body can include a number of configurations to facilitate the flow of water downward into the rain gutter. Once installed, the elastomeric strip 150 extending from the rear receiver 130 can engage the side of the structure and/or roofline and seal the gutter guard system 100 against the structure and/or roofline to further facilitate the flow of rain water across the gutter guard system 100 and prevent the entrapment of debris between the side of the structure and/or roofline and the gutter guard system and/or rain gutter.

Figure 18:
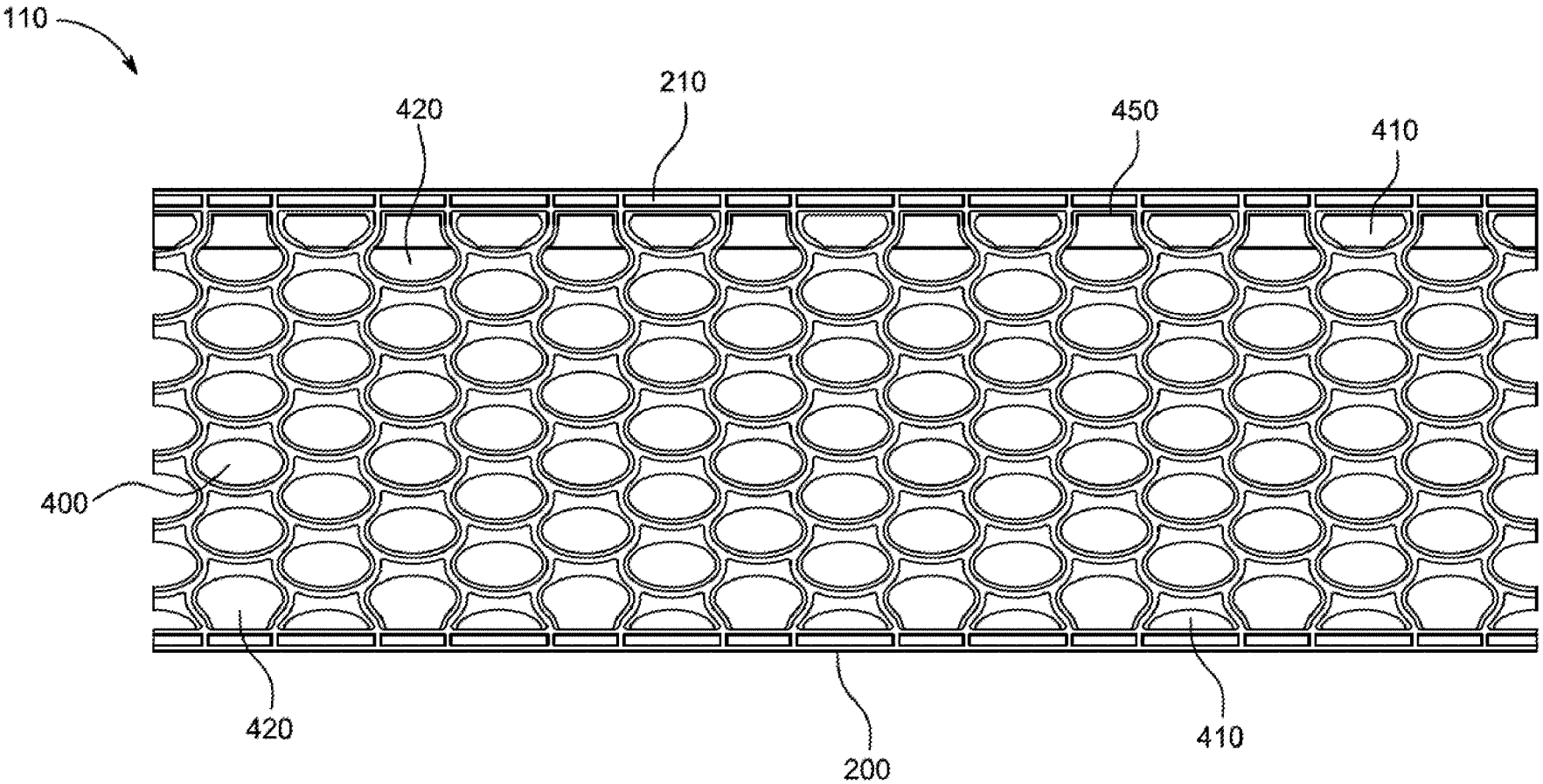
FIG. 18 schematically illustrates a top view of the main body of the gutter guard system of FIG. 7.
Figure 19:
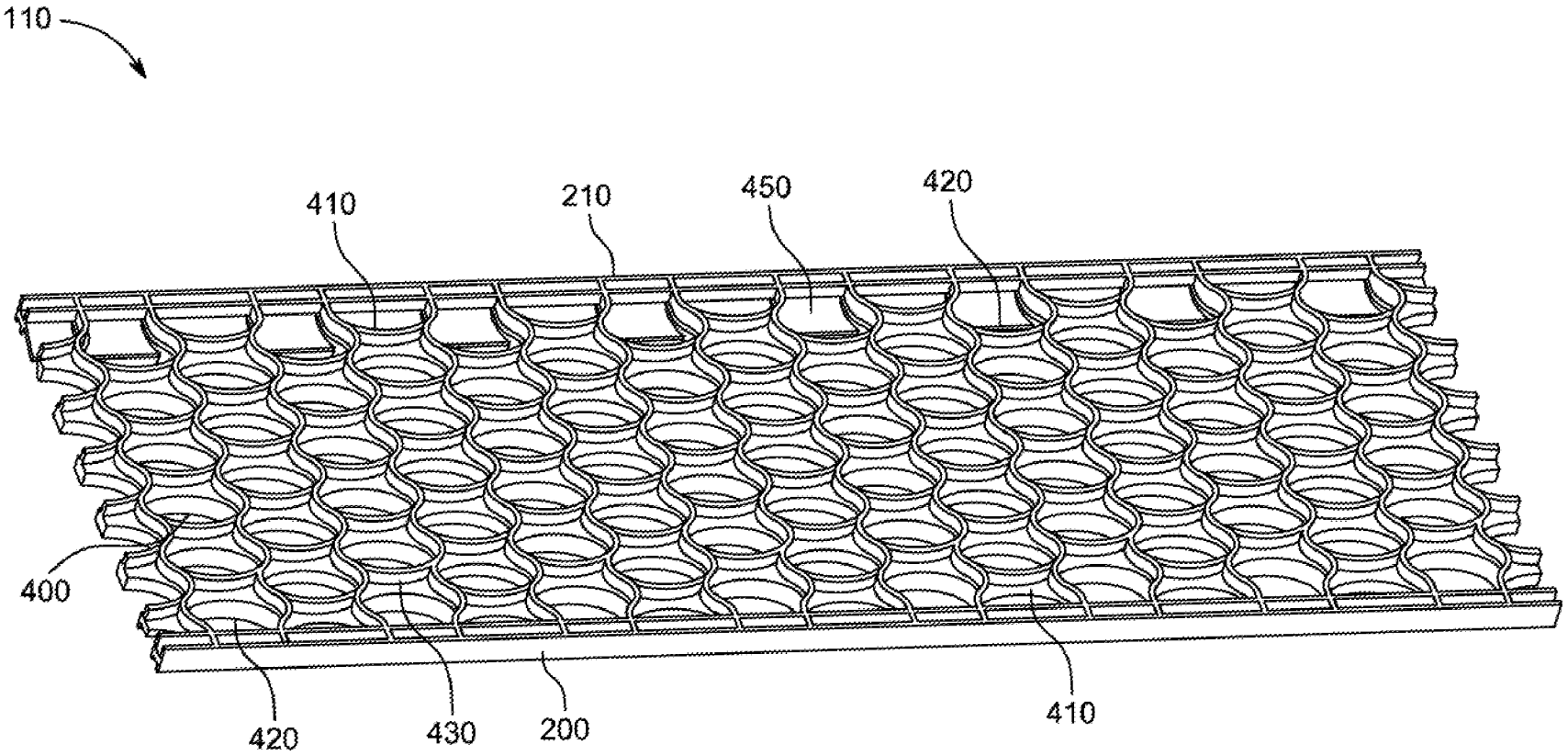
FIG. 19 schematically illustrates a top perspective view of the main body of the gutter guard system of FIG. 7.
Figure 20:
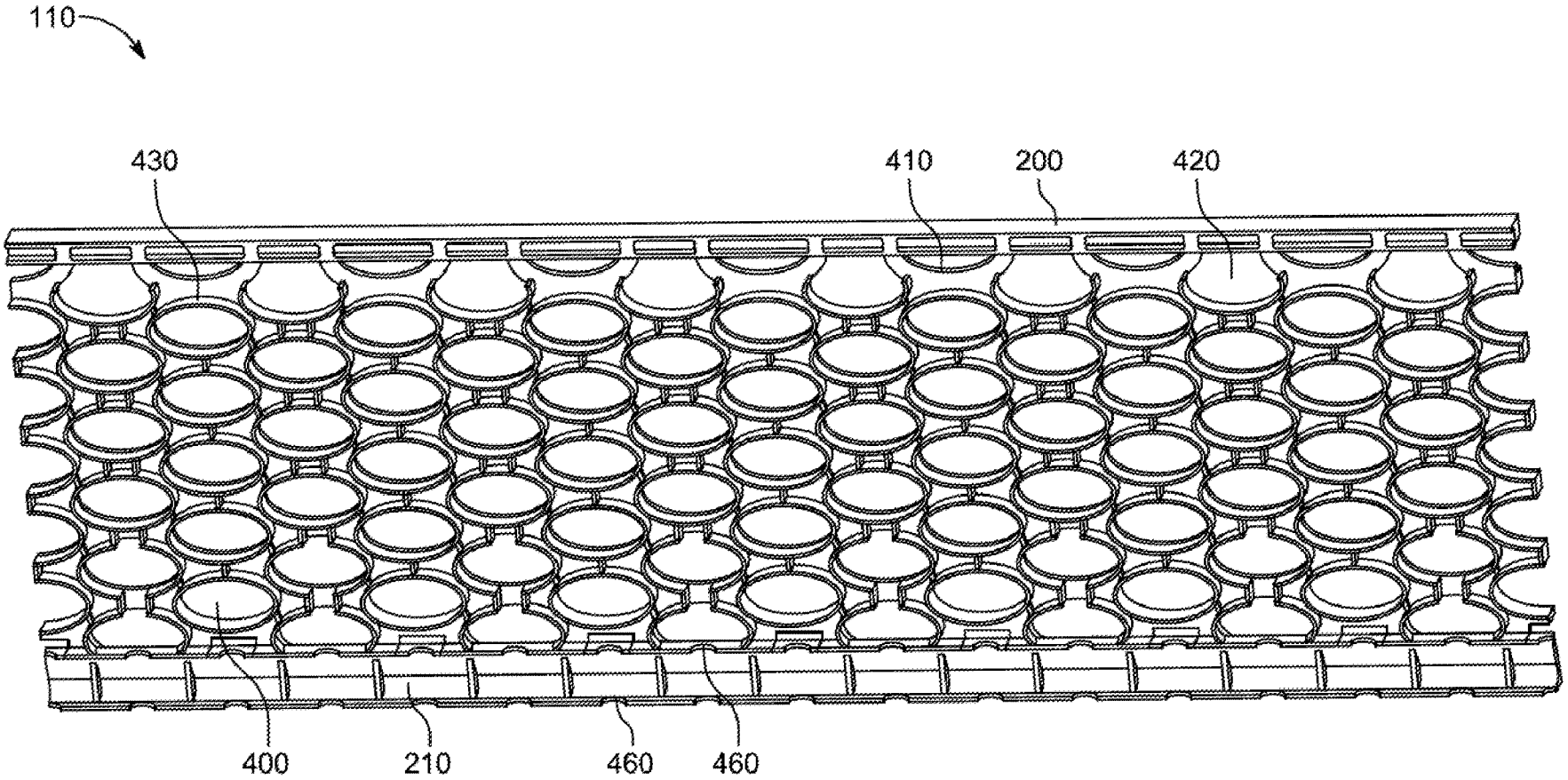
FIG. 20 schematically illustrates a bottom perspective view of the main body of the gutter guard system of FIG. 7.
Figure 21:
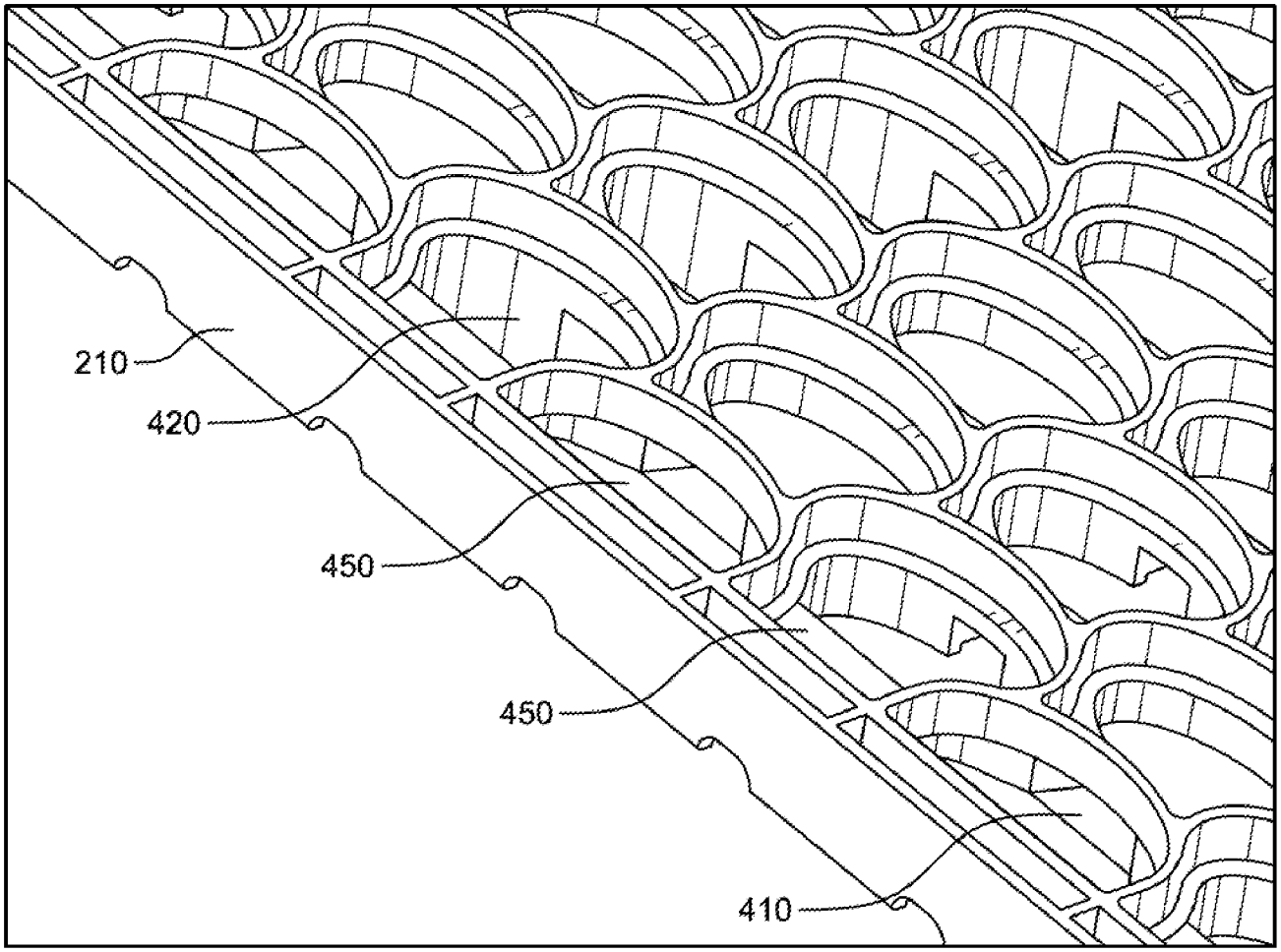
FIG. 21 schematically illustrates a detailed view of the main body of the gutter guard system of FIG. 7.
Figure 22:
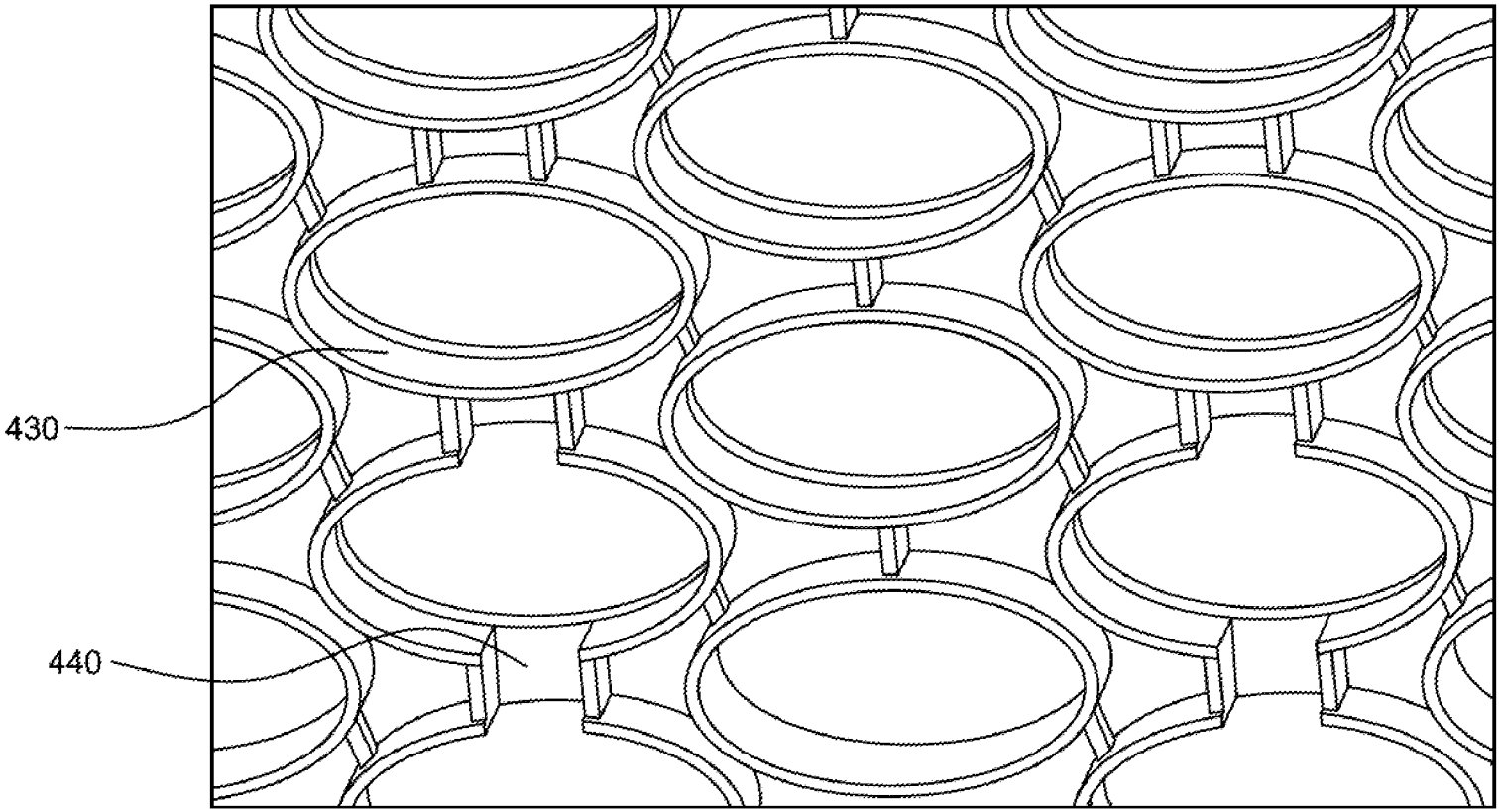
FIG. 22 schematically illustrates another detailed view of the main body of the gutter system of FIG. 7.

The embodiment of a main body 110 illustrated in FIGS. 7-11 is further discussed in detail with reference to FIGS. 18-22. FIG. 18 is a top view of the main body 110, FIG. 19 is a perspective view of the top of the main body 110, FIG. 20 is a perspective view of the bottom of the main body 110, FIG. 21 is a detailed view of the main body 110; and FIG. 22 is a detained view of the underside of the main body 110. The main body 110 includes a series of features that manage the flow of water ("water management features") as it moves across the gutter guard system. For example, the main body 110 can include a plurality of apertures of different shapes and sizes, where each aperture forms a passage through the top surface and bottom surface of the main body 110. In the example of the main body 110 illustrated in FIGS. 18-22, the majority of the apertures are oval shaped apertures 400, with some apertures near the first edge 200 and second edge 210 of the main body 110 shaped as semi-oval apertures 410 and truncated key-hole shaped apertures 420.

With regard to the arrangement of the apertures (400, 410, and 420) within a main body 110, FIGS. 18-22 illustrates one exemplary arrangement. Oval shaped apertures 400 are arranged such that the long axis of the oval shaped aperture 400 is generally parallel with the first 200 and second 210 edge s. The oval shaped apertures 400 are arranged in generally staggered rows that are generally parallel to the first 200 and second 210 edge s. This is to say that a first row 470 of oval shaped apertures 400 includes a number of oval shaped apertures 400 that are in-line with each other and spaced apart from each other. A second row 480 or over shaped apertures 400 is positioned proximate to the first row 470, and the oval shaped apertures 400 of the second row 480 are positioned in part in the spaces between the oval shaped apertures 400 of the first row 470. In such an arrangement, the first row 470 and the second row 480 have the same structure; however, the rows 470, 480 are laterally off-set with respect to each other. In the arrangement illustrated in FIGS. 18-22, there are nine total rows of oval shaped apertures 400, each is laterally off-set as compared to the rows positioned most proximate to the row to form a series of staggered rows.

In the embodiment illustrated in FIGS. 18-22, the semi-oval apertures 410 and truncated key-hole shaped apertures 420 are arranged in single rows 490 that are generally parallel to the first 200 and second 210 edges and positioned proximate to either the first edge 200 or second edge 210. Within each row 490, the apertures alternate between semi-oval apertures 410 and truncated key-hole shaped apertures 420. In this arrangement each of the semi-oval apertures 410 and truncated key-hole shaped apertures 420 are engaged with either the first edge 200 or second edge 210. In the arrangement illustrated in FIGS. 18-22, there are two rows 490 of semi-oval apertures 410 and truncated key-hole shaped apertures 420, one positioned proximate to the first edge 200 and one positioned proximate to the rear edge 210. In an alternative embodiment, a row can be arranged of only semi-oval apertures 410 or only truncated key-hole shaped apertures 420. Such a row can be positioned proximate to either the first edge 200 or second edge 210.

As best illustrated in FIGS. 21 and 22, along the perimeter of the apertures 400, 410, 420 extended edges 430 extend perpendicularly away from the apertures 400, 410, 420 on both the top side and bottom side of the main body 110. As will be discussed herein, the extended edges 430 create contact points with the screen 140, which facilitates water management. As will be appreciated, the main body 110 creates a large number of contact points with the screen, while the plurality of apertures 400, 410, 420 create ample openings for rainwater to pass through from the top of the gutter guard system into the rain gutter.

Figure 4C:
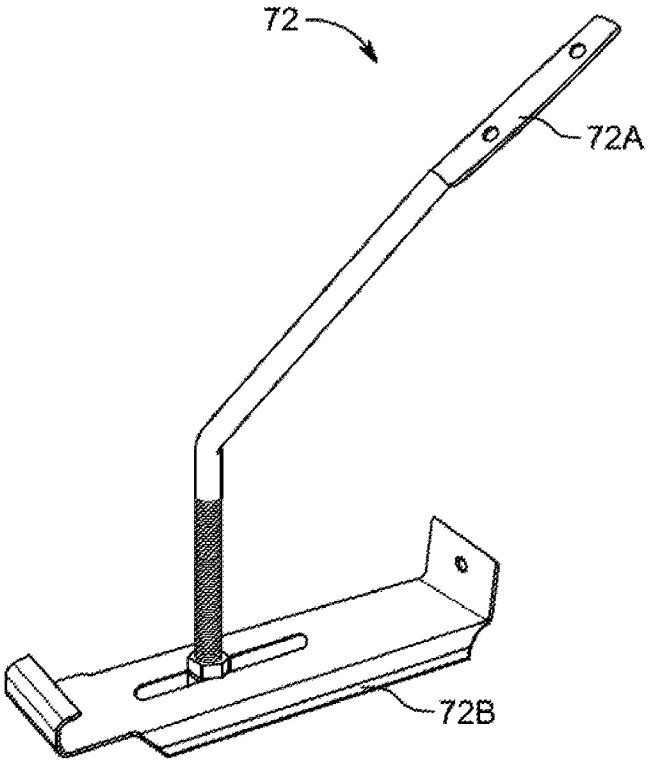
FIG. 4C schematically illustrates exemplary hardware and accessories used to attach half-round gutters to structures and/or rooflines.
Figure 4B:
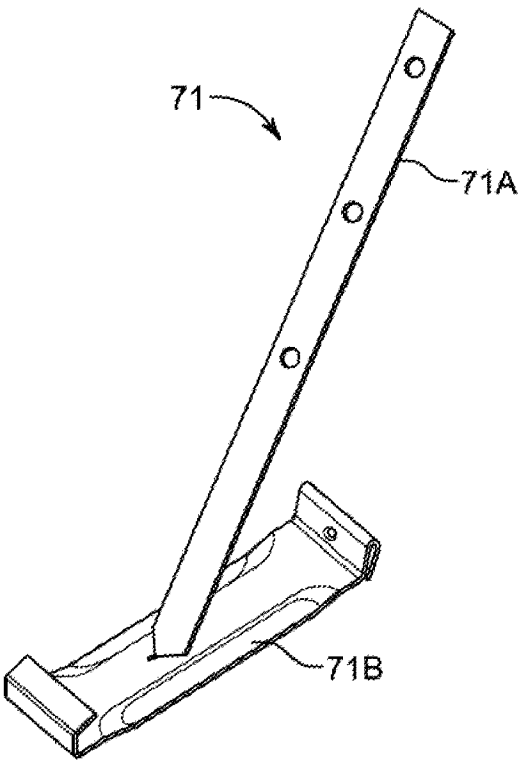
FIG. 4B schematically illustrates exemplary hardware and accessories used to attach half-round gutters to structures and/or rooflines.
Figure 4A:
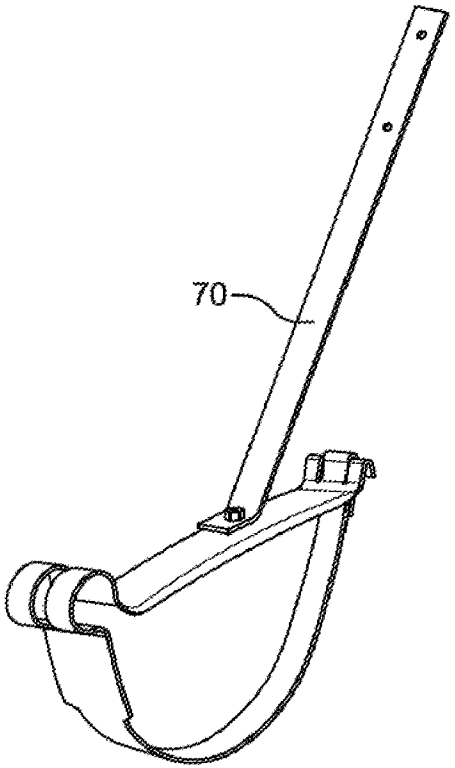
FIG. 4A schematically illustrates exemplary hardware and accessories used to attach half-round gutters to structures and/or rooflines.
Figure 4E:
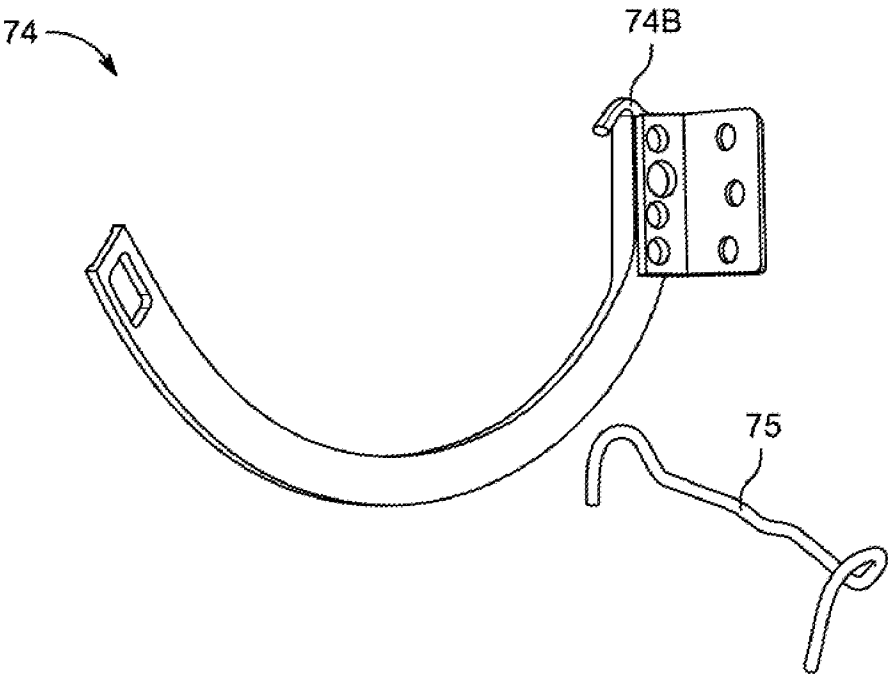
FIG. 4E schematically illustrates exemplary hardware and accessories used to attach half-round gutters to structures and/or rooflines.
Figure 4D:
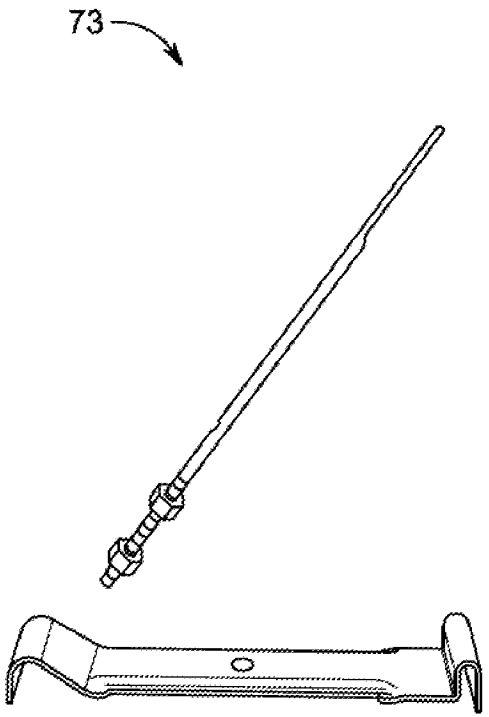
FIG. 4D schematically illustrates exemplary hardware and accessories used to attach half-round gutters to structures and/or rooflines.
Figure 4G:
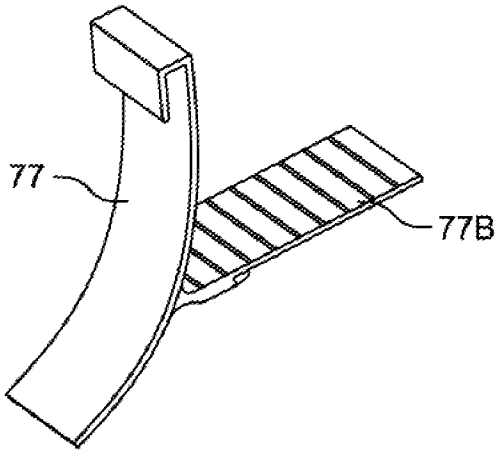
FIG. 4G schematically illustrates exemplary hardware and accessories used to attach half-round gutters to structures and/or rooflines.
Figure 4I:
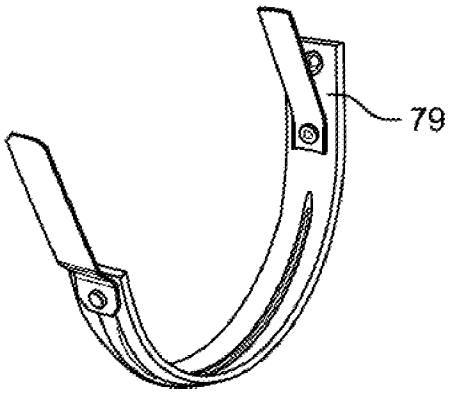
FIG. 4I schematically illustrates exemplary hardware and accessories used to attach half-round gutters to structures and/or rooflines.
Figure 4F:
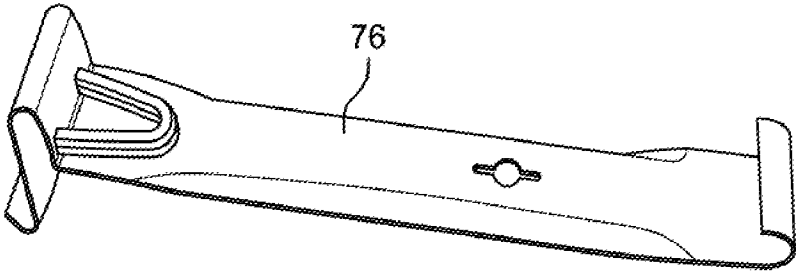
FIG. 4F schematically illustrates exemplary hardware and accessories used to attach half-round gutters to structures and/or rooflines.
Figure 4H:
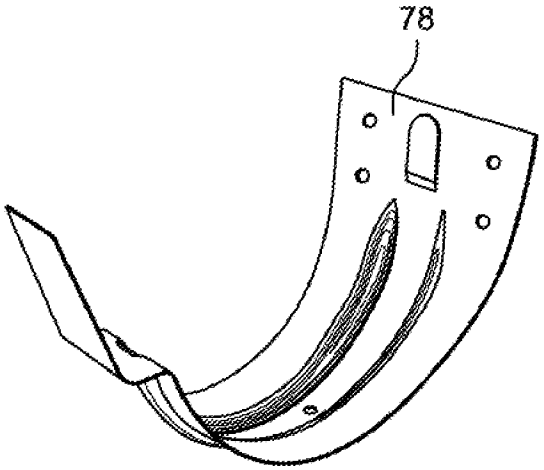
FIG. 4H schematically illustrates exemplary hardware and accessories used to attach half-round gutters to structures and/or rooflines.
Figure 4L:
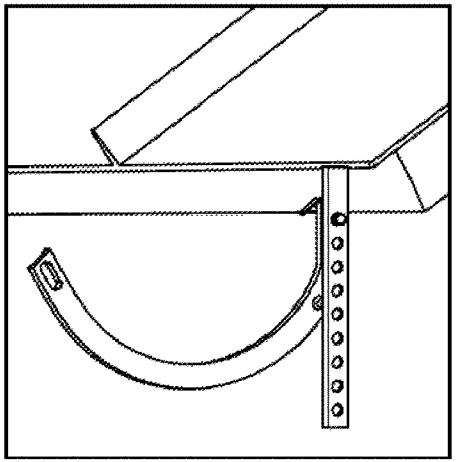
FIG. 4L illustrates an exemplary sickle and shank arrangement for securing a gutter to a roofline.
Figure 4O:
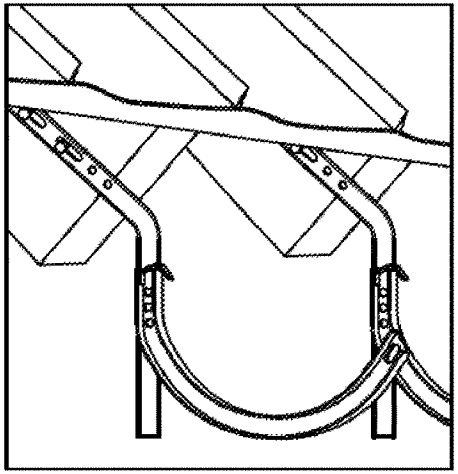
FIG. 4O illustrates an exemplary sickle and shank arrangement for securing a gutter to rater tails.
Figure 4K:
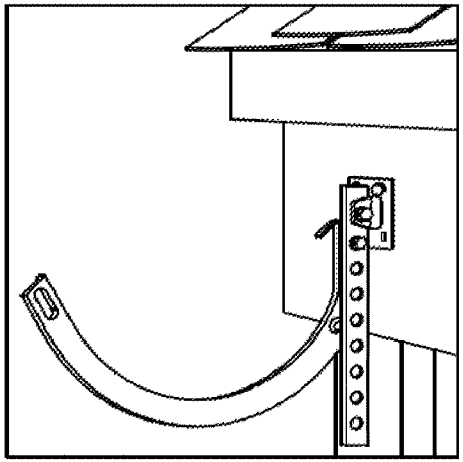
FIG. 4K illustrates an exemplary sickle and shank arrangement for securing a gutter to a fascia board.
Figure 4N:
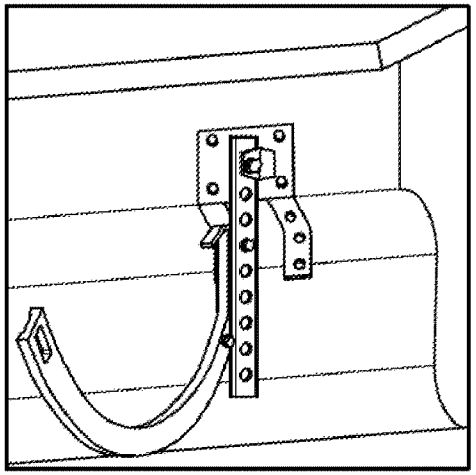
FIG. 4N illustrates an exemplary sickle and shank arrangement for securing a gutter to a crown molding board.
Figure 4J:
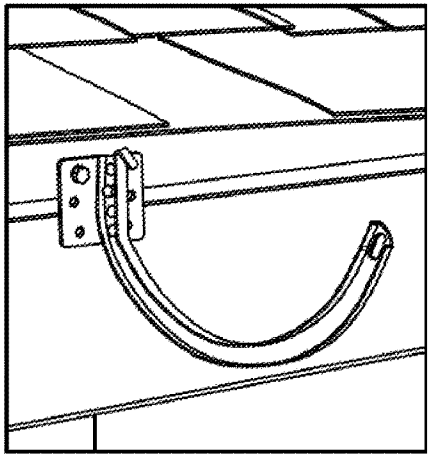
FIG. 4J illustrates an exemplary sickle and shank arrangement for securing a gutter to a fascia board.
Figure 4M:
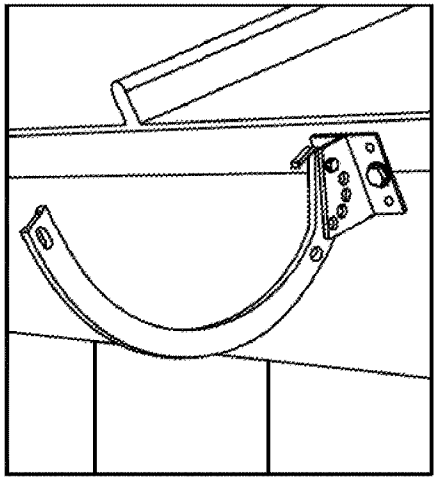
FIG. 4M illustrates an exemplary sickle and shank arrangement for securing a gutter to a roof.
Figure 5:
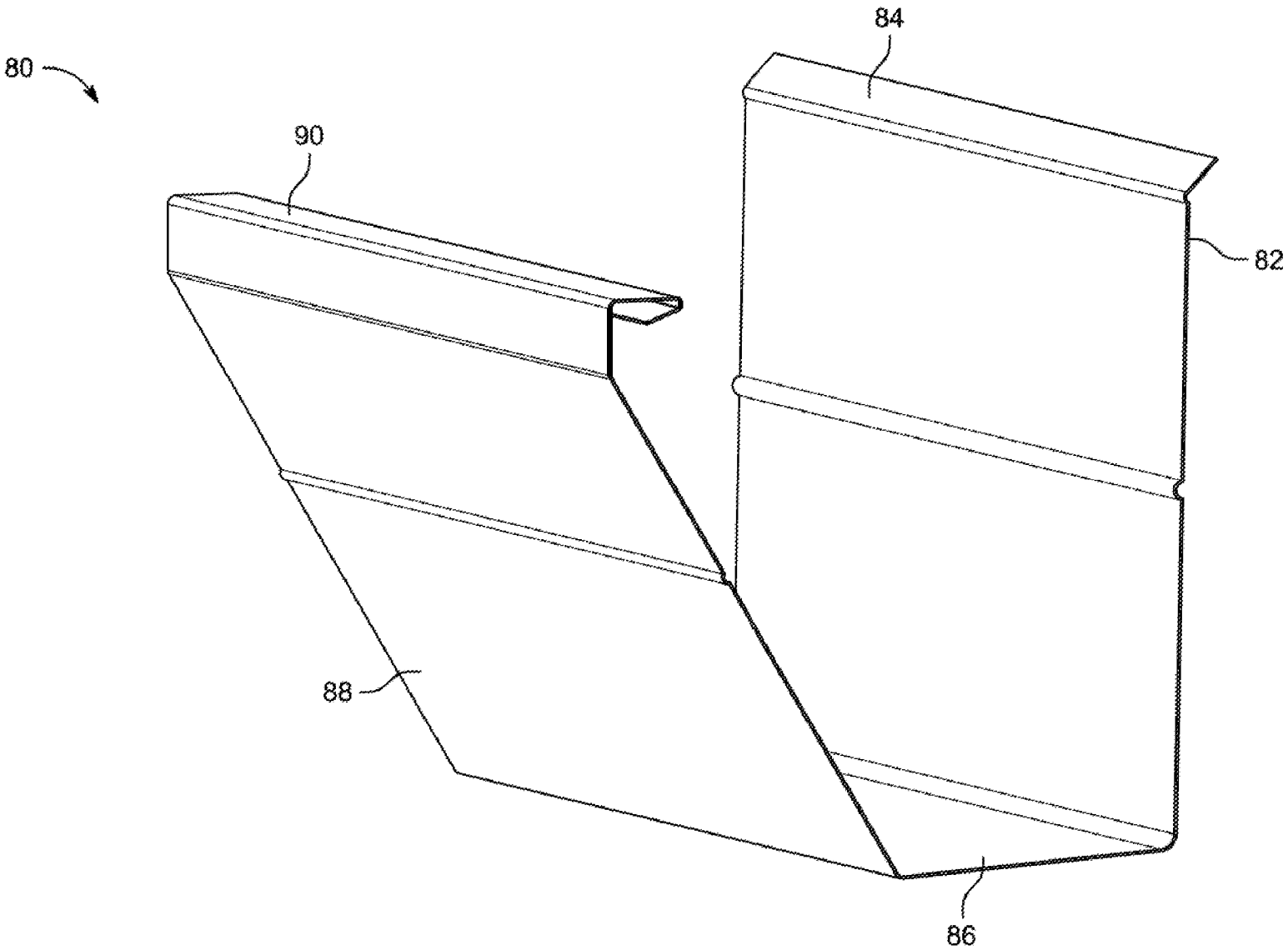
FIG. 5 schematically illustrates a perspective view of an exemplary winged-backed fascia-style gutter for use with gutter guard systems disclosed herein.
Figure 6:
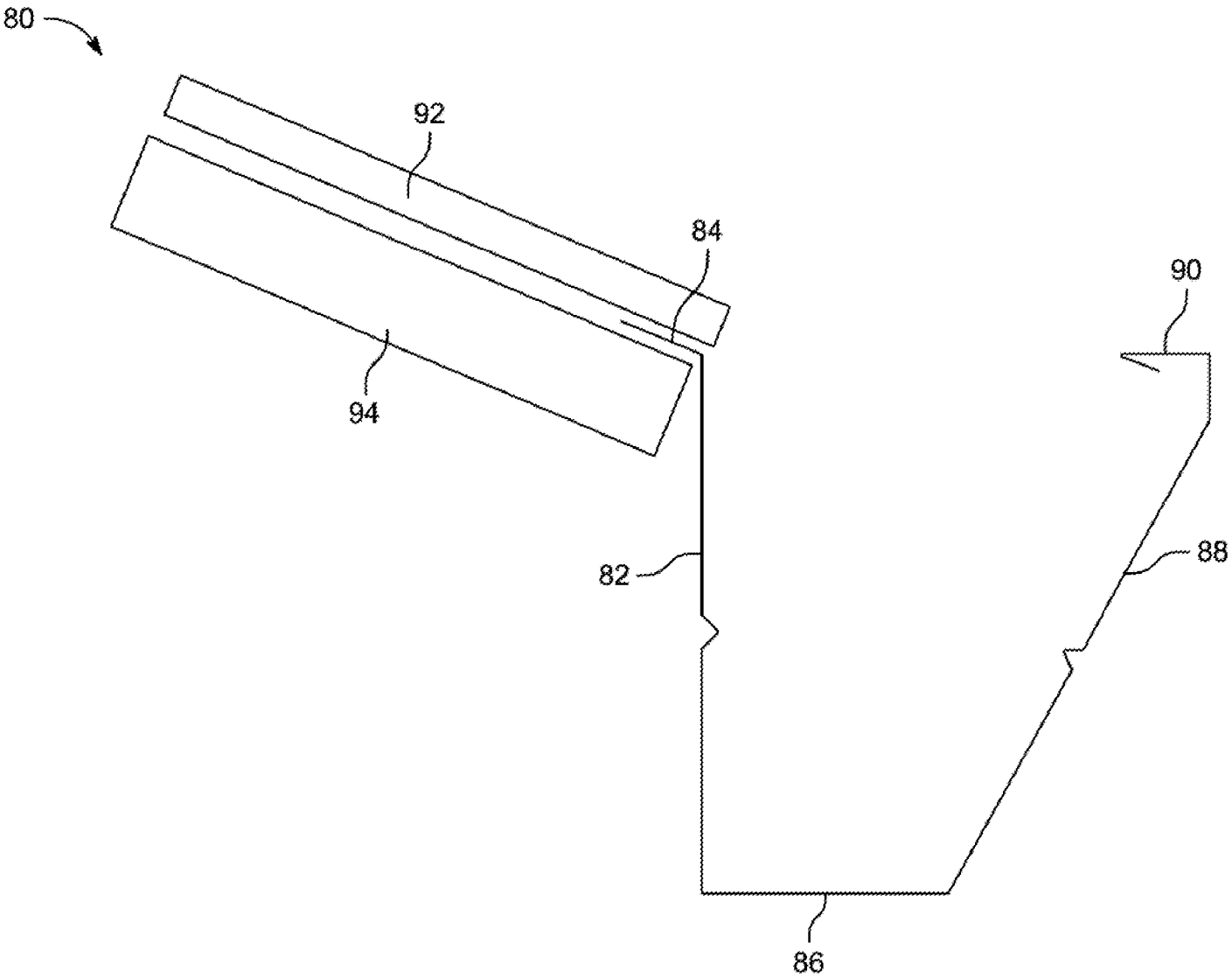
FIG. 6 schematically illustrates a two-dimensional side view of the fascia-style winged-back gutter of FIG. 5 installed on a structure.
Figure 7:
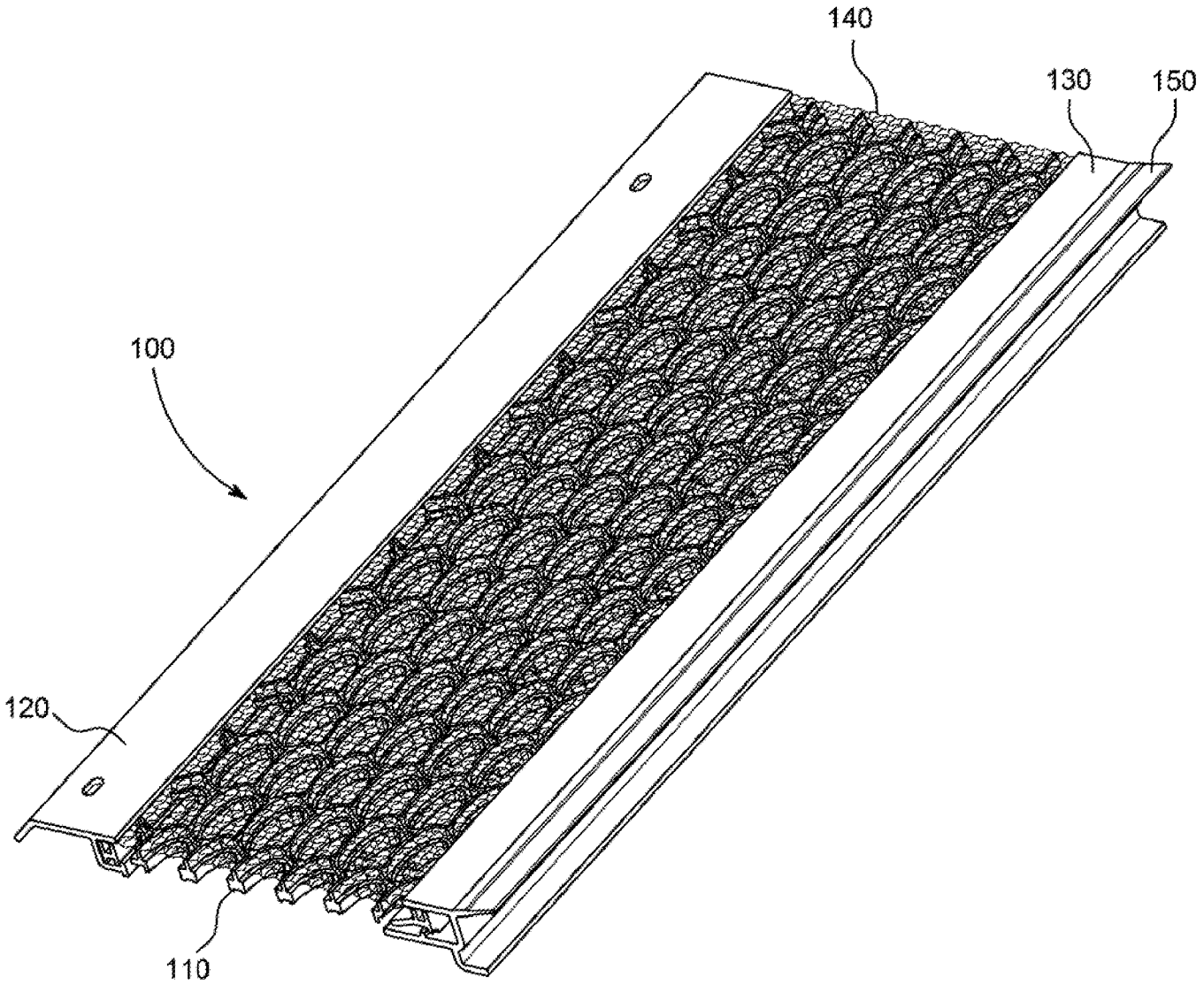
FIG. 7 schematically illustrates a perspective view of an exemplary gutter guard system disclosed herein.

The plurality of apertures 400, 410, 420 also creates openings for certain attachment mechanisms, such as straps and/or bars, that are used to secure rain gutters to a structure. In other words, the plurality of apertures 400, 410, 420 are sized such that a gutter guard system can be installed such that the attachment mechanisms can pass through apertures 400, 410, 420 in the main body 110 without affecting the manner in which the rain gutter is attached to the structure. In one example, half-round gutters typically include hardware and accessories to secure the gutter to the structure and/or roofline (see FIG. 4A-4O). In many of these attachment mechanisms, a portion of the attachment mechanism is positioned within the half-round gutter and a portion extending upward such as to attached to the structure and/or roofline. It will be appreciated that the portions extending upward from the half-round gutters can pass through apertures in the main body and attach the gutter to the structure and/or roofline without affecting the manner in which the gutter guard system is installed within the rain gutter or affecting the manner in which the rain water is managed by the gutter guard system.

It will be appreciated that the positioning, shape, and arrangement of the apertures form a relatively rigid structure for the main body 110. Such rigid structure lessens the need for elements to support the gutter guard system once installed in a rain gutter. In certain embodiments, the main body 110 has sufficient rigidity for the gutter guard system 100 to be installed in a rain gutter without the need for any additional support structures such as hangers or similar hardware.

The extended edges 430 serve as wicking structures on both the top surface and bottom surface of the main body 110. When the screen 140 is positioned on the top surface of the main body 110, the extended edges 430 make contact with the screen 140. When the gutter guard system 100 is positioned on a rain gutter, rainwater runs across the screen 140. As rainwater encounters the areas of contact between the screen 140 and extended edge 430, surface tension causes the rainwater to engage the extended edges 430 and wick downward toward the rain gutter. As will be appreciated, the arrangement of the extended edges 430 and screen 140 form a substantial number of contact points and a substantial total contact area between the extended edges 430 and screen 140 at which rainwater running across the screen 140 can wick downward toward the rain gutter. Once rainwater wicks downward into the main body 110, passing though the apertures to the bottom side of the main body 110, the extended edges 430 on the bottom side of the main body 110 engage the rainwater and further wick downward and into the rain gutter, thus, eliminating or reducing the tendency of water to flow forward or sideways along the underside of the main body 110 (known as "water walk"). Although the lengths of the extended edges 430 are illustrated as consistent across the main body 110, in certain embodiments the length of the extended edges 430 extending down from the bottom surface of the main body 110 can vary from aperture to aperture. Such an arrangement can further eliminate or reduce water walk. To further manage the rainwater within the main body 110, a series of openings 440 in the extended edges 430 allow water that is outside of the apertures a path to wick down through the apertures and into the rain gutter (see FIG. 22 for detailed view of the underside of the main body 110), thus further eliminating or reducing water walk.

As illustrated in FIGS. 18 and 19, a shelf 450 runs along the second edge 210 of the main body 110. The arrangement of the shelf 450 and the apertures 410, 420 positioned proximate to the second edge 210 of the main body 110 can provide paths for rainwater that gathers in the channel of a rear receiver to flow into the rain gutter. As illustrated in FIG. 9, the rear edge of the main body 110 is located within the rear receiver 130. As illustrated in FIG. 21, portions 450 of the shelf located in both semi-oval apertures 410 and truncated key-hole shaped apertures 420 include inclined surfaces such that rainwater that gathers in the channel of the rear receiver 130 can flow down the inclined surface, through openings in the apertures 410, 420, and into the rain gutter. Furthermore, as illustrated in FIG. 20, the second edge 210 of the main body 110 includes a series of notches 460. In one embodiment, the series of notches 460 includes a pair of notches 460 positioned in line with each for the semi-oval apertures 410 and truncated key-hole shaped apertures 420. Such notches 460 further provide a path for rainwater to flow from the channel of the rear receiver 130 into the rain gutter.

As will be understood upon reading and understanding this disclosure, the gutter guard system, particularly the main body 110, includes a number of features and combinations of features to manage water flowing across the gutter guard system that result in water flowing downward into the rain gutter. In addition to the large open areas provided by both the screen 140 and apertures in the main body 110, the main body includes extended edges 430 extending upward that contact the screen to encourage wicking of water downward into the rain gutter, extended edges 430 that extend downward from the main body 110 to create additional wicking and eliminate or reduce water walk, and the arrangement of apertures 400, 410, 420 into staggered columns (as illustrated in FIGS. 18 through 20) additionally providing paths for even heavy water flow to flow downward into the rain gutter. The arrangement of such staggered columns interrupts and inhibits the sideways flow of water across the main body and encourages the water to wick downward into the rain gutter.

Figure 23:
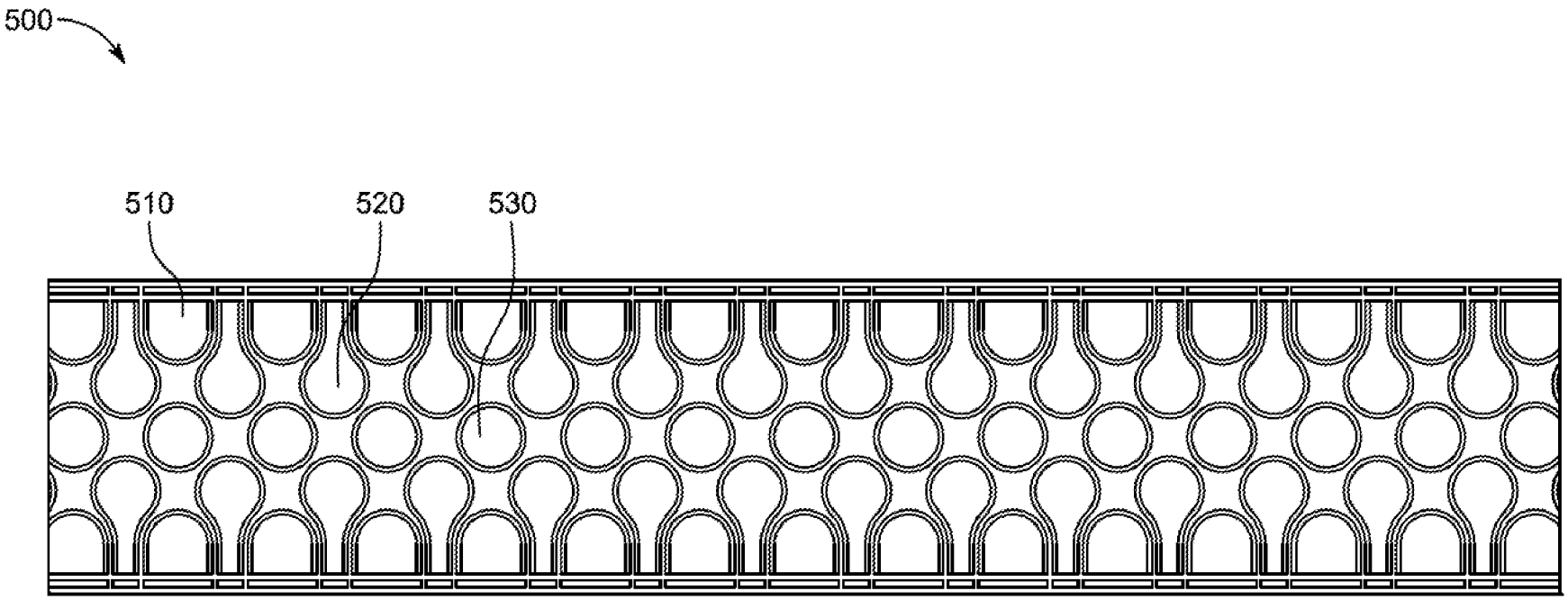
FIG. 23 schematically illustrates a top view of another embodiment of a main body for use in a gutter guard system.
Figure 24:
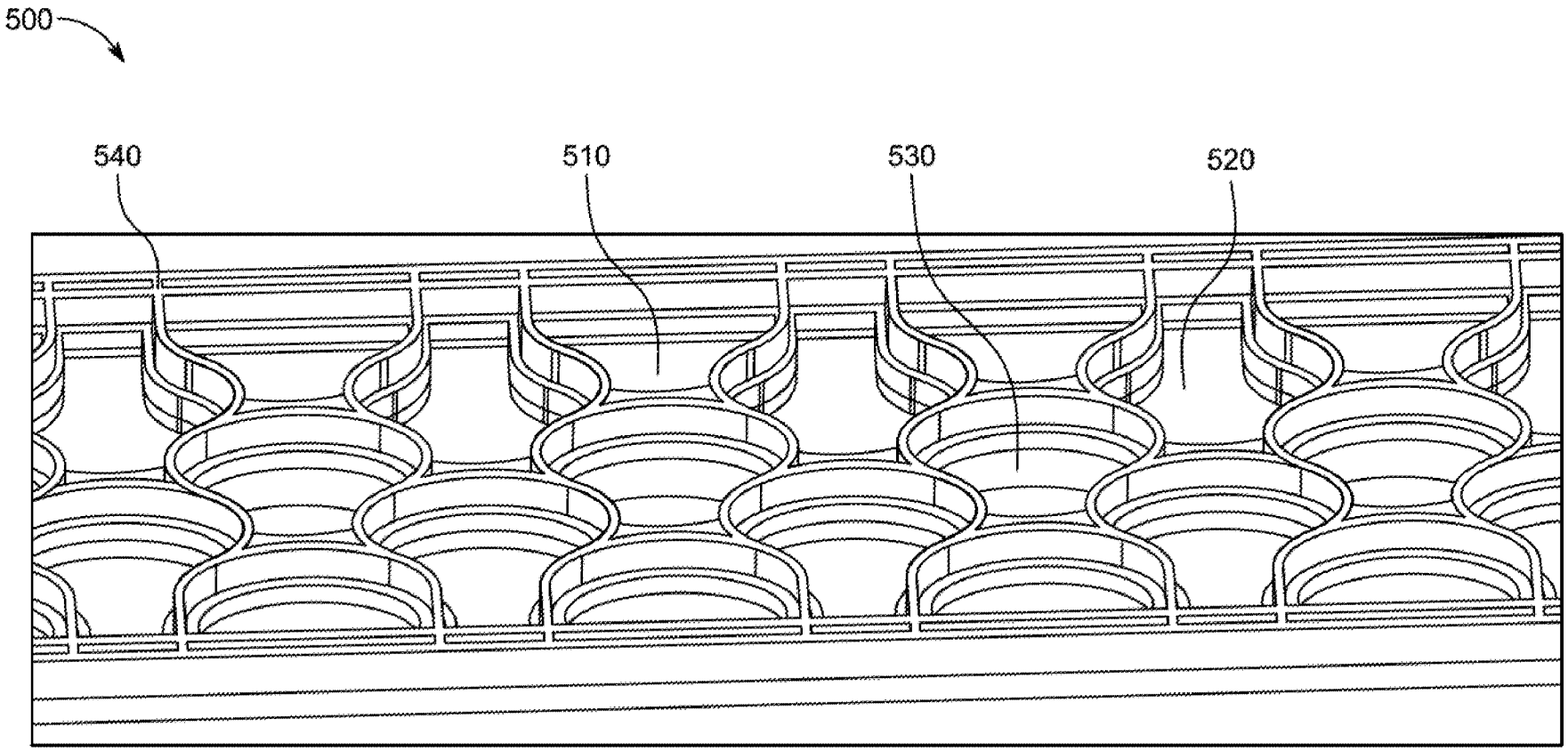
FIG. 24 schematically illustrates a detailed view of the main body of FIG. 23.

FIGS. 23 and 24 illustrate another embodiment of a main body 500 that includes a series of features that manage the flow of rainwater as it moves across a gutter guard system. In this embodiment, the main body 500 includes a plurality of different shaped apertures. The exemplary main body 500 includes u-shaped apertures 510, key-hole shaped apertures 520, and circular apertures 530.

With regard to the arrangement of the apertures (510, 520, and 530) within a main body 500, FIGS. 23 and 24 illustrates one exemplary arrangement. Circular shaped apertures 530 are arranged is a row 540 that is generally parallel with a first edge 550 and a second edge 560. In alterative embodiments, circular apertures 530 can be arranged in multiple rows and can be positioned as staggered rows as described herein.

In the embodiment illustrated in FIGS. 23 and 24, the u-shaped apertures 510 and key-hole shaped apertures 520 are arranged in single rows 570 that are generally parallel to the first 550 and second 560 edges and positioned proximate to either the first edge 550 or second edge 550. Within each row 570, the apertures alternate between u-shaped apertures 510 and key-hole shaped apertures 520. In this arrangement each of the u-shaped apertures 510 and key-hole shaped apertures 520 are engaged with either the first edge 550 or second edge 560. In the arrangement illustrated in FIGS. 23 and 24, there are two rows 570 of u-shaped apertures 510 and key-hole shaped apertures 520, one positioned proximate to the first edge 550 and one positioned proximate to the rear edge 560. In an alternative embodiment, a row can be arranged of only u-shaped apertures 510 or only key-hole shaped apertures 520. Such a row can be positioned proximate to either the first edge 550 or second edge 560.

As best illustrated in FIG. 24, along the perimeter of the apertures are extended edges 580 that extend perpendicularly away from the apertures on both the top side and bottom side of the main body 500. As with the main body 110 described above, the extended edges 580 of the main body 500 contact the screen and create a large number of contact points and a large contact area for rainwater to wick downward through the screen, where the plurality of apertures 510, 520, 530 create ample openings for rainwater to pass through into the rain gutter.

While apertures as discussed and illustrated herein are described as oval, semi-oval, circular, truncated key-hole shaped and the like, it will be understood that this disclosure encompasses and includes arrangements of apertures in the main body that include a variety of specific shapes, a variety of specific locations, and a variety of mixture of different shaped apertures. It will be appreciated that embodiments of the main bodies and screens as disclosed herein include openings that facilitate and do not inhibit the flow of water through the screens and main bodies into the rain gutter. The proportions and relationship between the open areas of the main body and screen promotes a maximum and optimal infusion of water into the rain gutter. Additionally, the prevalence of wicking features further facilitates the flow of water from the screen and main body into the rain gutter. Additionally, openings in the main bodies and screens promote and maximize airflow through the screen, main body and rain gutter. Thus, providing the gutter guard system with a number of benefits. For example, such airflow provides for the rain gutter, gutter guard system, and any debris resting on the screen to dry quickly and efficiently. The drying of the gutter guard system and rain gutters can extend the longevity and durability of the gutter guard system and rain gutter. When debris resting on the gutter guard system dries quickly and efficiently, biological growth such as moss and mold are reduced or prevented. Also such efficient drying discourages attachment of debris to the screen or main body. The drying of debris makes it much more likely that such debris is carried away by winds or the next flow of water across the screen further reducing the ill effects of debris resting on the screen.

FIGS. 25 through 48 illustrate another exemplary embodiment of a gutter guard system 600 that includes a main body 610, a front receiver 620, a rear receiver 630, and a screen 640. As will be further detailed herein, the gutter guard system 600 can be assembled from its components and once assembled, can generally be disassembled and the components reused. Additionally, the components illustrated, such as the front receiver 620 and rear receiver 630 and the main body 610, can be replaced with similar but different components to accommodate a variety of styles, sizes, and color of rain gutters as well as accommodating different structures and rooflines. For example, the main body 610 illustrated in the figures is a four inch main body designed for use in a five inch gutter. However, the gutter guard system 600 as illustrated could also be assembled using a three inch or five inch main body with the front 620 and rear 630 receivers as shown to accommodate four and six inch gutters. Additionally, different front and rear receivers can be used with the four inch main body 610 illustrated herein to accommodate different styles of gutters and different rooflines. Generally, the gutter guard systems disclosed herein can be mixed and matched to utilize different main bodies and different front and rear receivers to accommodate different sizes and styles of gutters systems and different rooflines.

Figure 25:
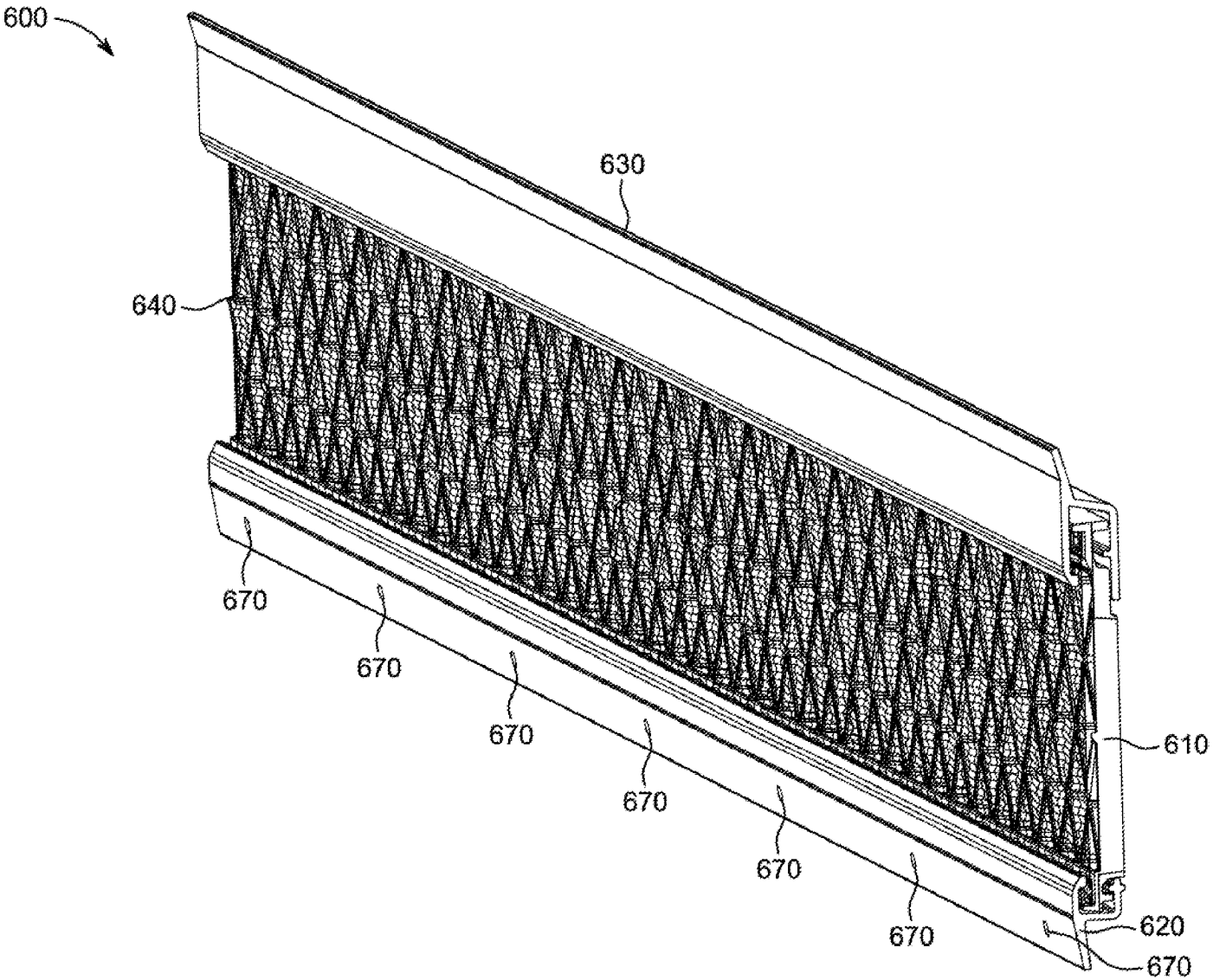
FIG. 25 schematically illustrates a perspective view of an exemplary gutter guard system disclosed herein.
Figure 26:
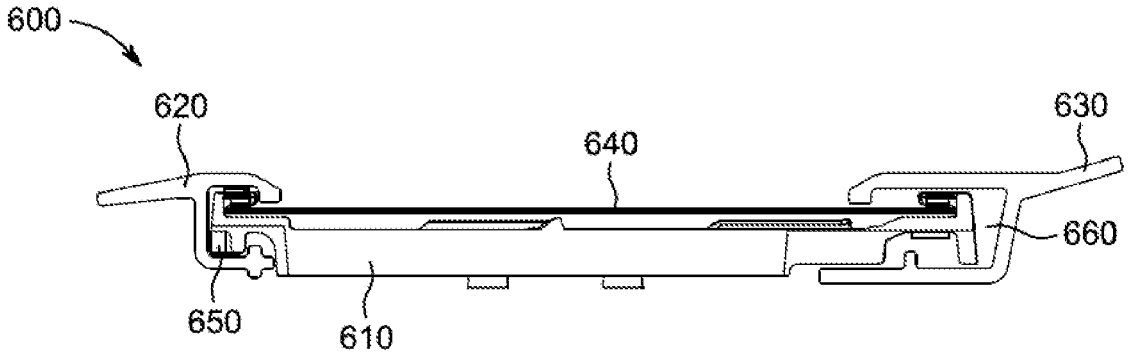
FIG. 26 schematically illustrates a side view of a gutter guard system of FIG. 25.
Figure 27:
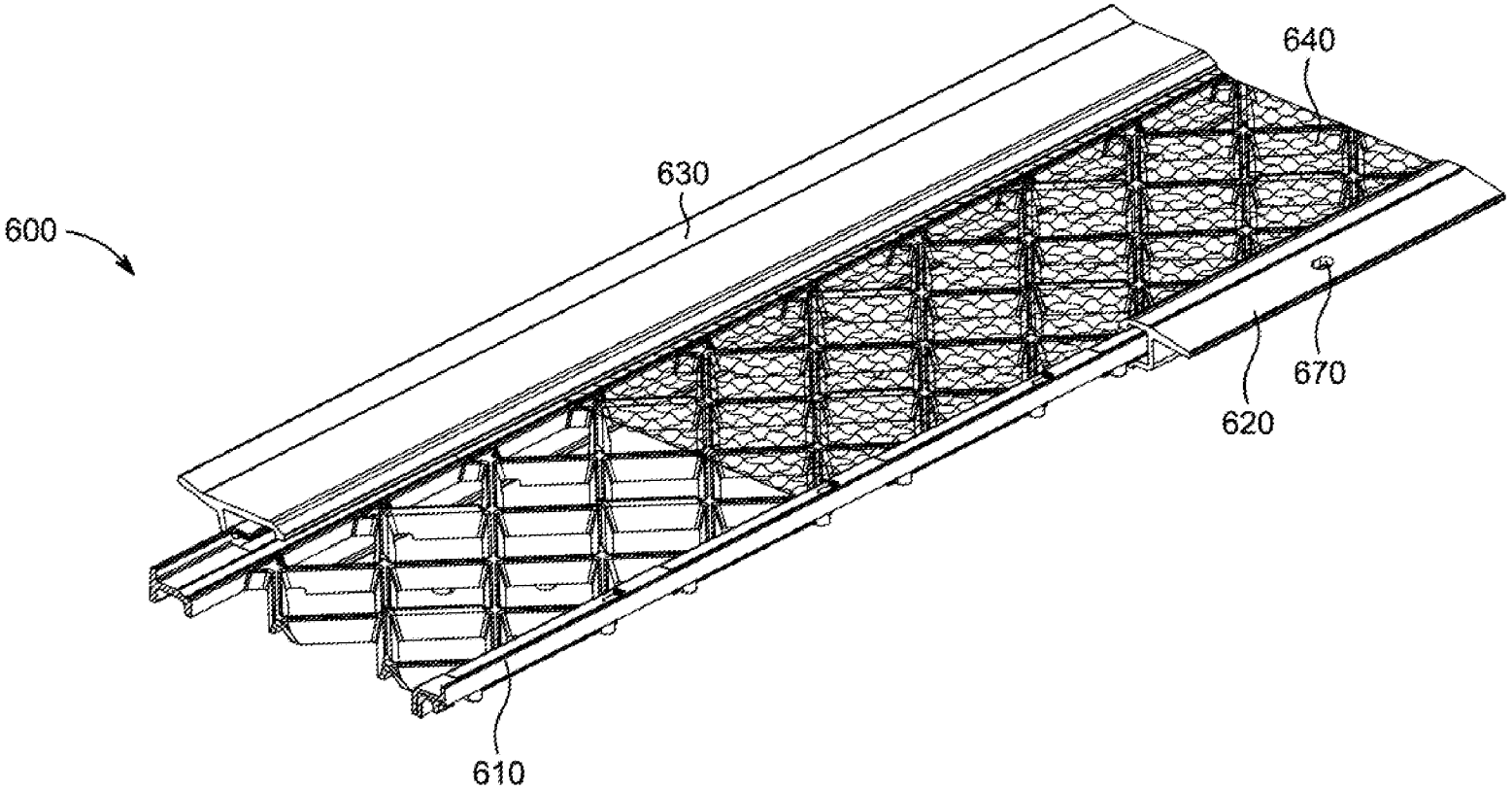
FIG. 27 schematically illustrates a perspective view of the gutter guard system of FIG. 25 with portions removed.

The gutter guard system 600 can be assembled such that the screen 640 is placed in contact with a top surface of the main body 610, a front receiver 620 is attached to a first or front edge the main body 610, and the rear receiver 630 is attached to a second and opposite edge or rear edge of the main body 610. FIG. 25 illustrates a perspective view of an assembled gutter guard system 600; FIG. 26 is a side view of the assembled gutter guard system 600; and FIG. 27 illustrates another perspective view of the assembled gutter guard system 600 with portions of the front receiver 620, rear receiver 630, and screen 640 removed to illustrate further detail of the gutter guard system 600.

The front 620 and rear 630 receivers each include a channel (as illustrated in FIG. 26), such that the front edge of the main body 610 is slid into channel 650 of the front receiver 620, and the rear edge of the main body 610 is slid into channel 660 of the rear receiver 630 to, in part, secure the screen 640 to the main body 610 together with the front 620 and rear 630 receivers. As will be further described, certain features of the main body 610, such as tuck tabs, may be used to further secure the screen 640 within the gutter guard system 600. The main body 610 and front 620 and rear 630 receivers can be arranged such that the rear receiver 630 can only be assembled with a rear portion of the main body 610 and the front receiver 620 can only be assembled with a front portion of the main body 610. Thus, the arrangement minimizes or eliminates inadvertent errors during assembly of the gutter guard system.

Once assembled, the gutter guard system 600 can be placed onto or into a rain gutter to channel water into the rain gutter and stop debris from entering the rain gutter. As illustrated in FIGS. 25 and 27, one or more apertures 670 can be provided in the front receiver 620 that can be used to secure the front receiver 620 to the rain gutter using a fastener such as a screw or rivet.

In one embodiment, the screen is a 30 mesh metal screen. In one example, the screen can be made of 316L stainless steel wire, more specifically, 316L stainless steel wire that is 0.0085 inches in diameter. The screen can be arranged in a square weave such that there are 30 wires for each linear inch of screen in both the width and length directions. In such an arrangement, the surface area of the screen includes approximately 55% open area. It will be understood with such a large percentage of open area, the screen can facilitate water flowing through the screen toward the water management section and into the rain gutter even when debris such as leaves temporarily come to rest on top of the screen. The 0.0085 inch diameter 316L stainless steel wire arranged as such provides a number of benefits, including resistance to corrosion and rust when exposed to the elements, generally prevents common debris from passing through the screen, enhances self-cleaning of the screen due to debris passing over the screen, and promotes water infusion through the screen as water travels across the screen. Furthermore, in one embodiment, such an arrangement maintains a generally flat surface when exposed to the elements so that the screen maintains its functionality and aesthetic appeal over time. In other embodiments, as will be described herein, the screen includes features and contours that rise above the general plane of the screen to promote rainwater infusion through the screen and to prevent or limit the matting of debris on the top of the screen.

As noted above, the main body 610 can be manufactured in different widths to accommodate different widths of rain gutter such as, for example, three inch, four inch, and five inch widths for residential use. As previously discussed, such an arrangement provides for structural integrity of the gutter guard system because the components are typically used as designed. There is no need to cut or plane a larger main body to accommodate a rain gutter with a smaller width. Additionally, the lattice or diamond pattern (hereinafter the "diamond pattern") of the structural members of the main body 610 provides sufficient stiffness and strength such that the main body 610 and the gutter guard system 600 remain generally planar when installed on a rain gutter without the requirement for any ancillary support structures such as hangers and straps. The main body 610 provides the required rigidity despite the main body 610 having a greater percentage of open area than traditional gutter guard assemblies currently on the market. Thus, the combination of the main body 610 and the screen 640 result in greater percentage of open area to facilitate water infusion through the screen 640 and main body 610, while providing the rigidity and structural integrity required to efficiently install the gutter guard system 600 without the need for hangers, straps, and the like.

For structures, such as large homes or commercial buildings, with large roof surface areas, larger rain gutters can be utilized to accommodate the greater flow of rain water from the roof and into the rain gutter. For such larger rain gutters, including rain gutters that are six, seven, eight inches in width or more, the main body can be arranged generally as illustrated in the figures, but the width and thickness of the main body can be increased to accommodate substantially wider rain gutters and provide additional rigidity and structural integrity for the gutter guard system to span such substantially wider rain gutters. Such increased in width and thicknesses can be achieved by modifications to injection molding tooling, but such modifications can maintain the thickness of the edges of the main body such that the front and rear receivers as described herein can continue to be used to accommodate the assembly of gutter guard systems for substantially wider rain gutters. Additionally, a rear receiver can be widened or multiple rear receivers can be used with main bodies disclosed herein to span gutter openings greater than six inches in width.

Figure 28:
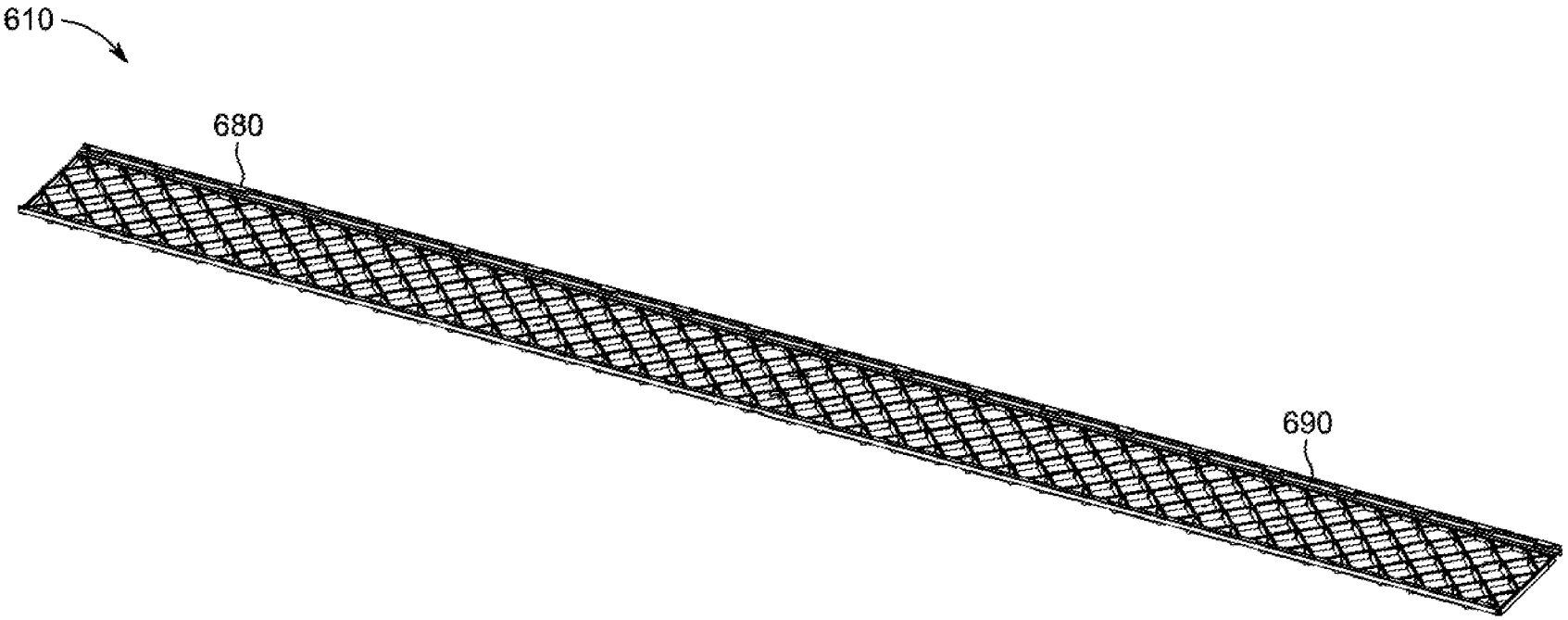
FIG. 28 schematically illustrates a perspective view of a main body for use with the gutter guard system of FIG. 25.
Figure 29:
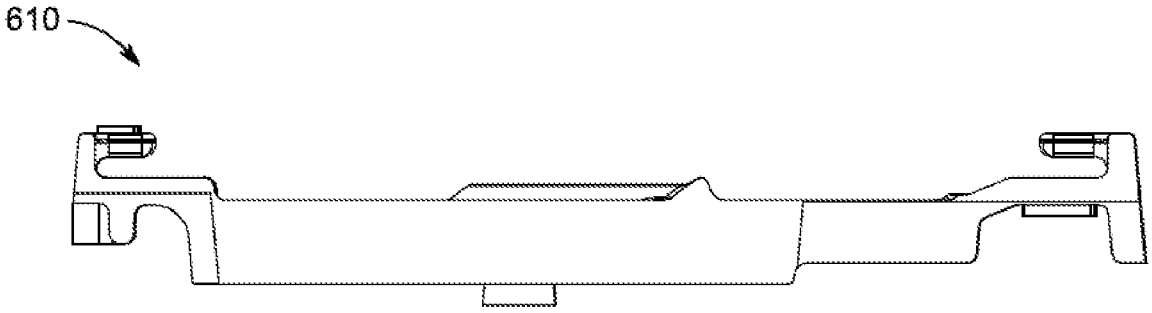
FIG. 29 schematically illustrates a side view of a main body for use with the gutter guard system of FIG. 25.
Figure 30:
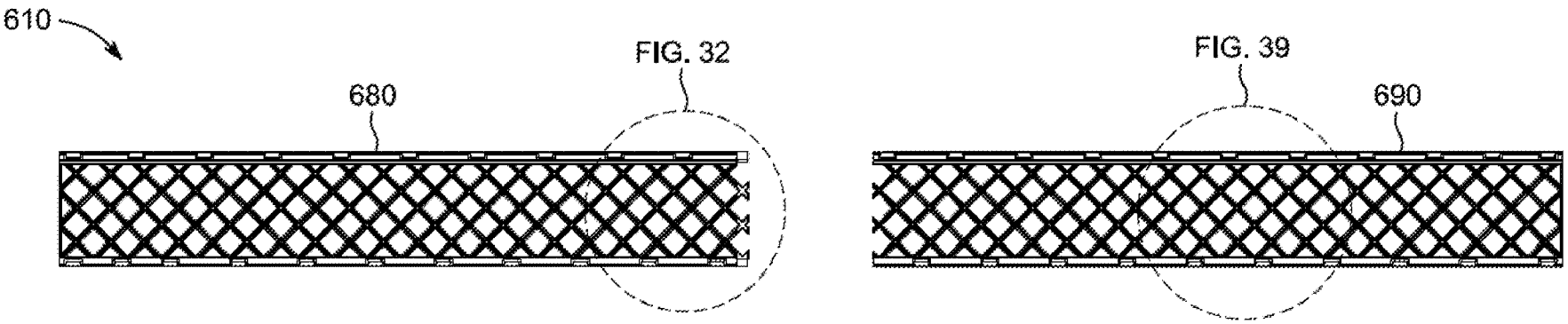
FIG. 30 schematically illustrates a top exploded view of a main body for use with the gutter guard system of FIG. 25.
Figure 31:
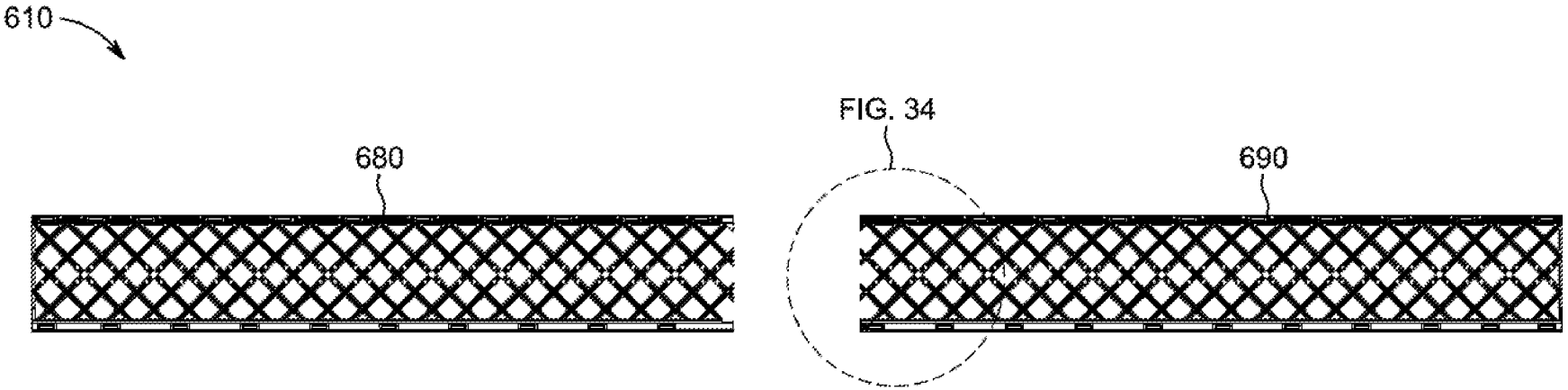
FIG. 31 schematically illustrates a bottom exploded view of a main body for use with the gutter guard system of FIG. 25.
Figure 32:
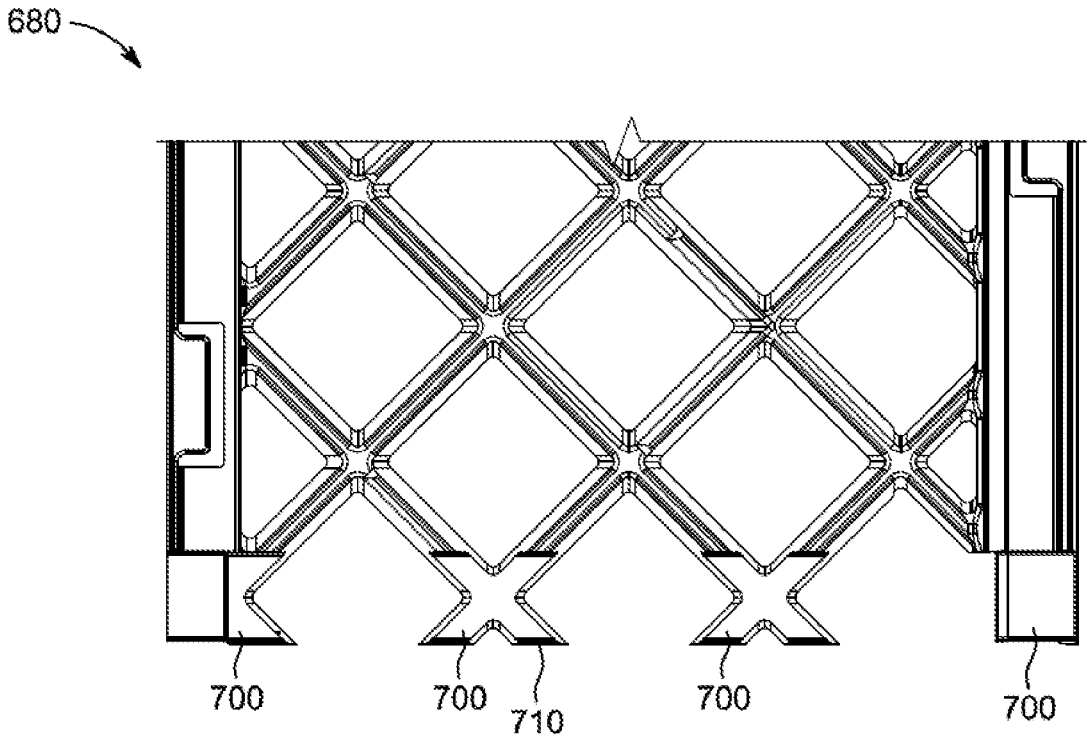
FIG. 32 is a detailed view of a main body for use with the gutter guard system of FIG. 25.
Figure 33:
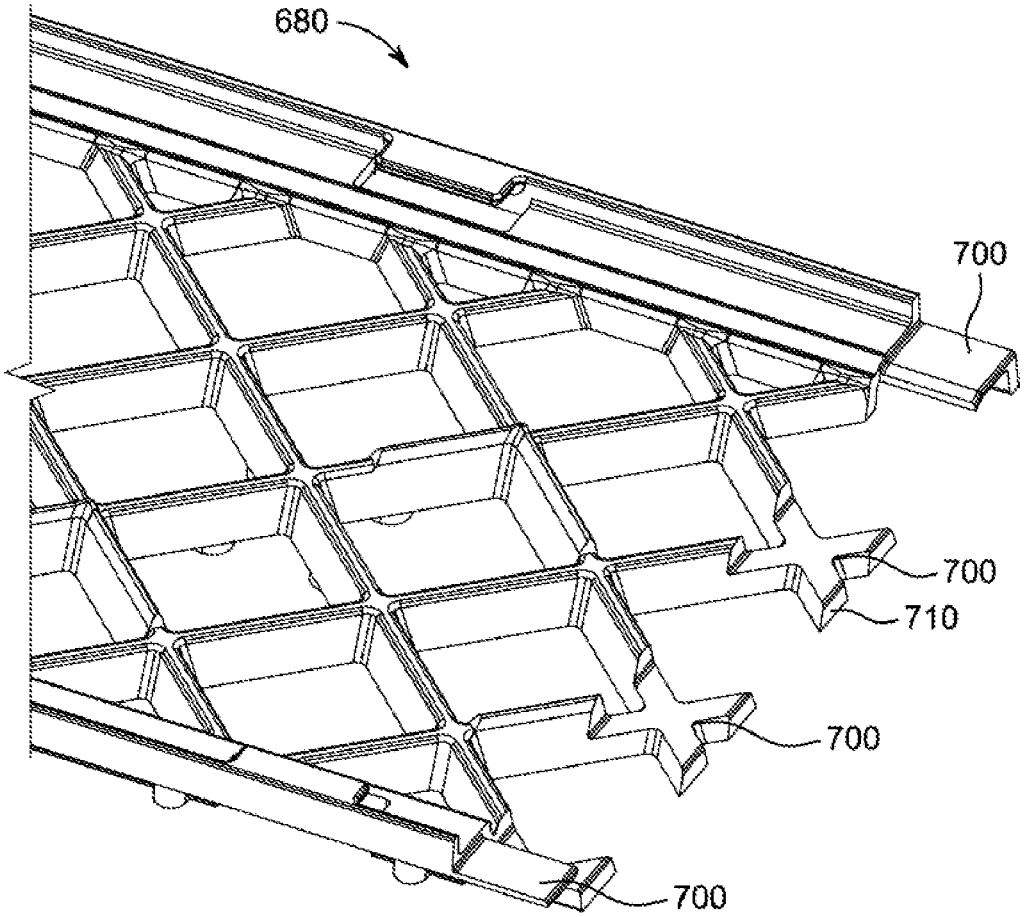
FIG. 33 is another detailed view of a main body for use with the gutter guard system of FIG. 25.
Figure 34:
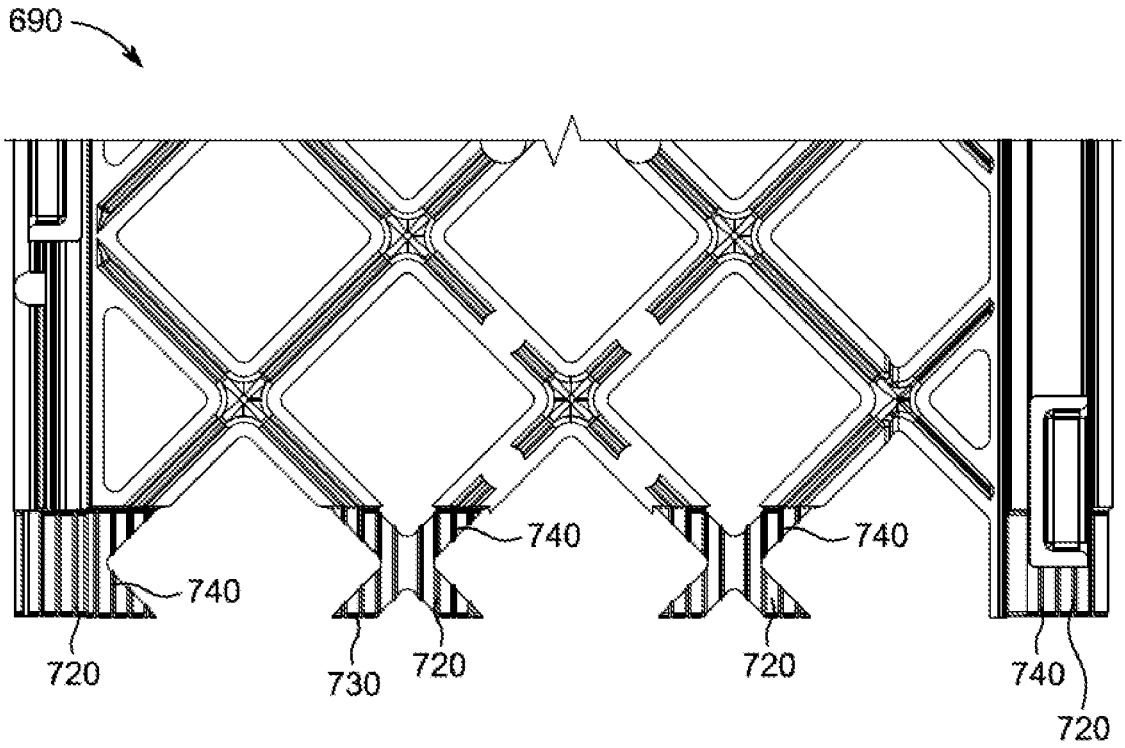
FIG. 34 is another detailed view of a main body for use with the gutter guard system of FIG. 25.
Figure 35:
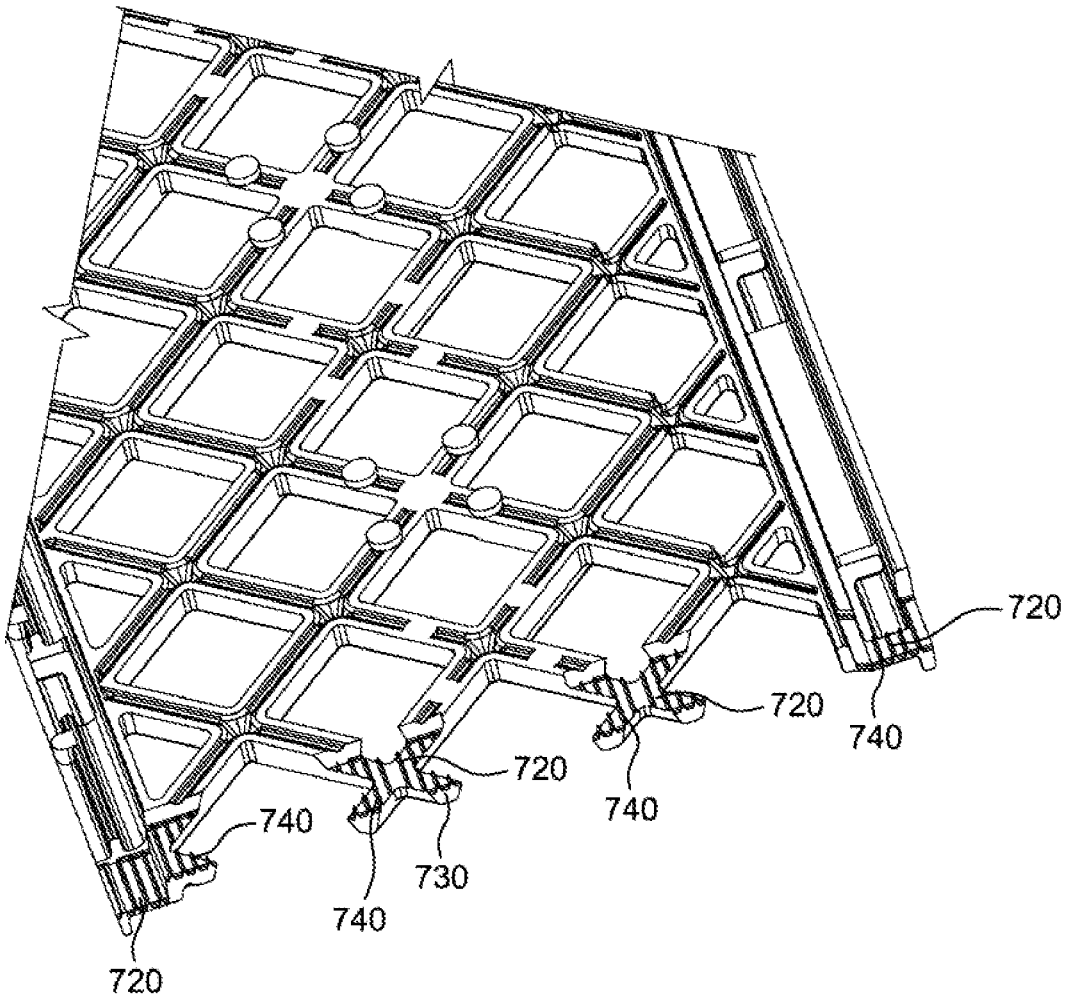
FIG. 35 is another detailed view of a main body for use with the gutter guard system of FIG. 25.
Figure 36:
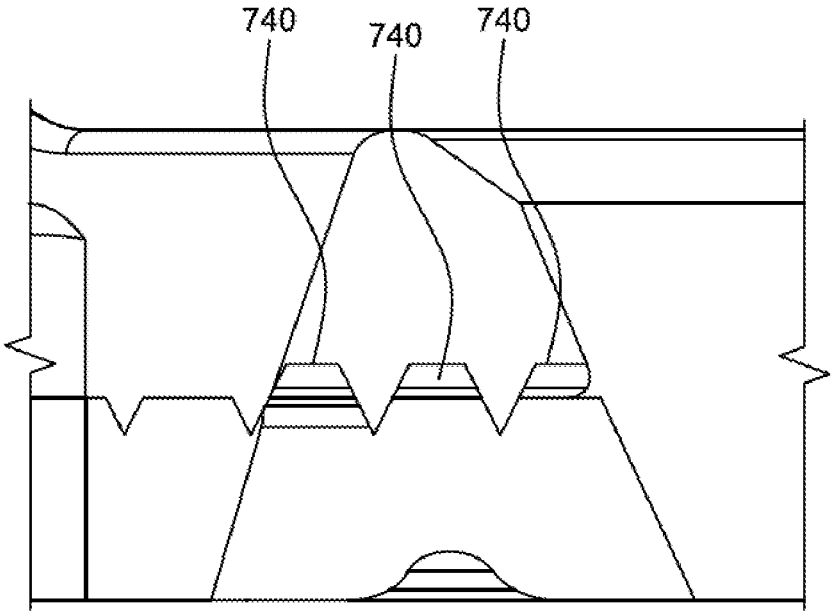
FIG. 36 is another detailed view of a main body for use with the gutter guard system of FIG. 25.
Figure 37:
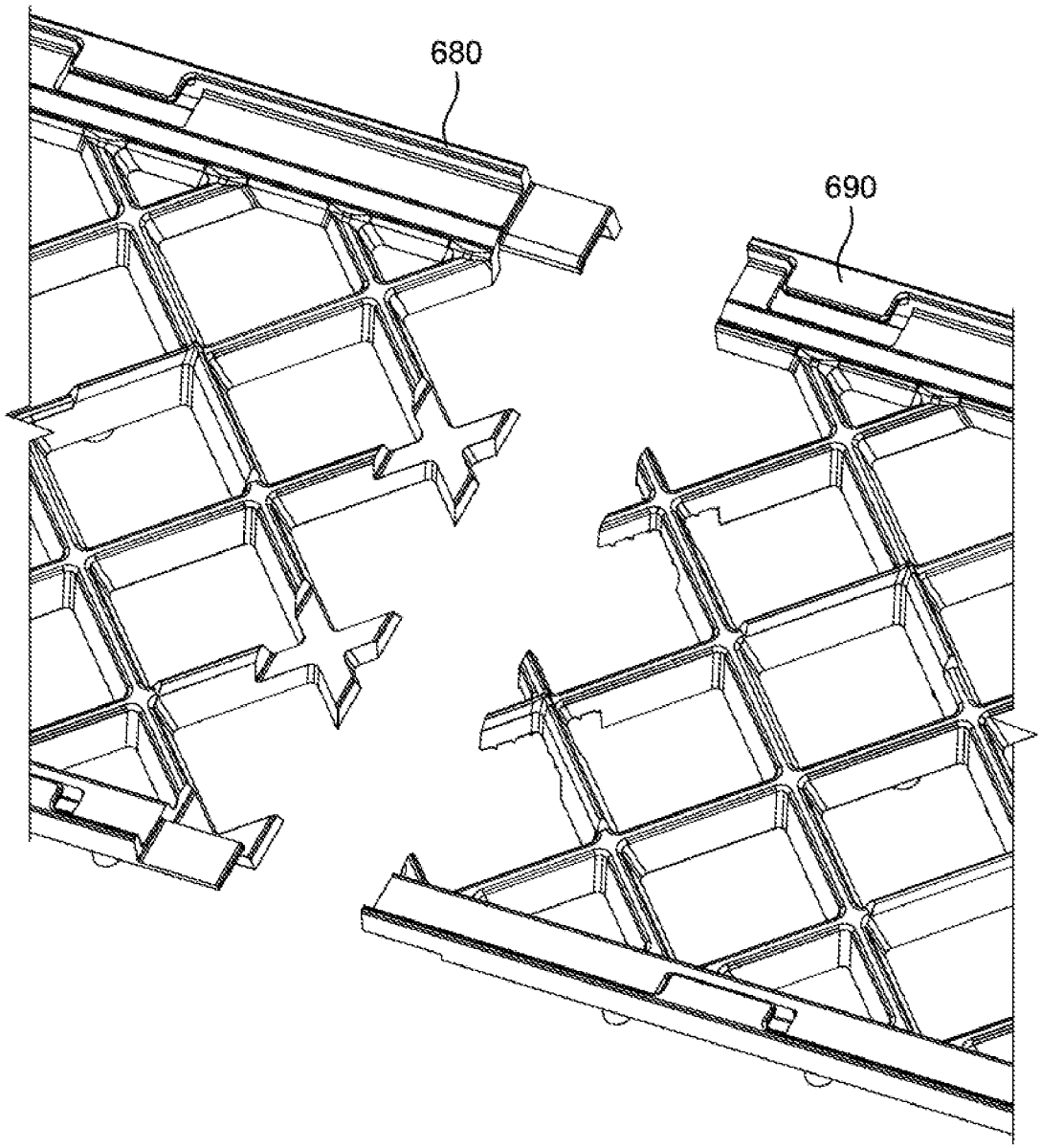
FIG. 37 is another detailed view of a main body for use with the gutter guard system of FIG. 25.

FIGS. 28 through 41 illustrate features of the main body 610. In one embodiment, the main body 610 is a five foot long main body assembled from two 30-inch subsections—a first main body subsection 680 and a second main body subsection 690. In such an arrangement, the manufacturing process for the 30-inch subsections 680, 690 is relatively straightforward. Once manufactured, the two main body subsections 680, 690 can be permanently joined to form the main body 610 that will be used to form the final gutter guard system 600 installed in rain gutters. FIG. 28 illustrates a perspective view of the assembled main body 610; FIG. 29 illustrates a side view of the assembled main body 610; FIG. 30 illustrates a top view of the first 680 and second 690 main body subsections prior to assembly; and FIG. 31 illustrates a bottom view of the first 680 and second 690 main body subsections prior to assembly.

Figure 38:
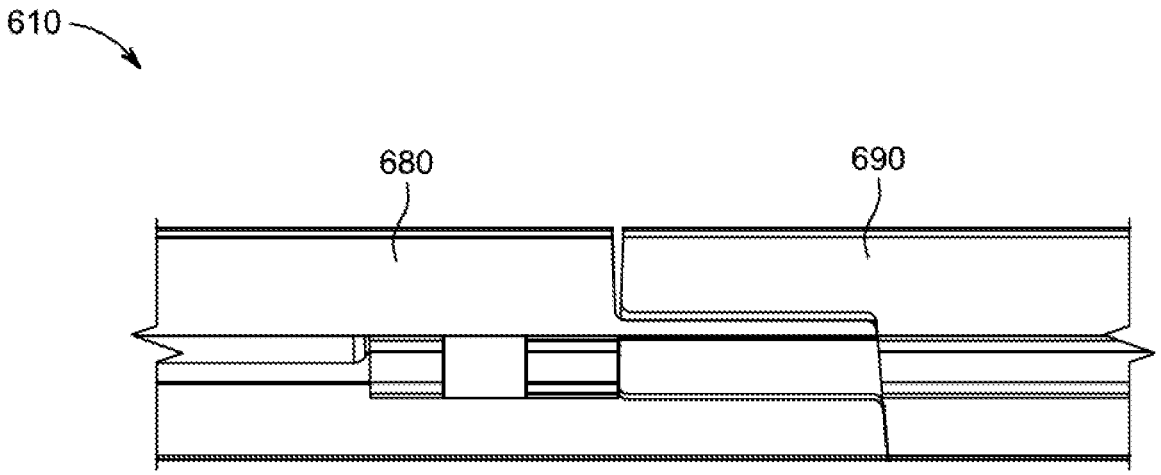
FIG. 38 is another detailed view of a main body for use with the gutter guard system of FIG. 25.
Figure 39:
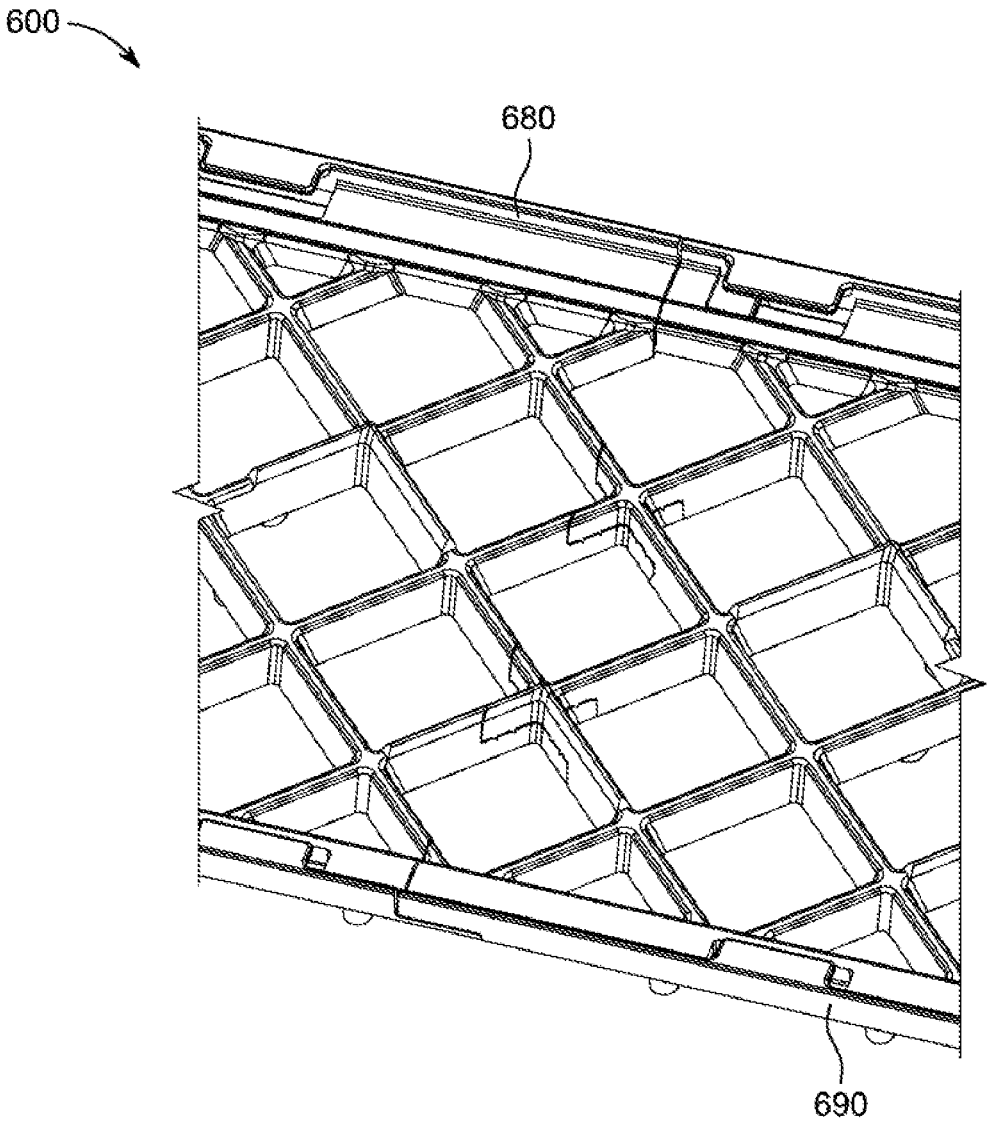
FIG. 39 is another detailed view of a main body for use with the gutter guard system of FIG. 25.

In one embodiment, a sonic welding manufacturing process is used to join the first 680 and second 690 main body subsections. The first 680 and second 690 main body subsections include mating features that facilitate the sonic welding process. For example, as illustrated in detail views in FIGS. 32 and 33, the first main body subsection 680 includes a series of recesses 700 on its top surface proximate to an edge 710 of the first main body subsection 680, and as illustrated in detail views in FIGS. 34 and 35, the second main body subsection 690 includes a series of recesses 720 on its bottom surface proximate to an edge 730 of the second main body subsection 690. The recesses 720 of the second main body subsection 690 include a series of cleats 740, as best illustrated in the detailed side view of FIG. 36. When the first 680 and second 690 main body subsections are to be joined through the sonic welding manufacturing process, the recesses 700 of the first main body subsection 680 are matched with the recesses 720 of the second main body subsections 690 to create a joint between the two components. The sonic welding manufacturing process is initiated and the cleats 740 act as energy directors focusing the ultrasonic energy to create heat at the joint. The cleats 740 melt and bond the first 680 and second 690 main body subsections at the joint to form the assembled main body 610. FIG. 38 illustrates a side view of the assembled main body 610 and FIG. 39 illustrates a perspective view of the assembled main body 610.

Figure 40:
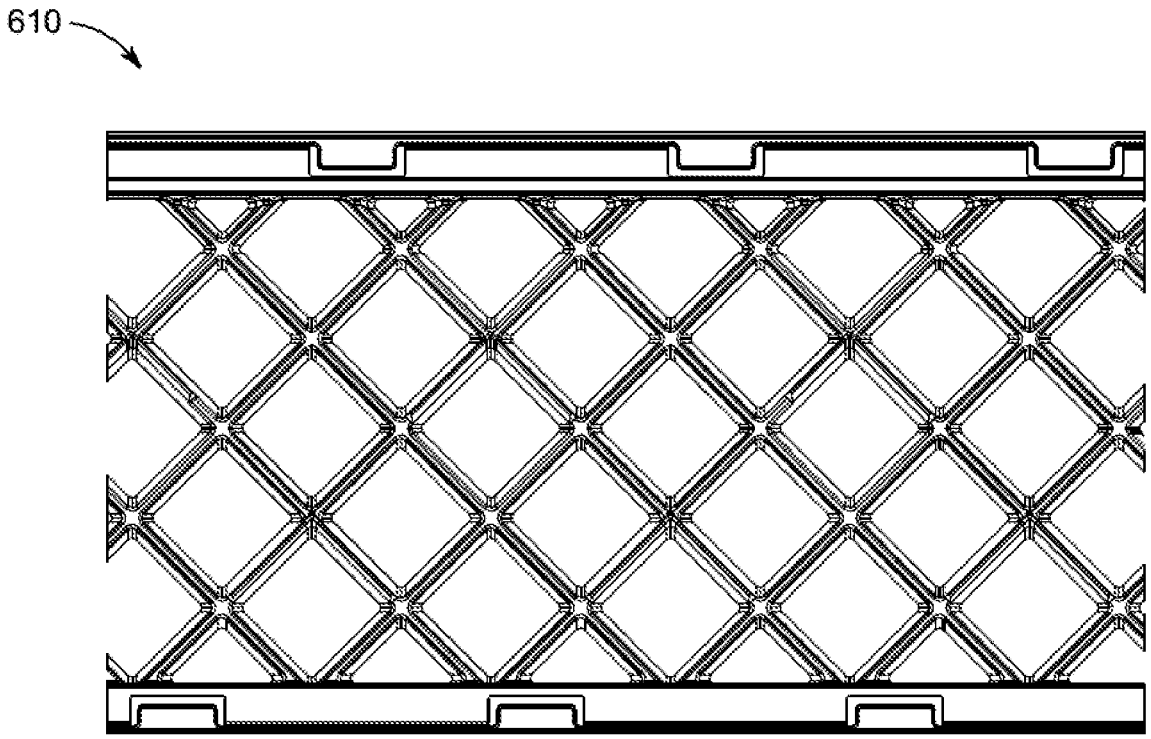
FIG. 40 is another detailed view of a main body for use with the gutter guard system of FIG. 25.

FIGS. 40 through 48 illustrate additional features of the main body 610. FIG. 40 is a detailed view of the diamond pattern of the supporting members of the main body 610. This diamond pattern increases the cross-sectional open space as compared to conventional gutter guards. Such additional open space facilitates greater rainwater flow through the gutter guard system 600 and into the rain gutter and enhances the flow of air through the gutter guard system, which prevents matting of debris on the screen. In testing, a four inch main body with the diamond pattern processed approximately 8.5 gallons of water per linear foot per minute. For the diamond pattered four inch main body, the percentage of open cross-sectional area is 66.83%.

Figure 41:
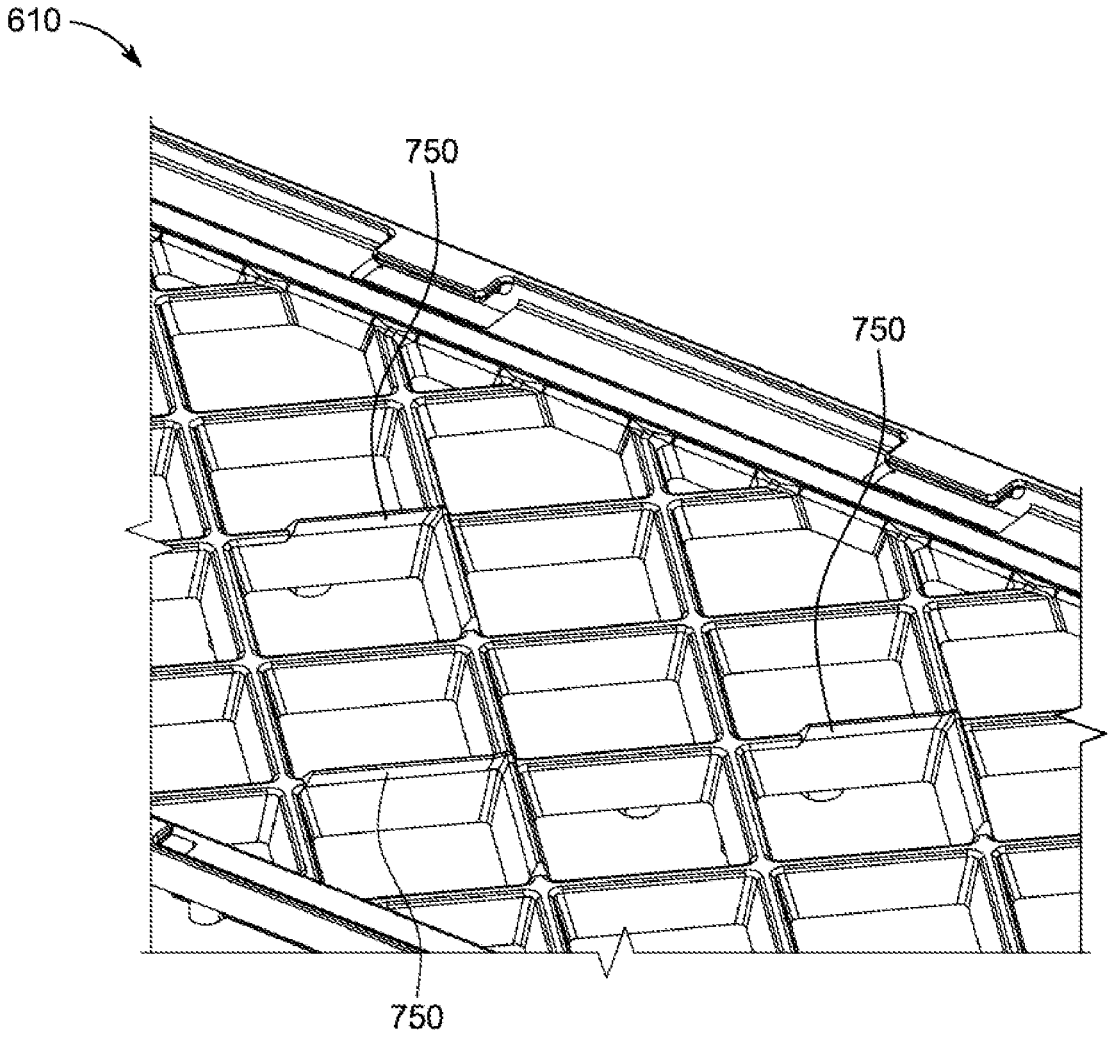
FIG. 41 is another detailed view of a main body for use with the gutter guard system of FIG. 25.

As best illustrated in FIG. 41, the structural members of the diamond pattern include a number of wicking edges 750. These wicking edges 750 are raised features that are tapered so that a thin edge of the feature contacts and engages with the screen 640 when the gutter guard system 600 is assembled. Such contact and engagement creates a wicking phenomena that encourages water passing along the top of the screen to wick down through the screen 640, toward the main body 610 and into the rain gutter. As is illustrated in FIG. 41, the wicking edges 750 are periodically placed and staggered along the main body 610. Such an arrangement enhances water flow down in the rain gutter while maintain ample room for air flow proximate to the screen 640, which discourages matting of debris on the top of the screen 640.

Figure 42:
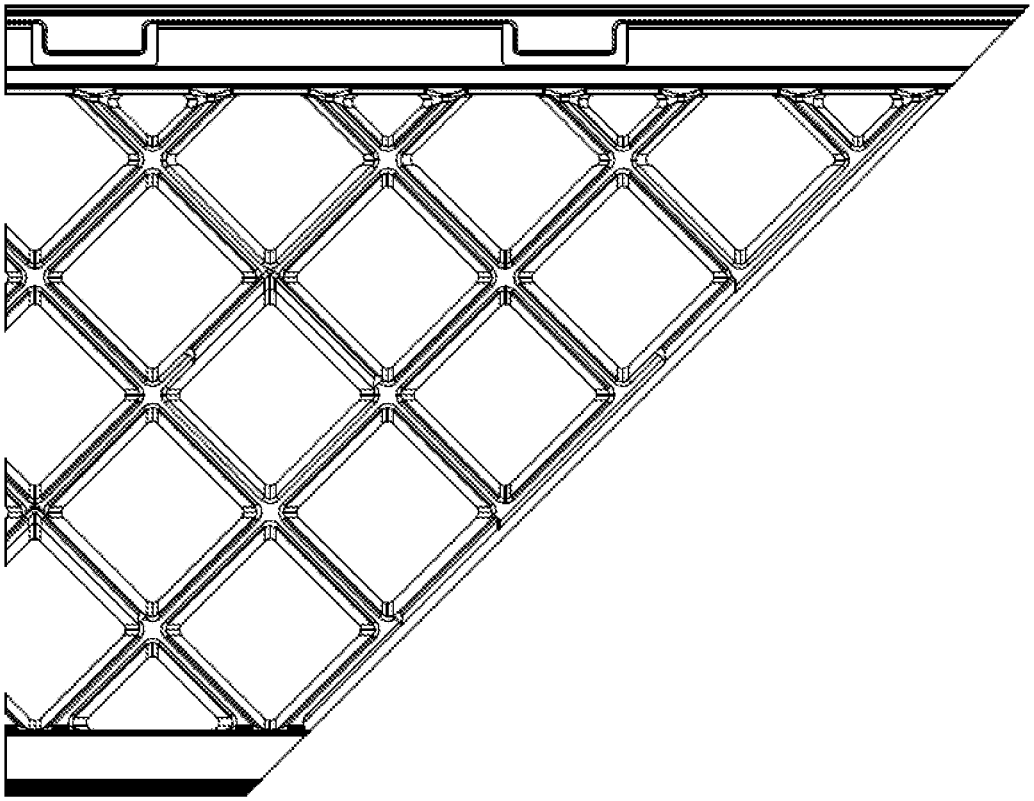
FIG. 42 is a detailed view of a main body trimmed for a gutter corner application.
Figure 43:
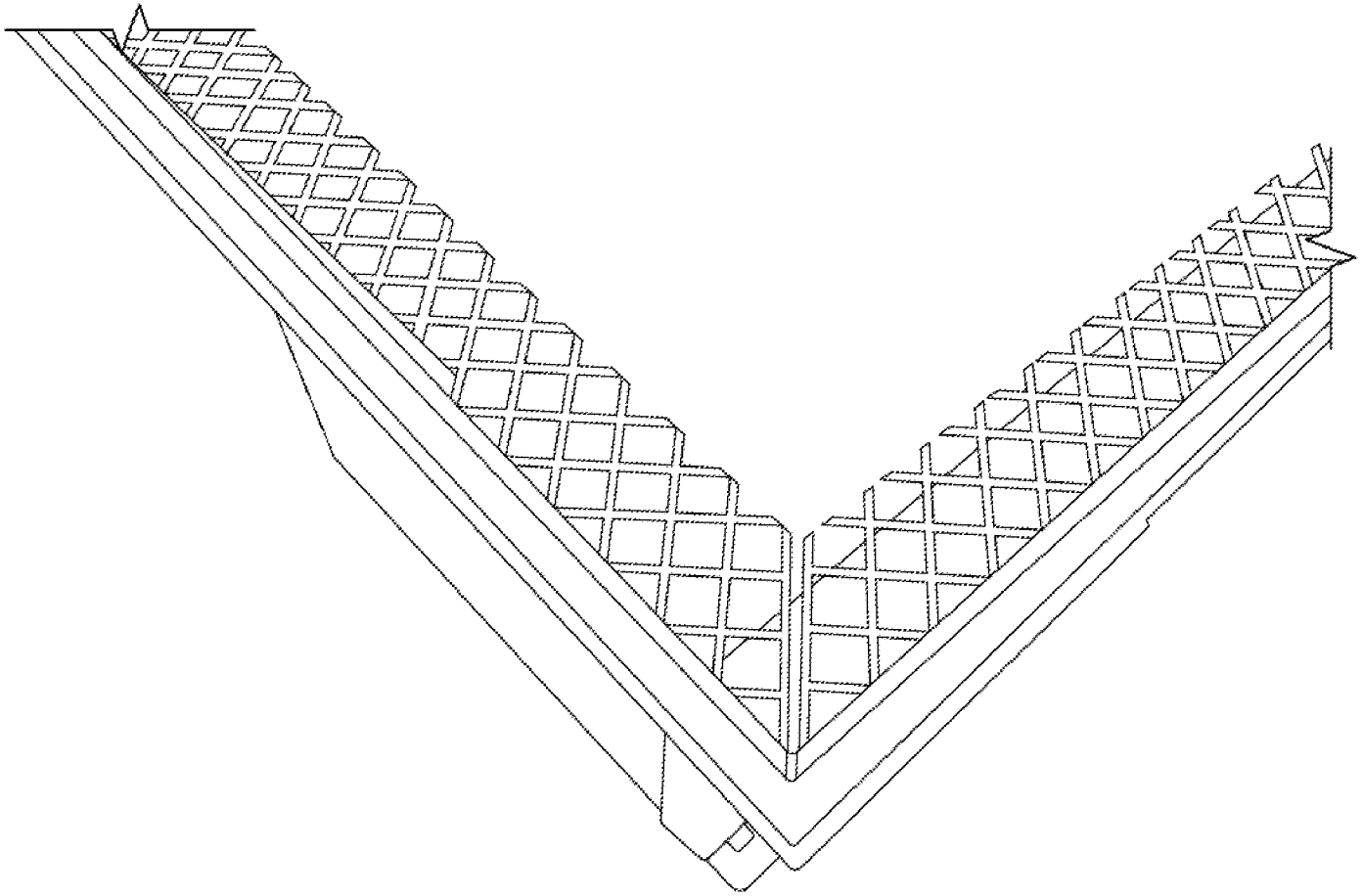
FIG. 43 is a top view of a gutter guard system installed in an outside corner of a house.
Figure 44:
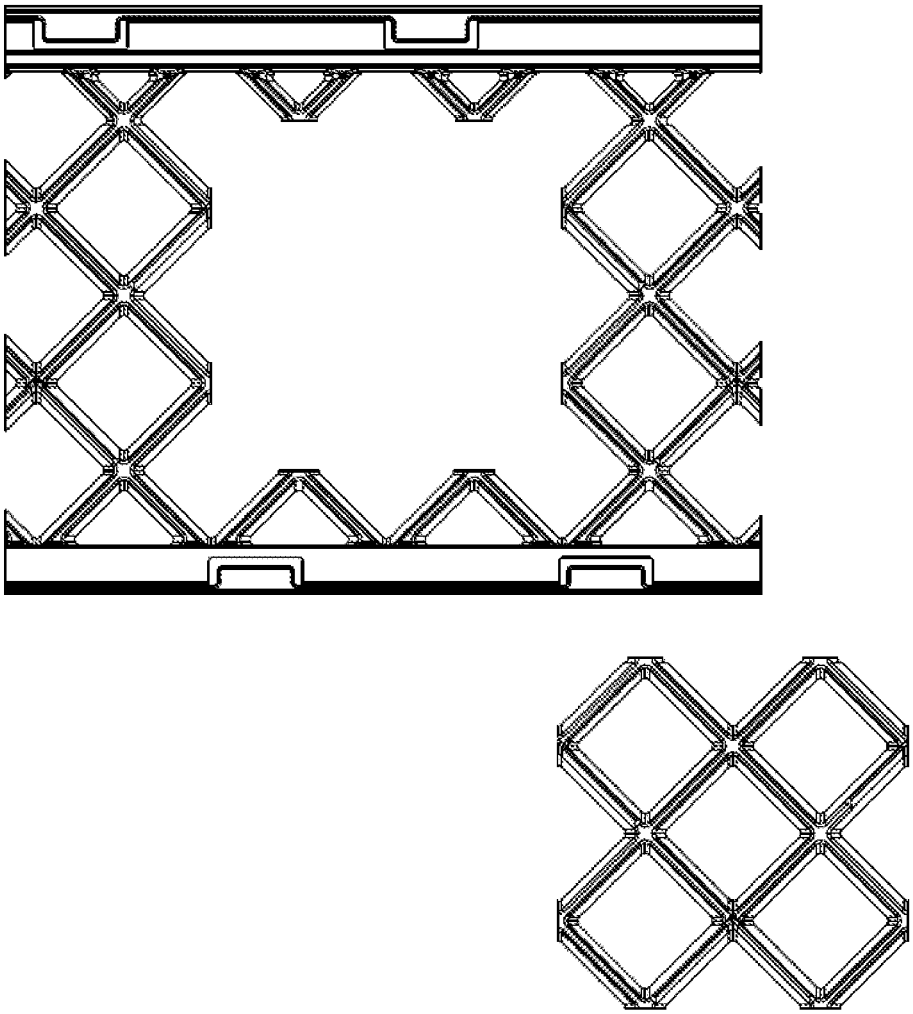
FIG. 44 is a top view of a main body modified to accommodate a down spout.
Figure 45:
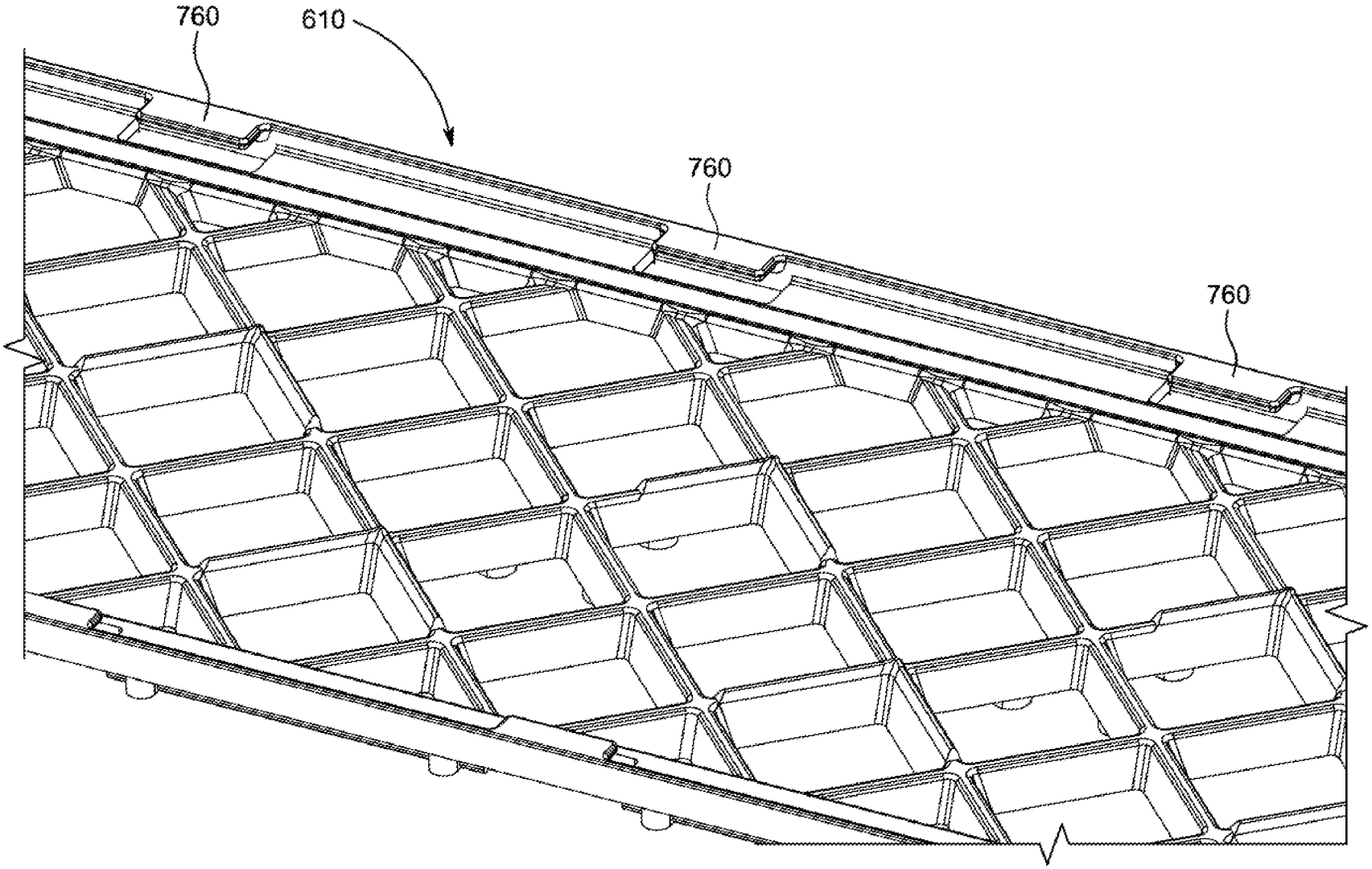
FIG. 45 is perspective view of the tuck tabs of a main body.

As illustrated in FIGS. 42 through 44, the diamond pattern assists a user in modifying the main body 610 to account for practical issues that arise during installation of gutter guard systems 600. For example, rain gutters routinely include "inside" and "outside" corners to accommodate the roofline of a home or structure. To accommodate such corners, it is useful to trim the end of the gutter guard system (and specifically the main body) at a 45-degree angle. As illustrated in FIG. 42, due to the diamond pattern, it is straightforward to trim the main body appropriately with hand tools. As illustrated in FIG. 43, once the main bodies are trimmed at a 45-degree angle, two segments of a gutter guard system can be formed and installed in an outside corner to fully cover the rain gutter at that outside corner and provide a rib for structural support in the corner. It will be understood that a similar technique can be employed to accommodate an inside corner of a rain gutter.

As illustrated in FIG. 44, a section of the main body can be removed with hand tools by snipping the intersections of structure members to create an opening in the main body. Such an opening as illustrated in FIG. 44 can be sized to accommodate a downspout passing through a gutter guard system that is installed on the first floor of a multi-story structure.

Figure 46:
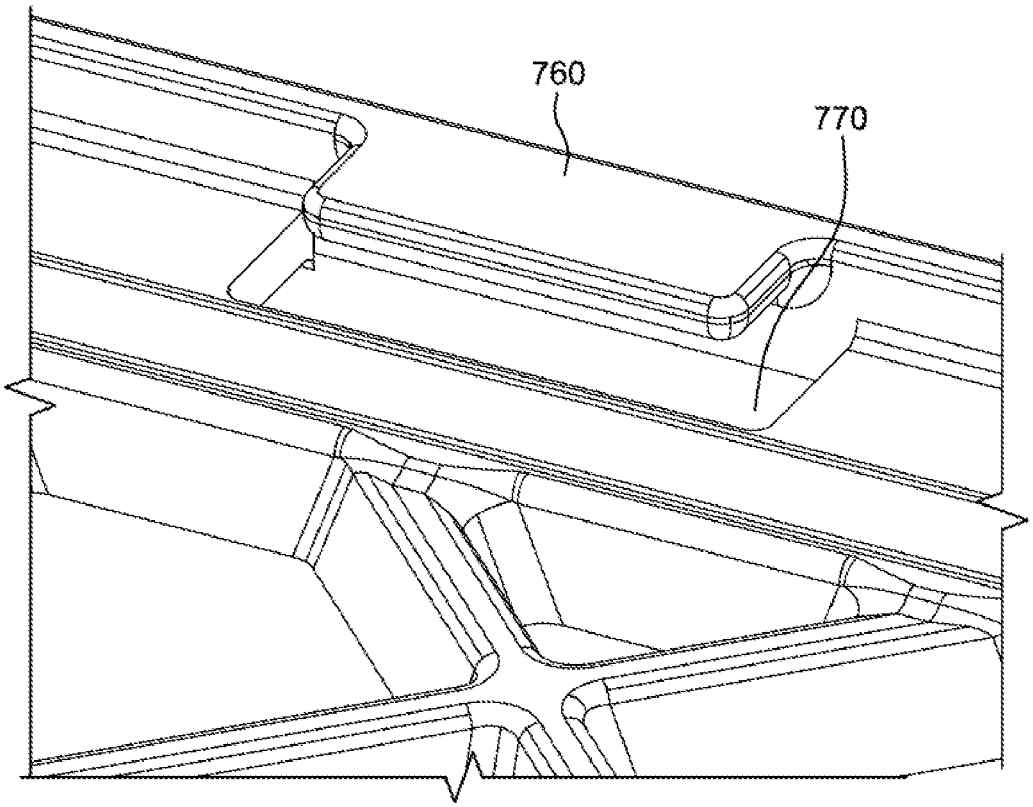
FIG. 46 is another perspective view of the tuck tabs of a main body.
Figure 47:
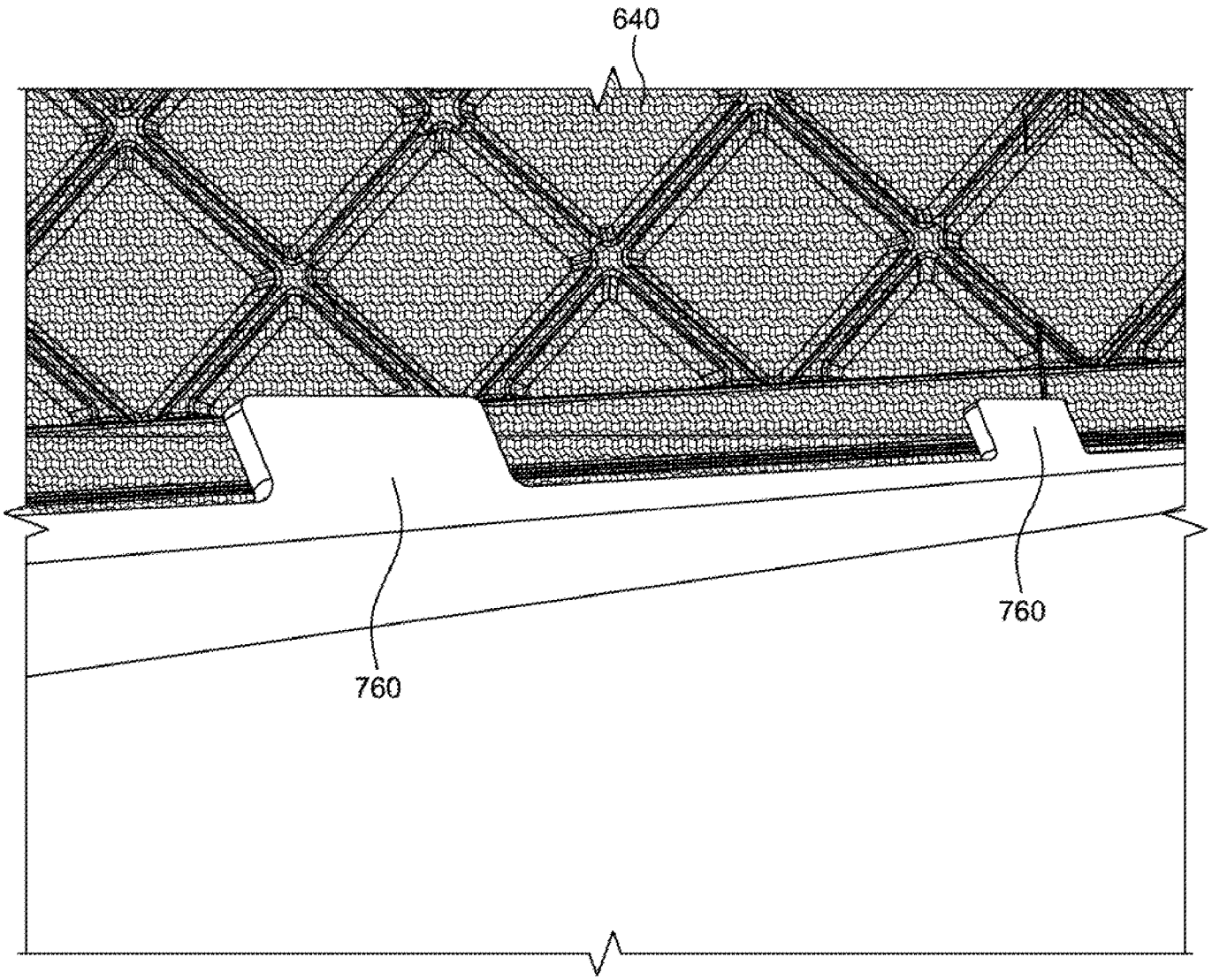
FIG. 47 is perspective view of a screen secured to a main body using tuck tabs.
Figure 48:
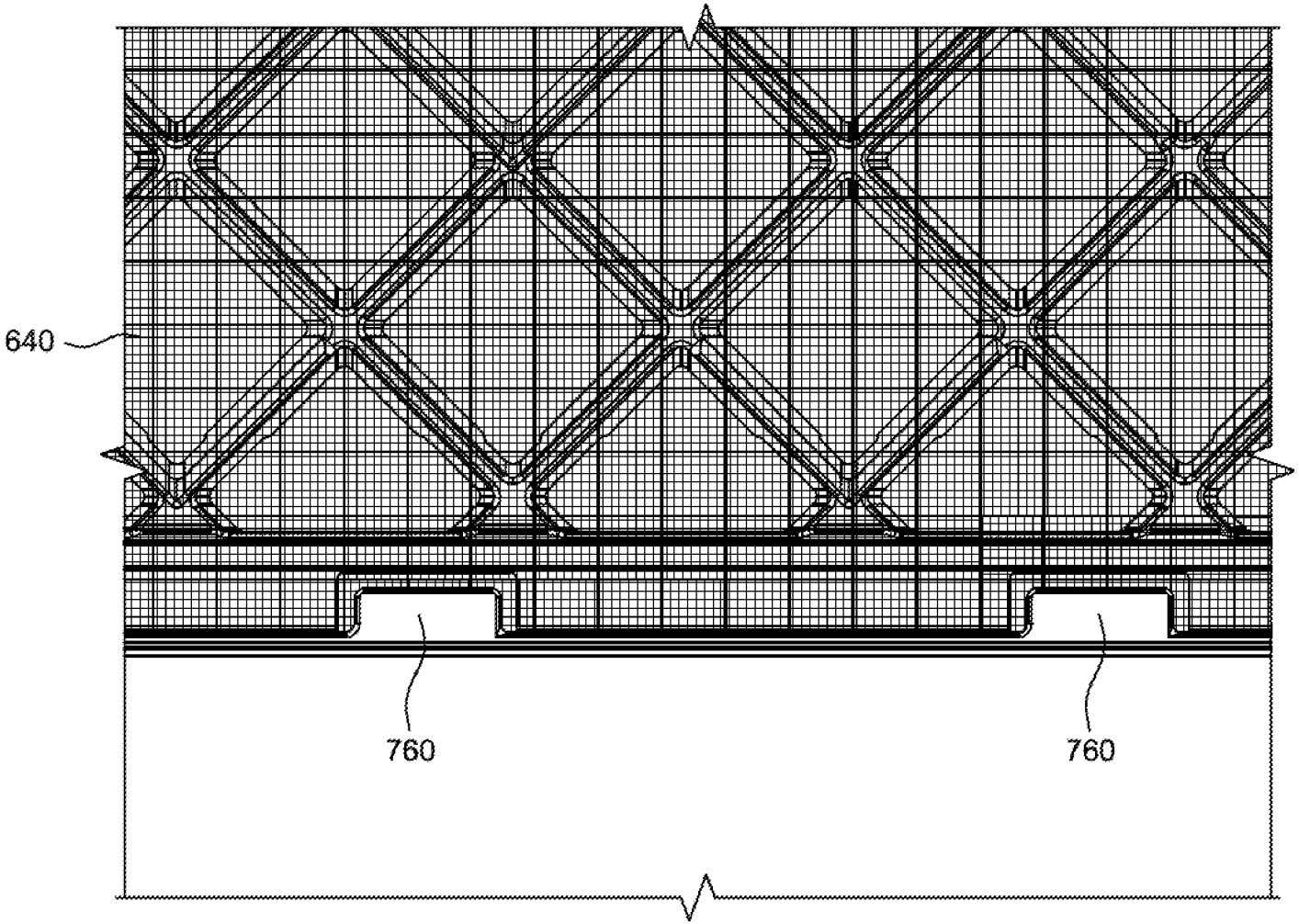
FIG. 48 is top view of a screen secured to a main body using tuck tabs.
Figure 49:
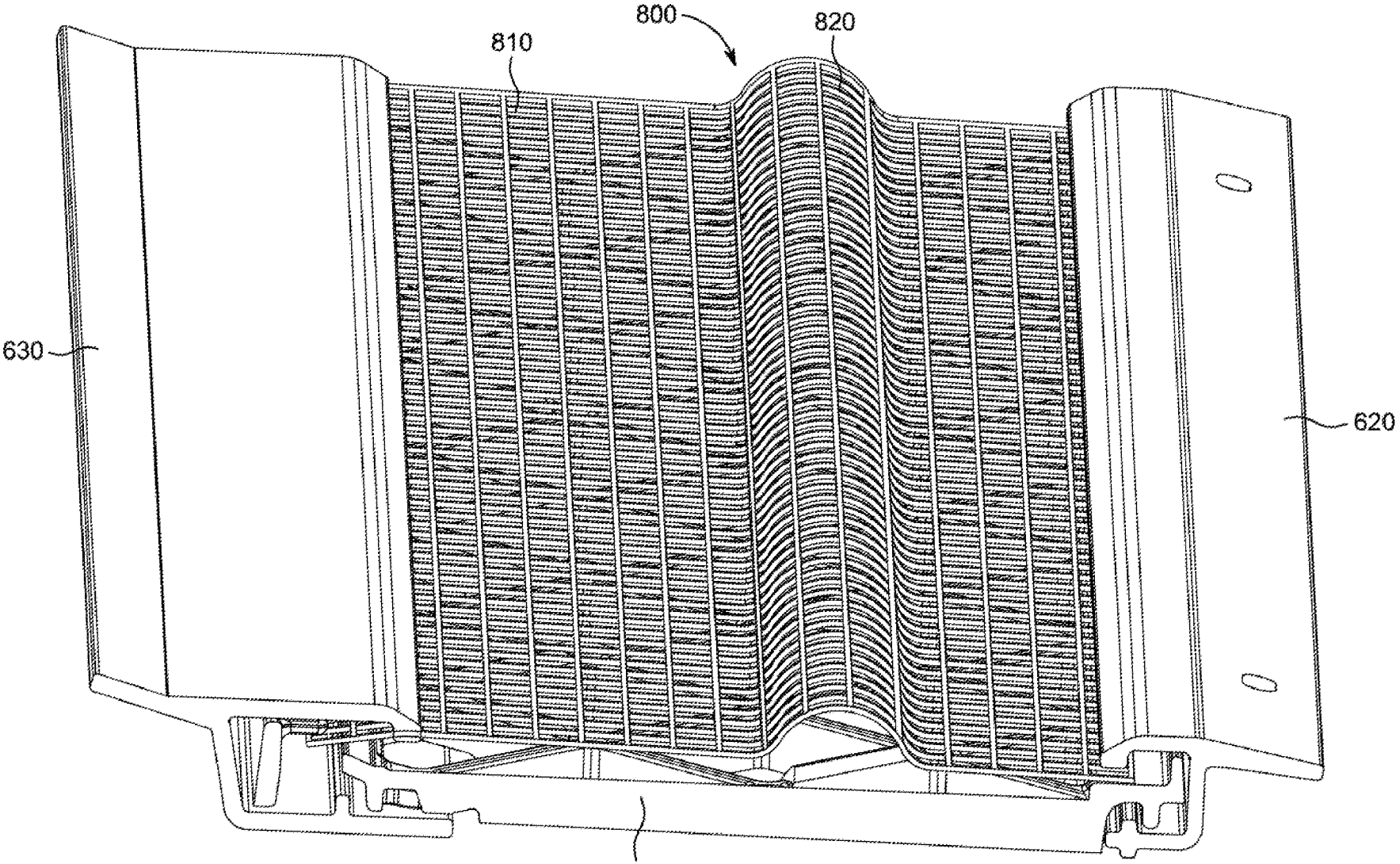
FIG. 49 is a perspective view of a gutter guard system with an alternative screen.
Figure 50:
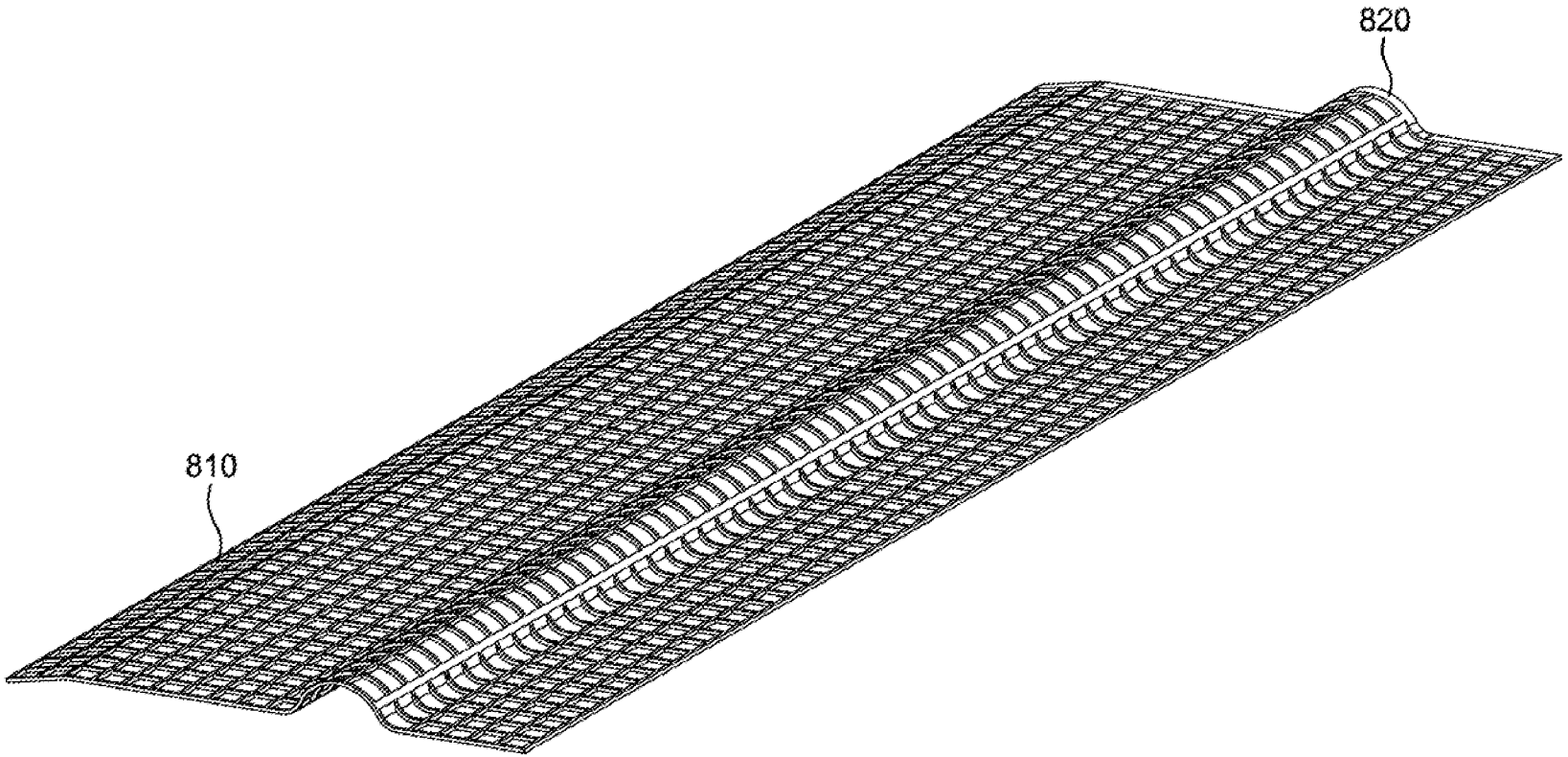
FIG. 50 is a perspective view of the alternative screen.

As illustrated in FIGS. 45-48, the main body 610 includes a series of tuck tabs 760 along the front and back edges of the main body 610. These tuck tabs 760 are arranged to secure the screen 640 to the main body 610. To assemble the screen 640 with the main body 610, the screen 640 is slid along the top of the main body 610 with the two longitudinal edges of the screen 640 captured by the tuck tabs 760. As best illustrated in FIG. 46, a recess 770 is formed under each tuck tab 760. This recess allows for ease of installation of the screen 640 and provides for the tuck tab 760 to apply a slight downward pressure on the screen 640 to better secure the screen 760 though a friction fit.

In another embodiment of a gutter guard system, an alternative screen design can be used. For example, as illustrated in FIGS. 47-50, a gutter guard system 800 includes the main body 610, front receiver 620, and rear receiver 630 as previously disclosed, but includes a screen 810 that includes a raised and rounded area 820 running along the length of the screen 810. The raised and rounded area 820 serves as a hurdle or obstacle that slows down rainwater as it passes over the screen 810. This slowing of rainwater keeps the rainwater on the surface of the screen for a longer period of time, providing more opportunity for the water to wick downward, pass through the screen and into the rain gutter. The raised area additionally promotes air flow across the surface of the screen 810 and results in less matting of debris on the top surface of the screen 810.

Figure 51:
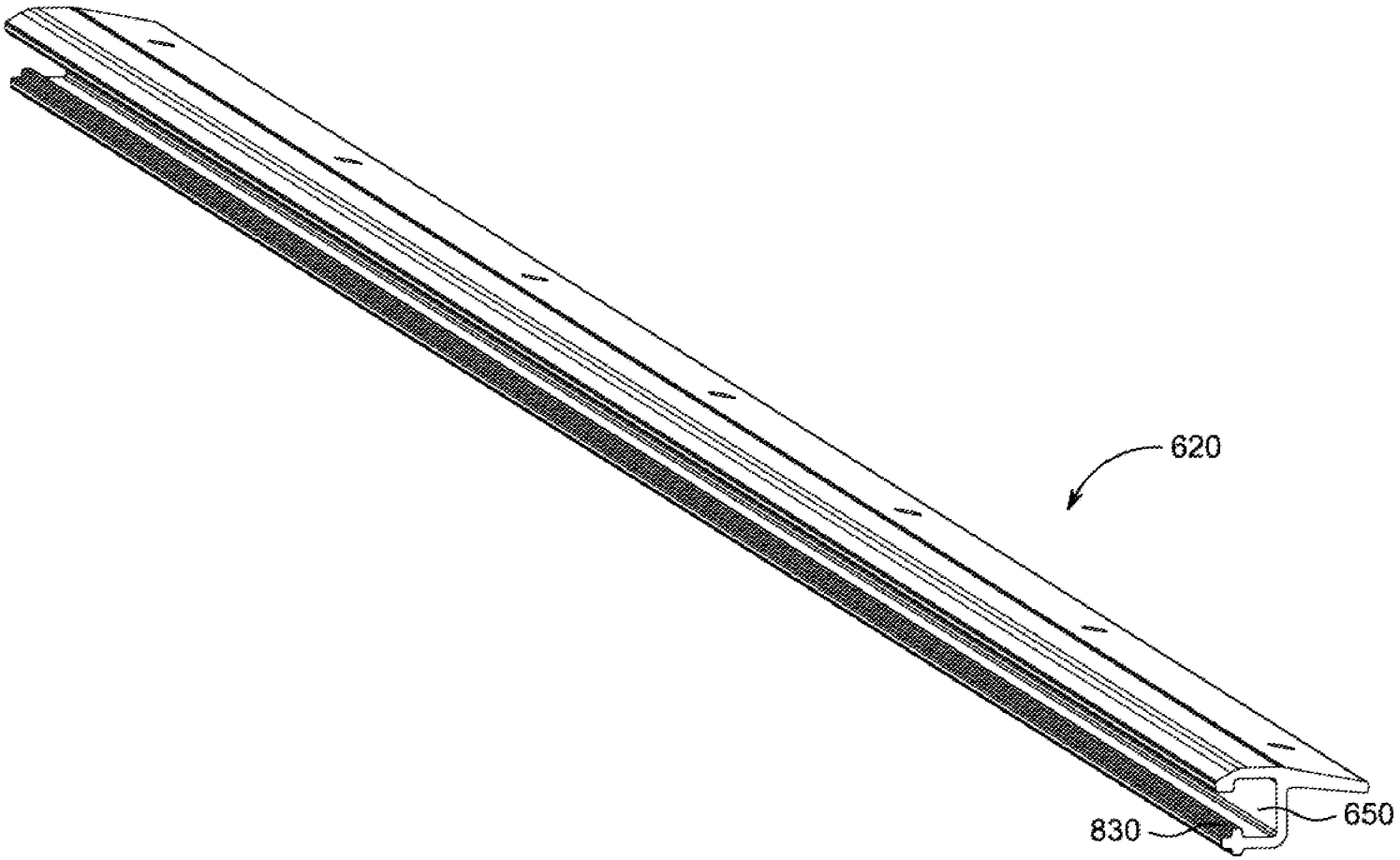
FIG. 51 is a perspective view of a front receiver.
Figure 52:
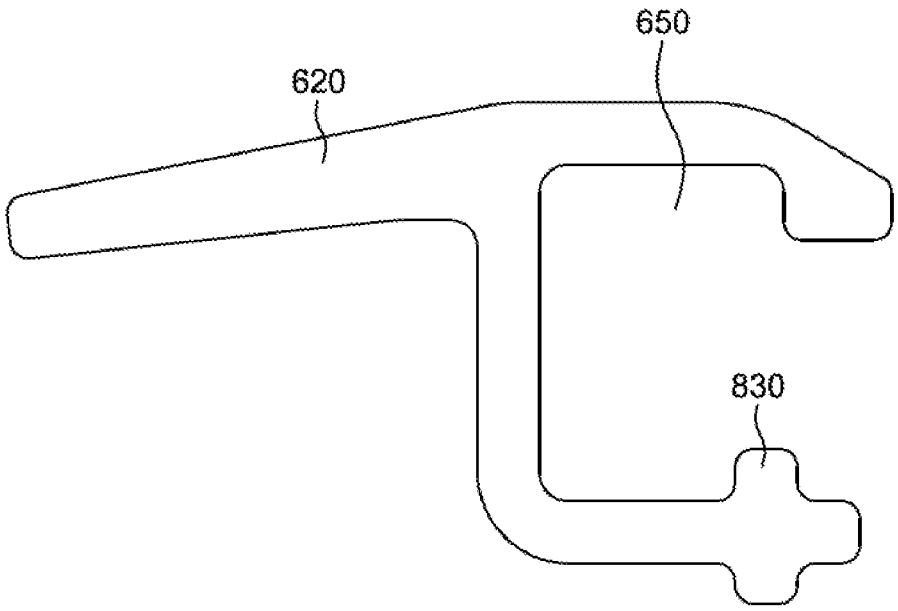
FIG. 52 is a side view of a front receiver
Figure 53:
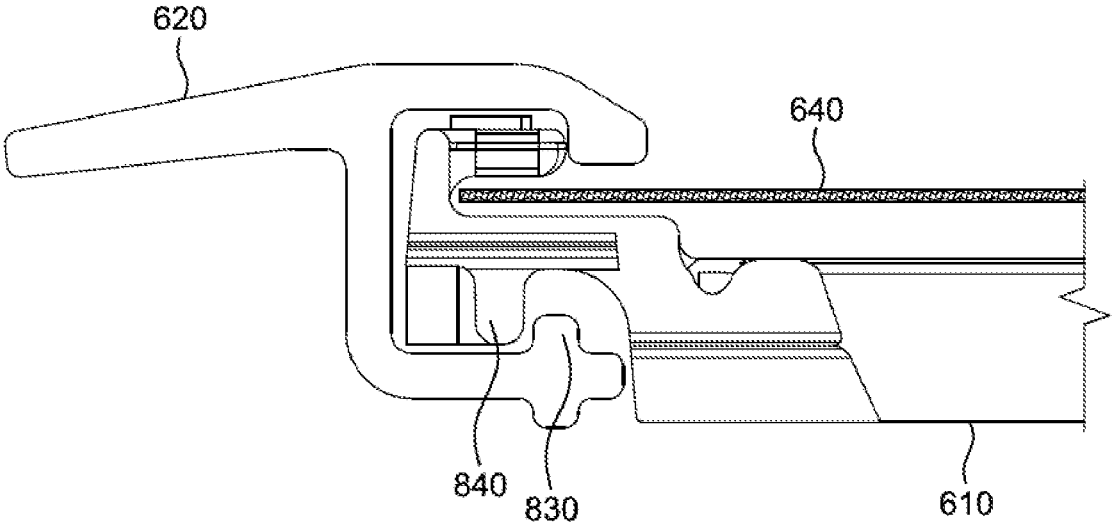
FIG. 53 is a side view of a front secured to a main body.
Figure 54:
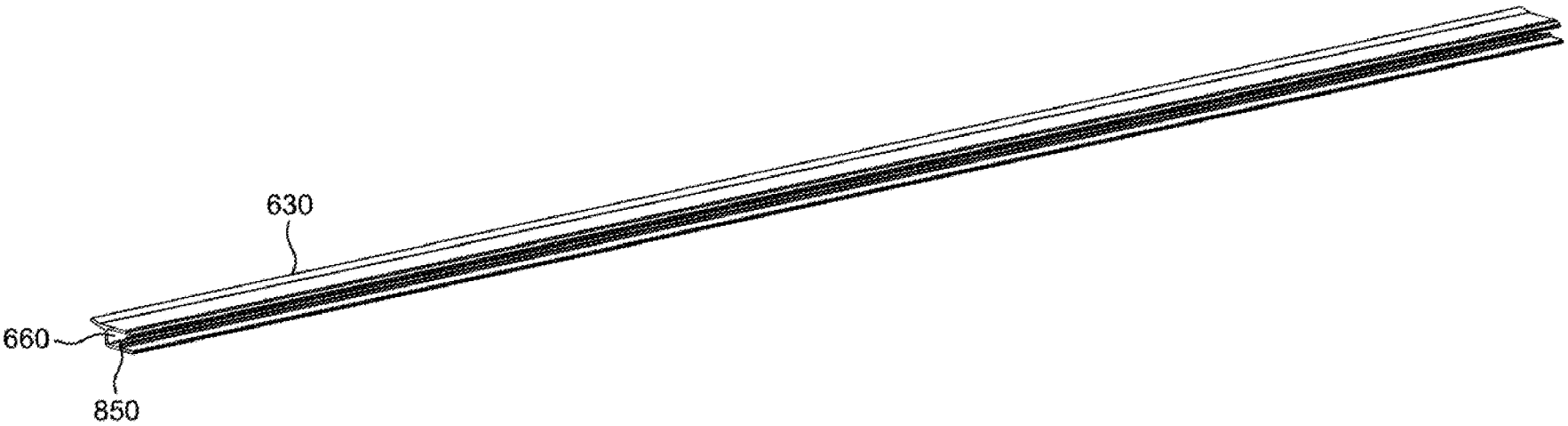
FIG. 54 is a perspective view of a rear receiver.
Figure 55:
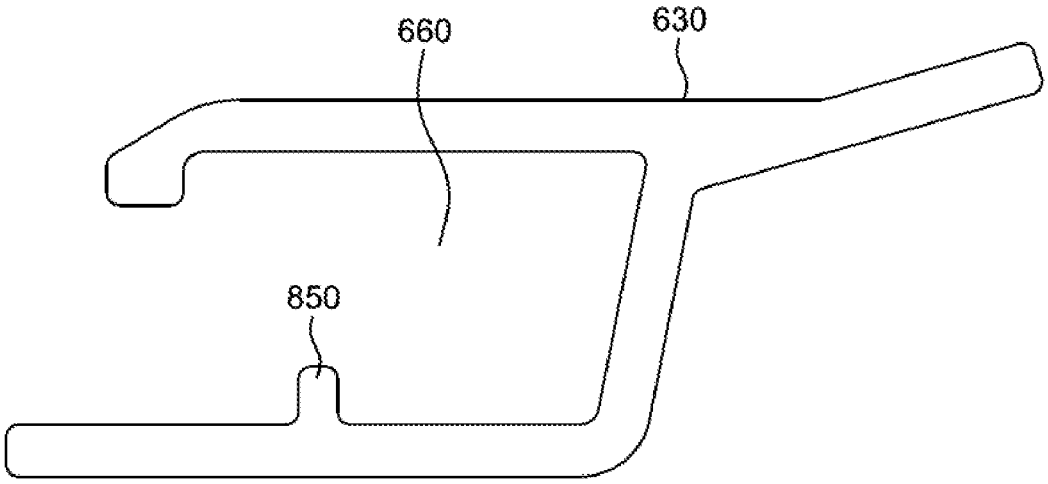
FIG. 55 is a side view of a rear receiver
Figure 56:
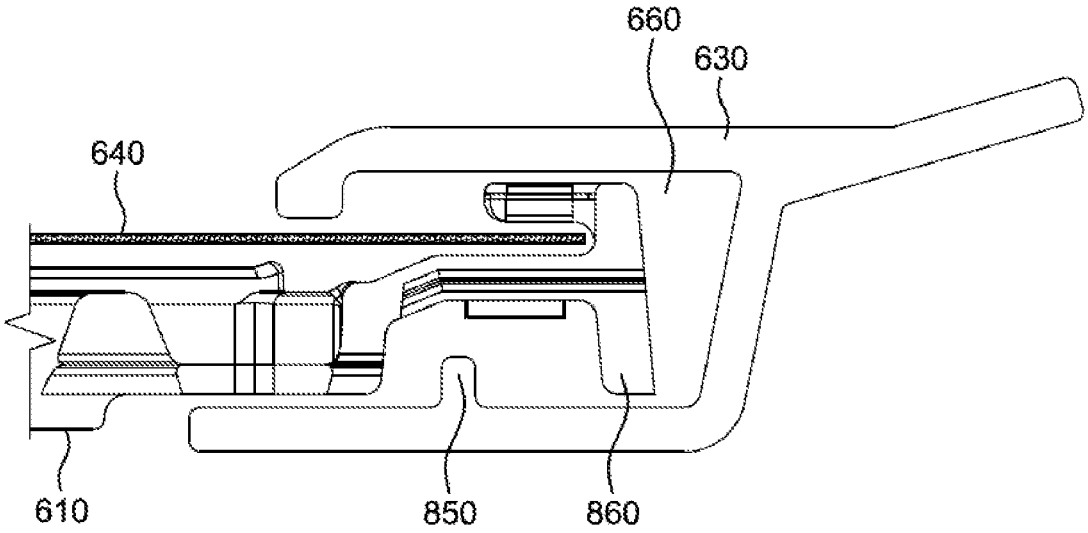
FIG. 56 is a side view of a rear secured to a main body

FIGS. 51 through 56 illustrate the front 620 and rear 630 receivers. FIG. 51 illustrates a perspective view of the front receiver 620; FIG. 52 illustrates a side view of the front receiver 620; FIG. 53 illustrates a side view of the front receiver 620 engaged with the main body 610; FIG. 54 illustrates a perspective view of the rear receiver 630; FIG. 55 illustrates a side view of the rear receiver 630; and FIG. 56 illustrates a side view of the rear receiver 630 engaged with the main body 610. As noted above, the channels 650, 660 of the front 620 and rear 630 receivers can be arranged such that front 620 and rear 630 receivers can be slid onto the main body 610 when assembling the gutter guard system 600. In addition, the channels 650, 660 of the front 620 and rear 630 receivers can be arranged so that the main body 610 can move laterally within the channels 650, 660 such that the width of the gutter guard system 600 can be adjusted to accommodate for imperfections and different manufacturing tolerances amongst rain gutters. For example, as illustrated in FIGS. 51 through 53, the front receiver 620 includes a stop 830 located within the channel 650 that engages with a downward extending leg 840 of the main body 610. Such an arraignment provides for the stop 830 to ensure that the front receiver 620 stays engaged with the main body 610, while arranged to allow some lateral movement of the main body 610 relative to the front receiver 620.

Similarly, as illustrated in FIGS. 54 through 56, the rear receiver 630 includes a stop 850 located within the channel 660 that engages with a downward extending leg 860 of the main body 610. Such an arraignment provides for the stop 850 to ensure that the rear receiver 630 stays engaged with the main body 610, while arranged to allow significant lateral movement of the main body 610 relative to the rear receiver 630. As will be understood, the gutter guard system 600 is arranged such that there is "play" within the components. Such an arrangement allows for the over all width of the gutter guard system 600 to be adjustable to accommodate rain gutters that are nominally the same width, but have varying widths due to manufacturing tolerances, inconsistencies in raw materials, warping, deformation, and the like. Securing the front 620 and rear 630 receivers and the main body 610 and screen 640 forms a stable assembly that can be unassembled as necessary.

Figure 57:
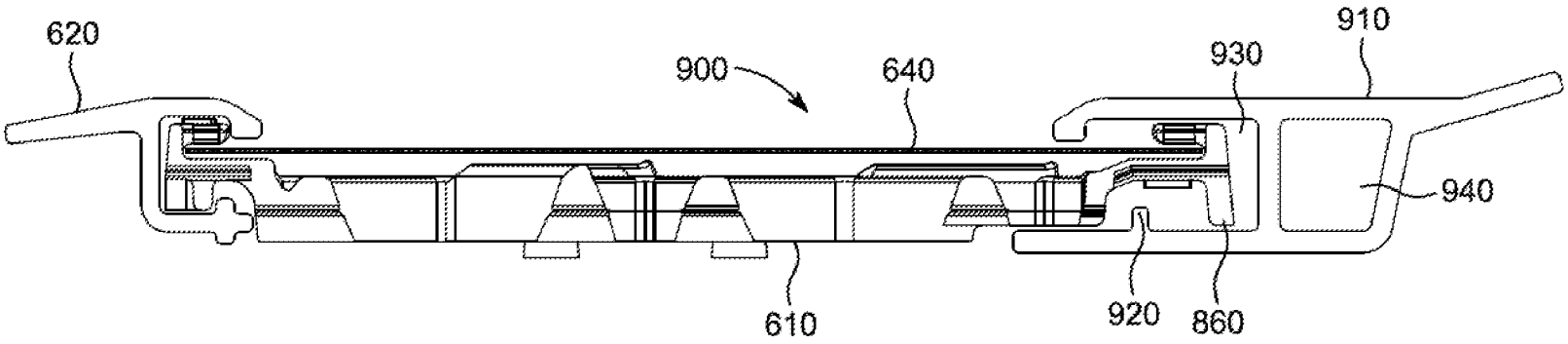
FIG. 57 is a side view of a gutter guard system with an alternative rear receiver.
Figure 58:
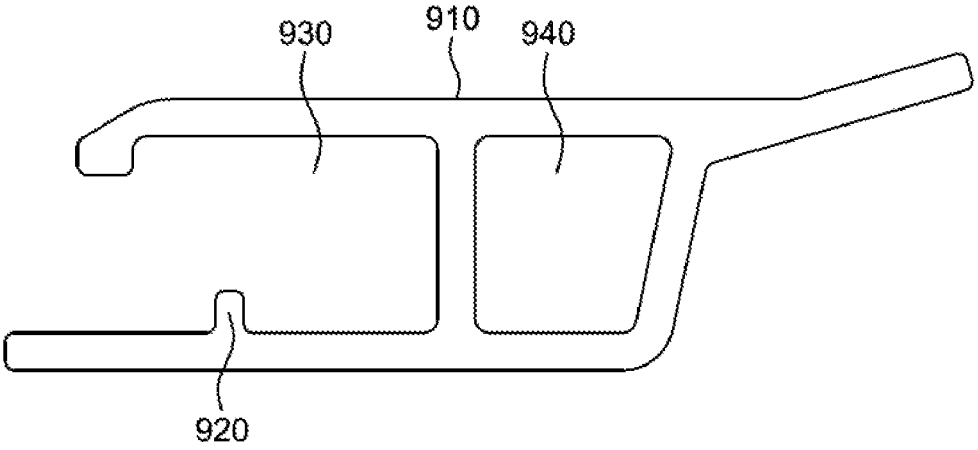
FIG. 58 is a side view of the alternative rear receiver.

In addition to the front 620 and rear 630 receivers illustrated and described in FIGS. 25-56, other front and rear receivers can be used with the main body 610 as described in FIGS. 28-56. One example of an alternative rear receiver is illustrated in FIGS. 57 and 58. As illustrated, a gutter guard system 900 includes a main body 610, front receiver 620, and screen 640 as previously described; however those components are paired with an alternative rear receiver 910. The rear receiver 910 includes a stop 920 within a channel 930 that engages with the main body 610 to secure the main body 610 within the channel 930, while providing for significant lateral movement within the channel 930 to adjust the over all width of the gutter guard system 900. The rear receiver 910 includes a second channel 940, which widens the rear receiver 910. When assembled into a gutter guard system 900, such a wider rear receiver 910 results in a greater over all width of the gutter guard system 900. Thus, providing for the gutter guard system 900 to accommodate wider rain gutters.

Figure 59:
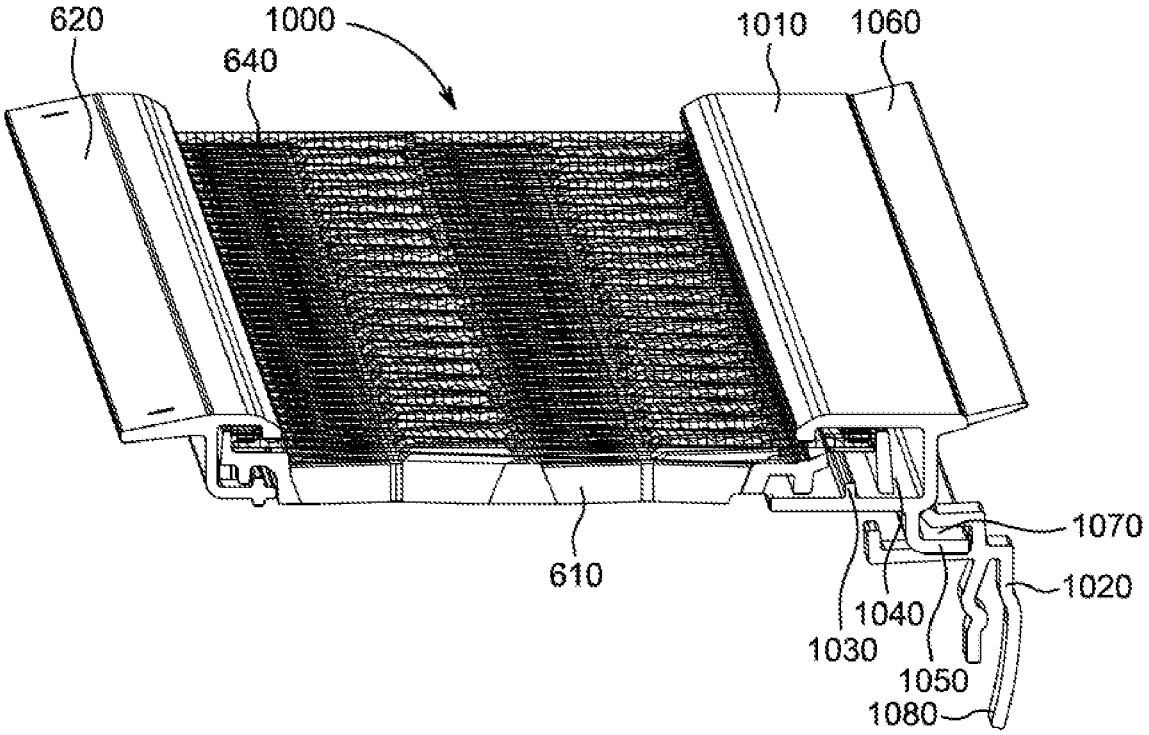
FIG. 59 is a perspective view of a gutter guard system with an alternative rear receiver and a clip.
Figure 60:
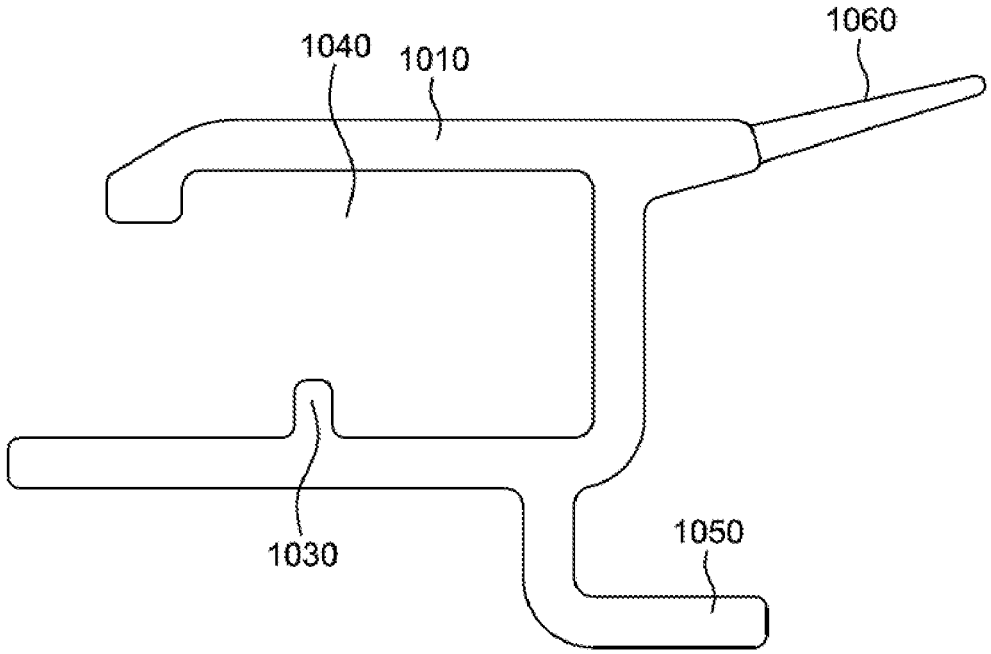
FIG. 60 is a side view of the alternative rear receiver.

Another example of an alternative rear receiver used with an additional component is illustrated in FIGS. 59 and 60. In certain instances, rain gutters are arranged such that it is difficult to engage the rear receiver with the rain gutter or structure. The gutter guard system 1000 of FIGS. 59 and 60 address this issue. As illustrated, a gutter guard system 1000 includes a main body 610, front receiver 620, and screen 640 as previously described; however those components are paired with an alternative rear receiver 1010 and a clip 1020. The rear receiver 1010 includes a stop 1030 within a channel 1040 that engages with the main body 610 to secure the main body 610 within the channel 1040 while providing room for lateral movement. The rear receiver 1010 includes a rear ward extending leg 1050 and a rear ward extending elastomeric member 1060. The clip 1020 includes a first slot 1070 arranged to accommodate the rear ward extending leg 1050 of the rear receiver 1010. The clip 1020 further includes a second slot 1080 arranged to accommodate the rear lip of a rain gutter. In such an arrangement, the clip 1020 can couple the rear receiver 1010 to the rain gutter, thus securing the gutter guard system 1000, to the rain gutter. When the gutter guard system is secured to the rain gutter, the rear ward extending elastomeric member 1060 is designed to extend toward the house or structure and engage the house or structure. The elastomeric nature can seal against the structure and channel rainwater onto the gutter guard system.

Figure 61:
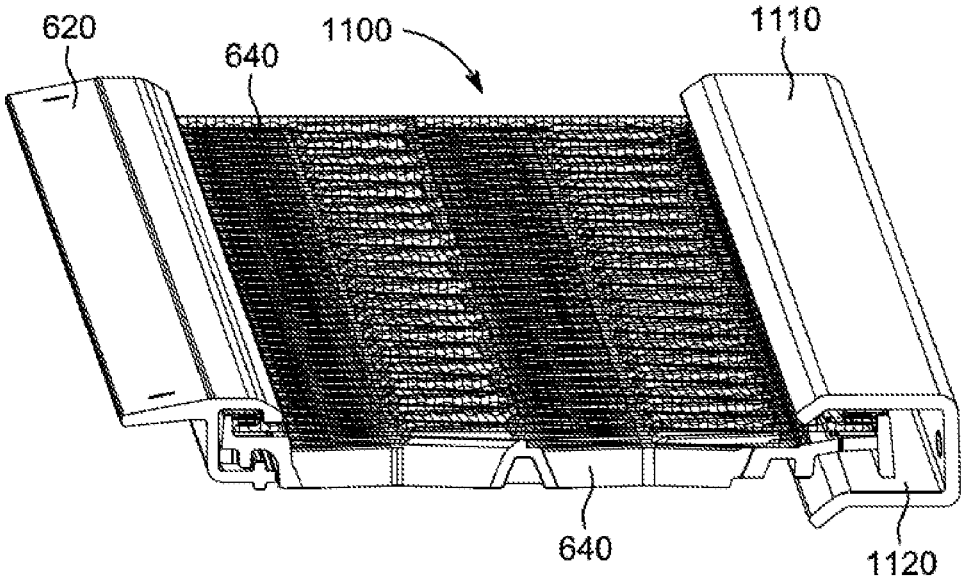
FIG. 61 is a perspective view of a gutter guard system with an alternative rear receiver
Figure 62:
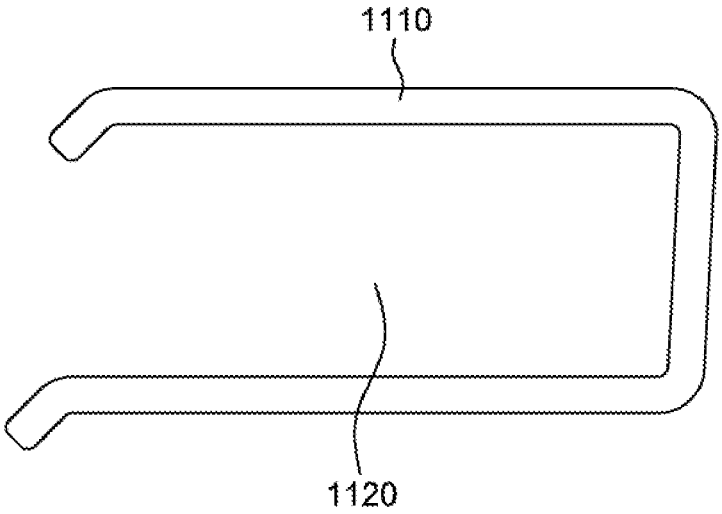
FIG. 62 is a side view of the alternative rear receiver.
Figure 63:
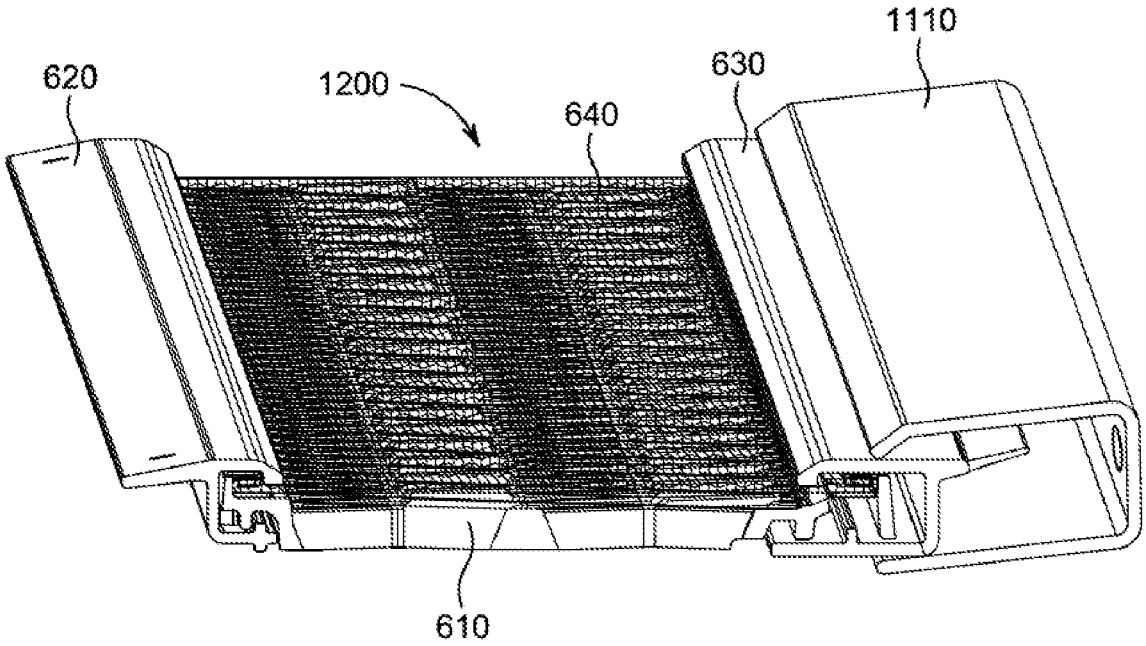
FIG. 63 is a perspective view a gutter guard system assembled with two rear receivers.

FIGS. 61-63 illustrate an additional alternative and versatile rear receiver. In a first embodiment, a gutter guard system 1100 includes a rear receiver 1110 assembled with the main body 610, front receiver 620, and screen 640 as previously described. The rear receive 1110 includes a channel 1120 the capture the rear edge of the main body 610. The channel 1120 is wide and provides for significant lateral movement of the main body 610 to adjust the over all width of the gutter guard system 1100 to varying sized rain gutters. In another embodiment of a gutter guard system 1200, the rear receiver 630 previously described is assembled with the main body 610, front receiver 620, and screen 640. A second rear receiver 1110 is slid over the first rear receiver 630. Such an arrangement increases the over all width of the gutter guard system 1200 to accommodate larger rain gutters.

Figure 64:
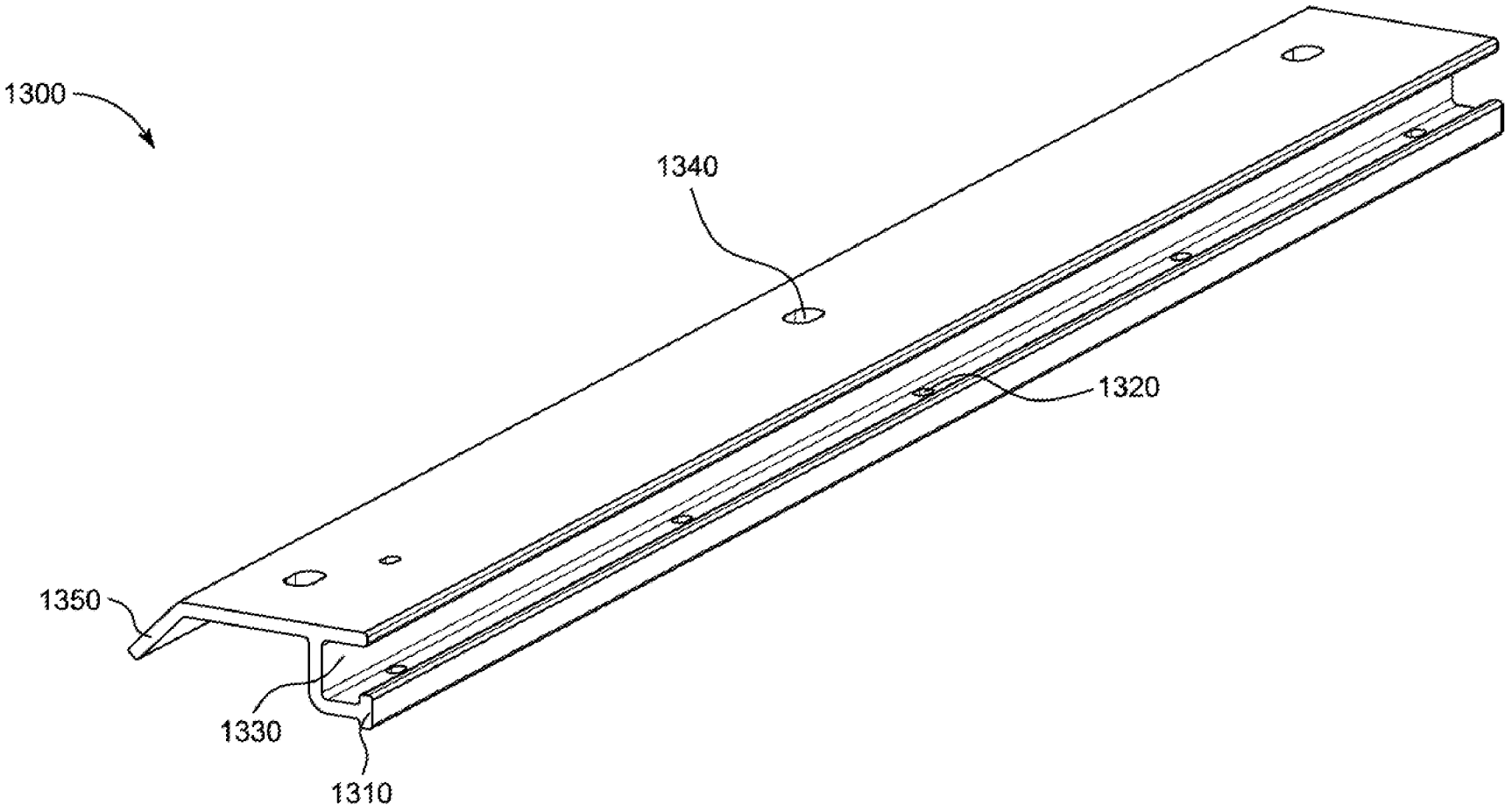
FIG. 64 schematically illustrates an embodiment of a front receiver for use with the gutter guard systems disclosed herein.
Figure 65:
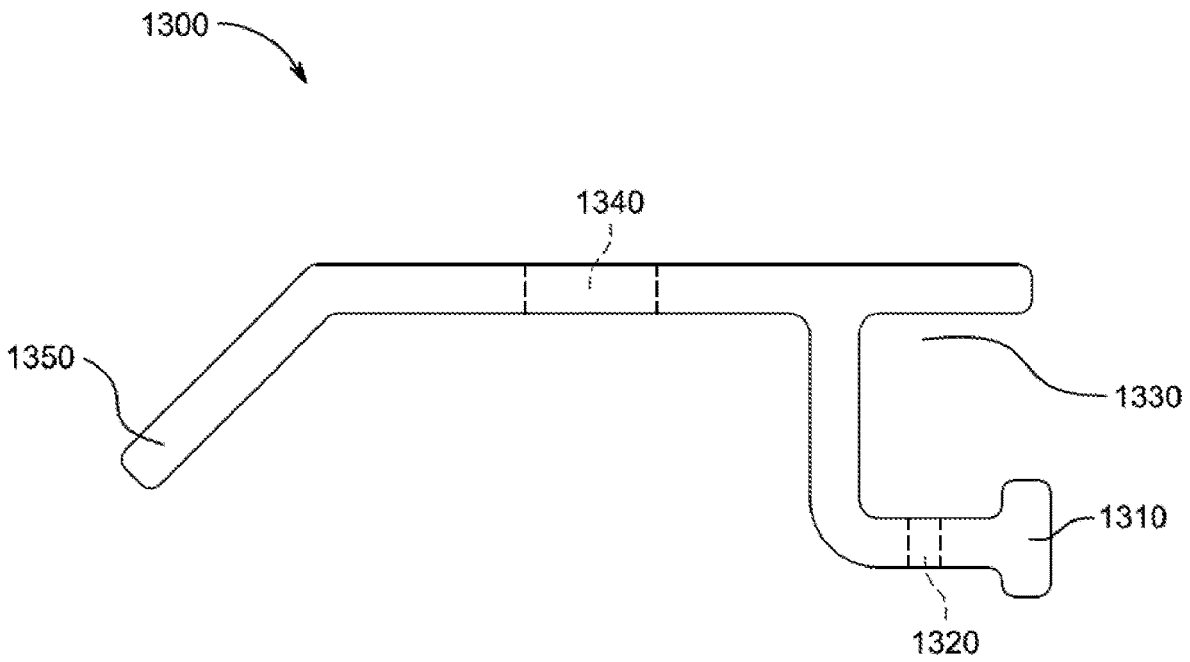
FIG. 65 schematically illustrates a side view of the front receiver of FIG. 64.
Figure 66:
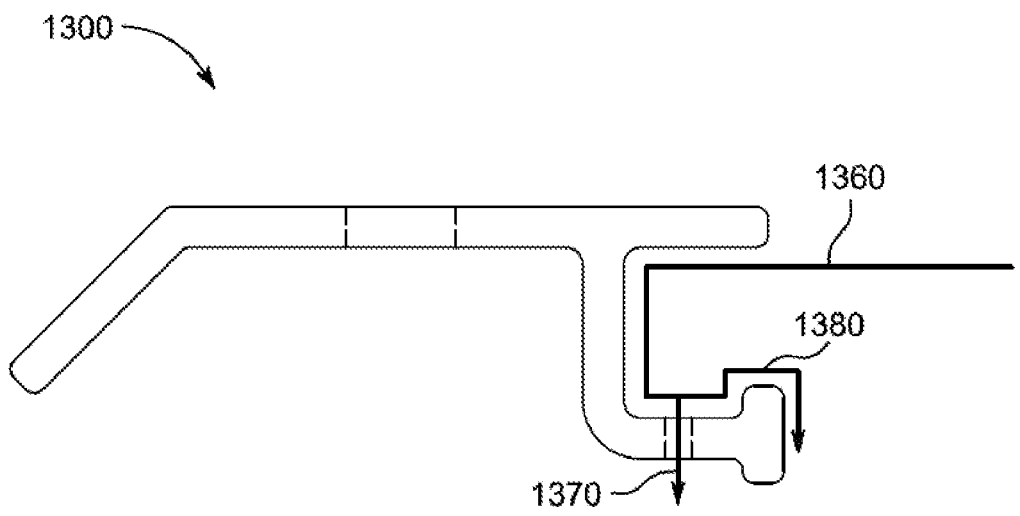
FIG. 66 schematically illustrates a side view of a water flow pattern of the front receiver of FIG. 64.
Figure 67:
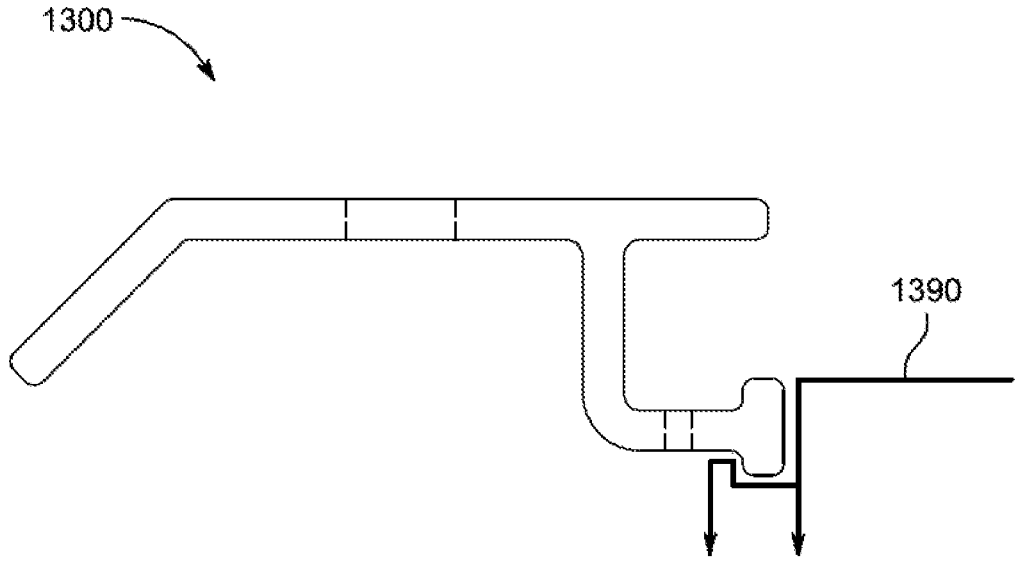
FIG. 67 schematically illustrates a side view of a water flow pattern of the front receiver of FIG. 64.

Generally, the gutter guard system includes additional features that channel rainwater into the rain gutter. For example, FIGS. 64 and 65 illustrate a front receiver 1300. The front receiver 1300 includes a drip edge 1310. The drip edge 1310 includes a vertical surface that engages water running across the top and bottom sides of a main body toward the front receiver 1300. When the water engages the vertical surface of the drip edge 1310, the water wicks downward into the rain gutter. The front receiver 1300 can also include a series of holes 1320 in a bottom surface of a channel 1330 of the front receiver 1300. Water that runs across the top surface of the main body 110 may enter the channel 1330 when the water engages the front receiver 1300. The series of holes 1320 provides a path for water in the channel 1330 to flow into the rain gutter. FIGS. 66 and 67 illustrate the flow of water relative to the drip edge 1310. As illustrated in FIG. 66, water that flows across the top surface of the main body can enter the channel 1330 along flow path 1370. The water can flow into the channel and either flow downward through the series of holes 1320 through flow path 1370 or wick downward along the drip edge 1310 along flow path 1380. As illustrated in FIG. 67, water that flows across the bottom surface of the main body can engage the drip edge 1310 and wick downward along flow path 1390, either wicking directly downward upon engaging the drip edge 1310 or curling around the drip edge and then wicking downward.

The structure of the drip edge 1310 can serve additional purposes in the gutter guard system. For example, as described prior, once a main body is engaged in the channel 1330 of the front receiver 1300, the vertical surface of the drip edge 1310 can function as a stop to capture the main body within the channel 1330. Furthermore, the front receiver 1300 can include a series of slots 1340 along its top surface. The front receiver 1300 can be secured to the rain gutter by fasteners passing through the slots 1340 and into the front lip of the rain gutter. The slots 1340 can be sized such that the head of any fastener used to secure the front receiver 1300 to a rain gutter covers the slot 1340, thus preventing water from passing through the slots 1340. Such management of water can eliminate or reduce occurrences of water running down the face of the rain gutter, which can lead to discoloration known in the industry as "zebra" or "tiger" striping.

It will be understood that the color of the front receiver 1300 can be chosen to match the color of the rain gutter. One method of matching the color of the front receiver 1300 to the color of the rain gutter is to laminate the front receiver 1300 such that it matches the rain gutter. Such laminations can be arranged to withstand the elements. In one example, the lamination is a multilayer laminate that includes a primer layer that adheres to the surface of the front receiver 1300. An acrylic layer containing a color pigment is adhered to the primer layer. A clear acrylic layer is adhered to the pigmented acrylic layer. Finally, a polyvinylidene fluoride (PVDF) layer is adhered to the clear acrylic layer. It will be further understood that in certain embodiments, the front receiver and the rear receiver can be fabricated from two different materials. For example, one receiver can be fabricated from aluminum or other metal, while the other receiver can be fabricated from a polymer.

Figure 68:
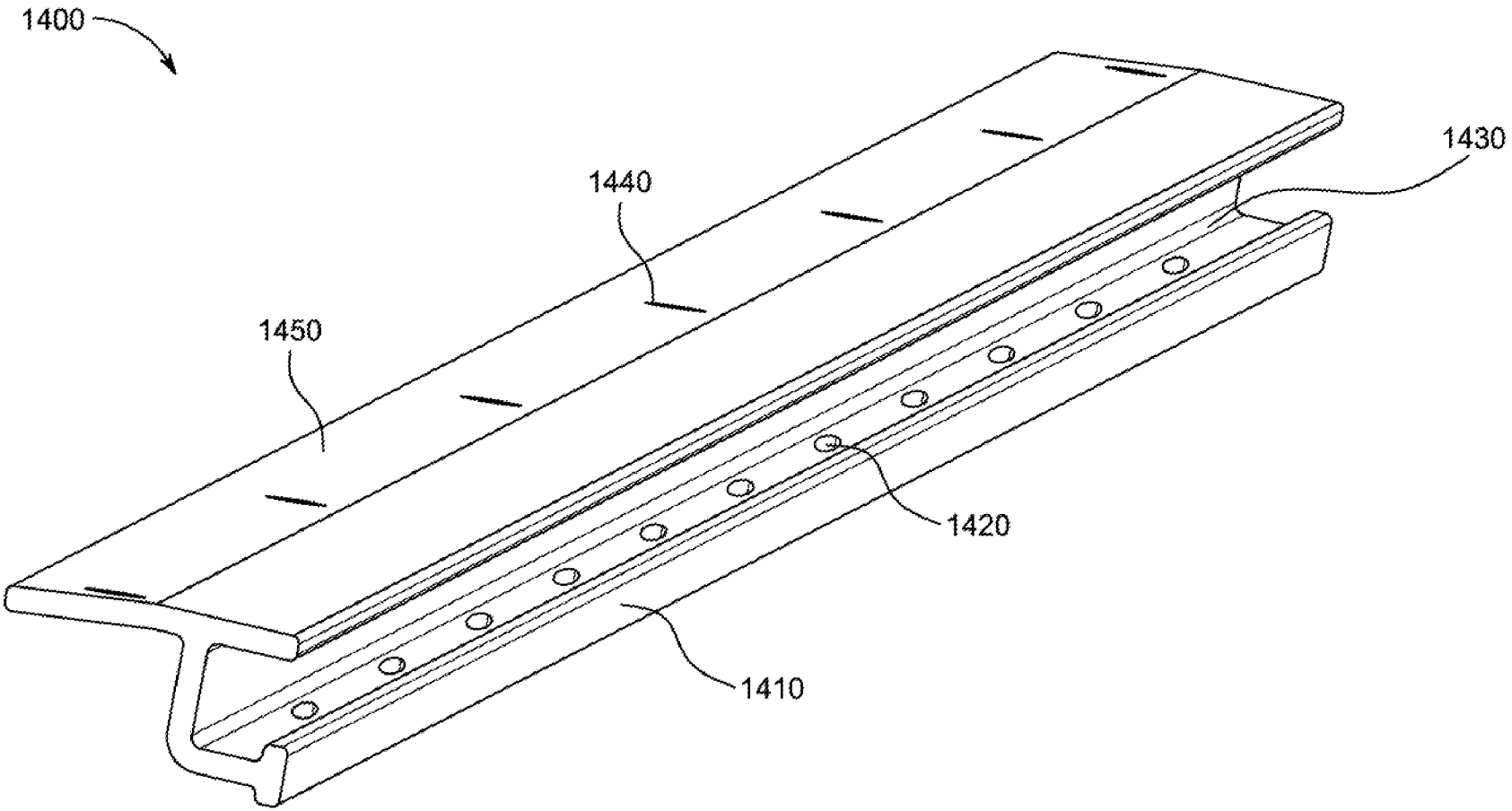
FIG. 68 schematically illustrates another embodiment of a front receiver for use with the gutter guard systems disclosed herein.

In the embodiment of the front receiver 1300 illustrated in FIGS. 64 and 65, once the gutter guard system is installed onto a rain gutter, a front leg 1350 rests on the front lip of the rain gutter and typically extends past the front lip of the rain gutter and, thereby, acts as a drip edge. In other embodiments, the front edge of the front receiver does not extend past the front lip of the rain gutter. One such embodiment of a front receiver 1400 is illustrated in FIG. 68. Similar to the front receiver 1300 illustrated in FIGS. 64 and 65, the front receiver 1400 of FIG. 68 includes a drip edge 1410 and may include a series of holes 1420 in the channel 1430 and a series of slots 1440 to secure the front receiver 1400 to the rain gutter. The front leg 1450 of the front receiver 1400 is shorter than the leg of the front receiver 1300 illustrated in FIGS. 64 and 65. Once the gutter guard system is installed onto a rain gutter, a front leg 1450 rests on top of the front lip of the rain gutter and is designed to terminate just short of the edge of the front lip of the rain gutter. One reason for shortening the front leg 1450 such that it does not extends past the front lip of the rain gutter is that if the color of the front receiver does not match the color of the rain gutter, such a mismatch will not be visible by an observer located at ground level. Such an arrangement can be useful when a structure includes uniquely or custom colored rain gutters. Even if the color of the front receiver 1300 or 1400 cannot be matched to the color of the rain gutter, the front receiver can be offered in a variety of colors and a front receiver can be selected that complements the color of the rain gutter.

FIGS. 69 through 76 illustrate a number of embodiments of rear receivers for use with the gutter guard system to accommodate a variety of rain gutter styles, sizes, rooflines, and structures. Similar to the description of front receivers, rear receivers can be laminated or colored to match the rain gutter or for other aesthetic or functional purposes.

Figure 69:
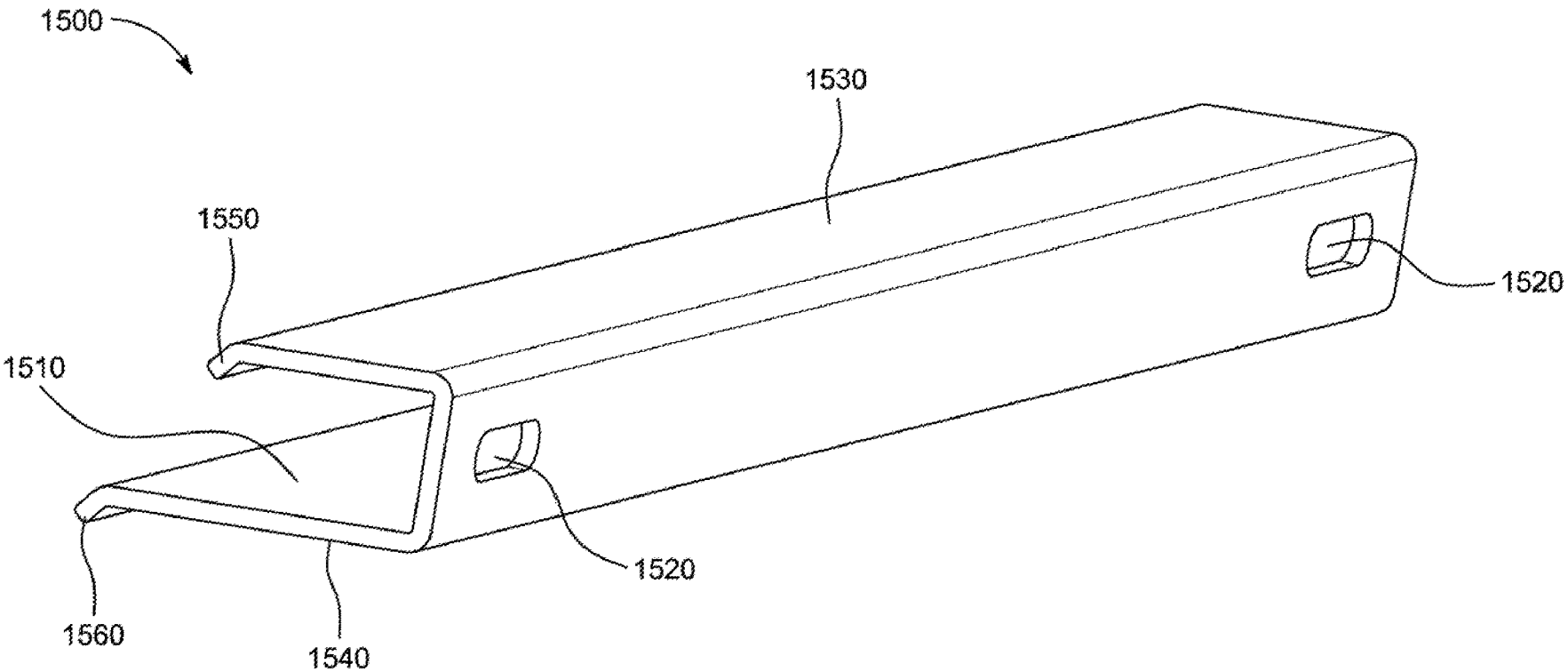
FIG. 69 schematically illustrates an embodiment of a rear receiver for use with the gutter guard systems disclosed herein.

FIG. 69 illustrates an embodiment of a rear receiver 1500. The rear receiver 1500 includes a channel 1510 into which the main body can be positioned. The rear receiver 1500 further includes a series of holes 1520 in a vertical back surface of the rear receiver 1500. In one embodiment, the holes 1520 are oval in shape. An upper member 1530 and a lower member 1540 define the channel 1510. The upper member 1530 include a downwardly angled edge 1550, and the lower member 1540 includes a downward angled edge 1560. Such downwardly angled edges 1550, 1560 can act as drip edges and otherwise facilitate the flow of water from the roof of the structure onto the gutter guard system. Furthermore, such downwardly angled edges 1550, 1560 can provide structural support for the rear receiver 1500 along the length of the rear receiver 1500. The rear receiver 1500 is arranged to either sit on top of the rear lip or hem of a rain gutter or be positioned just above the rear lip or hem of the rain gutter without engaging the rain gutter. Additionally, the rear receiver 1500 may engage the rear lip or hem of the rain gutter. The rear receiver 1500 does not have to be secured to the rain gutter. Instead, the rear receiver 1500 may be secured directly to the structure or roofline by passing fasteners through the series of holes 1520 into the structure or roofline. In some embodiments where the rear receiver 1500 may be positioned within the rain gutter, the fasteners may also pass through a portion of the rain gutter. Although not illustrated in FIG. 69, the rear receiver 1500 can include one or more stops as described with other embodiments herein. As noted above, the rear receiver 1500 illustrated in FIG. 69 can be used with any style or size of rain gutter including custom rain gutters.

Figure 70:
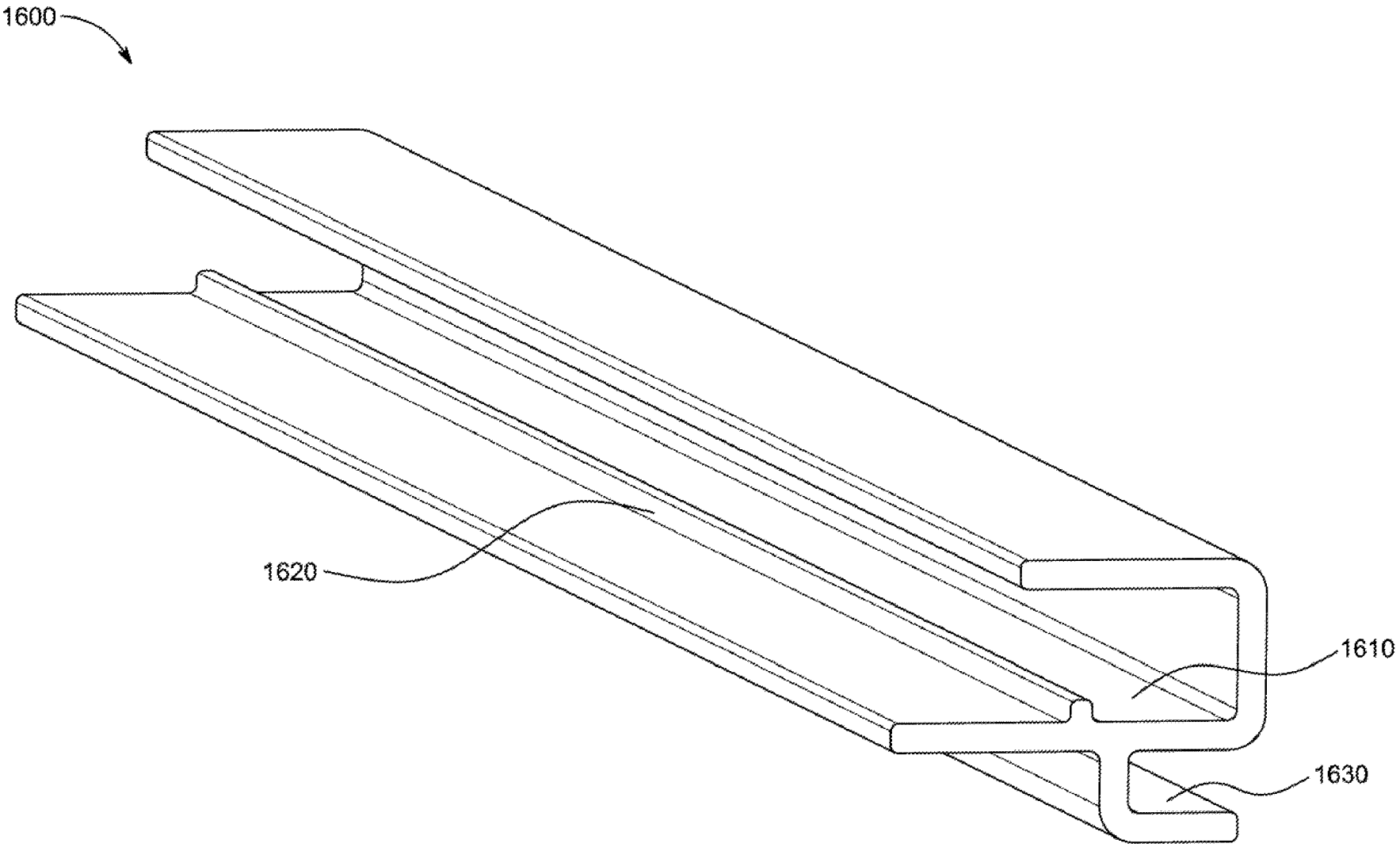
FIG. 70 schematically illustrates another embodiment of a rear receiver for use with the gutter guard systems disclosed herein.
Figure 71:
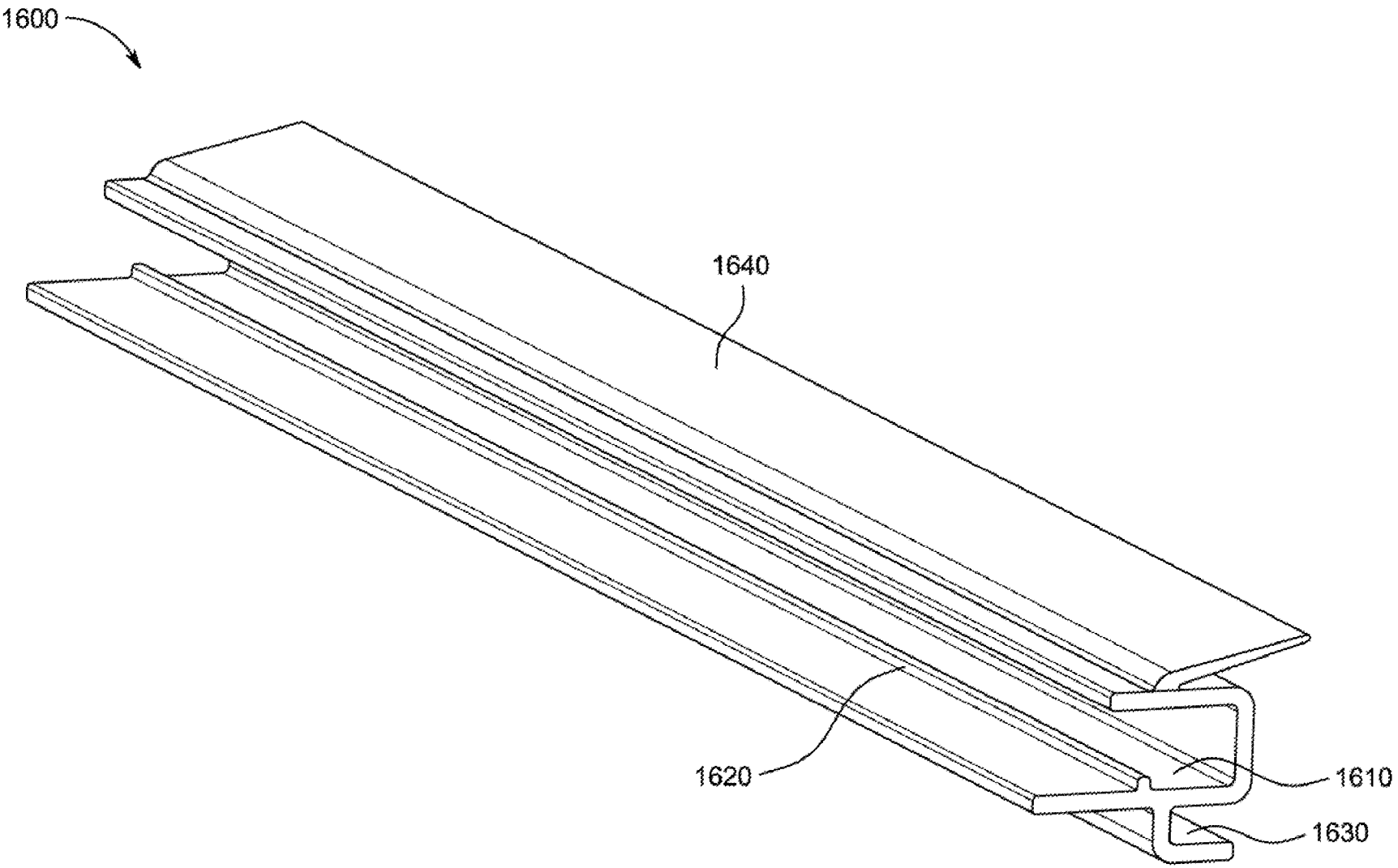
FIG. 71 schematically illustrates another embodiment of a rear receiver for use with the gutter guard systems disclosed herein.
Figure 72:
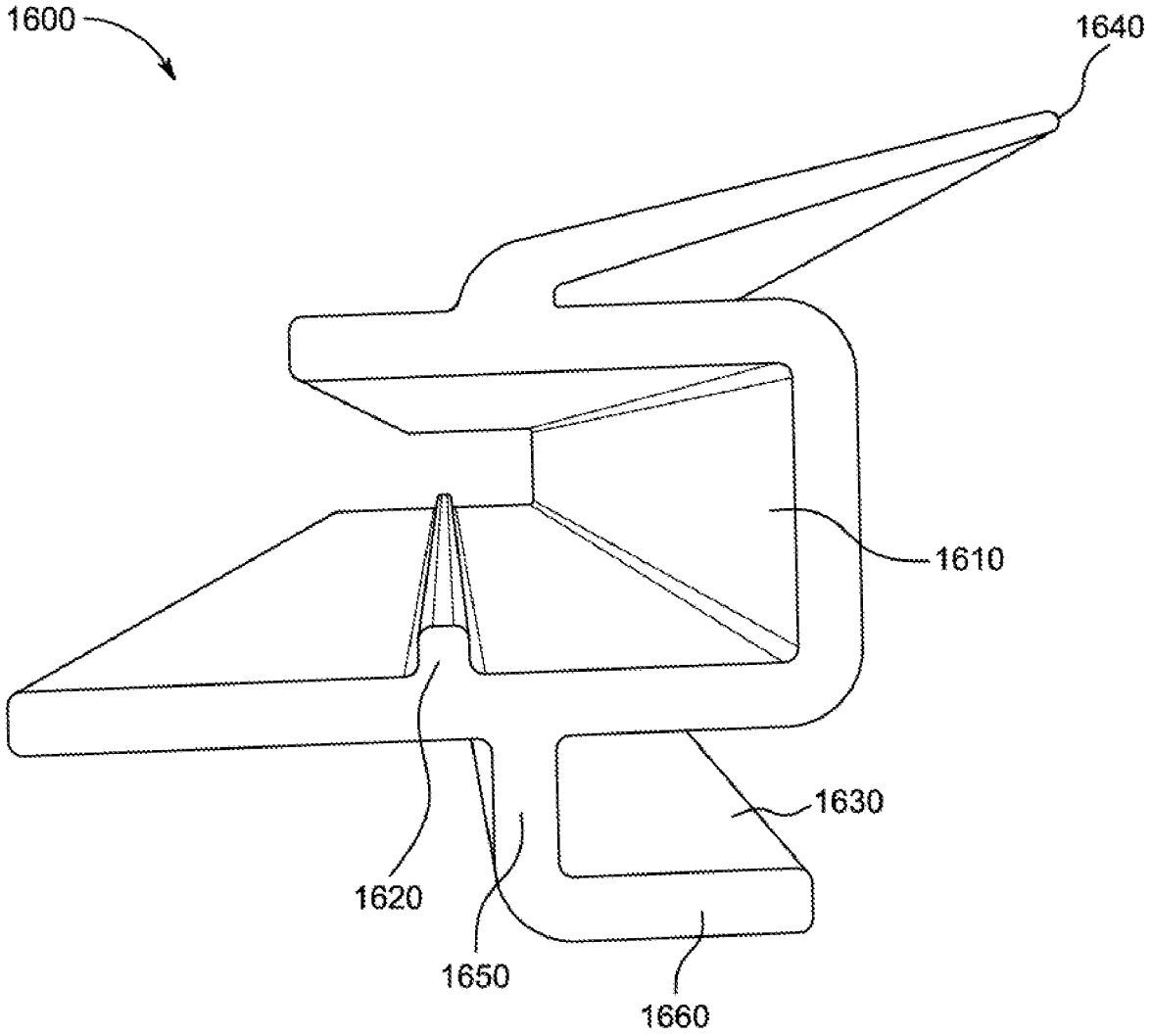
FIG. 72 schematically illustrates a side view of the rear receiver of FIG. 71.
Figure 77:
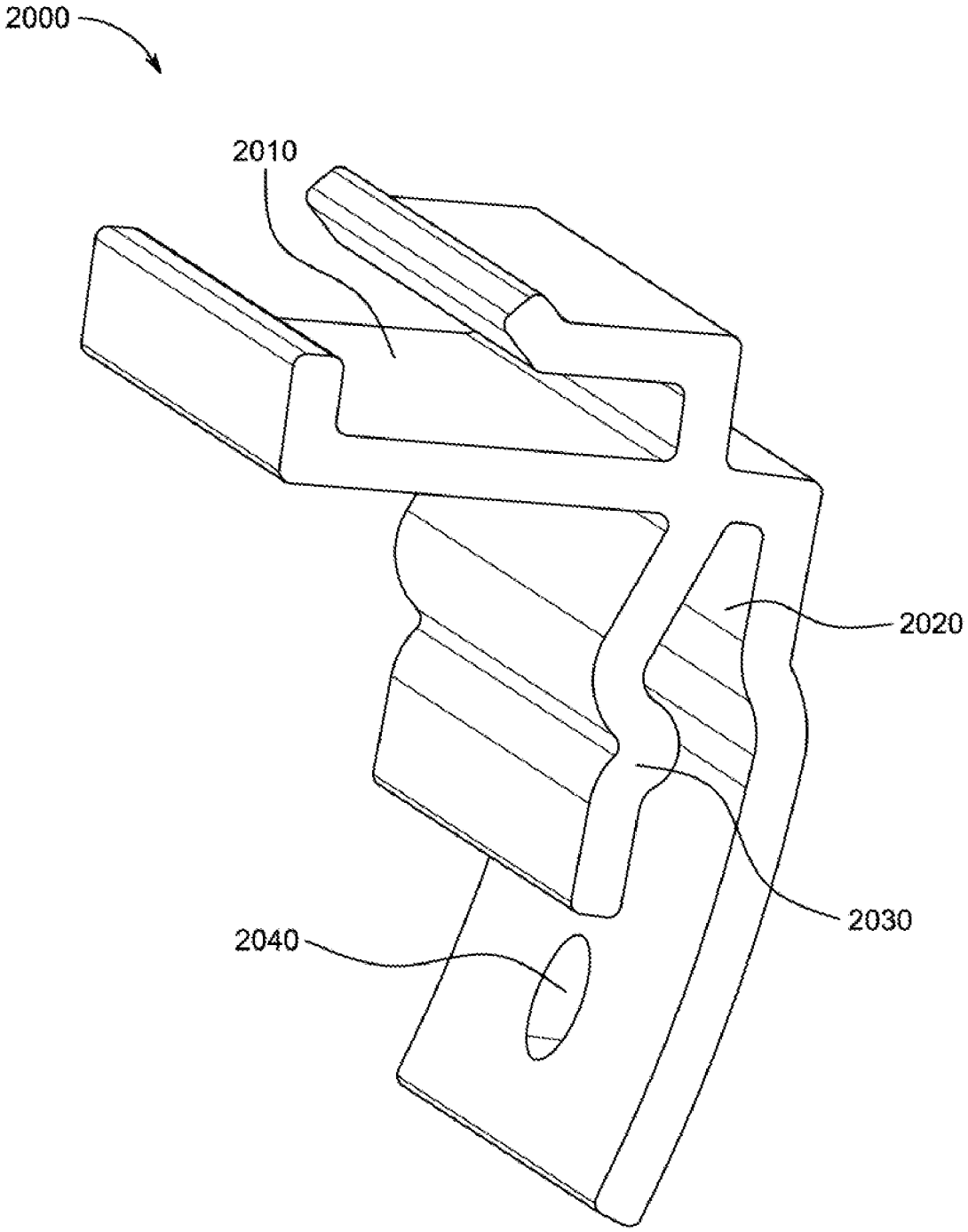
FIG. 77 schematically illustrates a clip for use with a gutter guard system.
Figure 78:
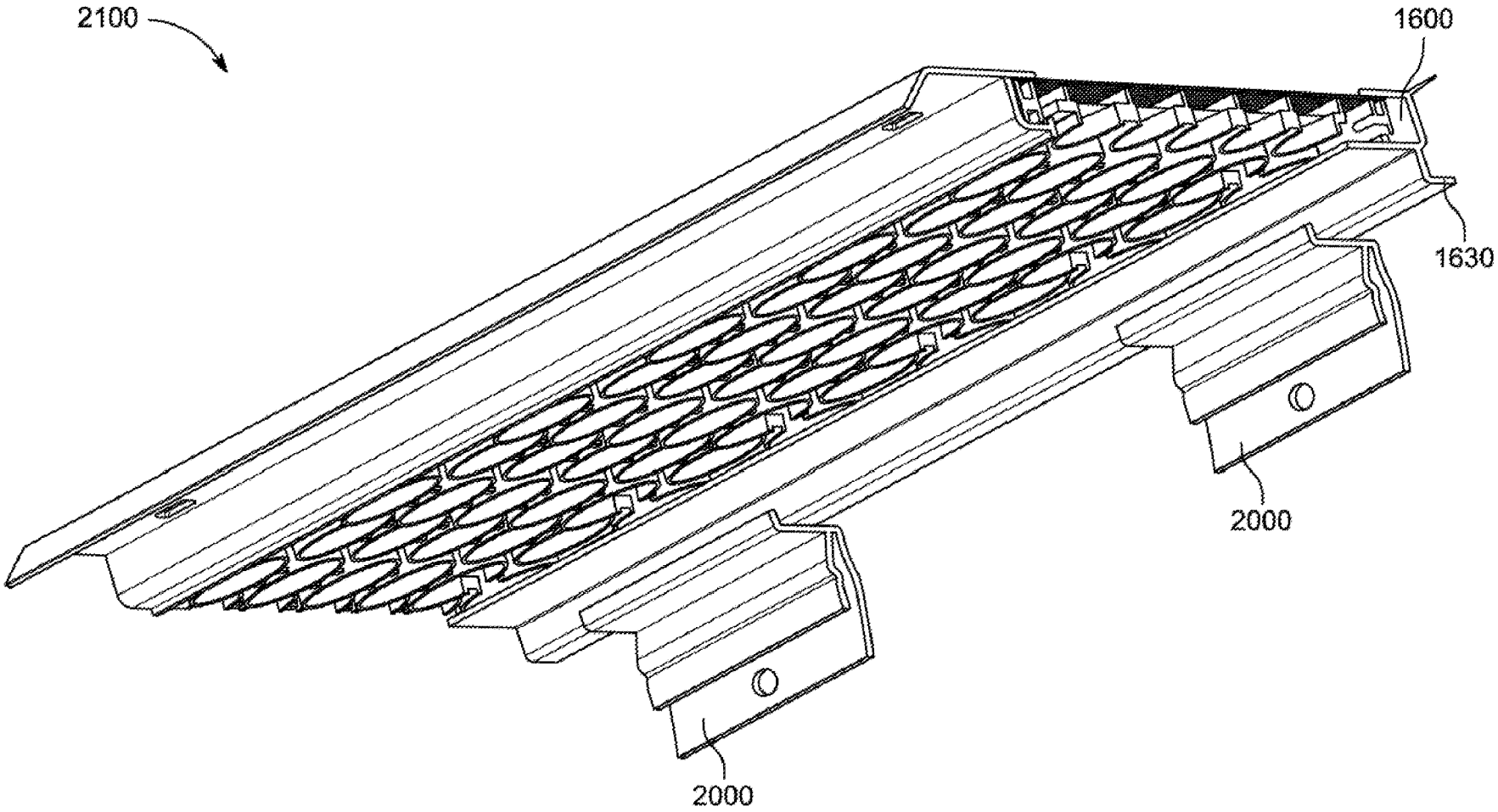
FIG. 78 schematically illustrates a pair of clips from FIG. 77 in a gutter guard system.

FIGS. 70-72 illustrates two variations of another embodiment of a rear receiver 1600. As illustrated in FIG. 70, the rear receiver 1600 includes a first channel 1610 to capture a main body of a gutter guard system. The first channel 1610 includes a stop 1620 to engage with the main body to further secure the main body within the first channel 1610. The stop 1620 of the rear receiver 1600 can be arranged such that there is play in the fit between the main body and rear receiver 1600 such that a degree of lateral movement is allowed between the main body and the rear receiver 1600. Such an arrangement allows for the over all width of a gutter guard system to be adjustable to accommodate rain gutters that are nominally a given width, but may vary in width due to manufacturing tolerances, inconsistencies in raw materials, warping, deformation, and the like. Similar to prior descriptions, the rear receiver 1600 can include more than one stop. The rear receiver 1600 includes a second channel 1630 that can optionally engage either the structure and/or roofline directly or engage the rear lip of the rain gutter to secure the rear receiver 1600 to either the structure and/or the roofline of the rain gutter. Optionally, the back wall of the first channel 1610 can include a series of holes to accommodate fasteners to secure the rear receiver 1600 directly to the structure and/or roofline. As will be subsequently discussed, the rear receiver 1600 can be secured to the rear lip or hem of a rain gutter through the use of a clip or bracket (as illustrated in FIGS. 77 and 78 for example).

As illustrated in FIGS. 71 and 72, an elastomeric strip 1640 can be secured to the top portion of the rear receiver 1600 such that when the gutter guard system is installed, the elastomeric strip 1640 is in contact with the structure or roofline and thereby directs rain water onto the surface of the gutter guard system and prevents the entrapment of debris between the side of the structure and/or roofline and the gutter guard system or rain gutter. The rear receiver 1600 can be used with any style and size rain gutters including custom gutters.

Figure 73:
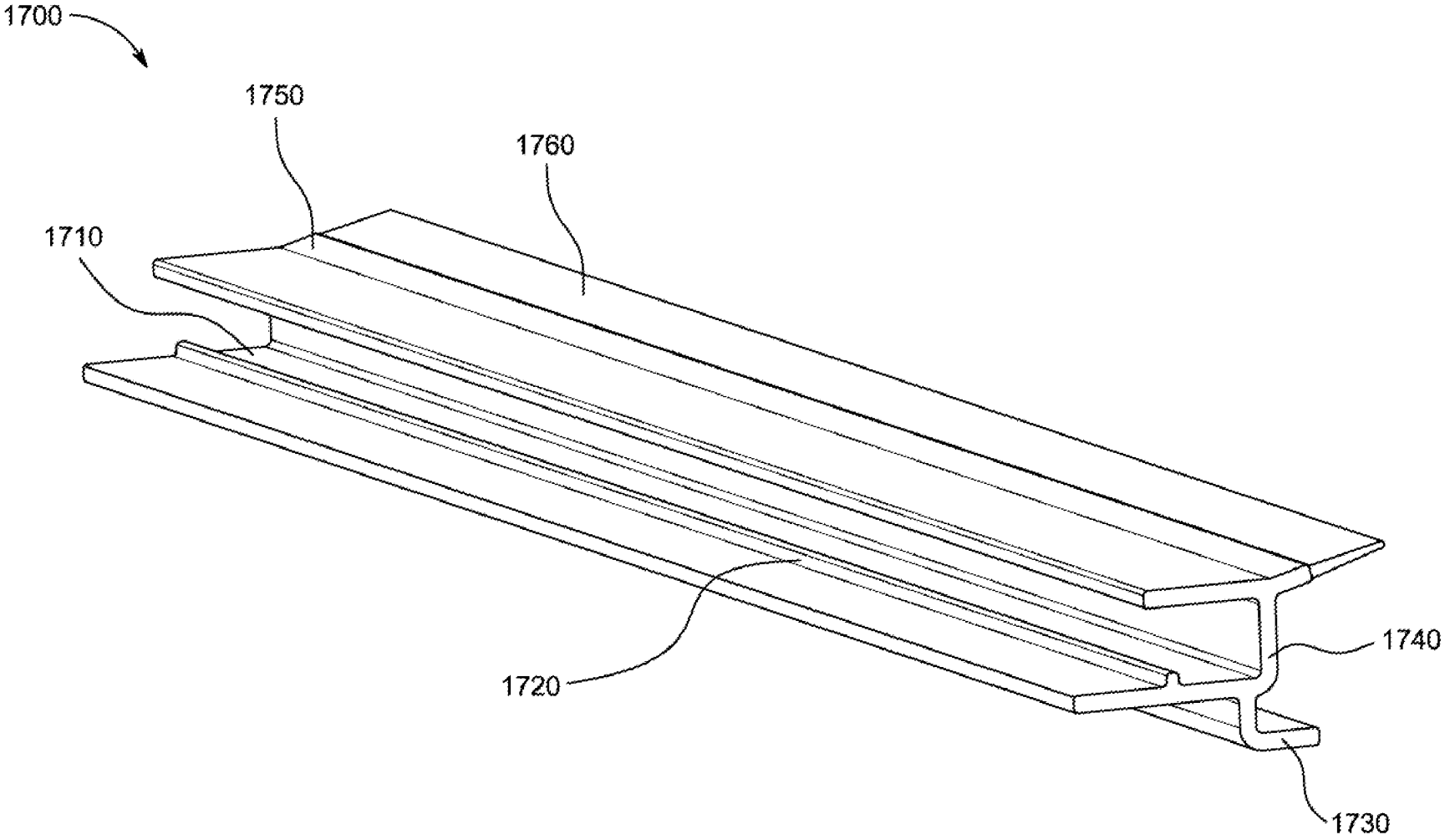
FIG. 73 schematically illustrates another embodiment of a rear receiver for use with the gutter guard systems disclosed herein.
Figure 74:
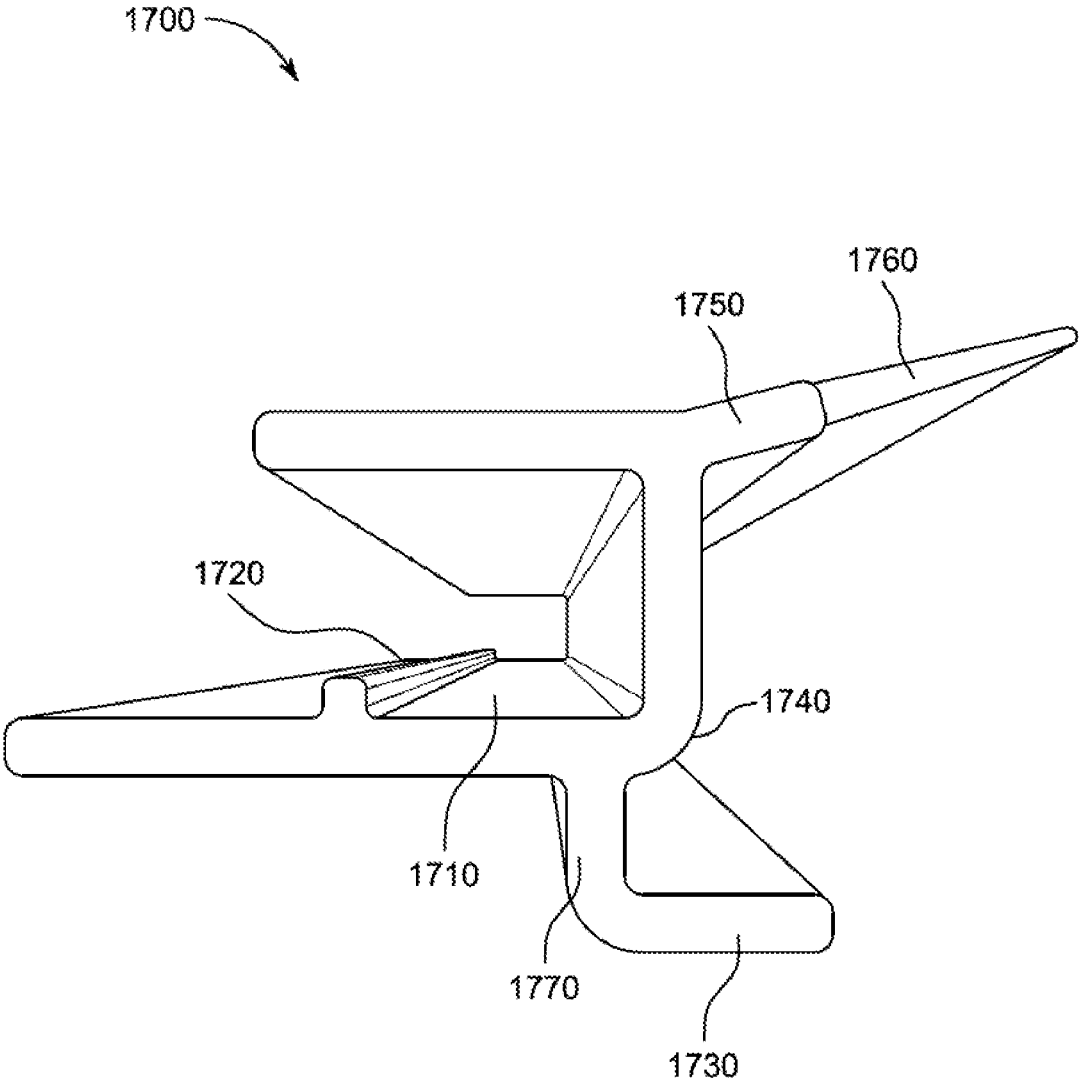
FIG. 74 schematically illustrates a side view of the rear receiver of FIG. 73.

FIGS. 73 and 74 illustrate another embodiment of a rear receiver 1700. Similar to the embodiment of FIGS. 70 through 72, this rear receiver 1700 includes a channel 1710 to capture a main body of a gutter guard system. The channel 1710 includes a stop 1720 to engage with the main body to further secure the main body within the channel 1710. The stop 1720 of the rear receiver 1700 can be arranged such that there is play in the fit between the main body and rear receiver 1700 such that a degree of lateral movement is allowed between the main body and the rear receiver 1700. Such an arrangement allows for the over all width of a gutter guard system to be adjustable to accommodate rain gutters that are nominally a given width, but may vary in width due to manufacturing tolerances, inconsistencies in raw materials, warping, deformation, and the like. The rear receiver 1700 includes a rear ward extending leg 1730 that can engage with the rear lip or hem of the rain gutter or a clip (to be subsequently discussed) that connects the rear receiver 1700 to the rear hem of the rain gutter. The rear ward extending leg 1730 can rest on top of the rear lip or hem of the rain gutter, or the rear lip or hem of the rain gutter can be captured between the rear ward extending leg 1730 and the underside of the extension of the channel 1740. Optionally, the rear ward extending leg 1730 can include a series of holes to accommodate fasteners to secure the rear receiver 1700 to the rear lip of the rain gutter. The rear receiver 1700 further includes an angled extension 1750 extending at an upward angle from the rear receiver 1700. Optionally, an elastomer strip 1760 can be attached to the angled extension 1750. Upon installation, the angled extension 1750 and/or the elastomer strip 1760 can engage the structure and/or roofline. Such an engagement can facilitate rainwater running off the roof of the structure and onto the screen and main body of the gutter guard system and prevent the entrapment of debris between the side of the structure and/or roofline and the gutter guard system or rain gutter. The rear receiver 1700 of FIGS. 73 and 74 can be used with any size or style of half-round rain gutter.

Figure 75:
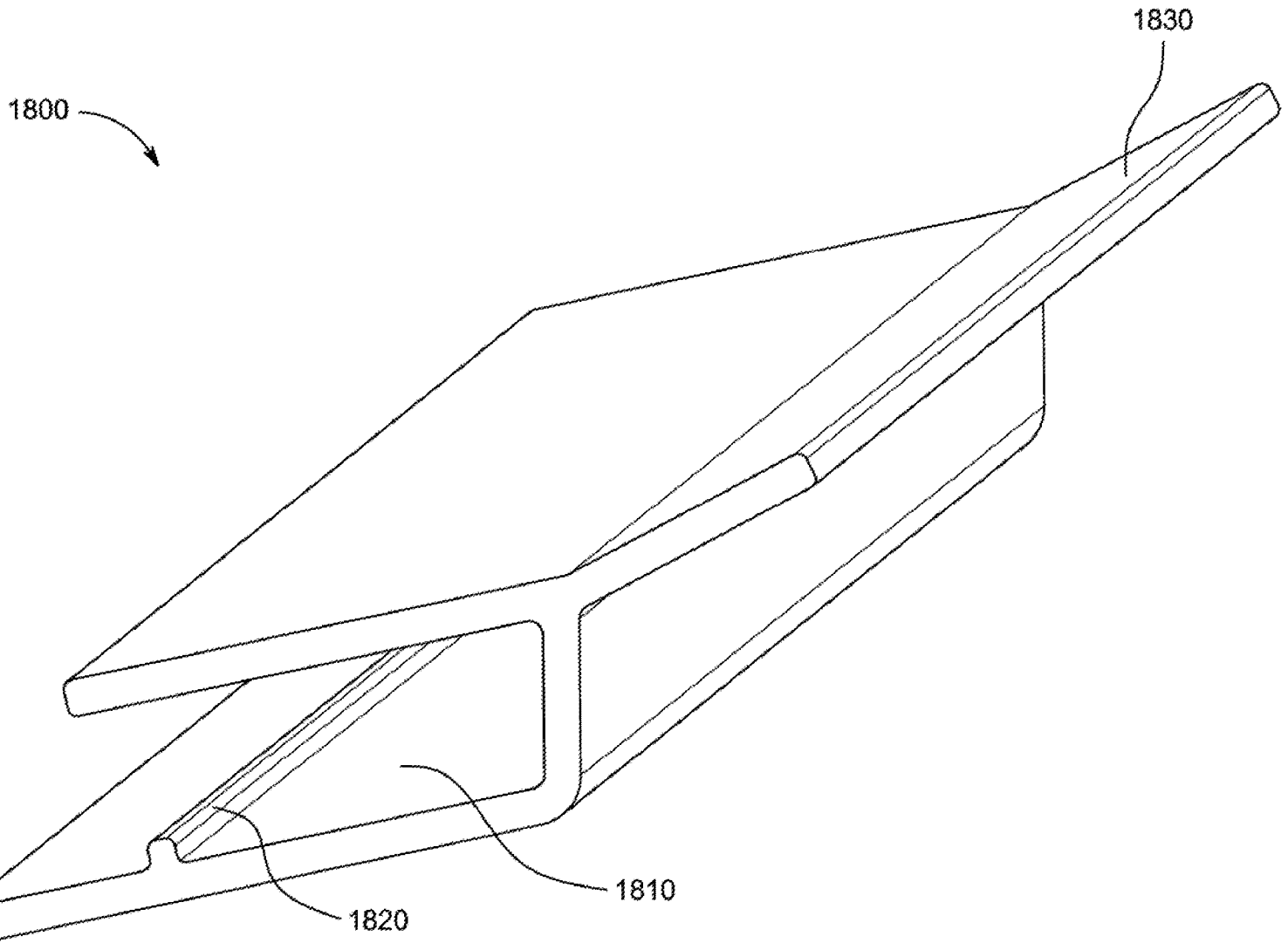
FIG. 75 schematically illustrates another embodiment of a rear receiver for use with the gutter guard systems disclosed herein.

FIG. 75 illustrates another embodiment of a rear receiver 1800. Similar to previously described embodiment, this rear receiver 1800 includes a channel 1810 to capture a main body of a gutter guard system. The channel 1810 includes a stop 1820 to engage with the main body to further secure the main body within the channel 1810. The stop 1820 of the rear receiver 1800 can be arranged such that there is play in the fit between the main body and rear receiver 1800 such that a degree of lateral movement is allowed between the main body and the rear receiver 1800. Such an arrangement allows for the over all width of a gutter guard system to be adjustable to accommodate rain gutters that are nominally a given width, but may vary in width due to manufacturing tolerances, inconsistencies in raw materials, warping, deformation, and the like. The rear receiver 1800 includes an angled extension 1830 that can optionally engage with the rear lip of the rain gutter (such as winged-back rain gutters) and features secured to the structure and/or roofline. The angled extension 1830 can rest on top of the rear lip of the rain gutter, the structure, and/or the roofline. The relatively shallow angle or profile of the angled extension 1830 provides for the rear receiver 1800 accommodating a variety of rear portions of gutters, wingbacks angles, and/or roof angles. Optionally, an elastomer strip can be attached to the angled extension 1830 to form a seal with the stricture and/or roof. The rear receiver 1800 of FIG. 75 can be used with any style and size of rain gutter, including custom rain gutters.

Figure 76:
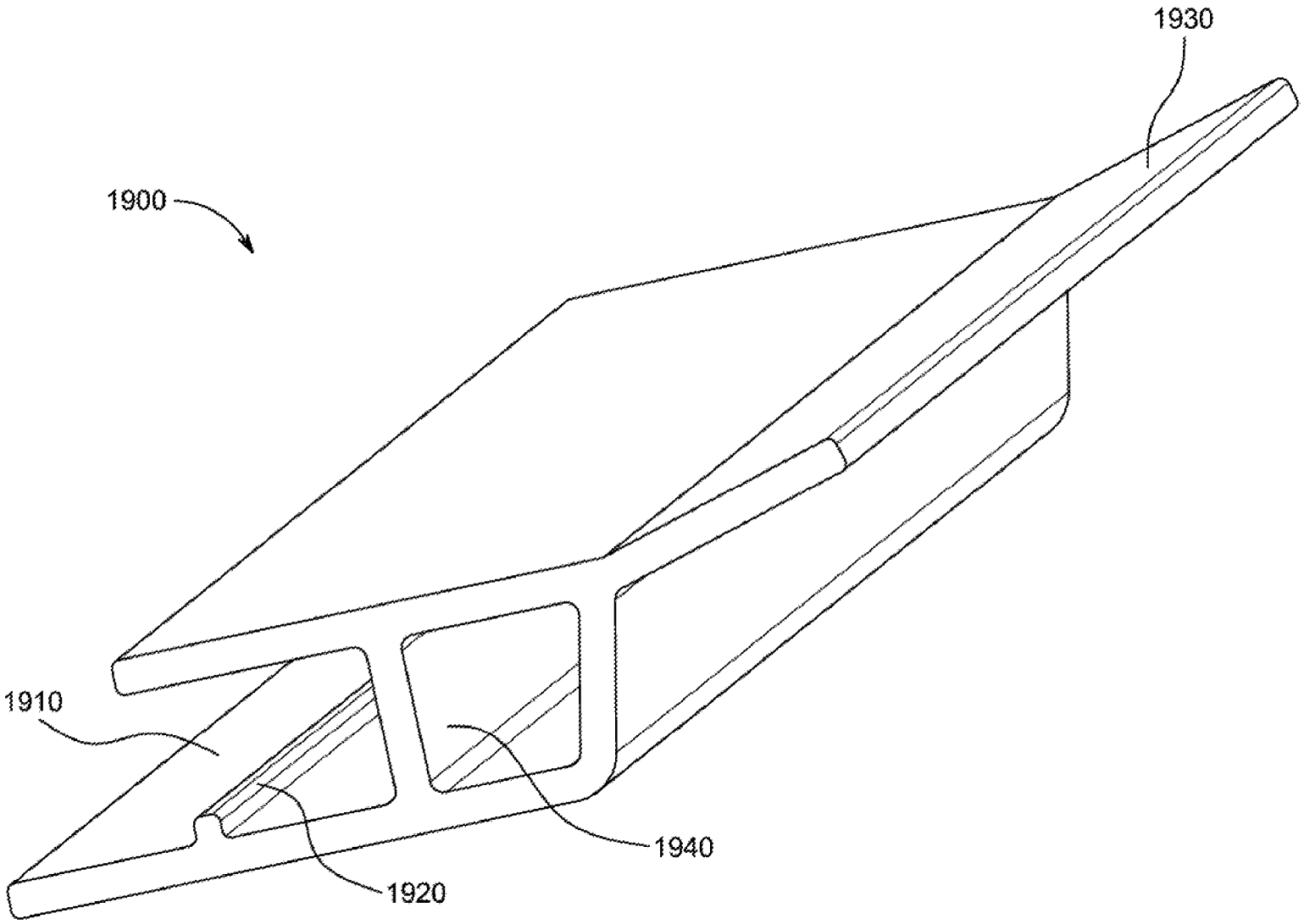
FIG. 76 schematically illustrates yet another embodiment of a rear receiver for use with the gutter guard systems disclosed herein.

FIG. 76 illustrates another embodiment of a rear receiver 1900. Similar to previously described embodiments, this rear receiver 1900 includes a channel 1910 to capture a main body of a gutter guard system. The channel 1900 includes a stop 1920 to engage with the main body to further secure the main body within the channel 1910. The stop 1920 of the rear receiver 1900 can be arranged such that there is play in the fit between the main body and rear receiver 1900 such that a degree of lateral movement is allowed between the main body and the rear receiver 1900. Such an arrangement allows for the over all width of a gutter guard system to be adjustable to accommodate rain gutters that are nominally a given width, but may vary in width due to manufacturing tolerances, inconsistencies in raw materials, warping, deformation, and the like. The rear receiver 1900 includes an angled extension 1930 similar to the rear receiver 1800 of FIG. 75 that can optionally engage with the rear lip of the rain gutter (such as winged-back rain gutters) and features secured to the structure and/or roofline. The angled extension 1930 can rest on top of the rear lip of the rain gutter, structure, and/or roofline. The relatively shallow angle or profile of the angled extension 1930 provides for the rear receiver 1900 accommodating a variety of rear portions of gutters, wingbacks angles, and/or roof angles. Optionally, an elastomer strip can be attached to the angled extension 1930 to form a seal with the structure and/or roofline. The rear receiver 1900 of FIG. 76 can be used with any style and size of rain gutter including custom gutters.

The rear receivers disclosed herein are arranged such that the main body can be assembled with the rear receiver through a variety of methods. For example, the rear receiver can be slid onto the main body as previously described. Additionally, the main body can be maneuvered into the channel of the rear receivers from the front of the channel of a rear receiver. The main body can be tilted at an angle so that the rear edge (described as the second edge herein) of the main body can be inserted into the channel and then the main body is rotated into a horizontal position to complete the insertion of the main body into the channel. As will be understood, such a method can allow the extended leg of the main body to be positioned behind a stop of the rear receiver so that when the main body is rotated back to a horizontal position, the main body becomes secured within the rear receiver. The dimensions of the main body and rear receiver are designed with enough tolerance or play to facilitate such an assembly method. Such assembly methods are useful when the rear receiver is first secured to the rain gutter, structure, and/or roofline.

As discussed herein, front receivers and rear receivers can be reversibly secured to a main body. This is to say that a main body, front receiver, and rear received can be assembled to form a gutter guard system with structural integrity. However, once assembled, the front and/or rear receiver can be selectively disassembled from the main body so that, for example, another more appropriate front and/or rear receiver can be assembled with the main body. Such an arrangement facilitates installation of the gutter guard system in that an installer can assemble a gutter guard system, check for the applicability of the arrangement to a particular rain gutter and/or structure and then make adjustments if necessary to facilitate the best fit for the gutter guard system to the rain gutter and structure. It will be appreciated that with such interchangeability, it is best to create front and rear receivers that can only be secured to the main body in one appropriate configuration. This is to say that each front receiver is designed so that it can only be secured to the front edge of the main body and not the rear edge of the main body and only in the correct orientation (i.e., it cannot be assembled "upside down"). Similarly, each rear receiver is designed so that it can only be secured to the rear edge of the main body and not the front edge of the main body and only in the correct orientation (i.e., it cannot be assembled "upside down"). To accomplish such arrangements, a number of features can be designed into the front and rear receivers, particularly the channels of the front and rear receivers that accommodate the main body. For example, the over all interior shape of the channel of a front or rear receiver can be shaped to match the shape of the front or rear edge of the main body as appropriate. Stops and other mechanical features can also be included in front and rear receivers to inhibit the incorrect assembly of gutter guard system.

Figure 79:
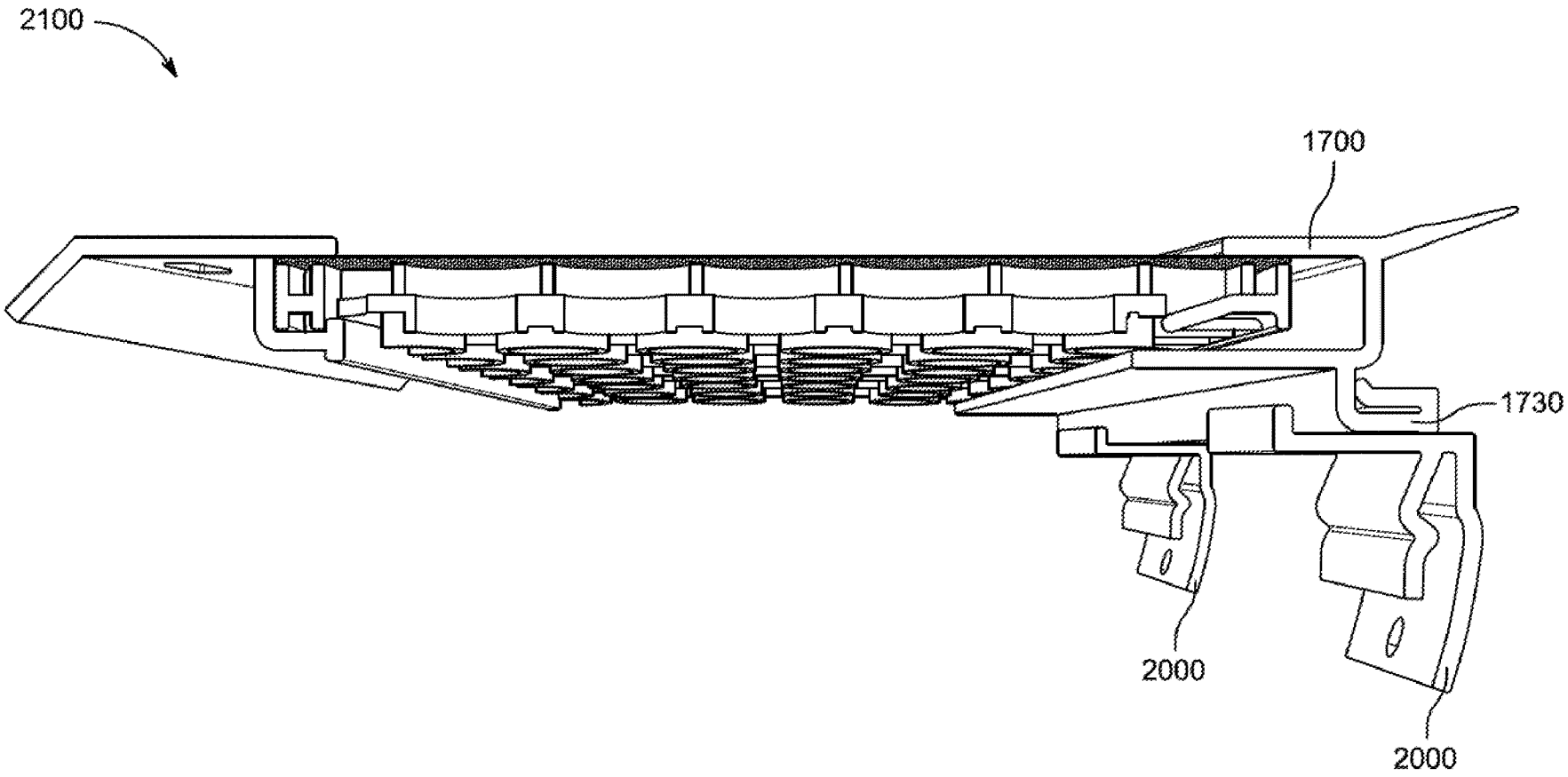
FIG. 79 schematically illustrates another view of a pair of clips from FIG. 77 in a gutter guard system.

In various embodiments of gutter guard systems, clips or brackets can be used to secure or hold the gutter guard in position by one end of the clip or bracket capturing a rear portion of the rear receiver and the other end of the clip or bracket capturing the rear lip or hem of the rain gutter with or without a fastener. For example, FIG. 77 illustrates a clip 2000 that is arranged to attach to a rear receiver and the rear lip or hem of a rain gutter. FIGS. 78 and 79 illustrate a pair of clips 2000 secured to a rear receiver 1700 illustrated in FIG. 73 as part of a gutter guard system 2100. Although embodiments are illustrated and described as utilizing a pair of clips, it will be understood that additional clips can be used depending on the specific installation of a gutter guard system, For example, in one embodiment, three clips can be used to support a five foot section of a gutter guard system.

Figure 80A:
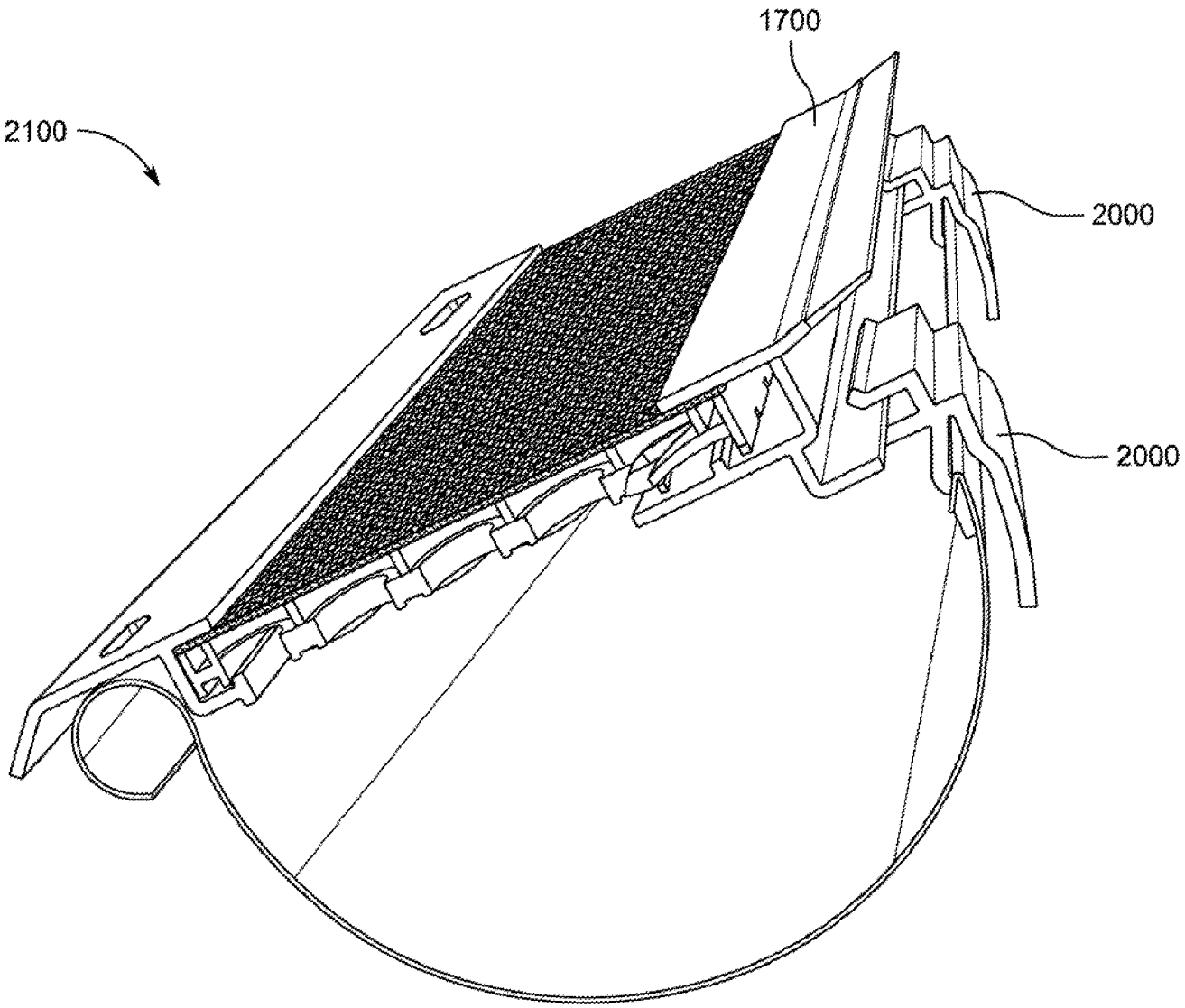
FIG. 80A schematically illustrates the gutter guard system of FIG. 79 with clips.
Figure 80B:
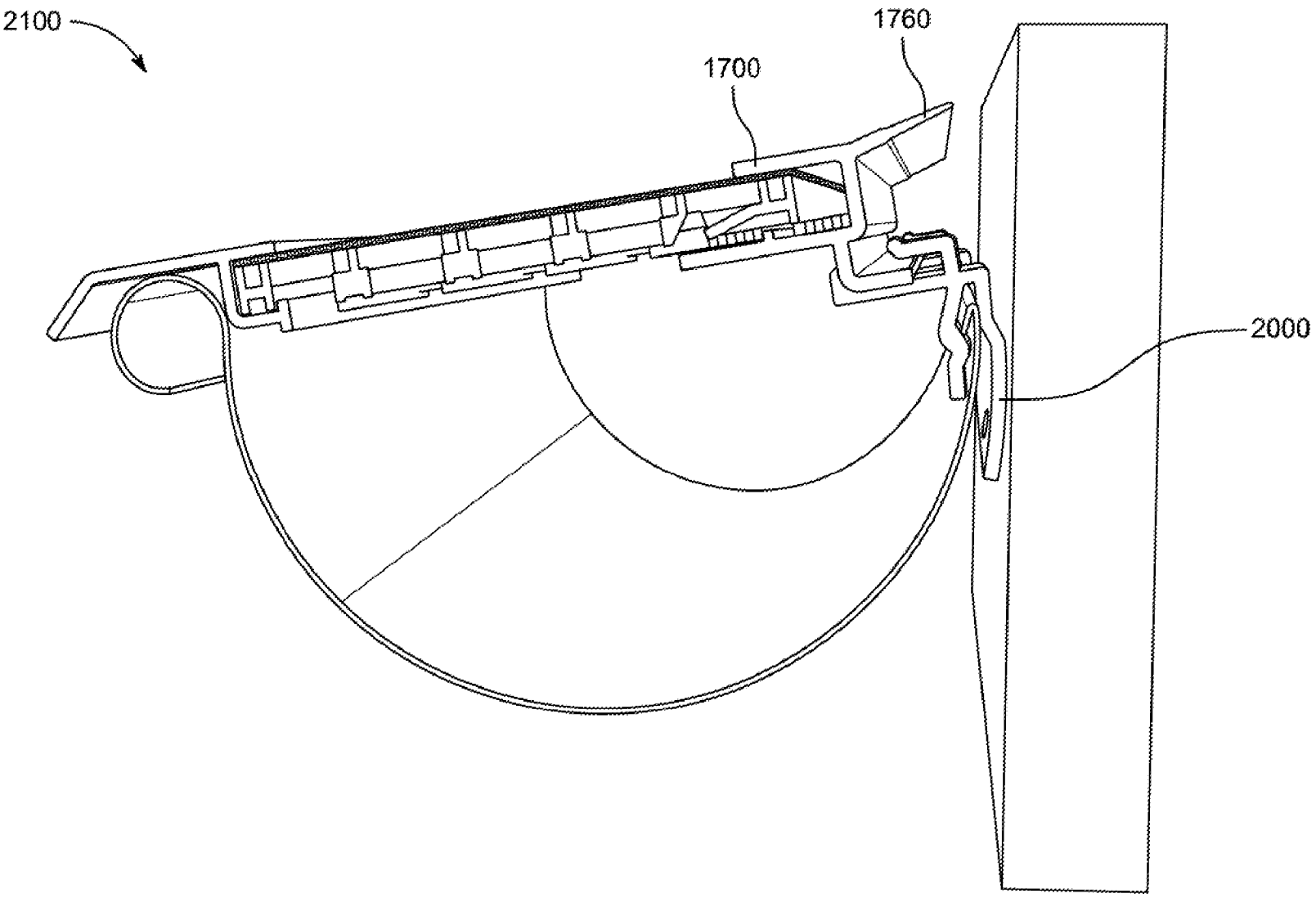
FIG. 80B schematically illustrates the gutter guard system of FIG. 79 installed on a half-round rain gutter with clips.

The clip 2000 includes a first slot 2010 arranged to capture the first extension 1730 of the rear receiver 1700. The clip 2000 further includes a second slot 2020 arranged to capture a rear lip or hem of a rain gutter. The second slot 2020 is designed to accept different thicknesses and heights of lips and hems of gutters such as half-round gutters (illustrated in FIG. 80A). The thickness and height of the lip or hem of a gutter depends on the particular design and manufacturing process of the gutter. For example, thickness and height can depend on whether the lip or hem has been formed by a rolling or pressing process. The second slot 2020 further includes a nub 2030 arranged to engage the rear lip of a rain gutter to further secure the clip 2000 to the rear lip of the rain gutter. Additionally, the clip 2000 is arranged to accommodate a variety of mechanisms used to secure the rain gutter to the structure and/or roofline. For example, when a sickle and shank mechanism (illustrated as 74 in FIG. 4E) is used as compared to other attachment mechanisms, the rain gutter can be positioned a distance from the structure (as illustrated in FIG. 80B). This can make it challenging to secure the gutter guard system to the rain gutter, the structure and/or roofline. However, the design of the clip 2000 can achieve attachment of the gutter guard system to the rain gutter (also as illustrated in FIG. 80B). Optionally, the clip 2000 can be secured to the rain gutter or directly to the structure and/or roofline by passing a fastener through an aperture 2040 in the clip 2000. As illustrated in FIG. 80A, such a clip 2000 can be used with a half-round rain gutter. It will be understood that such an arrangement can be used with any style and size of rain gutters including customized rain gutters.

Figure 83:
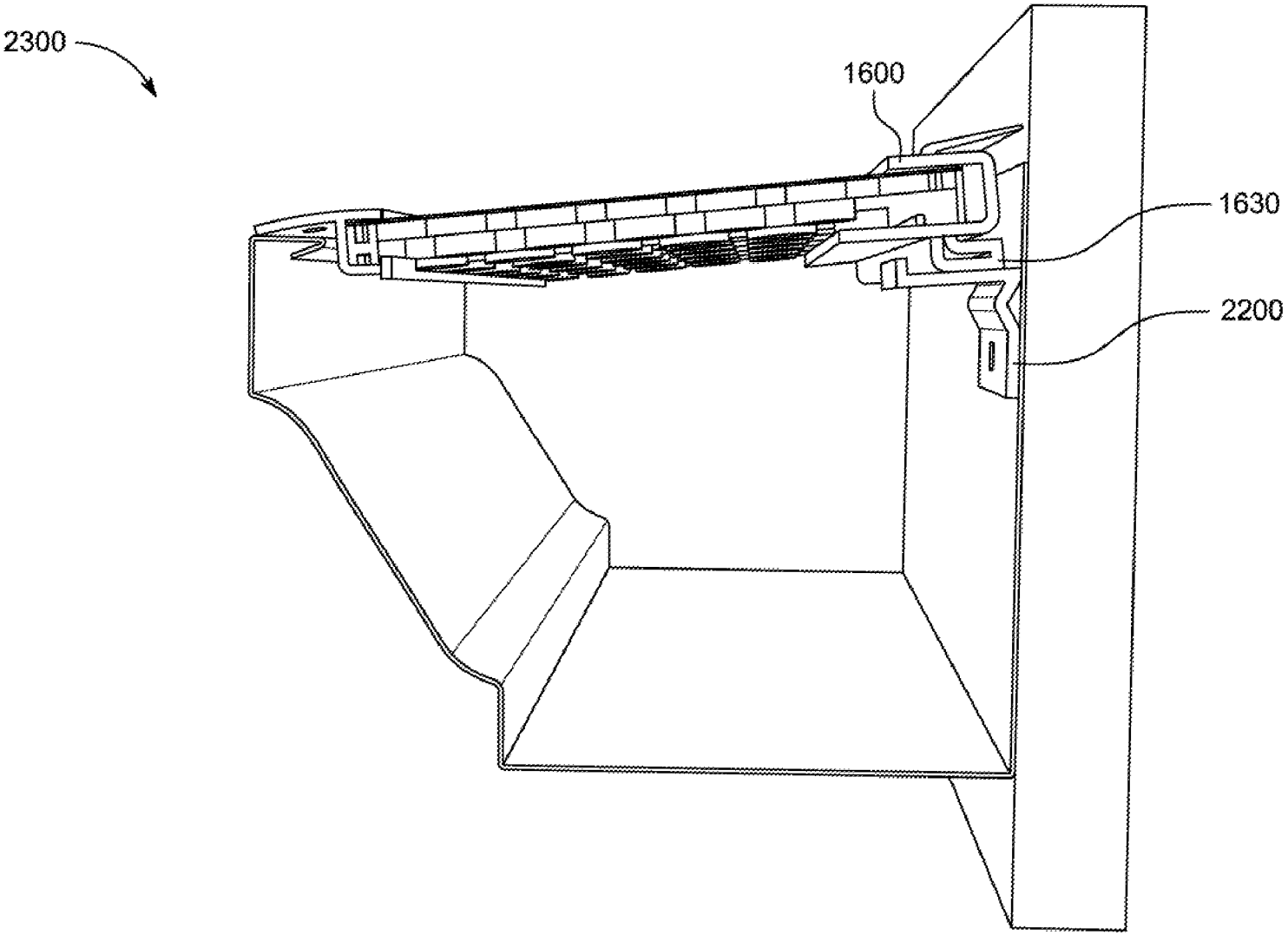
FIG. 83 schematically illustrates a clip of FIG. 81 in a gutter guard system installed in a K-style rain gutter.

As further illustrated in FIG. 80B, a gap remains between elastomer strip 1760 and the structure. In other embodiments, such as in FIG. 83, an elastomer strip is in contact with the structure. In either embodiment, the elastomer strip promotes a smooth transition of water flowing from the roof onto the gutter guard system. The elastomer strip as arranged in FIG. 80B is typically used when the edge of the roofline extends past the structure and over the rear receiver of the gutter guard system. In such an embodiment, the gap between the elastomer strip and the structure promotes airflow around the gutter and gutter guard system. Such airflow can create currents that blow loose debris off of the screen of the gutter guard system. The elastomer strip as arranged in FIG. 83 is typically used when the edge of the roofline does not extend past the edge of the structure or does not substantially extend beyond the edge of the structure. Placing the elastomer strip in contact with the structure, promotes a smooth transition of water flowing from the roof onto the gutter guard system. In both the arrangements illustrated in FIGS. 80B and 83, the elastomer strip limits or prevents debris from falling behind the elastomer strip and into the interface between the clip and/or bracket and structure or gutter and structure. It will be understood that the elastomer strip can be extended or shortened to accommodate structures and/or rooflines based on regional architectural preferences for structures and/or rooflines and local trade practices.

Figure 81:
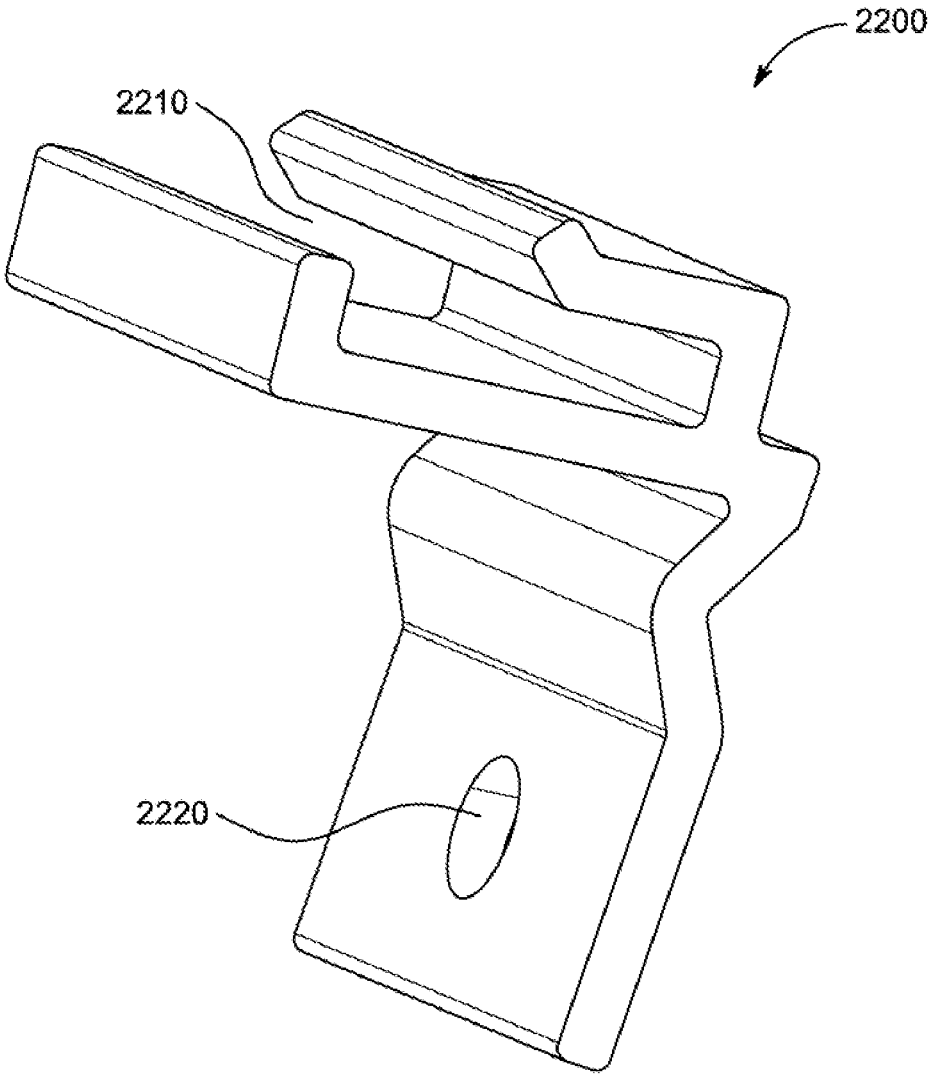
FIG. 81 schematically illustrates a bracket for use with a gutter guard system.
Figure 82:
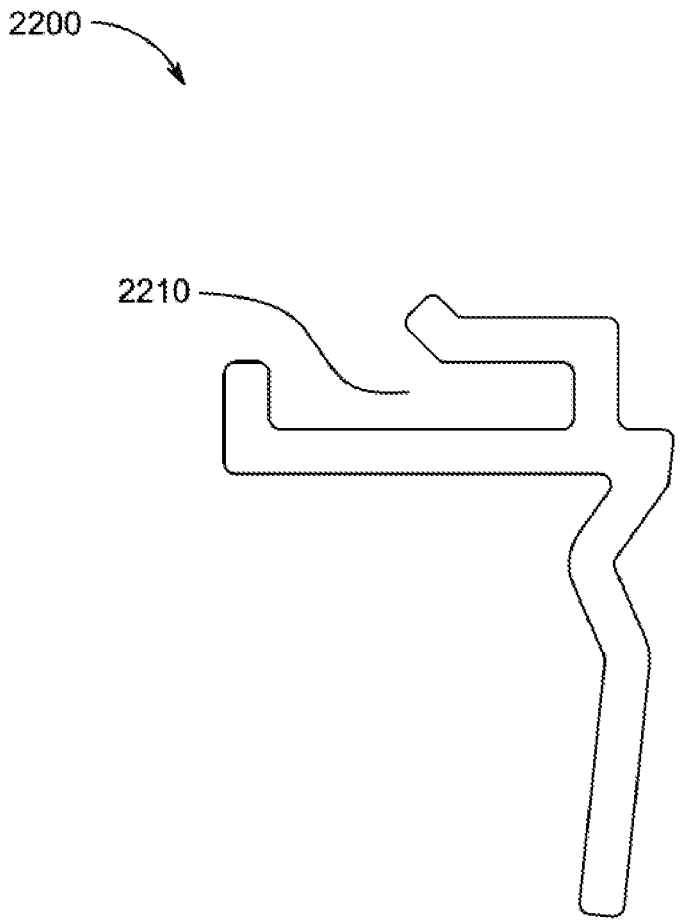
FIG. 82 schematically illustrates a side view of the bracket of FIG. 81.

For example, FIGS. 81 and 82 illustrates a bracket 2200 for attachment to a rear receiver and securing a gutter guard system to a rain gutter, structure, and/or roofline. FIG. 83 illustrates the clip 2200 secured to a rear receiver 1600 illustrated in FIGS. 71 and 72 as part of a gutter guard system 2300. The bracket 2200 includes a first slot 2210 arranged to capture the second channel 1630 of the rear receiver 1600. The bracket 2200 further includes an aperture 2220 for securing to a rain gutter, structure, and/or roofline.

As illustrated in FIG. 83, such a bracket 2200 can be used with a K-style rain gutter. Such brackets 2200 can also be used with any style and size of rain gutters including custom rain gutters.

In comparing FIGS. 80B and 83, and the rear receivers (900 and 1700) used therein, it will be appreciated that the arrangement of certain features of rear receivers can facilitate assembly and installation of a gutter guard system. For example, the rear receiver 1600 includes a downwardly extending leg 1650 (as illustrated in FIG. 72), and the rear receiver 1700 includes a similar downward extending leg 1770 (as illustrated in FIG. 74). As will be appreciated by comparing the two downwardly extending legs 1650 and 1770, the lateral position of the extending leg determines a pivot point for a rear receiver. The pivot point for rear receiver 1600 is near the lateral midpoint of the rear receiver 1600. The pivot point for rear receiver 1700 is near the rear portion of the rear receiver 1700. Furthermore, rear receiver 1600 includes a rear ward extending leg 1660 (as illustrated in FIG. 72), and rear receiver 1700 includes a similar rear ward extending leg 1730 (as illustrated in FIG. 74). As will be appreciated by comparing the two rear ward extending leg 1660 and 1730, the rear ward extending leg 1660 of rear receiver 1600 extend to near the rear most portion of the rear receiver 1600. The rear ward extending leg 1730 of rear receiver 1700 extend substantially further toward the rear most portion of rear receiver 1700 as compared to the rear ward extending leg 1660 of rear receiver 1600. By selectively designing rear receivers with regard to the placement of features such as the pivot point and the rear ward extending leg, the rear receiver can be arranged to facilitate more efficient assembly with a specific clip or bracket or make it more efficient for the rear receiver to engage with a rain gutter, structure, and/or roofline. For example, specific design choices for the features for a rear receiver can make it easier for the rear receiver to engage with a clip or bracket, whether the engagement is accomplished by inserting the rear receiver from a vertical direction or a horizontal direction.

The arrangement of clips and brackets are such that the first channels of clips and brackets and second channel of the clips and brackets include an appropriate amount of play such that the clip or bracket do not have to be perfectly installed in order to capture the rear receiver or the rear lip or hem of the gutter. This is to say that the clips and brackets can be misaligned or askew relative to each other and/or the gutter, and the rear receiver and/or rear lip or hem of the gutter can still be inserted into the first channel and/or second channel. Such an arrangement facilitates efficient and effective installation of a gutter guard system. It will be appreciated that gutters are often installed such that there are elevation changes and other misalignments along the length of a gutter. The arrangement of the clips and brackets as described herein address such issues with installed gutters. As will be appreciated, providing an installer with flexibility in installing a gutter guard onto a gutter that is elevated off the ground and runs the length of a structure can be important to the quality of the installation of the gutter guard systems.

It will be understood that when installing a gutter guard system on a structure, multiple main bodies, screens, front and rear receivers, clips and/or brackets may be required to install the gutter guard system along the entire roofline of the structure. As will be understood, the main bodies, screens, front receivers, and rear receivers are manufactured in certain discrete lengths to provide for convenient and efficient shipping, storage, and installation. For example, such components can be manufactured in five foot lengths. It will be understood that such components can be manufactured in other lengths longer or shorter than five feet. However, it may be impractical to manufacture such components in the lengths that allow for a single component to span the entire length of a roofline of one side of a structure, where the length of a straight section of roofline for a residential home can be sixty feet in length or longer. Therefore, sever al of each gutter guard system component is required to accommodate the installation of a gutter guard system on most structures.

Figure 84:
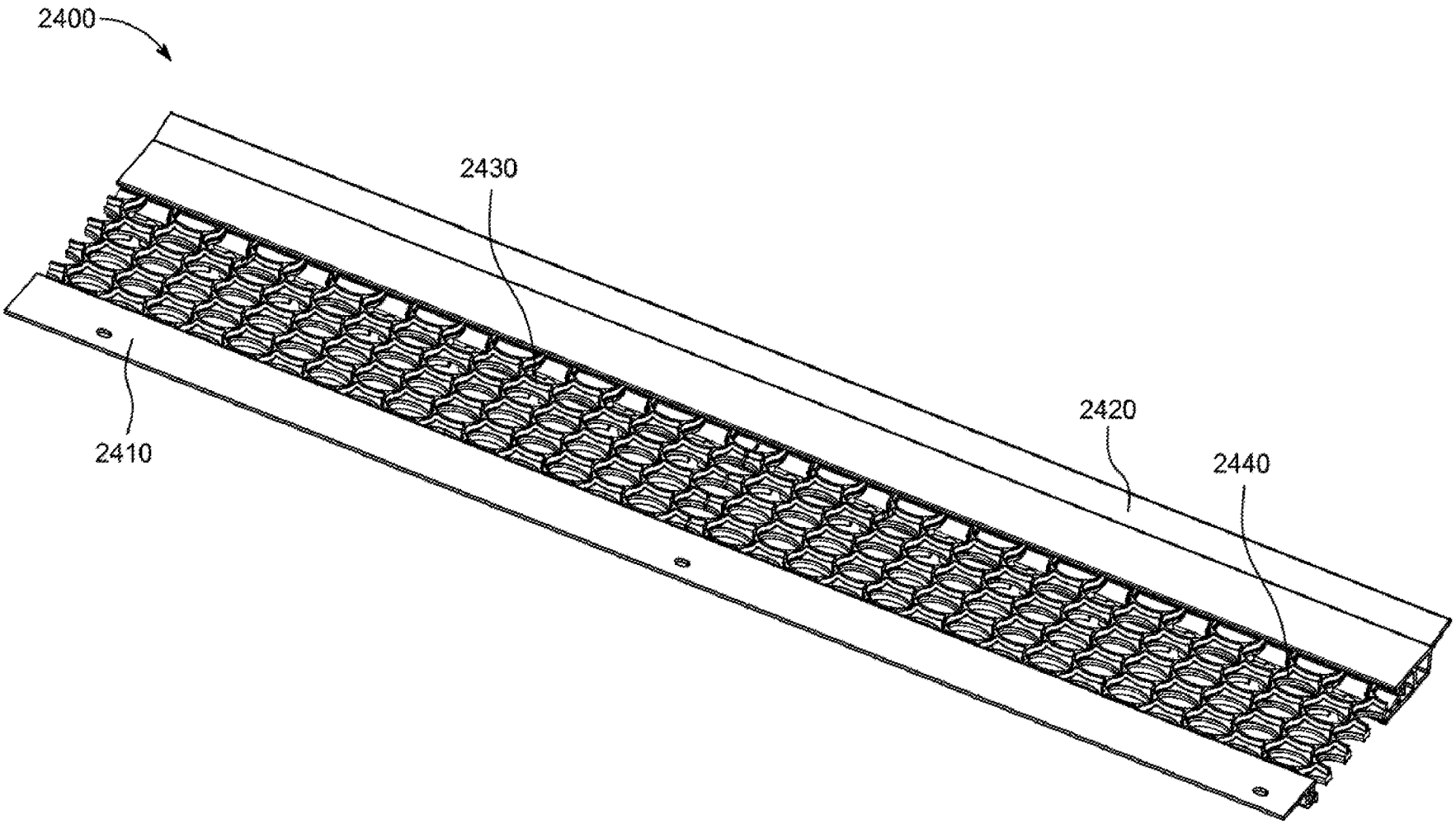
FIG. 84 schematically illustrates a perspective view of a gutter guard system securing a pair of main bodies with one front receiver and one rear receiver.
Figure 85:
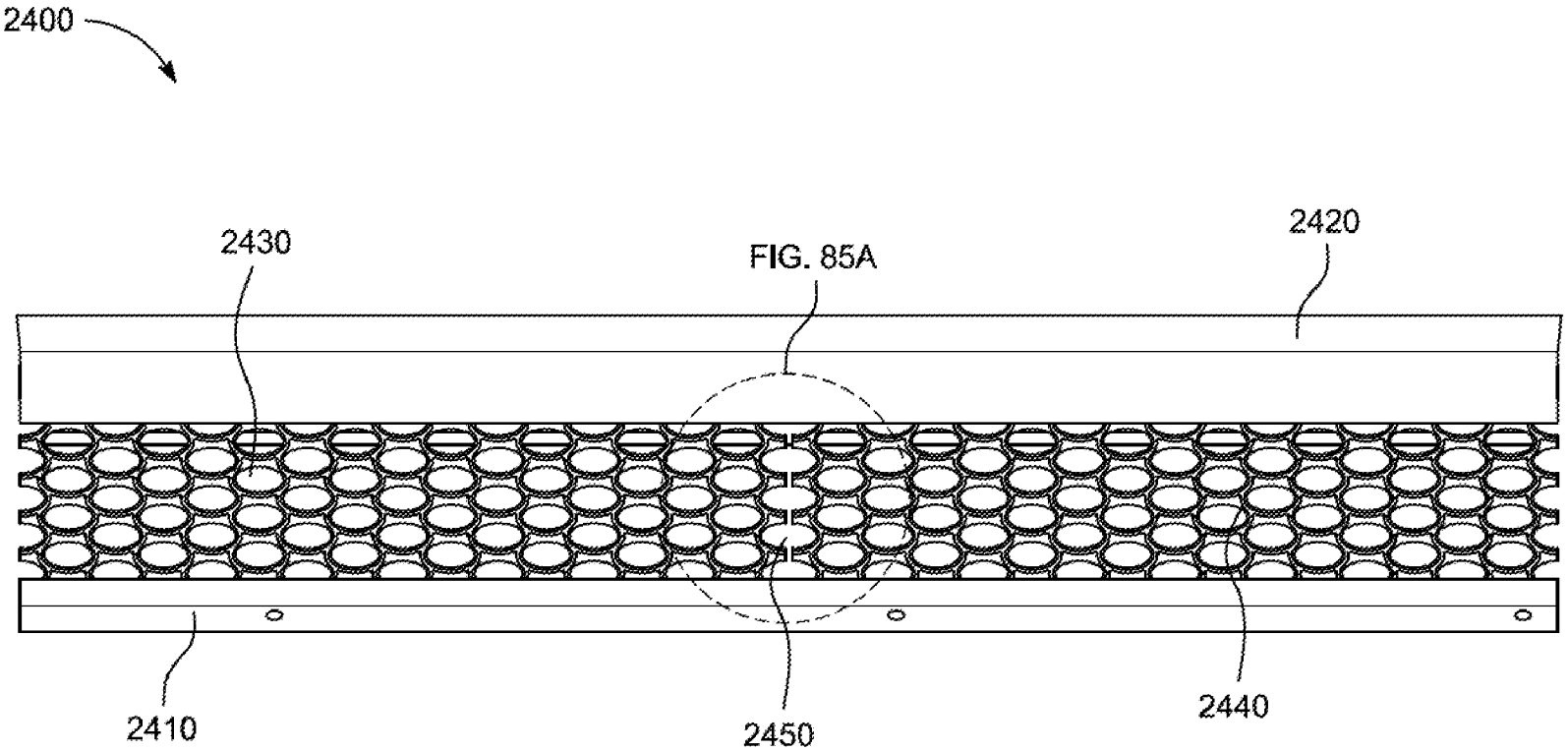
FIG. 85 schematically illustrates a top view of the gutter guard system of FIG. 84.
Figure 85A:
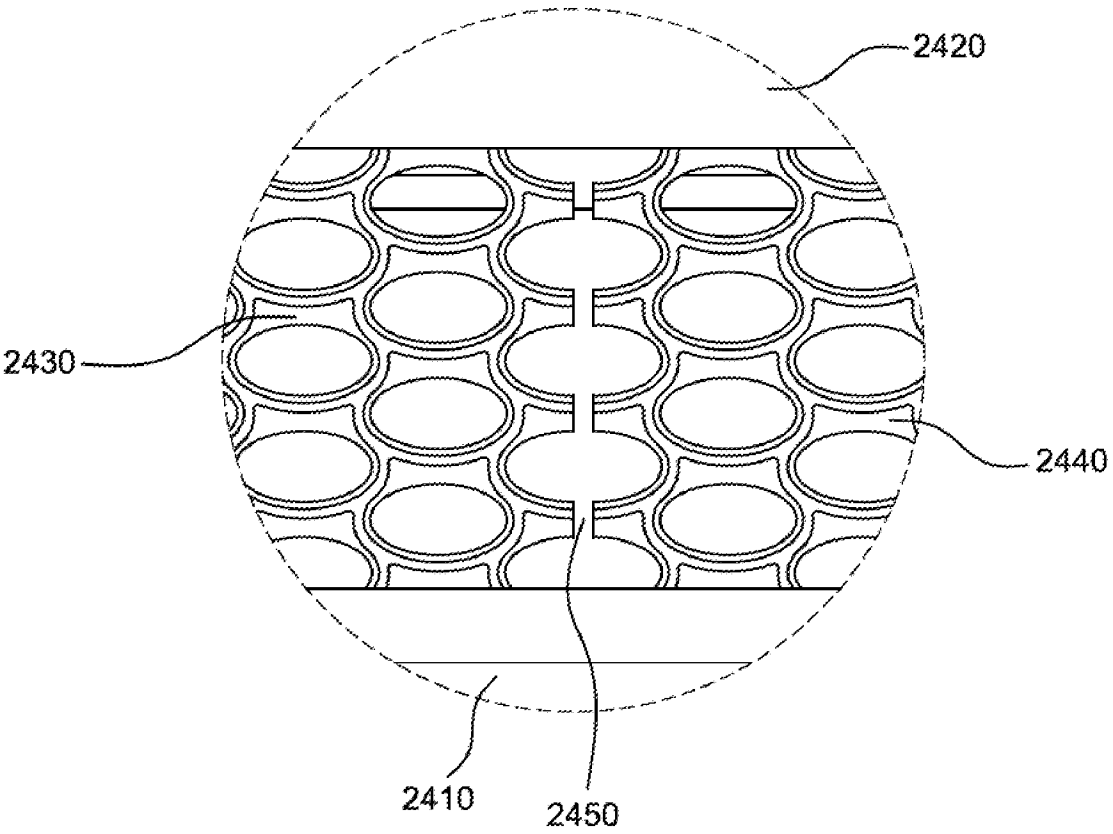
FIG. 85A schematically illustrates a detailed view of a butt joint of the gutter guard system of FIG. 84.
Figure 86:
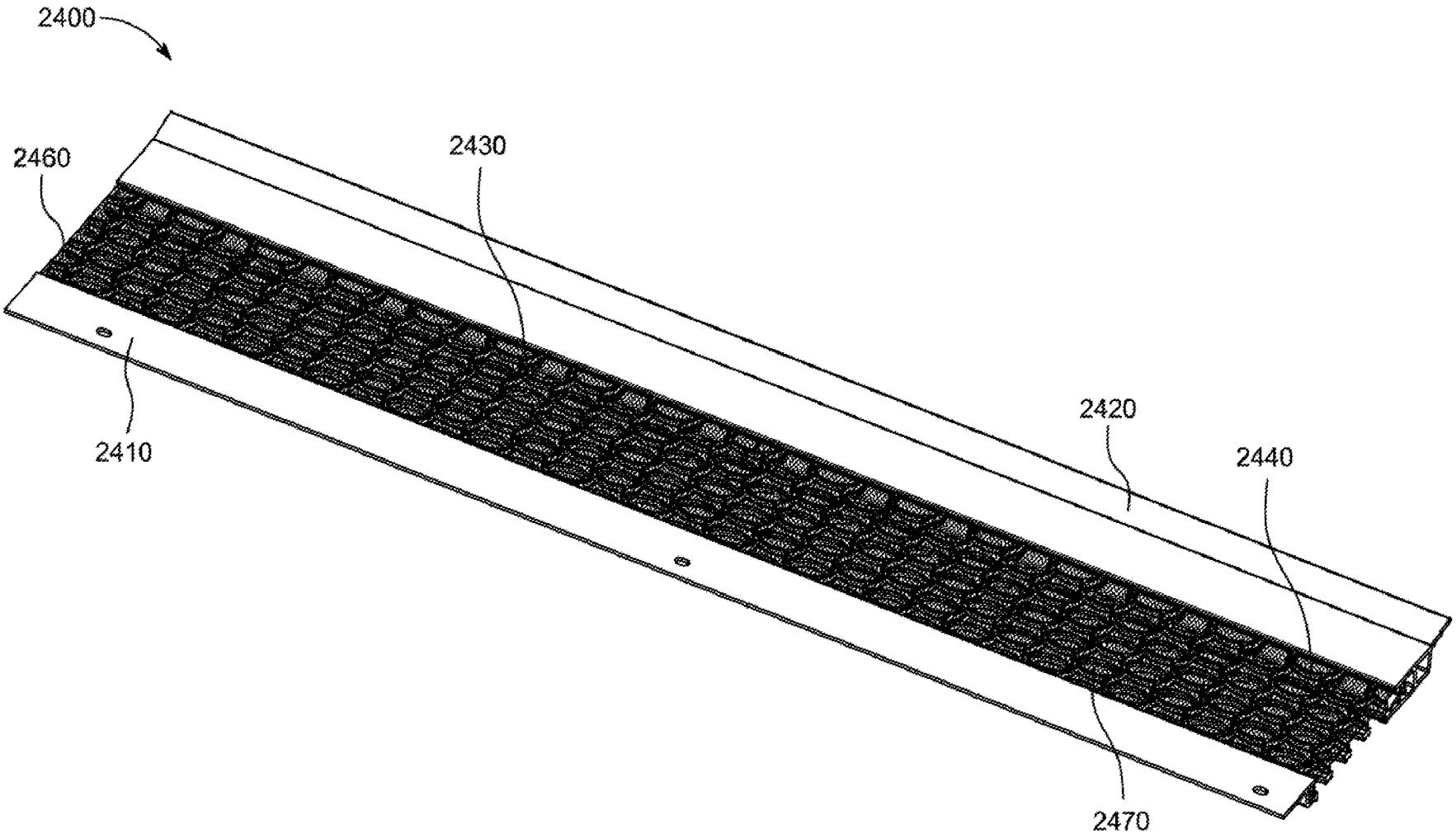
FIG. 86 schematically illustrates a perspective view of a gutter guard system securing a pair of main bodies and a pair of screens with one front receiver and one rear receiver.
Figure 87:
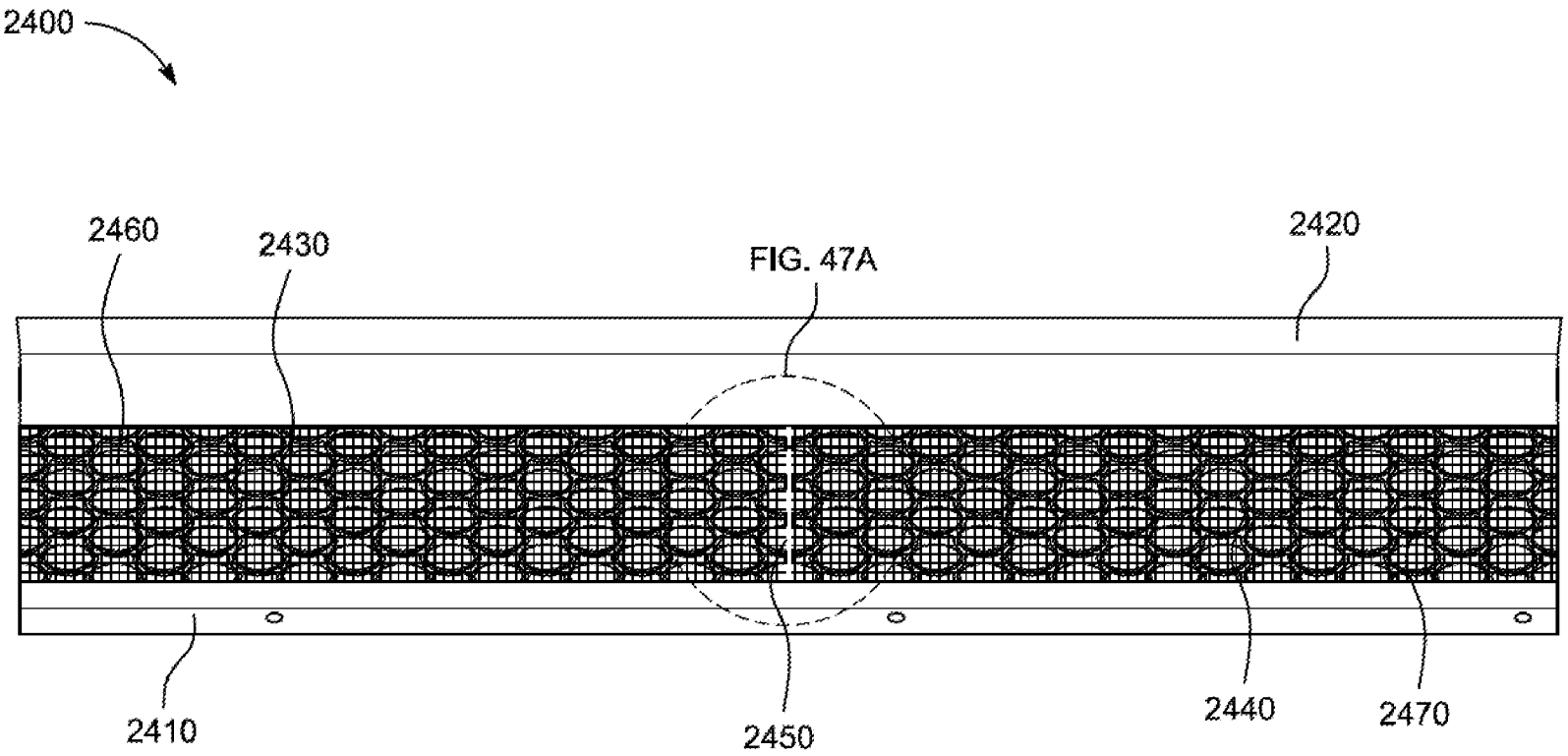
FIG. 87 schematically illustrates a top view of the gutter guard system of FIG. 86.
Figure 87A:
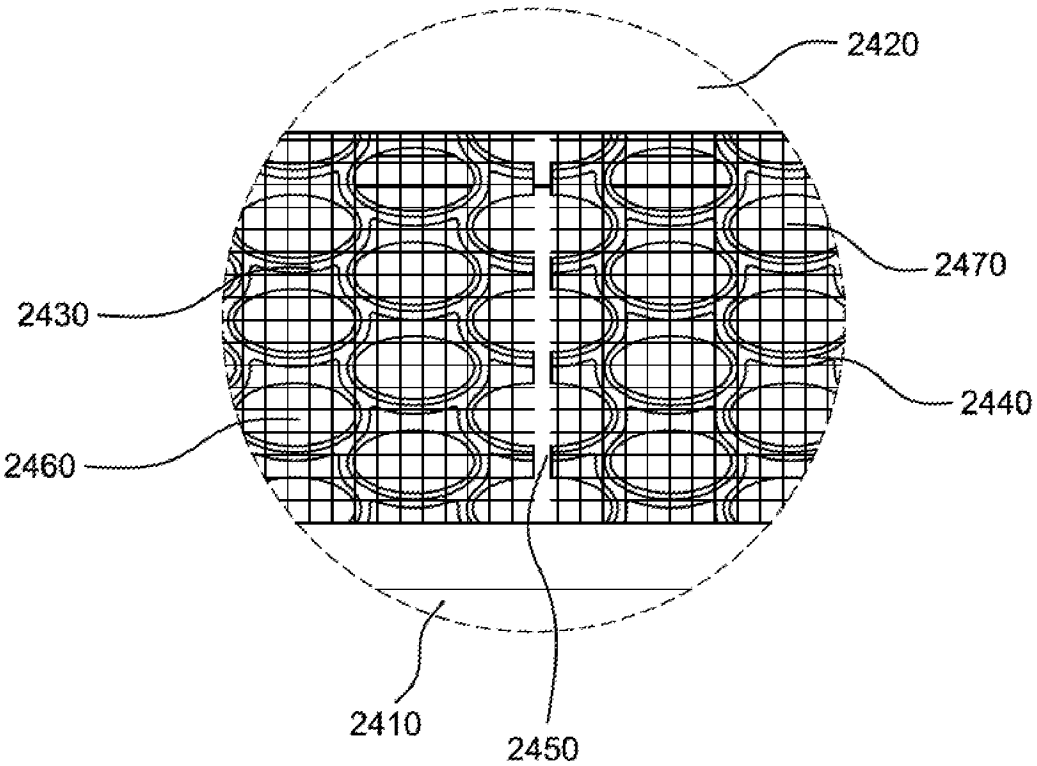
FIG. 87A schematically illustrates a detailed view of a butt joint of the gutter guard system of FIG. 86.

A number of techniques can be utilized to accomplish an installation of a gutter guard system along the entire roofline of a structure. Some techniques provide for added structural stability or coherence along the length of a section of the roofline of a structure. For example, in one technique, front receivers and/or rear receivers can be positioned such that the front receiver and/or rear receiver provide structural stability to the gutter guard system. Such a gutter guard system 2400 is illustrated in FIGS. 84-87 (FIGS. 83-85 do not include a screen for ease of description, however, FIGS. 86-87 do include a screen to illustrate the gutter guard system 2400 as it can be installed). FIG. 84 illustrates a perspective view of assembled components of an exemplary gutter guard system 2400, and FIG. 85 illustrates a top view of assembled components of an exemplary gutter guard system 2400. A front receiver 2410 and/or rear receiver 2420 are positioned such that a portion of a first main body 2430 and a portion of a second main body 2440 are each attached to the front receiver 2410 and/or the rear receiver 2420. In such an arrangement the front 2410 and rear 2420 receivers span the butt joint created when the first main body 2430 and second main body 2440 are positioned adjacent to each other (as best illustrated in detailed FIG. 85A). The first 2430 and second 2440 main bodies can be positioned such that there is a gap 2450 between the first 2430 and second 2440 main bodies. The gap 2450 can provide play between the installed main bodies 2430,2440 so as to assure that the main bodies 2430,2440 do not over lap or interfere with each other. FIGS. 86, 84 and 87A illustrate the embodiment of FIGS. 84-85 with a pair of screens 2460,2470 atop the main bodies 2430,2440.

Figure 88:
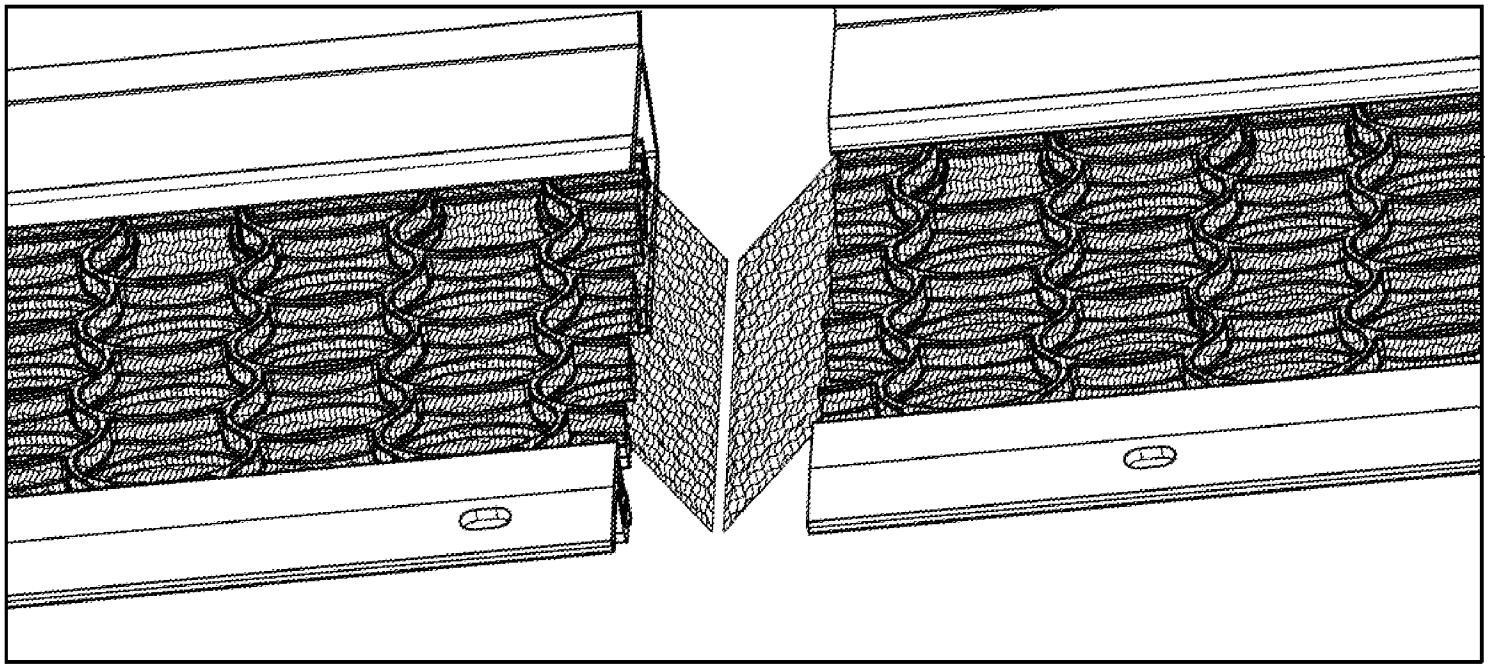
FIG. 88 schematically illustrates a pair of gutter guard systems prior to installation.
Figure 89:
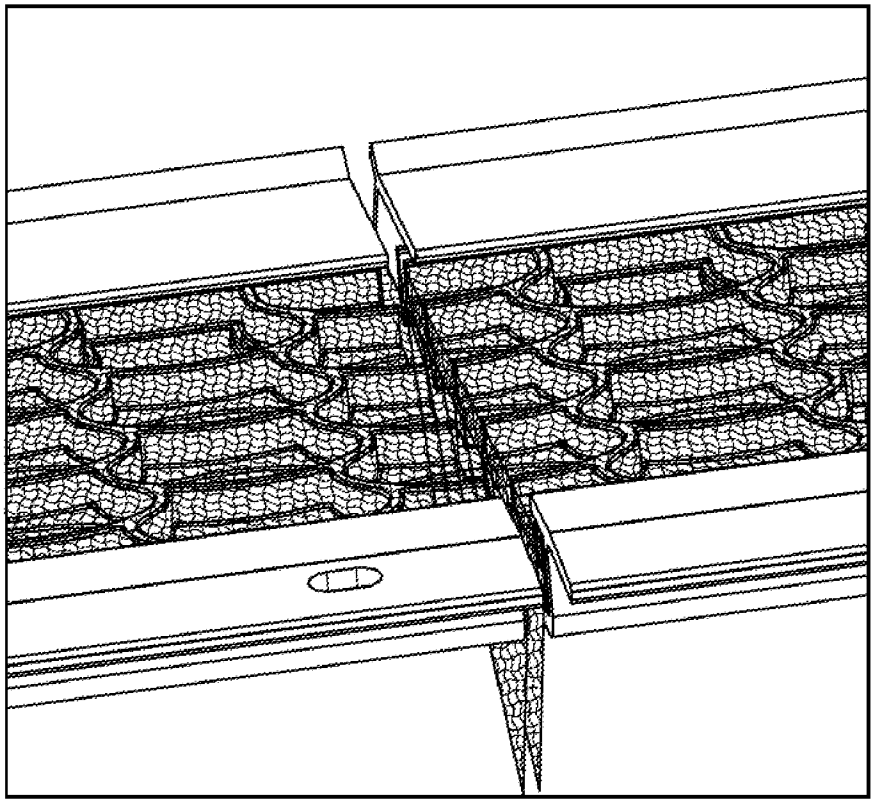
FIG. 89 illustrates the pair of gutter guard systems of FIG. 88 assembled to form a butt joint between the pair of gutter guard systems during installation.

FIGS. 88 and 89 illustrate an arrangement where the front receiver and rear receiver do not engage two main bodies, but only one. FIG. 88 illustrates two gutter guard systems prior to installation. The screens are manufactured to be longer than the main bodies. The portion of the screen over hanging the main body is bent downward as illustrated in FIG. 88. FIG. 89 illustrates two such gutter guard systems assembled. In such an arrangement, a butt joint is formed by the engagement of the rear receivers, engagement of the front receivers, and engagement of the main bodies and screens.

Figure 90:
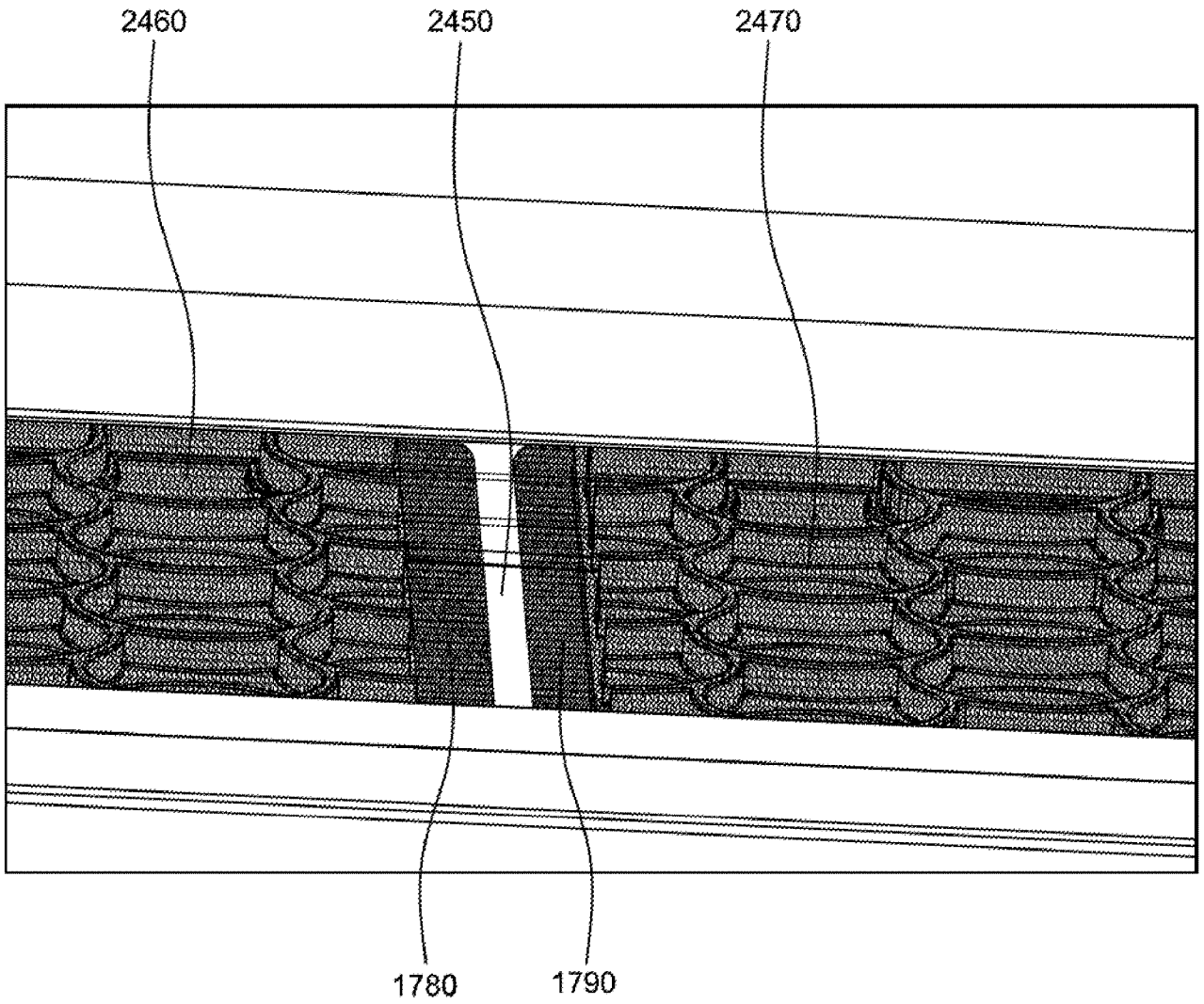
FIG. 90 illustrates two gutter guard systems with water flow and debris mitigation features at the butt joint between two gutter guard systems.
Figure 91:
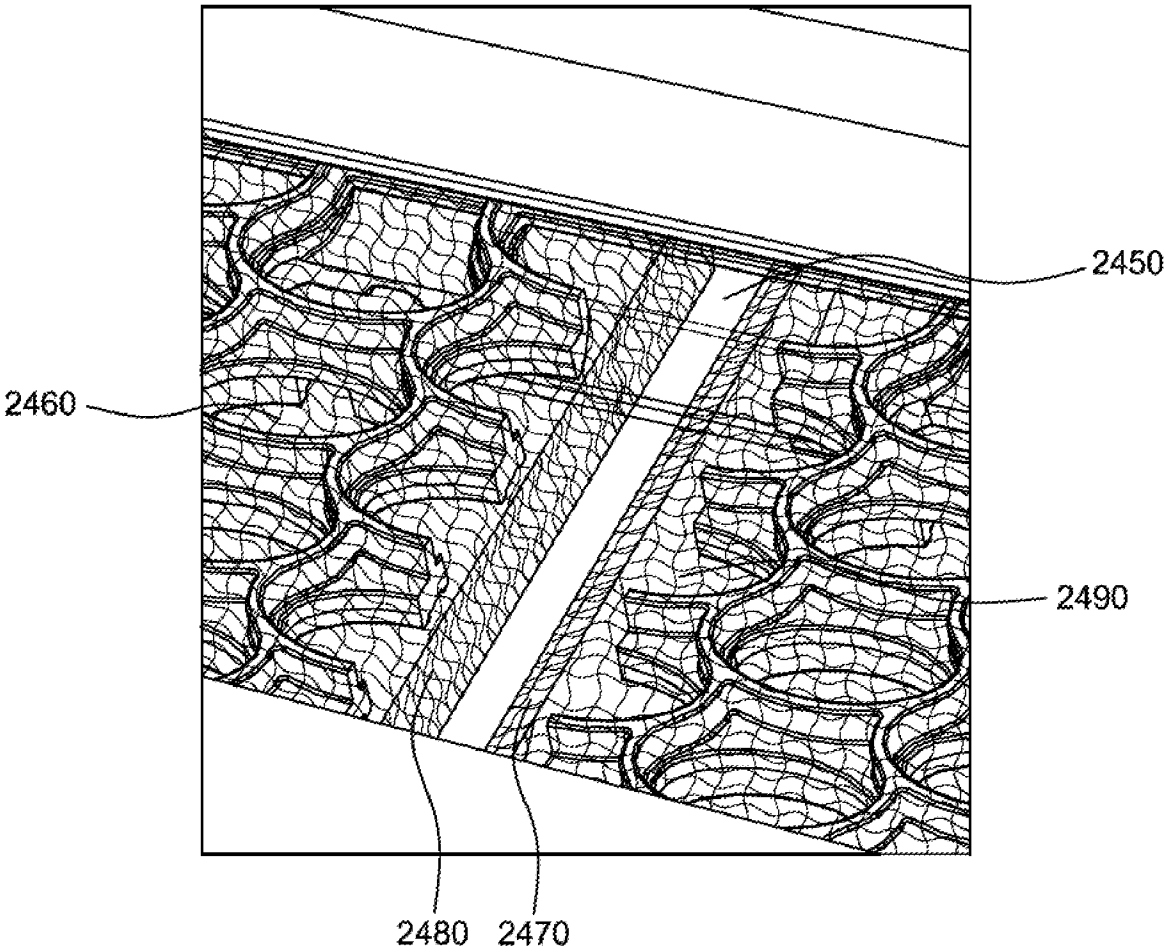
FIG. 91 illustrates another view of the two gutter guard systems of FIG. 90.

Returning to embodiments where a front and rear receiver accommodate two main bodies, as illustrated in FIGS. 90 and 91, the screens 2460,2470 can be arranged to manage water running along the gap 2450 to wick downward into the gutter. The end 2480 of the first screen 2460 is bent downwards, and the end 2490 of the second screen 2470 is also bent downwards. Arranging the ends 2480,2490 in such a manner will channel water running along the gap 2450 downward into the gutter.

As will be understood, such a positioning of components as illustrated in FIGS. 84-91 can facilitate the installation of the gutter guard system in addition to increased stability to the gutter guard system upon installation. Such an arrangement can also enhance the management of water flow. For example, the staggered construction positions the front receiver 2410 proximate to the butt joint 2450. Any water that runs along the butt joint will engage the front receiver 2410, and the front receiver 2410 will encourage the water to wick downwards into gutter. The arrangements can also enhance aesthetics by hiding the butt joint from view.

Other embodiments for main bodies can include securing features formed into the main bodies, where such securing features provide for adjacent main bodies to be secured to each other. Such embodiments can increase the stability and rigidity of a gutter guard system by forming physical connections between adjacent main bodies that transfer and/or distribute forces applied to the main bodies. Additionally, such embodiments can increase the manufacturability of main bodies. For example, if a typical desired length of a main body is five feet and the desired method of manufacturing for such a main body is injection molded, then the main body is typically injection molded as one integral five foot section. Such a length, particularly when compared to the main body's typical width and height, can offer challenges to designing a mold and injection parameters that can consistently form the main body with a single injection molding step. Such challenges can result in high scrap rates and inefficient manufacture of main bodies. However, if main bodies include securing features as described herein, main bodies can be manufactured in shorter lengths, such as, for example, two and one-half foot lengths, where two such main bodies can be secured together to form a main body assembly that has the rigidity and structural integrity analogous to an integral five foot main body. As will be further detailed, the main bodies can be arranged to include securing features on both ends of the main body such that any number of main bodies can be secured together to form any desired length of continuous main bodies. Additionally, main bodies can be arranged to include securing features on only one end of the main body, where such an arrangement accommodates the securing together of two main bodies. As will be understood, in such an arrangement, two main bodies can be secured together to form a main body assembly of a desired length.

Figure 92:
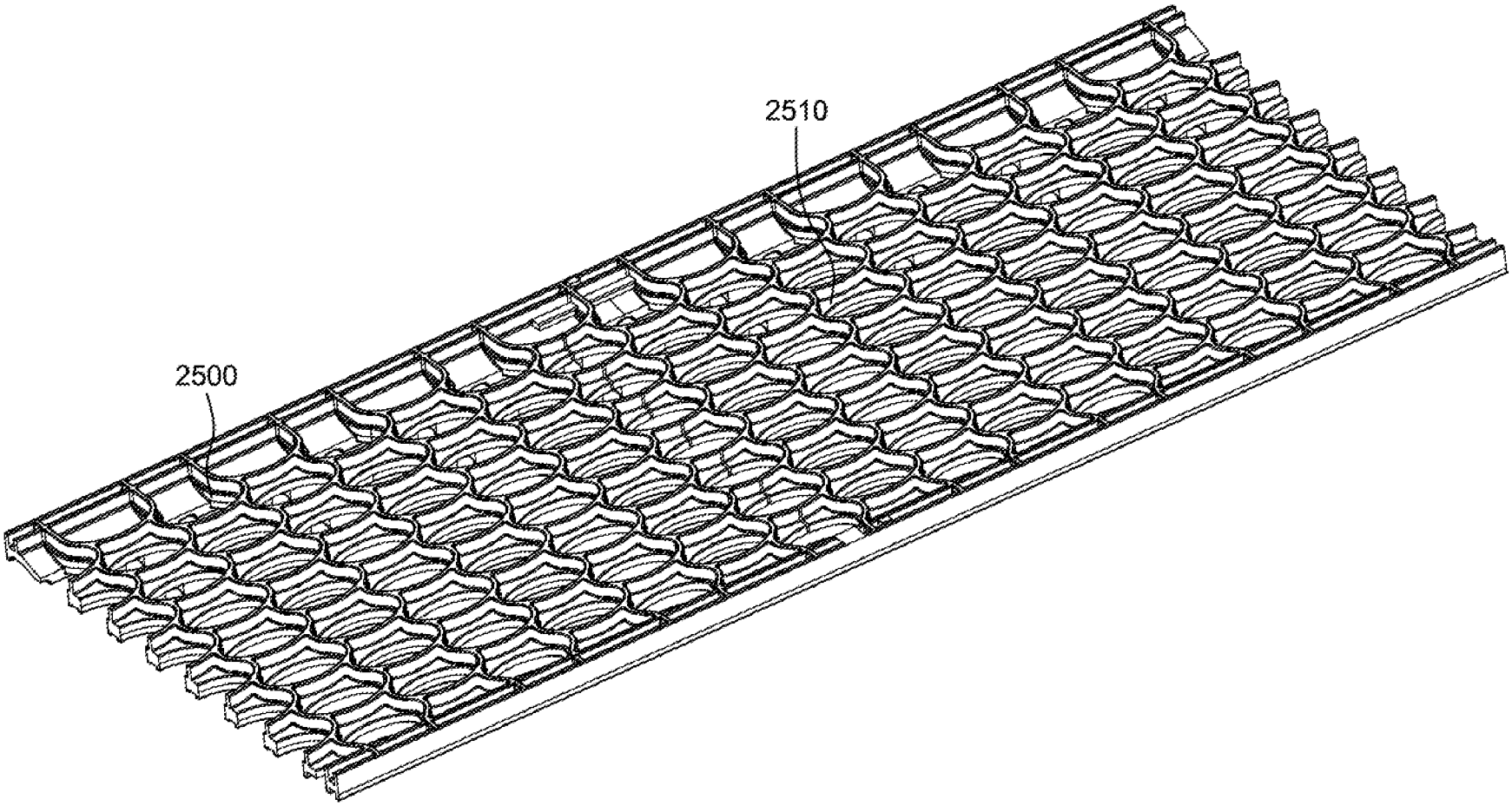
FIG. 92 schematically illustrates a pair of main bodies secured together with sever al securing features.
Figure 93:
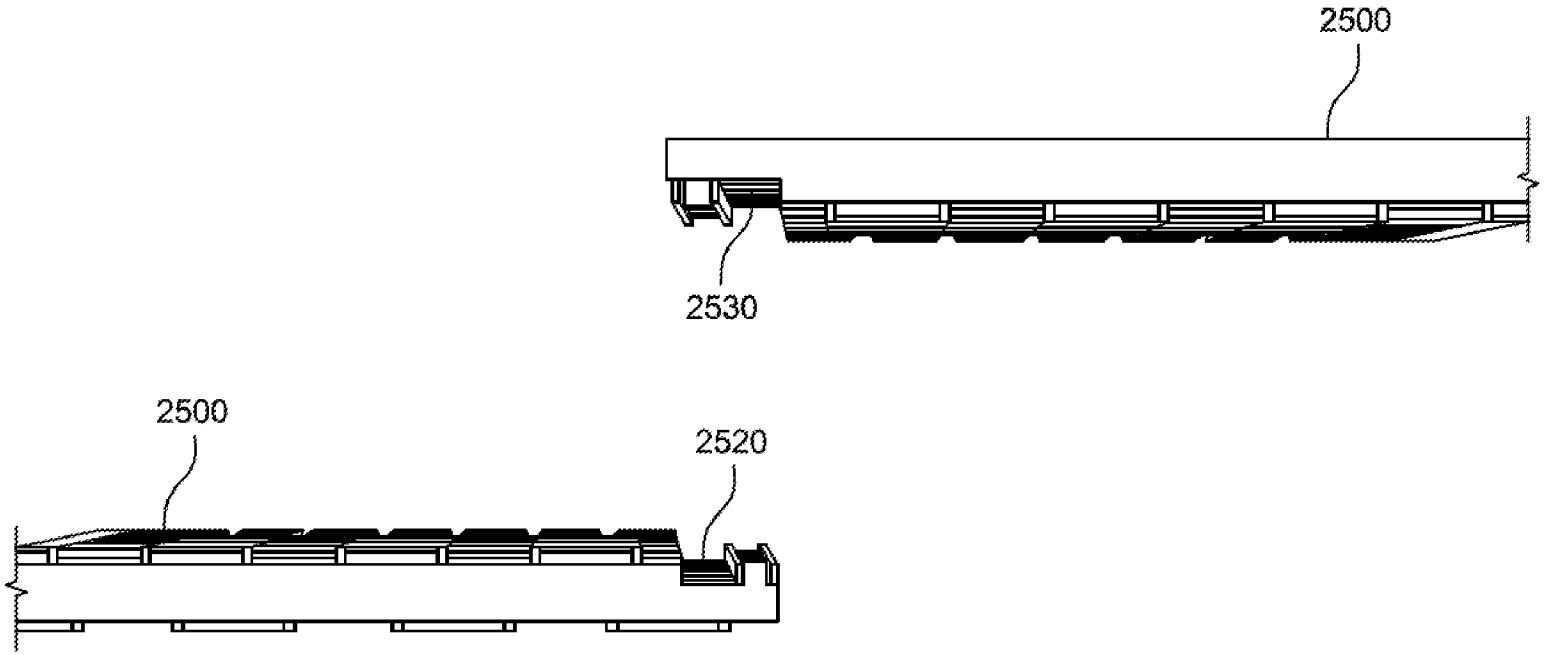
FIG. 93 schematically illustrates an exploded view of the pair of main bodies of FIG. 92.

Exemplary main bodies with securing features are illustrated in FIGS. 92, 93, 94, 94A, 94B, 94C, 95, 95A, 95B, and 95C. FIG. 92 illustrates a first main body 2500 and a second main body 2510 secured together, and FIG. 93 illustrates an exploded view of the first main body 2500 and second main body 2510. As illustrated in FIG. 93, the first main body 2500 includes a recessed section 2520 on its top surface at one end of the first main body 2500, and the second main body 2510 includes a recessed section 2530 on its bottom surface at one end of the second main body 2510. As will be understood, the recessed section 2520 of the first main body 2500 and the recessed section 2530 of the second main body 2510 are sized and shaped such that the recessed sections 2520,2530 "mate" upon the assembly of the first main body 2500 and the second main body 2510. This is to say that the recessed sections 2520,2530 are sized and shaped so that upon assembly, the first main body 2500 and second main body 2510 can function as a continuous main body. For example, upon assembly, as illustrated in FIG. 92, the top surface of the first main body 2500 and the top surface of the second main body 2510 are generally coplanar and form a continuous top surface across the first 2500 and second 2510 main bodies. Similarly, upon assembly, the bottom surface of the first main body 2500 and the bottom surface of the second main body 2510 are generally coplanar and form a continuous bottom surface across the first 2500 and second 2510 main bodies. Additionally, upon assembly of the first main body 2500 and second main body 2510, the longitudinal edges of the first 2500 and second 2510 main bodies align to form continuous longitudinal edges across the first 2500 and second 2510 main bodies. It will be understood that with such an arrangement, upon assembly of two main bodies, the assembly can function as a single continuous main body.

As illustrated in FIGS. 92 and 93, the first main body 2500 includes a recessed surface 2520 on its top surface at one end of the first main body 2500, and there is no recess on the opposite end of the first main body 2500. Similarly, the second main body 2510 includes a recessed surface 2530 on its bottom surface at one end of the second main body 2510, and no recess on the opposite end of the second main body 2510. It will be understood that with such an arrangement, the intention is for two main bodies (and only two main bodies) to be assembled into a main body assembly. As discussed herein, such an arrangement can facilitate a more efficient manufacturing process and allow for post manufacturing assembly of two main bodies into a main body assembly that is of a desired length. Alternatively, each end of a main body can include a recessed section, with one end having a recess on the top surface and the opposite end having a recess in the bottom surface. It will be understood that such an arrangement allows for multiple main bodies to be secured together in series to form variable continuous lengths of main bodies to accommodate transportation, assembly, and/or installation needs for gutter guard systems installed on various structures.

Figure 94:
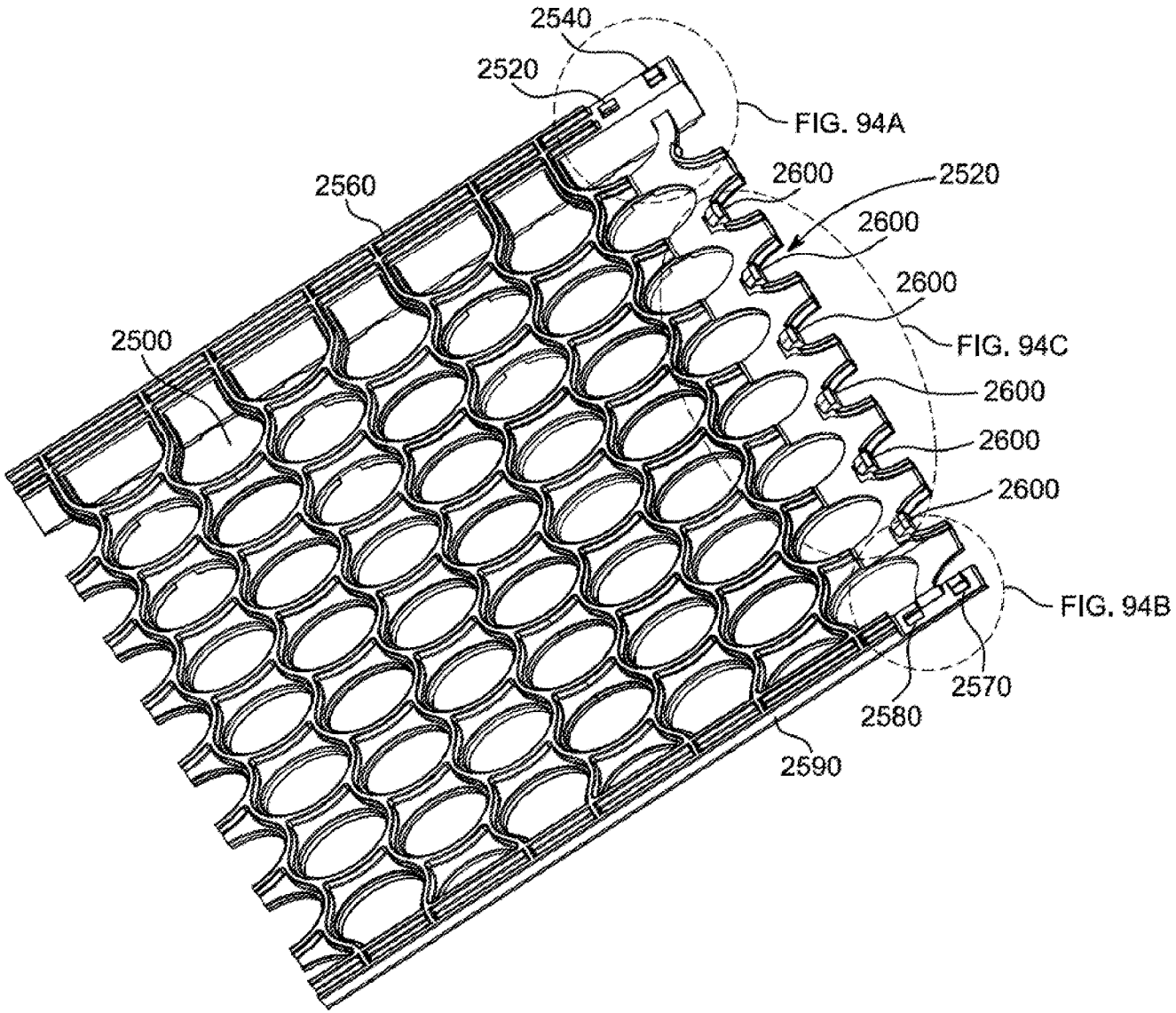
FIG. 94 schematically illustrates a main body with sever al securing mechanisms on its top surface.
Figure 94B:
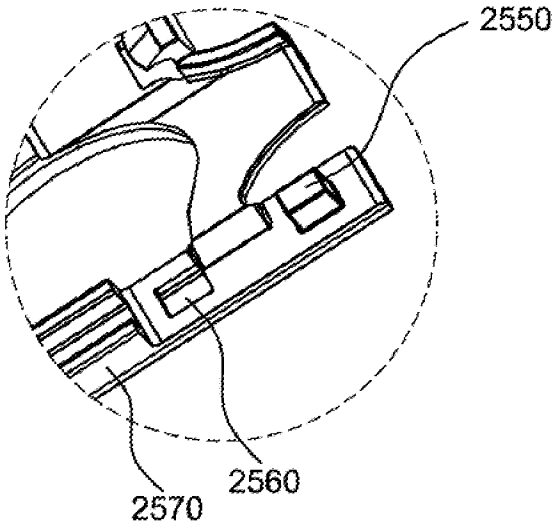
FIG. 94B is a detailed view of certain other securing features of the main body of FIG. 94.
Figure 94A:
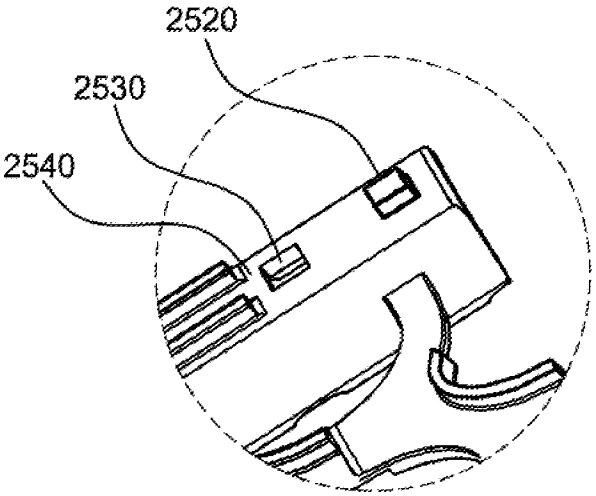
FIG. 94A is a detailed view of certain securing features of the main body of FIG. 94.
Figure 94C:
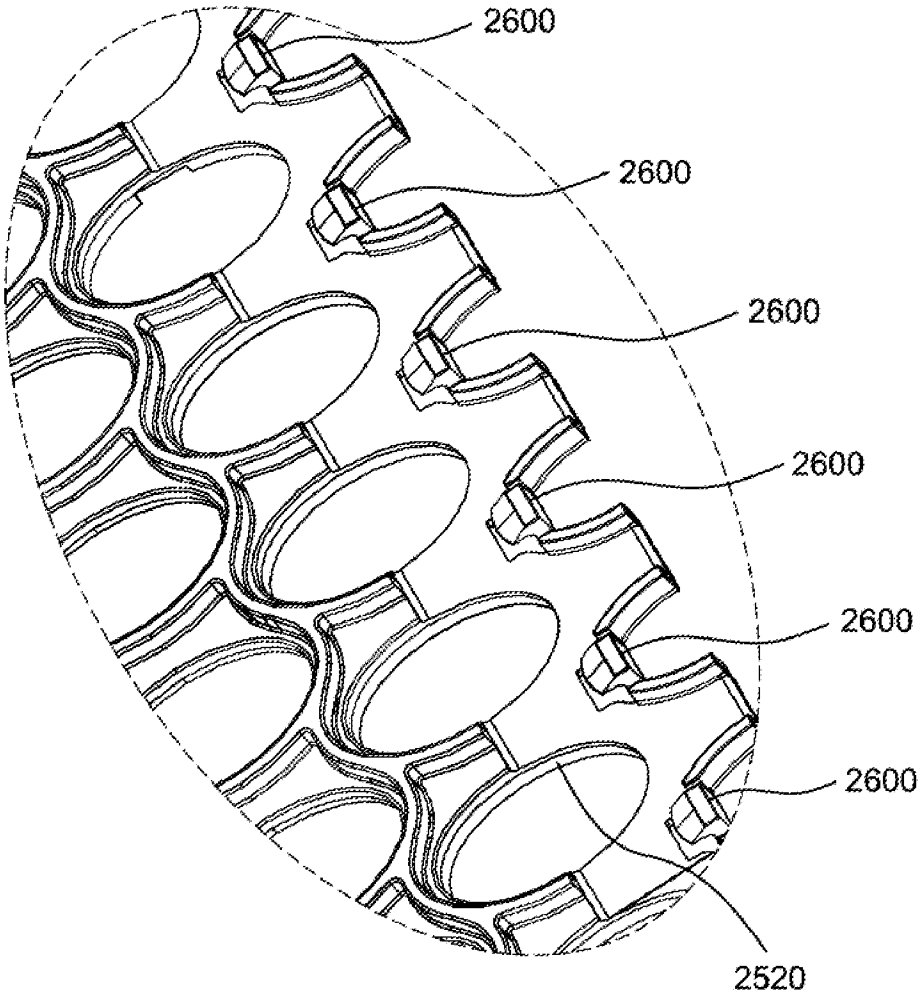
FIG. 94C is a detailed view of certain other securing features of the main body of FIG. 94.

As illustrated in FIG. 94, the recessed section 2520 on the top surface of the first main body 2500 includes a number of securing features. For example, the first main body 2500 includes a first tab 2540 and a first slot 2550 near the rear edge 2560 of the first main body 2500. The first main body 2500 also includes a second tab 2570 and a second slot 2580 near the front edge 2590 of the first main body 2500. The first main body 2500 further includes a series of hooks 2600 positioned along the end of the recessed section 2520. FIGS. 94A, 94B, and 94C are detailed illustrations of these features. As illustrated in FIGS. 94A and 94B, the tabs 2540, 2570 are generally rectangular in shape and extend perpendicularly above the recessed section 2520. In one embodiment, the tabs 2540,2570 extend above the recessed section 2520 such that the top of the tabs 2540,2570 are, upon assembly of two main bodies, generally in the same plane as the top surface of the first main body 2500. The slots 2550,2580 pass through the first main body 2500 and are rectangular in shape and match the shape of the tabs 2540,2570. As illustrated in FIG. 94C, the first main body 2500 includes a series of hooks 2600 positioned at the edge of oval shaped apertures and extending perpendicularly above the recessed section 2520.

Figure 95:
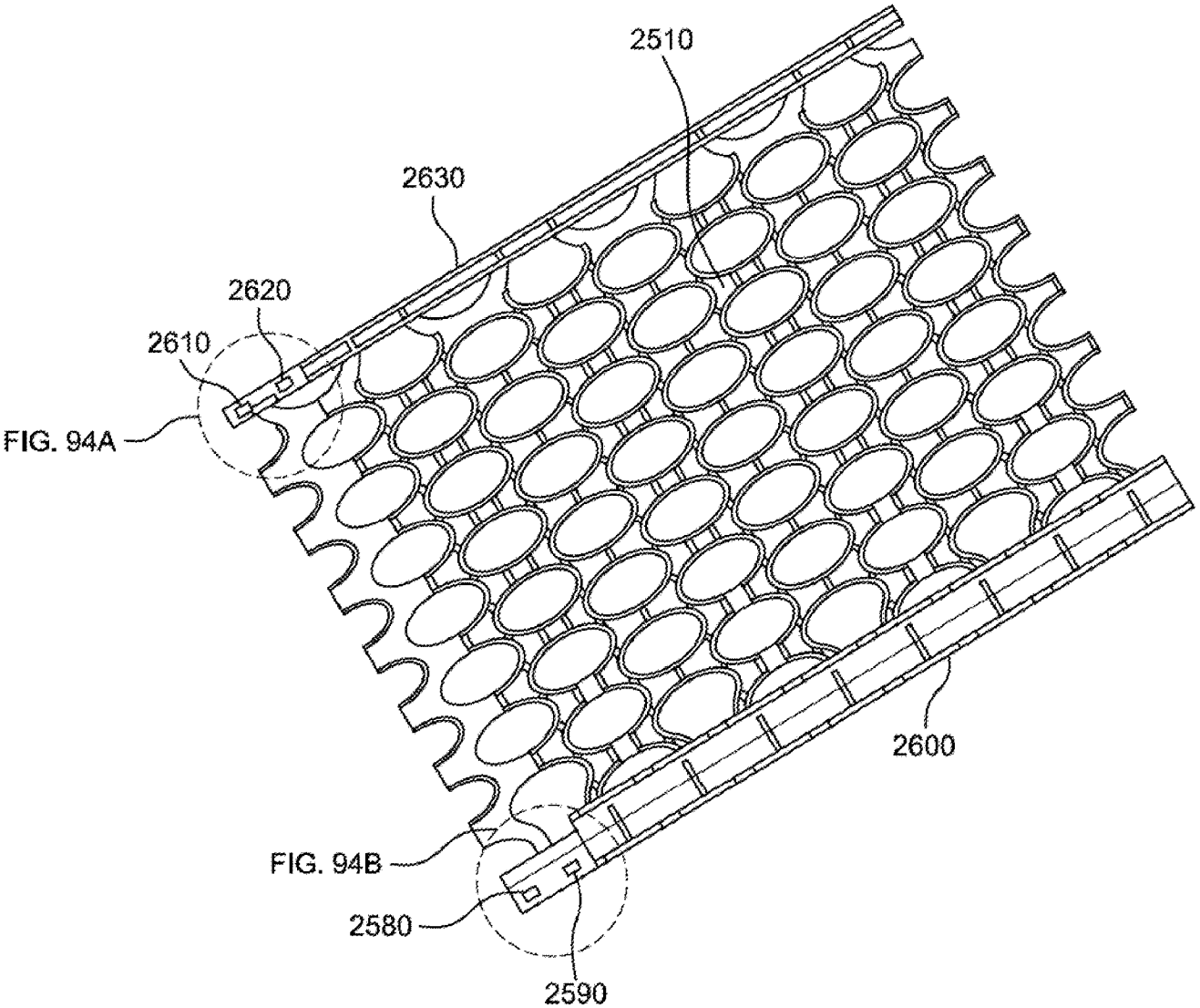
FIG. 95 schematically illustrates a main body with sever al securing mechanisms on its bottom surface.
Figure 95B:
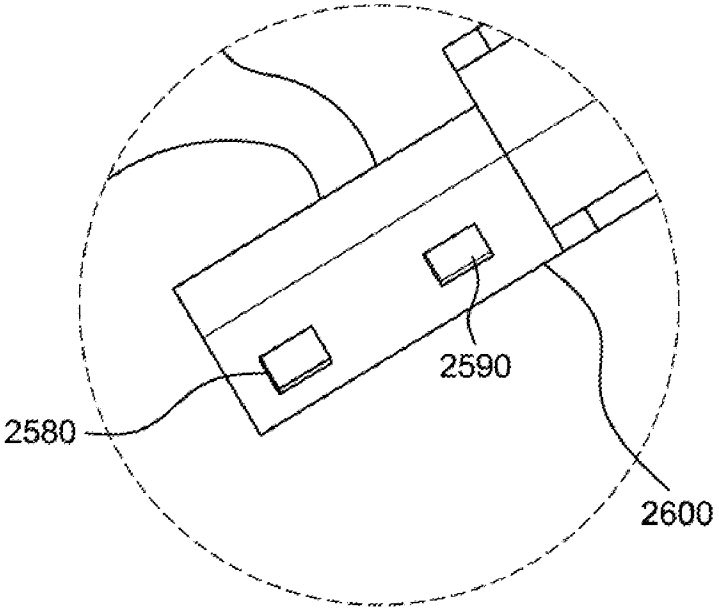
FIG. 95B is a detailed view of certain other securing features of the main body of FIG. 95.
Figure 95A:
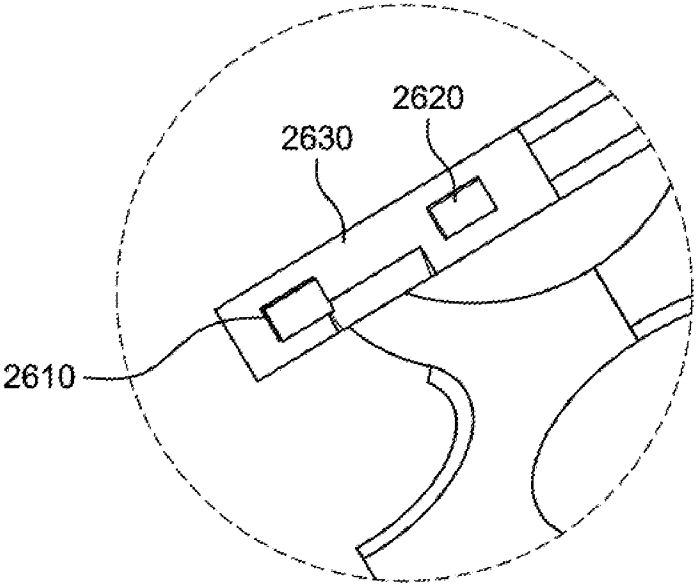
FIG. 95A is a detailed view of certain securing features of the main body of FIG. 95.
Figure 95C:
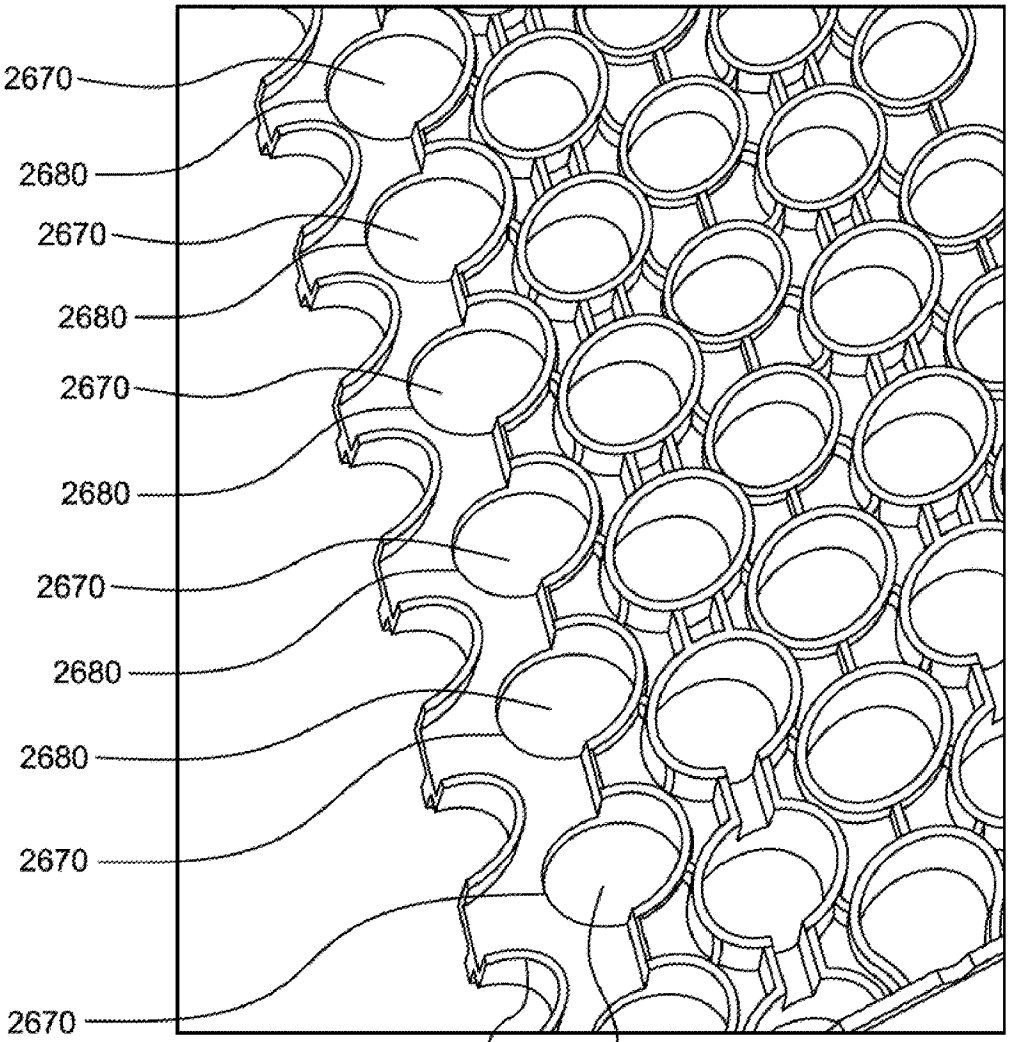
FIG. 95C is a detailed view of certain securing features of the main body of FIG. 95.

As illustrated in FIG. 95, the recessed section 2530 on the bottom surface of the second main body 2510 includes a number of securing features (the second main body 2510 is illustrated with the bottom surface facing upward). For example, the second main body 2510 includes a third tab 2610 and a third slot 2620 near the rear edge 2630 of the second main body 2510. The second main body 2510 also includes a fourth tab 2640 and a fourth slot 2650 near the front edge 2660 of the second main body 2510. The second main body 2510 further includes oval shaped apertures 2670 positioned along the end of the recessed section 2530. FIGS. 95A, 95B, and 95C are detailed illustrations of these features. As illustrated in FIGS. 95A and 95B, the tabs 2610, 2640 are generally rectangular in shape and extend perpendicularly above the recessed section 2530. In one embodiment, the tabs 2610,2640 extend above the recessed section 2530 such that the top (or "bottoms" in this case) of the tabs 2610,2640 are, upon assembly of two main bodies, generally in the same plane as the bottom surface of the second main body 2510. The slots 2620,2650 pass though the main body and are rectangular in shape and match the shape of the tabs 2610,2640. As illustrated in FIG. 95C, the second main body 2510 includes a series of oval shaped apertures 2670. Each of the oval shaped apertures 2670 are partially positioned in the recessed section 2530. The portion of each oval shaped aperture 2670 that is positioned in the recessed section 2530 does not include an extended edge extending perpendicularly away from the apertures as previously described herein for oval shaped apertures. This is to say, that a portion of the perimeter 2680 of the oval shaped aperture 2670 is flat relative to the surface of the recessed portion 2530.

When the first main body 2500 is installed adjacent to the second main body 2510, the first tab 2540 of the first main body 2500 is inserted into the third slot 2620 of the second main body 2510, and the third tab 2610 of the second main body 2510 is inserted into the first slot 2550 of the first main body 2500. Correspondingly, the second tab 2570 of the first main body 2500 is inserted into the fourth slot 2650 of the second main body 2510, and the fourth tab 2640 of the second main body 2510 is inserted into the second slot 2580 of the first main body 2500. The tabs and slots can be designed so that each tab and slot pairing creates a friction fit when the tab is inserted into the slot. In essence, the tabs and slots can be arranged such that each tab "snaps" into its respective slot. Such an arrangement can form a secured attachment between adjacent main bodies, and thus, assist in forming a gutter guard system that is structurally stable. In another embodiment, the tabs can be generally rectangular, but have a tapered profile such that the cross-sectional area of the tab slightly decreases as the tab extends above the recess. In such an arrangement, the tabs can function as a guide to facilitate efficient assembly of the main bodies. With a tapered profile, an assembler can more easily locate the tabs in the slots. During assembly, as the tab progresses through the slot, its cross-sectional area increases, and as the tab becomes fully inserted into the slot, the tab can form a friction fit with the slot to assist in securing the two main bodies together.

Furthermore, when the first main body 2500 is installed adjacent to the second main body 2510, each of the hooks 2600 of the first main body 2500 is engaged with a corresponding perimeter 2680 of an oval shaped aperture 2670 of the second main body 2510. The hooks 2600 and the perimeters 2680 of the oval shaped apertures 2670 can be designed so that each hook 2600 "snaps" over and onto the surface proximate to the corresponding perimeter 2680 of an oval shaped aperture 2670. This is to say that upon the initiation of the assembly of two main bodies, a sloped nose (best illustrated in FIG. 94C) of the hook 2600 engages with the perimeter 2680 of an oval shaped aperture 2670. Upon such engagement, the hook 2600 is slightly deflected to allow the sloped nose to pass over the perimeter 2680 of the oval shaped aperture 2670. Once the sloped nose passes over the perimeter 2680, the hook returns to its natural position (i.e., the hook 2600 snaps back to its natural position) and the sloped nose secures the hook 2600 to the perimeter 2680 of the oval shaped aperture 2670. Such an arrangement can form a secured attachment between adjacent main bodies, and thus, assist in forming a gutter guard system that is structurally stable.

Similar to prior disclosure, it will be understood that a first main body can include only one set of securing features, which are located on its top surface at one end of the main body, and a second main body can include only one set of securing features, which are located on its bottom surface at one end of the main body. Such an arrangement can form a system where a pair of main bodies is secured together to form a main body assembly. Additionally, each main body can include a first set of securing features on its top surface on one end of the main body while also including a second set of securing features on its bottom surface on an opposite end of the main body. Such an arrangement can form a system where each main body is secured to a first main body adjacent to its first end and a second main body adjacent to its second and opposite end.

As described herein, the width of main bodies can be static. That is to say that main bodies are manufactured in varying widths to accommodate various gutter systems. For example, main bodies can be manufactured in about three inch widths, about four inch widths and about five inch widths. When assembling a gutter guard system, the most applicable width of main body is selected for a particular gutter. However, in another embodiment, a gutter guard assembly can be arranged such that the width of the gutter guard system is adjustable. Such an adjustable gutter guard system 2700 is illustrated in FIGS. 96-103. As will be subsequently described, the adjustable gutter guard system 2700 is arranged such that the width of the gutter guard system is dynamically adjustable between a fully contracted position (i.e., arranged at a minimum width, as illustrated in FIGS. 96, 98, and 100) and a fully extended position (i.e., arranged at a maximum width, as illustrated in FIGS. 97, 99, and 101). As illustrated in FIGS. 96 and 97, the adjustable gutter guard system 2700 includes a front receiver 2710, a rear receiver 2720, a main body 2730, and a screen 2740. The front receiver 2710, main body 2730, and screen 2740 are arranged so that the combination of components can move together relative to the rear receiver 2720 to adjust the width of the adjustable gutter guard system 2700. As illustrated in FIGS. 98-101, such movement is facilitated by a plurality of rails 2750 that are secured to the main body 2730 and slideably engage the rear receiver 2720 through a plurality of apertures 2760,2770 extended from the rear receiver 2720. The rails 2750 can be secured to the main body 2730 by a pair of hooks 2780,2790 or other similar mechanisms. As will be understood, the width of the adjustable gutter guard system 2700 is adjusted by sliding the rear receiver 2720 along the plurality of rails 2750. The plurality of rails 2750 can be distributed at equal distances from one another so as to facilitate a smooth operation of sliding the rear receiver 2720 along the rails 2750. The rear receiver 2720 includes a slot 2800 that accommodates the movement of the screen 2740 (best illustrated in FIGS. 100 and 101). As illustrated in FIG. 100, when the adjustable gutter guard system 2700 is in its fully contracted position, the screen 2740 is positioned such that one end of the screen 2740 is near the back end of the slot 2800, and as illustrated in FIG. 101, when the gutter guard system is in its fully extended position, the screen 2740 is positioned such that the end of the screen 2740 is near the opening of the slot 2800. As illustrated in FIGS. 100 and 101, a portion of the screen 2740 remains within the slot 2800, thus, regardless of the adjustment of the adjustable gutter guard system 2700, the screen 2740 covers the full width between the front receiver 2710 and rear receiver 2720. When installing such an adjustable gutter guard system 2700, an installer can assess the gutter system to determine the correct width for the adjustable gutter guard system 2700, slide the rear receiver 2720 along the rails 2750 until the adjustable gutter guard system 2700 is the correct width, and install the adjustable gutter guard system 2700.

Figure 103:
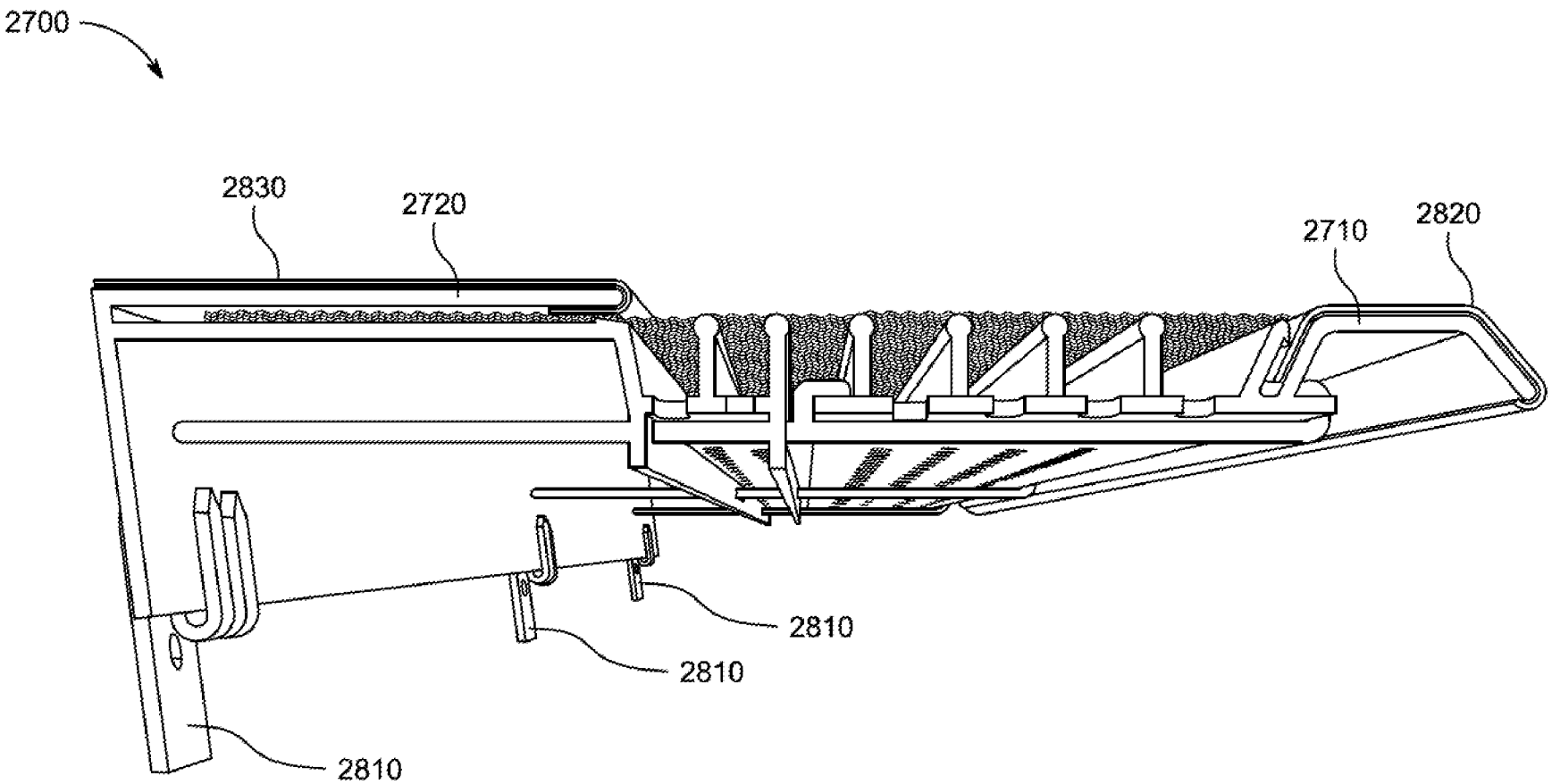

The adjustable gutter guard system 2700 can include additional components as illustrated in FIGS. 102 and 103. The adjustable gutter guard system 2700 can include a series of clips 2810 to facilitate attachment of the adjustable gutter guard system 2700 to a gutter or structure. Such clips 2810 can include the types previously described herein. Furthermore, the adjustable gutter guard system 2700 can include a front receiver cover plate 2820 secured to the front receiver 2710 and a rear receiver cover plate 2830 secured to the rear receiver 2720. The front 2820 and rear 2830 receiver cover plates can be applied to the front 2710 and rear 2720 receivers to achieve a desired aesthetic appearance. For example, the front 2820 and rear 2830 receiver cover plates can be provided in a number of colors so that the adjustable gutter guard system 2700 can be customized depending on a customer's preferred color scheme. In another example, the front 2820 and rear 2830 receiver cover plates can be provided in a number of textures to meet customer preferences. The front 2820 and rear 2830 receiver cover plates can be manufactured from a thin metal sheeting and/or other appropriate materials so that the front 2820 and rear 2830 receiver cover plates can be formed around the front 2710 and rear 2820 receivers as illustrated in FIG. 103. Although the front 2820 and rear 2830 receiver cover plates are described and illustrated as assembled with an adjustable gutter guard system 2700, it will be understood that front and rear receiver cover plates can be applied to other front and rear receivers described and illustrated herein.

Another technique for accommodating various widths of rain gutter systems is to combine additional modular components into a gutter guard system to extend the over all width of the gutter guard system. Such examples are illustrated in FIGS. 104-110. FIGS. 104 and 105 illustrates a gutter guard system 2900 that includes a front receiver 120 as illustrated in FIGS. 7-11, a three inch main body 2910 described herein and generally illustrated in FIGS. 7-11 and 18-24, a screen 140, and a rear receiver 1800 as illustrated in FIG. 75. As previously described, the rear receiver 1800 includes an angled extension 1830 that can optionally engage with the rear lip and/or wingback of the rain gutter or features secured to the structure and/or roofline. The angled extension 1830 can rest on top of the rear lip and/or wingback of the rain gutter, the structure, and/or the roofline. However, it will be appreciated that such an arrangement may be too small in width for certain rain gutters and exchanging the three inch main body 2910 for a four inch main body may form a gutter guard system that is too large for the rain gutter. One alternative is to add another rear receiver 1500, illustrated in FIG. 69, to extend the over all width of the gutter guard system. The rear receiver 1500 can be engaged with the rear receiver 1800, which is secured to the main body 2910, by sliding the angled extension 1830 into the channel 1510 of the rear receiver 1800. As best illustrated in FIG. 105, such an arrangement can extend the over all width of the gutter guard system to accommodate a rain gutters that may be of a unique size.

FIGS. 106-110 illustrate similar arrangements to that of FIGS. 104-105. FIG. 106 illustrates a gutter guard system 3000 similar to FIGS. 104-105 except that it includes the front receiver 1400 as illustrated in FIG. 68. FIG. 107 illustrates a gutter guard system 3100 similar to FIGS. 104-105 except that it includes a four inch main body 3110. FIG. 108 illustrates a gutter guard system 3200 similar to FIG. 106 except that it includes a four inch main body 3110. FIG. 109 illustrates a gutter guard system 3300 similar to FIGS. 104, 105, and 107 except that it includes a five inch main body 3310. FIG. 110 illustrates a gutter guard system 3400 similar to FIGS. 106 and 108 except that it includes a five inch main body 3310.

Referring to FIGS. 104 and 105, the configuration of a gutter guard system with two rear receivers 1500,1800 can also be arranged to facilitate water flow across the pair of rear receivers 1500,1800. As illustrated in FIG. 104, shown by flow line 2920, the inclined surface of rear receiver 1800 encourages water to flow forward across the surface of the rear receiver 1800 and away from the structure. When the water engages the second rear receiver 1500, much of the water will continue to flow across the surface of the second rear receiver 1500 and onto the screen 140 and main body 110. As illustrated in FIG. 105, shown by flow line 2930, if any water wicks back along the angled extension 1830, the water will fall into the channel 1510 of the rear receiver 1500 onto a downwardly angled surface and again be encouraged to flow away from the structure and into the rain gutter.

The foregoing description of examples has been presented for purposes of illustration and description. It is not intended to be exhaustive or limiting to the forms described. Numerous modifications are possible in light of the above teachings. Some of those modifications have been discussed, and others will be understood by those skilled in the art. The examples were chosen and described in order to best illustrate principles of various examples as are suited to particular uses contemplated. The scope is, of course, not limited to the examples set forth herein, but can be employed in any number of applications and equivalent devices by those of ordinary skill in the art.

We claim:

1. A modular platform for configuring a gutter guard system for installation onto a gutter system, the modular platform comprising:

a plurality of main bodies;

a plurality of screens arranged to be assembled with at least one of the plurality of main bodies;

a plurality of front receivers arranged to be selectively and reversibly assembled with at least one of the plurality of main bodies; and a plurality of rear receivers arranged to be selectively and reversibly assembled with at least one of the main bodies, wherein each of the plurality of rear receivers comprises:

a channel arranged to engage the rear receiver with at least one of the main bodies of the plurality of main bodies, the channel comprising:

an upper member with a top surface and a bottom surface;

a lower member with a top surface and a bottom surface, positioned below the upper member when the rear receiver is engaged with at least one of the main bodies; and a vertical member connecting the upper member to the lower member, wherein the vertical member includes one or more apertures positioned through the vertical member;

wherein, when the plurality of screens, plurality of front receivers, and the plurality of rear receivers are assembled with the plurality of main bodies, a gutter guard system is formed.

2. The modular platform of claim 1, wherein the upper member of the rear receiver includes a downwardly angled edge.

3. The modular platform of claim 2, wherein the lower member includes a downwardly angled edge.

4. The modular platform of claim 3, wherein when the channel of one of the plurality of rear receivers engages at least one main body, the downwardly angled edge of the upper member engages with a top surface of the main body.

5. The modular platform of claim 4, wherein when the channel of one of the plurality of rear receivers engages at least one main body, the top surface of the lower member engages with a bottom surface of the main body.

6. The modular platform of claim 5, wherein the engagement of the channel of one of the plurality of rear receivers with at least one main body provides for the main body to move laterally within the channel to provide for adjusting the width of the gutter guard system.

7. The modular platform of claim 1, wherein each of the one or more apertures is arranged such that fasteners can be passed through each aperture to secure the rear receiver to a structure or a gutter system.

8. The modular platform of claim 1, wherein the lower member extends further away from the vertical member than the upper member.

9. The modular platform of claim 2, wherein the downwardly angled edge of the upper member is at an approximately forty-five degree angle to the upper member.

10. The modular platform of claim 3, wherein the downwardly angled edge of the lower member is at an approximately forty-five degree angle to the lower member.

11. The modular platform of claim 1, wherein the upper member is at an approximately ninety degree angle to the vertical member.

12. The modular platform of claim 1, wherein the lower member is at an approximately ninety degree angle to the vertical member.

13. The modular platform of claim 1, wherein the upper member and lower member are generally parallel to each other.

* * * * *